US007461484B2

(12) United States Patent
Battey et al.

(10) Patent No.: US 7,461,484 B2
(45) Date of Patent: Dec. 9, 2008

(54) CUSTOMIZABLE PARTITION SYSTEM

(75) Inventors: David J. Battey, Kentwood, MI (US); Roy W. Fink, Portage, MI (US); Richard Scott Hand, Grand Rapids, MI (US); Joshua W. Hoekstra, Jenison, MI (US); Robert E. Jeffers, Ada, MI (US); Michael P. Kelley, Rockford, MI (US); Douglas B. MacDonald, Lowell, MI (US); Gaylan M. McColley, Stanton, MI (US); Karl J. Mead, E. Grand Rapids, MI (US); F. Javier Olvera, Kentwood, MI (US); William H. Palermo, Spring Lake, MI (US); Todd Pelman, San Francisco, CA (US); Micah E. Roberts, Grand Rapids, MI (US); Mark T. Slager, Caledonia, MI (US); Steven J. Throndset, Kentwood, MI (US)

(73) Assignee: Steelcase Inc., Grand Rapids, MI (US)

( * ) Notice: Subject to any disclaimer, the term of this patent is extended or adjusted under 35 U.S.C. 154(b) by 904 days.

(21) Appl. No.: 10/367,249

(22) Filed: Feb. 14, 2003

(65) Prior Publication Data

US 2004/0020137 A1 Feb. 5, 2004

Related U.S. Application Data

(63) Continuation-in-part of application No. 10/077,553, filed on Feb. 15, 2002, now Pat. No. 6,684,929.

(51) Int. Cl.
*E04C 2/52* (2006.01)

(52) U.S. Cl. ..... 52/220.7; 52/293.3; 52/243

(58) Field of Classification Search ..... 52/36.1, 52/239, 243, 271, 293.3, 220.7, 236.9; 160/130, 160/135; 411/508; 24/289

See application file for complete search history.

(56) References Cited

U.S. PATENT DOCUMENTS 405,791 A 6/1889 Moushey (Continued)

FOREIGN PATENT DOCUMENTS

CA 1284263 1/1989

(Continued)

OTHER PUBLICATIONS

Exhibit A is a Knoll Currents Price List, Jan. 2001.
Exhibit B is promotional material describing SMED International Office Furniture published at least as early as Feb. 14, 2001.
Exhibit C is "Scott Adams: Dilbert's Ultimate Cubicle", Aug. 28, 2001, http://www.cnn.com/2001/CAREER/jobenvy/08/28/dilbert.scott.adams/index.html.

*Primary Examiner*—Basil Katcheves
(74) *Attorney, Agent, or Firm*—Price, Heneveld, Cooper, DeWitt & Litton, LLP

(57) ABSTRACT

A partition system includes an internally-open partition frame having permanent and removable frame members forming multiple vertical and horizontal wireways, with both lay-in and feed-through wire routing. Utility support brackets are attachable for good wire management. The partition frame supports a wide variety of customizable and functional surface components, including a markerboard wall surface, a slatwall, a colored/covered wall surface, a wall surface including utility outlets, a transparent window. The partition frame includes continuous horizontal and vertical rows of slots that flexibly and adjustably support furniture accessories, such as a worksurface, at selected heights and locations along the partition system. Covers are provided that maintain a very high-quality appearance with uniform lines and gaps. Some covers include adjustable edge-mounted light seals for eliminating light leaks and unsightly areas. Further, the present partition system provides flexibility, customizability, rearrangeability, reconfigurability, and an intuitive assembly.

32 Claims, 83 Drawing Sheets

U.S. PATENT DOCUMENTS

| | | | | |
|---|---|---|---|---|
| 419,521 | A | | 1/1890 | Heald et al. |
| 783,383 | A | | 2/1905 | Olson |
| 1,247,938 | A | | 11/1917 | Curtenius |
| 1,328,677 | A | | 1/1920 | LaHodny |
| 1,476,758 | A | | 12/1923 | LaHodny |
| 1,588,093 | A | | 6/1926 | Carlson |
| 1,630,906 | A | | 5/1927 | Ricken |
| 1,679,632 | A | | 8/1928 | Schlegel |
| 1,695,973 | A | | 12/1928 | Olsson |
| 1,708,068 | A | | 4/1929 | Kuney |
| 1,733,107 | A | | 10/1929 | Ahlberg |
| 1,780,852 | A | | 11/1930 | Sullivan |
| 1,820,667 | A | | 8/1931 | Leyes |
| 1,907,679 | A | | 5/1933 | Smith |
| 1,908,270 | A | | 5/1933 | Shaffer |
| 1,981,240 | A | | 11/1934 | McNeil |
| 2,000,243 | A | | 5/1935 | Manske |
| 2,027,491 | A | | 1/1936 | Percy |
| 2,052,755 | A | | 9/1936 | Duffy |
| 2,139,322 | A | | 12/1938 | Miner |
| 2,156,633 | A | | 5/1939 | LaDucer |
| 2,160,513 | A | | 5/1939 | Pasternak |
| 2,248,715 | A | | 7/1941 | Mafera |
| 2,260,178 | A | | 10/1941 | Guignon, Jr. |
| 2,262,426 | A | | 11/1941 | Hall |
| 2,281,482 | A | | 4/1942 | Crayton |
| 2,333,993 | A | | 11/1943 | Frailing |
| 2,336,870 | A | | 12/1943 | Grotta |
| 2,345,650 | A | | 4/1944 | Attwood |
| 2,380,379 | A | | 7/1945 | Attwood |
| 2,439,664 | A | | 4/1948 | Marchand |
| 2,492,076 | A | | 12/1949 | Wahle |
| 2,507,224 | A | | 5/1950 | Scanlon et al. |
| 2,637,423 | A | | 5/1953 | Creegan |
| 2,676,680 | A | | 4/1954 | Kindorf |
| 2,696,139 | A | | 12/1954 | Attwood |
| 2,784,812 | A | | 3/1957 | Kindorf |
| 2,877,875 | A | | 3/1959 | Bolt |
| 2,878,955 | A | | 3/1959 | Hagan |
| 2,914,146 | A | | 11/1959 | Conley |
| 2,928,512 | A | | 3/1960 | Slater et al. |
| 2,944,642 | A | | 7/1960 | Evans |
| 2,947,093 | A | | 8/1960 | Masters |
| 2,994,413 | A | | 8/1961 | Levy et al. |
| 3,004,815 | A | | 10/1961 | O'Kain et al. |
| 3,037,593 | A | | 6/1962 | Webster |
| 3,039,727 | A | | 6/1962 | Engel, Jr. et al. |
| 3,042,978 | A | | 7/1962 | Eames et al. |
| 3,043,640 | A | | 7/1962 | Eames et al. |
| 3,049,161 | A | | 8/1962 | Attwood |
| 3,053,355 | A | | 9/1962 | Attwood |
| 3,121,977 | A | | 2/1964 | Bersudsky |
| 3,124,328 | A | | 3/1964 | Kortsch |
| 3,180,459 | A | | 4/1965 | Liskey, Jr. |
| 3,182,805 | A | | 5/1965 | Foster, Jr. et al. |
| 3,184,068 | A | | 5/1965 | Wende |
| 3,195,698 | A | | 7/1965 | Codrea |
| 3,212,646 | A | | 10/1965 | Propst |
| 3,226,468 | A | | 12/1965 | Patton et al. |
| 3,239,371 | A | | 3/1966 | Whitney et al. |
| 3,242,627 | A | | 3/1966 | Fountain |
| 3,245,182 | A | | 4/1966 | Zierold |
| 3,261,625 | A | | 7/1966 | Cripe |
| 3,282,013 | A | | 11/1966 | Boicey |
| 3,294,351 | A | | 12/1966 | Rollins, Jr. |
| 3,311,340 | A | | 3/1967 | Riis |
| 3,312,025 | A | | 4/1967 | Deakins |
| 3,312,027 | A | | 4/1967 | Lawer |
| 3,327,440 | A | | 6/1967 | Watkins |
| 3,345,461 | A | | 10/1967 | Bunting |
| 3,381,438 | A | | 5/1968 | Bohnsack |
| 3,399,856 | A | | 9/1968 | Pecaut |
| 3,403,220 | A | | 9/1968 | Riedel et al. |
| 3,404,501 | A | | 10/1968 | von Wedel |
| 3,409,261 | A | | 11/1968 | Leporati |
| 3,456,549 | A | | 7/1969 | Horton |
| 3,456,706 | A | | 7/1969 | Ollis, Jr. |
| 3,462,892 | A | | 8/1969 | Meyer |
| 3,483,910 | A | | 12/1969 | LaLonde et al. |
| 3,498,577 | A | | 3/1970 | Mehr |
| 3,517,467 | A | | 6/1970 | Propst et al. |
| 3,550,338 | A | | 12/1970 | Satkin et al. |
| 3,557,499 | A | | 1/1971 | Dickie et al. |
| 3,557,857 | A | | 1/1971 | Swenson |
| 3,574,367 | A | * | 4/1971 | Jankowski ..... 403/201 |
| 3,589,755 | A | | 6/1971 | King |
| 3,593,468 | A | | 7/1971 | Bustin |
| 3,601,432 | A | | 8/1971 | Fenwick et al. |
| 3,611,663 | A | | 10/1971 | Andrey |
| 3,620,404 | A | | 11/1971 | Grasso |
| 3,662,981 | A | | 5/1972 | Hogrebe |
| 3,683,100 | A | | 8/1972 | Deal et al. |
| 3,685,227 | A | | 8/1972 | Grisard et al. |
| 3,685,230 | A | | 8/1972 | Lickliter et al. |
| 3,697,034 | A | | 10/1972 | Shell |
| 3,703,792 | A | | 11/1972 | Bill |
| 3,733,759 | A | | 5/1973 | Schulte et al. |
| 3,753,325 | A | | 8/1973 | Stanley et al. |
| 3,759,297 | A | | 9/1973 | Anderson et al. |
| 3,766,696 | A | | 10/1973 | Totoonchie |
| D229,610 | S | | 12/1973 | Shinjo |
| 3,778,175 | A | | 12/1973 | Zimmer |
| 3,805,872 | A | | 4/1974 | Lorber |
| 3,807,102 | A | | 4/1974 | Albinson et al. |
| 3,823,251 | A | | 7/1974 | Heithecker et al. |
| 3,842,130 | A | | 10/1974 | Kawaguchi et al. |
| 3,849,962 | A | | 11/1974 | Albinson et al. |
| 3,851,433 | A | | 12/1974 | Colucci |
| 3,852,927 | A | * | 12/1974 | Birum, Jr. ..... 52/241 |
| 3,852,935 | A | | 12/1974 | Jones |
| 3,858,988 | A | * | 1/1975 | Cohen ..... 403/18 |
| 3,869,992 | A | | 3/1975 | Kramer |
| 3,889,044 | A | | 6/1975 | Flachbarth et al. |
| 3,901,612 | A | | 8/1975 | Canin |
| 3,908,330 | A | | 9/1975 | Frach et al. |
| 3,909,912 | A | | 10/1975 | Kiesling |
| 3,948,011 | A | | 4/1976 | Price et al. |
| 3,955,702 | A | | 5/1976 | Lundy |
| 3,966,158 | A | | 6/1976 | Boundy |
| 3,982,370 | A | | 9/1976 | Buffington |
| 3,986,312 | A | | 10/1976 | Calhoun et al. |
| 3,998,018 | A | | 12/1976 | Hodges |
| 4,015,397 | A | | 4/1977 | Flachbarth et al. |
| 4,018,019 | A | | 4/1977 | Raith et al. |
| 4,021,986 | A | | 5/1977 | McCall et al. |
| 4,025,017 | A | | 5/1977 | Miller |
| 4,030,260 | A | | 6/1977 | Sukolics et al. |
| 4,030,262 | A | | 6/1977 | Dean |
| 4,035,972 | A | | 7/1977 | Timmons |
| 4,055,329 | A | | 10/1977 | Hammond |
| 4,073,113 | A | | 2/1978 | Oudot et al. |
| 4,104,838 | A | | 8/1978 | Hage et al. |
| 4,109,429 | A | | 8/1978 | Whisson |
| 4,120,124 | A | | 10/1978 | Temple et al. |
| 4,123,879 | A | | 11/1978 | Blodee et al. |
| 4,133,153 | A | | 1/1979 | Hage |
| 4,134,238 | A | | 1/1979 | Auger |
| 4,135,337 | A | | 1/1979 | Medlin |
| 4,135,775 | A | | 1/1979 | Driscoll |
| 4,143,698 | A | | 3/1979 | Smolka |
| 4,146,074 | A | | 3/1979 | Kowalski |
| 4,177,305 | A | | 12/1979 | Feingold et al. |
| 4,178,468 | A | | 12/1979 | Jorgensen et al. |
| 4,185,430 | A | | 1/1980 | Gartung |

4,188,764 A 2/1980 Gode
4,192,106 A 3/1980 Hell
4,203,639 A 5/1980 VandenHoek et al.
4,222,542 A 9/1980 Wilson et al.
4,224,769 A 9/1980 Ball et al.
4,226,394 A 10/1980 Einborn
4,230,900 A 10/1980 Speet
4,250,676 A 2/1981 Presby
4,250,680 A 2/1981 Bomar
4,252,989 A 2/1981 Blumenthal
4,255,610 A 3/1981 Textoris
4,255,611 A 3/1981 Propst et al.
4,257,203 A 3/1981 Propst et al.
4,267,677 A 5/1981 Randolph et al.
4,269,005 A 5/1981 Timmons
4,277,123 A 7/1981 Haworth et al.
4,278,834 A 7/1981 Boundy
4,284,840 A 8/1981 Baker
4,294,498 A 10/1981 Van Luit
4,295,697 A 10/1981 Grime
4,313,646 A 2/1982 Millhimes et al.
4,319,792 A 3/1982 Britt et al.
4,365,561 A 12/1982 Tellier et al.
4,370,008 A 1/1983 Haworth et al.
4,373,111 A 2/1983 Myers et al.
4,376,561 A 3/1983 Vanden Hoek et al.
4,377,360 A 3/1983 Kennedy
4,378,173 A 3/1983 Hopwell
4,379,379 A 4/1983 Sengoku
4,391,073 A 7/1983 Mollenkopf et al.
4,391,426 A 7/1983 Gothberg
4,406,101 A 9/1983 Heidmann
4,406,379 A 9/1983 Anderson et al.
4,407,101 A 10/1983 Propst et al.
4,416,093 A 11/1983 Salkeld et al.
4,423,573 A 1/1984 Omholt et al.
4,429,934 A 2/1984 VandenHoek et al.
4,434,596 A 3/1984 McAteer et al.
4,434,900 A 3/1984 Cook
4,437,638 A 3/1984 Scheibenpflug
D273,460 S 4/1984 Sturm
4,443,986 A 4/1984 Propst et al.
4,447,031 A 5/1984 Souder, Jr. et al.
4,448,003 A 5/1984 Hasbrouck
4,448,004 A 5/1984 Thorsell
4,450,655 A 5/1984 Rosenthal et al.
4,450,970 A 5/1984 Shepherd
4,453,785 A 6/1984 Smith
4,463,684 A 8/1984 Klungle et al.
4,470,232 A 9/1984 Condevaux et al.
4,471,548 A 9/1984 Goudie
4,472,860 A 9/1984 Osterlind
4,506,399 A 3/1985 Espey et al.
4,515,087 A 5/1985 Kurrasch
4,516,751 A 5/1985 Westbrook
4,531,557 A 7/1985 Takegawa et al.
4,531,564 A 7/1985 Hanna
4,535,577 A 8/1985 Tenser et al.
4,536,612 A 8/1985 Domigan
4,545,168 A 10/1985 Dalton, Jr.
4,546,708 A 10/1985 Wilburth
4,549,712 A 10/1985 Simon et al.
4,550,893 A 11/1985 Wiersema et al.
4,556,337 A * 12/1985 Marshall ..... 403/255
4,559,410 A 12/1985 Hostetter
4,560,130 A 12/1985 Schwartz
4,561,619 A 12/1985 Robillard et al.
4,562,987 A 1/1986 Leeds et al.
4,567,698 A 2/1986 Morrison
4,567,835 A 2/1986 Reese et al.
4,571,907 A 2/1986 DeFouw et al.
4,575,295 A 3/1986 Rebentisch
4,577,055 A 3/1986 Wuertz
4,577,187 A 3/1986 Barr et al.
4,581,858 A 4/1986 Clark
4,581,859 A 4/1986 Doke et al.
4,589,621 A 5/1986 Hunt et al.
4,593,227 A 6/1986 Bruce et al.
4,593,499 A 6/1986 Kobayashi et al.
4,593,505 A 6/1986 Russell
4,596,098 A 6/1986 Finkbeiner et al.
4,601,137 A 7/1986 Bates
4,603,789 A 8/1986 Medlin, Sr.
4,611,448 A 9/1986 De Long
4,612,743 A 9/1986 Salzer
4,618,192 A 10/1986 Kelley
4,619,208 A 10/1986 Kurrasch
4,625,483 A 12/1986 Zacky et al.
4,631,881 A 12/1986 Charman
4,642,418 A 2/1987 Menchetti
4,644,408 A 2/1987 Coleman
4,646,211 A 2/1987 Gallant et al.
4,650,143 A 3/1987 Kurrasch
4,656,798 A 4/1987 Hazen
4,663,895 A 5/1987 Brice
4,667,605 A 5/1987 Bastian
4,667,794 A 5/1987 Martinez-Corral et al.
4,674,240 A 6/1987 Strausheim
4,677,794 A 7/1987 Parron et al.
4,679,368 A 7/1987 Pettinga et al.
4,681,380 A 7/1987 Carlin
4,682,457 A 7/1987 Spencer
4,684,425 A 8/1987 Bannister
4,685,255 A 8/1987 Kelley
4,693,047 A 9/1987 Menchetti
4,694,965 A 9/1987 Parnell
4,704,835 A 11/1987 Jordan
4,708,312 A 11/1987 Rohr
4,712,336 A 12/1987 Backer
4,716,692 A 1/1988 Harper et al.
4,716,702 A 1/1988 Dickson
4,719,730 A 1/1988 Winkowski
4,719,731 A 1/1988 Ravotti et al.
D295,415 S 4/1988 Thies et al.
4,740,167 A 4/1988 Millhimes et al.
4,742,979 A 5/1988 Syversten et al.
4,744,010 A 5/1988 Witte
4,759,450 A 7/1988 Ball et al.
4,762,072 A 8/1988 Boundy et al.
4,768,744 A 9/1988 Leeds et al.
4,772,000 A 9/1988 Aubert
4,783,036 A 11/1988 Vossoughi
4,784,552 A 11/1988 Rebentisch
4,787,767 A 11/1988 Wendt
4,792,881 A 12/1988 Wilson et al.
4,800,696 A 1/1989 Miller et al.
RE32,890 E 3/1989 DeFouw et al.
4,809,479 A 3/1989 Tierno et al.
4,811,539 A 3/1989 Menchetti
4,814,759 A 3/1989 Gombrich et al.
4,825,601 A 5/1989 Halverson
4,826,112 A 5/1989 Rettler
4,826,115 A 5/1989 Novitski
4,826,117 A 5/1989 Bastian et al.
4,830,531 A 5/1989 Condit et al.
4,831,791 A 5/1989 Ball
4,832,419 A 5/1989 Mitchell et al.
4,835,923 A 6/1989 Ybarra
4,836,478 A 6/1989 Sweere
4,836,486 A 6/1989 Vossoughi et al.
4,841,699 A 6/1989 Wilson et al.
4,846,434 A 7/1989 Krogsrud
4,852,500 A 8/1989 Ryburg et al.
4,852,842 A 8/1989 O'Neill
4,860,812 A 8/1989 DePietro et al.
4,870,794 A 10/1989 Menchetti 4,873,803 A 10/1989 Rundo
4,874,322 A 10/1989 Dola et al.
4,876,835 A 10/1989 Kelley et al.
4,881,349 A 11/1989 Brown et al.
4,881,352 A 11/1989 Glockenstein
4,881,471 A 11/1989 Schwartz et al.
4,882,453 A 11/1989 Chelsea
4,882,885 A 11/1989 Chatterson et al.
4,891,922 A 1/1990 Hozer et al.
4,893,446 A 1/1990 Gudmundsson et al.
4,902,852 A 2/1990 Wuertz
4,903,452 A 2/1990 Huang
4,905,428 A 3/1990 Sykes
4,907,384 A 3/1990 Underwood
4,914,873 A 4/1990 Newhouse
4,914,878 A 4/1990 Tamaki et al.
4,918,886 A 4/1990 Benoit et al.
4,934,119 A 6/1990 Ybarra
4,941,873 A 7/1990 Fischer
4,942,709 A 7/1990 Waldron
4,942,805 A 7/1990 Hellwig et al.
4,947,601 A 8/1990 McGuire
4,949,519 A 8/1990 Jeffers
4,950,099 A 8/1990 Roellin
4,952,164 A 8/1990 French et al.
4,957,402 A 9/1990 Klein et al.
4,958,671 A 9/1990 Bove
4,961,295 A 10/1990 Kosch, Sr. et al.
4,961,553 A 10/1990 Todd
4,964,525 A 10/1990 Coffey et al.
D312,177 S 11/1990 Walter et al.
4,969,403 A 11/1990 Schwartz et al.
4,976,080 A 12/1990 Zegel et al.
4,976,083 A 12/1990 Menchetti
4,977,696 A 12/1990 Johansson
4,979,554 A 12/1990 Nelson
4,982,536 A 1/1991 Muhlethaler
4,987,835 A 1/1991 Schwartz et al.
D314,482 S 2/1991 Walter et al.
4,990,110 A 2/1991 Byrne
4,991,365 A 2/1991 Jackson
4,993,576 A 2/1991 Byrne
4,995,215 A 2/1991 Menchetti
D315,651 S 3/1991 Citterio et al.
4,996,811 A 3/1991 Dull et al.
5,003,740 A 4/1991 Dull et al.
5,013,112 A 5/1991 Hellwig
5,013,252 A 5/1991 Nienhuis et al.
5,018,326 A 5/1991 Reynolds
5,020,293 A 6/1991 Itagaki
5,024,030 A 6/1991 Morrison
5,024,614 A 6/1991 Dola et al.
5,025,603 A 6/1991 Johnson
5,036,637 A 8/1991 Biebuyck
5,038,537 A 8/1991 Frambach
5,038,539 A 8/1991 Kelley et al.
5,044,135 A 9/1991 Kroon et al.
5,054,255 A 10/1991 Maninfior
5,058,347 A 10/1991 Schuelke et al.
5,058,354 A 10/1991 Menchetti
5,058,355 A 10/1991 Menchetti et al.
5,062,246 A 11/1991 Sykes
5,063,715 A 11/1991 Goodman
5,065,556 A 11/1991 DeLong et al.
5,069,263 A 12/1991 Edwards
5,070,666 A 12/1991 Looman
5,076,748 A 12/1991 Waterfield et al.
5,081,808 A 1/1992 Bastian et al.
5,083,514 A 1/1992 Schwartz et al.
5,086,597 A 2/1992 Kelley et al.
5,086,606 A 2/1992 Finses
5,087,207 A 2/1992 Byrne
5,088,541 A 2/1992 Persing et al.
5,091,607 A 2/1992 Stob
5,092,787 A 3/1992 Wise et al.
5,096,431 A 3/1992 Byrne
5,096,433 A 3/1992 Boundy
5,096,434 A 3/1992 Byrne
5,101,606 A 4/1992 Meru
5,107,651 A 4/1992 Menchetti et al.
5,108,063 A 4/1992 Koerber, Sr. et al.
5,112,240 A 5/1992 Nienhuis et al.
5,117,599 A 6/1992 Voss
5,125,193 A 6/1992 Beaulieu
5,125,197 A 6/1992 Fuchs
5,125,201 A 6/1992 Pieters et al.
5,129,200 A 7/1992 Kaneko
5,131,860 A 7/1992 Bogiel
5,134,826 A 8/1992 La Roche et al.
5,152,698 A 10/1992 Juhlin et al.
5,154,385 A 10/1992 Lindberg et al.
5,155,960 A 10/1992 Shaanan
5,164,544 A 11/1992 Snodgrass et al.
5,171,159 A 12/1992 Byrne
5,172,529 A 12/1992 Van De Riet
5,175,969 A 1/1993 Knauf et al.
5,177,616 A 1/1993 Riday
5,177,917 A 1/1993 del Castillo Von Haucke
5,178,555 A 1/1993 Kilpatrick et al.
5,184,441 A 2/1993 Balfanz, Jr.
5,186,517 A 2/1993 Gilmore et al.
5,187,908 A 2/1993 Losensky
5,187,912 A 2/1993 Hsueh
5,195,286 A 3/1993 DeLong et al.
5,196,255 A 3/1993 Cohen
5,199,778 A 4/1993 Aoki et al.
5,199,836 A 4/1993 Gogarty
5,203,711 A 4/1993 Bogiel
5,203,712 A 4/1993 Kilpatrick et al.
5,203,713 A 4/1993 French et al.
5,206,972 A 5/1993 Nudelmont et al.
5,207,037 A 5/1993 Giles et al.
5,207,041 A 5/1993 Wills
5,209,035 A 5/1993 Hodges et al.
5,212,915 A 5/1993 Antonio
5,214,889 A 6/1993 Nienhuis et al.
5,214,890 A 6/1993 Levitan et al.
5,219,406 A 6/1993 Raz
5,224,673 A 7/1993 Webb
5,228,579 A 7/1993 Kaufman
5,244,401 A 9/1993 Russell et al.
5,247,773 A 9/1993 Weir
5,251,996 A 10/1993 Hiller et al.
5,255,971 A 10/1993 Aisley
5,259,787 A 11/1993 Byrne
5,271,586 A 12/1993 Schmidt
5,274,970 A 1/1994 Roberts
5,277,005 A 1/1994 Hellwig et al.
5,277,006 A 1/1994 Ruster
5,277,007 A 1/1994 Hellwig et al.
5,277,512 A 1/1994 Dwillies
5,287,666 A 2/1994 Frascaroli et al.
5,289,927 A 3/1994 Emery
5,305,567 A 4/1994 Wittler
5,313,751 A 5/1994 Wittler
5,321,579 A 6/1994 Brown et al.
5,333,416 A 8/1994 Harris et al.
5,333,744 A 8/1994 LoCicero et al.
5,336,849 A 8/1994 Whitney
5,339,576 A 8/1994 Fussler
5,339,585 A 8/1994 Mollenkopf et al.
5,341,615 A 8/1994 Hodges et al.
5,347,778 A 9/1994 Bray
5,349,135 A 9/1994 Mollenkopf et al.
5,359,826 A 11/1994 Grearson
5,362,923 A 11/1994 Newhouse et al.

5,363,612 A 11/1994 Erickson
5,364,311 A 11/1994 Chou
5,373,793 A 12/1994 Crossman
5,375,798 A 12/1994 Hungerford, Jr.
5,375,802 A 12/1994 Branham, II
5,377,466 A 1/1995 Insalaco et al.
5,381,994 A 1/1995 Welch
5,383,318 A 1/1995 Kelley et al.
5,394,658 A 3/1995 Schreiner et al.
5,394,669 A 3/1995 Hallett et al.
5,398,909 A 3/1995 Sandwith
5,400,993 A 3/1995 Hamilton
5,406,760 A 4/1995 Edwards
5,408,796 A 4/1995 Hashimoto et al.
5,412,912 A 5/1995 Alves
RE34,977 E 6/1995 McCoy
5,421,112 A 6/1995 Knorr
5,427,446 A 6/1995 Glomski
5,429,252 A 7/1995 Liu
5,430,982 A 7/1995 Bane
5,430,984 A 7/1995 Young et al.
5,435,111 A 7/1995 Cox et al.
5,444,958 A 8/1995 Lu
5,467,565 A 11/1995 Bowman et al.
5,472,103 A 12/1995 Merl
5,474,402 A 12/1995 Wu
5,479,747 A 1/1996 Wu
5,487,246 A 1/1996 Hodges et al.
5,489,173 A 2/1996 Hofle
5,490,357 A 2/1996 Lin
5,502,930 A 4/1996 Burkette et al.
5,503,565 A 4/1996 McCoy
5,511,349 A 4/1996 Kelley et al.
5,514,004 A 5/1996 Swanson
5,516,183 A 5/1996 Gold
5,518,214 A 5/1996 Spencer
5,519,979 A 5/1996 Kunert et al.
5,524,394 A 6/1996 Szabo, Sr. et al.
5,524,402 A 6/1996 Sykes
5,533,237 A * 7/1996 Higgins ..... 24/289
5,537,290 A 7/1996 Brown et al.
5,542,158 A * 8/1996 Gronau et al. ..... 24/295
5,551,178 A 9/1996 Foley et al.
5,555,689 A 9/1996 Gilmore
5,560,169 A 10/1996 Palmer
5,562,469 A 10/1996 Nienhuis et al.
5,577,819 A 11/1996 Olsen
5,579,621 A 12/1996 Fang
5,584,714 A 12/1996 Karst et al.
5,586,593 A 12/1996 Schwartz
5,595,362 A 1/1997 Rinderer et al.
5,600,926 A 2/1997 Ehrlich
5,606,836 A 3/1997 Insalaco et al.
5,606,919 A 3/1997 Fox et al.
D378,731 S 4/1997 Kopish
5,619,824 A 4/1997 Russell et al.
5,622,017 A 4/1997 Lynn et al.
5,628,598 A 5/1997 Hofle
5,632,127 A 5/1997 Agar et al.
5,634,300 A 6/1997 Huebner et al.
5,638,650 A 6/1997 Edwards
5,642,593 A 7/1997 Shieh
5,644,380 A 7/1997 Jessen et al.
5,644,875 A 7/1997 Nielsen
5,655,740 A 8/1997 Lazarus
5,657,885 A 8/1997 White et al.
5,660,120 A 8/1997 Sims
5,675,944 A 10/1997 Kerr et al.
5,675,949 A 10/1997 Forslund et al.
5,685,113 A 11/1997 Reuter et al.
5,687,513 A 11/1997 Baloga et al.
5,689,924 A 11/1997 Mason
5,689,926 A 11/1997 Nichols
5,695,356 A 12/1997 Swanson
5,701,709 A 12/1997 Dixon, III
5,707,125 A 1/1998 Coglin
5,715,633 A 2/1998 Raz et al.
5,724,779 A 3/1998 Chang
5,730,300 A 3/1998 Chen
5,737,801 A 4/1998 Flood
5,737,887 A 4/1998 Smeenge
5,737,893 A 4/1998 Rossiter et al.
5,740,650 A 4/1998 Seiber et al.
5,743,054 A 4/1998 Luchetti et al.
5,743,055 A 4/1998 Conner et al.
5,744,750 A 4/1998 Almond
5,746,034 A 5/1998 Luchetti et al.
5,749,184 A 5/1998 McKann
5,752,357 A 5/1998 Piller
5,758,466 A 6/1998 Tucker
5,768,840 A 6/1998 Feldpausch et al.
5,775,034 A 7/1998 Logue
5,775,521 A 7/1998 Tisbo
5,778,612 A 7/1998 Kissinger et al.
5,784,841 A 7/1998 Nowell
5,791,093 A 8/1998 Diamond
5,797,237 A 8/1998 Finkell, Jr.
5,802,789 A 9/1998 Goodman et al.
5,803,146 A 9/1998 Boon
5,804,763 A 9/1998 Smeenge
5,806,258 A 9/1998 Miedema et al.
5,813,178 A 9/1998 Edwards
5,816,001 A 10/1998 Goodman et al.
5,819,490 A 10/1998 Current
5,826,385 A 10/1998 Dykstra et al.
5,826,639 A 10/1998 Miller
5,831,211 A 11/1998 Gartung et al.
5,833,417 A 11/1998 Sargent et al.
5,839,240 A 11/1998 Elsholz et al.
5,842,672 A 12/1998 Sweere et al.
5,852,904 A 12/1998 Yu et al.
D404,010 S 1/1999 Viklund et al.
5,867,955 A 2/1999 Russell
5,873,553 A 2/1999 Stahl et al.
5,875,594 A 3/1999 Hellwig et al.
5,875,596 A 3/1999 Muller
5,881,500 A 3/1999 Latino et al.
5,881,518 A 3/1999 Edwards et al.
5,886,295 A 3/1999 Carino et al.
5,893,539 A 4/1999 Tran et al.
5,899,025 A 5/1999 Casey et al.
5,899,035 A 5/1999 Waalkes et al.
5,901,512 A 5/1999 Bullwinkle
5,901,513 A 5/1999 Mollenkopf et al.
5,901,523 A 5/1999 Tasi
5,905,229 A 5/1999 McKitrick et al.
5,906,079 A 5/1999 Brickner et al.
RE36,226 E 6/1999 Antonio
5,907,937 A 6/1999 Loftus et al.
5,913,787 A 6/1999 Edwards
5,915,984 A 6/1999 Rupert et al.
5,916,100 A 6/1999 Mitchell et al.
D412,167 S 7/1999 Rosen
5,918,432 A 7/1999 Mahone et al.
5,918,433 A 7/1999 Reuter et al.
5,918,841 A 7/1999 Sweere et al.
5,921,040 A 7/1999 Glashouwer et al.
5,921,795 A 7/1999 Weener et al.
5,927,667 A 7/1999 Swanson
5,930,963 A 8/1999 Nichols
5,931,702 A 8/1999 Fladung
5,933,563 A 8/1999 Schaffer et al.
5,934,623 A 8/1999 Kopish
5,941,026 A 8/1999 Eisenreich et al.
5,941,720 A 8/1999 Byrne
5,943,834 A 8/1999 Jeffers et al.

5,944,203 A 8/1999 Vlah et al.
5,947,429 A 9/1999 Sweere et al.
5,949,025 A 9/1999 Nagai et al.
5,950,371 A 9/1999 Rives et al.
5,950,386 A 9/1999 Shipman et al.
5,967,479 A 10/1999 Sweere et al.
5,970,662 A 10/1999 Corcorran et al.
5,970,675 A 10/1999 Schray
D415,901 S 11/1999 Arko et al.
D416,251 S 11/1999 Rosen
D416,721 S 11/1999 Schacht et al.
5,974,742 A 11/1999 Schreiner et al.
5,974,753 A 11/1999 Hsu
5,983,574 A 11/1999 Holztrager
5,988,409 A 11/1999 Gusdorf et al.
5,992,809 A 11/1999 Sweere et al.
5,994,644 A 11/1999 Rindoks et al.
D417,572 S 12/1999 Schacht et al.
6,000,179 A 12/1999 Musculus et al.
6,000,180 A 12/1999 Goodman et al.
6,003,273 A 12/1999 Elsholz et al.
6,003,275 A 12/1999 Cornell et al.
6,009,676 A 1/2000 Feldpausch et al.
6,009,930 A 1/2000 Jantschek
6,010,099 A 1/2000 Wertz et al.
6,012,258 A 1/2000 Brown et al.
6,015,120 A 1/2000 Sweere et al.
6,015,195 A 1/2000 Anderson et al.
6,017,228 A 1/2000 Verbeek et al.
6,019,321 A 2/2000 Carlson, Jr. et al.
6,019,331 A 2/2000 Hoogland et al.
6,019,332 A 2/2000 Sweere et al.
6,021,613 A 2/2000 Reuter et al.
6,023,893 A 2/2000 Tanaka
6,036,516 A 3/2000 Byrne
6,037,538 A 3/2000 Brooks
6,038,802 A 3/2000 Tidwell
6,047,508 A 4/2000 Goodman et al.
6,047,509 A 4/2000 Savoie
6,052,958 A 4/2000 Miedema et al.
6,058,667 A 5/2000 MacDonald et al.
6,065,821 A 5/2000 Anderson et al.
6,067,762 A 5/2000 Greer et al.
6,073,399 A 6/2000 Shipman et al.
6,076,903 A 6/2000 Vander Park
6,079,173 A 6/2000 Waalkes et al.
6,082,064 A 7/2000 Mitchell et al.
6,086,300 A 7/2000 Frohlich
6,089,892 A 7/2000 Snow et al.
6,094,875 A 8/2000 Laine
6,098,358 A 8/2000 Waalkes et al.
6,100,942 A 8/2000 Hollenbaugh et al.
6,101,773 A 8/2000 Chau et al.
6,102,348 A 8/2000 O'Neill
6,105,322 A 8/2000 Chang
6,112,472 A 9/2000 Van Dyk et al.
6,112,485 A 9/2000 Beyer et al.
6,115,977 A 9/2000 Hornberger et al.
6,115,978 A 9/2000 Bastian et al.
6,125,600 A 10/2000 Bastian
6,128,877 A 10/2000 Goodman et al.
6,129,109 A 10/2000 Humber
6,131,347 A 10/2000 Hornberger et al.
6,131,866 A 10/2000 Kesinger
6,134,845 A 10/2000 Shipman et al.
6,134,846 A 10/2000 Lamb
6,134,852 A 10/2000 Shipman et al.
6,138,968 A 10/2000 Svantesson et al.
6,141,925 A 11/2000 Halvorson, Jr. et al.
6,141,926 A 11/2000 Rossiter et al.
6,148,567 A 11/2000 DeRuiter et al.
6,152,048 A 11/2000 Vander Park
6,152,410 A 11/2000 Mark
6,158,178 A 12/2000 Jeffers et al.
6,158,179 A 12/2000 Ackerly et al.
6,158,180 A 12/2000 Edwards
6,161,347 A 12/2000 Yu et al.
6,164,467 A 12/2000 DePottey et al.
6,167,664 B1 1/2001 Reuter et al.
6,167,665 B1 1/2001 Dame et al.
6,170,784 B1 1/2001 MacDonald et al.
6,173,536 B1 1/2001 Boyce
6,173,545 B1 1/2001 Feldpausch et al.
6,176,729 B1 1/2001 Myers
6,178,702 B1 1/2001 Hand et al.
6,185,899 B1 2/2001 De Niet
6,186,825 B1 2/2001 Bogiel et al.
6,189,270 B1 2/2001 Jeffers et al.
6,193,085 B1 * 2/2001 Nook et al. ..... 211/187
6,201,687 B1 3/2001 Murray
6,202,301 B1 3/2001 Kawaguchi
6,202,381 B1 3/2001 Dame et al.
6,202,966 B1 3/2001 MacDonald et al.
6,206,206 B1 3/2001 Saylor et al.
6,209,273 B1 4/2001 Jeffers et al.
6,209,836 B1 4/2001 Swanson
6,216,398 B1 4/2001 Shipman et al.
6,218,612 B1 4/2001 McKitrick et al.
6,223,478 B1 5/2001 Wheeler
6,223,485 B1 5/2001 Beck et al.
6,226,849 B1 5/2001 Beck et al.
6,227,384 B1 5/2001 Saylor et al.
6,227,499 B1 5/2001 Jennison et al.
6,230,445 B1 5/2001 Arko et al.
6,230,459 B1 5/2001 Jeffers et al.
6,235,988 B1 5/2001 Karst et al.
6,240,234 B1 5/2001 Falkenberg et al.
6,240,687 B1 6/2001 Chong
6,241,109 B1 6/2001 Kautz et al.
6,244,002 B1 6/2001 Martin
6,250,029 B1 6/2001 Jeffers et al.
6,250,032 B1 6/2001 Davis et al.
D445,456 S 7/2001 Saylor et al.
6,253,509 B1 7/2001 Hellwig et al.
6,256,941 B1 7/2001 Yu et al.
6,259,020 B1 7/2001 Ashline et al.
6,260,324 B1 7/2001 Miedema et al.
6,267,338 B1 7/2001 Saylor et al.
6,272,803 B1 8/2001 Stachowiak et al.
6,276,102 B1 8/2001 Shipman et al.
6,276,103 B1 8/2001 Waalkes et al.
6,279,278 B1 8/2001 Morris et al.
6,279,643 B1 8/2001 Shipman
6,282,854 B1 9/2001 Vos et al.
6,286,276 B1 9/2001 Shipman et al.
RE37,395 E 10/2001 Kunert et al.
6,295,764 B1 10/2001 Berridge et al.
6,295,775 B2 10/2001 Osterman et al.
6,298,616 B1 10/2001 Mitchell et al.
6,301,846 B1 10/2001 Waalkes et al.
6,301,847 B1 10/2001 Beck et al.
6,302,366 B1 10/2001 Saylor et al.
6,311,441 B1 11/2001 Beavers et al.
6,314,687 B1 11/2001 Schondelmayer et al.
6,325,223 B1 12/2001 Hannen
6,329,591 B2 12/2001 Karst et al.
6,330,773 B1 12/2001 MacDonald et al.
6,332,295 B1 12/2001 Spielhoff
6,336,302 B1 1/2002 Brugman et al.
6,339,907 B1 1/2002 Dame et al.
6,339,909 B1 1/2002 Brunnhofer et al.
6,341,457 B1 1/2002 Aerts et al.
6,343,947 B1 2/2002 Byrne
6,349,516 B1 2/2002 Powell et al.
6,367,213 B1 4/2002 Reuter et al.
6,386,723 B1 * 5/2002 Eberlein et al. ..... 362/33

| | | | |
|---|---|---|---|
| 6,399,909 | B1 | 6/2002 | Okada |
| 6,491,172 | B2 | 12/2002 | Chance et al. |
| 6,513,288 | B1 | 2/2003 | MacDonald et al. |
| 2001/0004099 | A1 | 6/2001 | Onishi |
| 2001/0017009 | A1 | 8/2001 | Lininger et al. |
| 2001/0019096 | A1 | 9/2001 | Andreoli et al. |
| 2002/0100236 | A1 | 8/2002 | Kuipers et al. |
| 2002/0108330 | A1 | 8/2002 | Yu et al. |
| 2002/0157335 | A1 | 10/2002 | Vos |
| 2003/0154673 | A1 | 8/2003 | MacGregor et al. |

FOREIGN PATENT DOCUMENTS

| | | |
|---|---|---|
| CA | 1256664 | 7/1989 |
| CA | 1339024 | 3/1997 |
| DE | 93366 | 10/1896 |
| DE | 2160513 | 6/1973 |
| DE | 2725637 | 12/1977 |
| DE | 3003017 | 7/1981 |
| DE | 3120723 | 3/1983 |
| DE | 3537135 | 4/1987 |
| DE | 4208193 | 9/1993 |
| DE | 19638221 | 4/1998 |
| EP | 0006707 | 1/1980 |
| EP | 0145410 | 6/1985 |
| EP | 0256160 | 2/1988 |
| EP | 0462920 | 6/1991 |
| EP | 0479330 | 4/1992 |
| EP | 0479331 | 4/1992 |
| EP | 0174426 | 7/1992 |
| EP | 0617178 | 6/1994 |
| EP | 0617496 | 9/1994 |
| EP | 0666425 | 8/1995 |
| FR | 1220067 | 5/1960 |
| FR | 2333993 | 7/1977 |
| GB | 962312 | 7/1964 |
| JP | 3202530 | 9/1991 |
| WO | 0021412 | 4/2000 |

* cited by examiner

IIIA
IIIB
IIIC
VII
VIII
IX
X

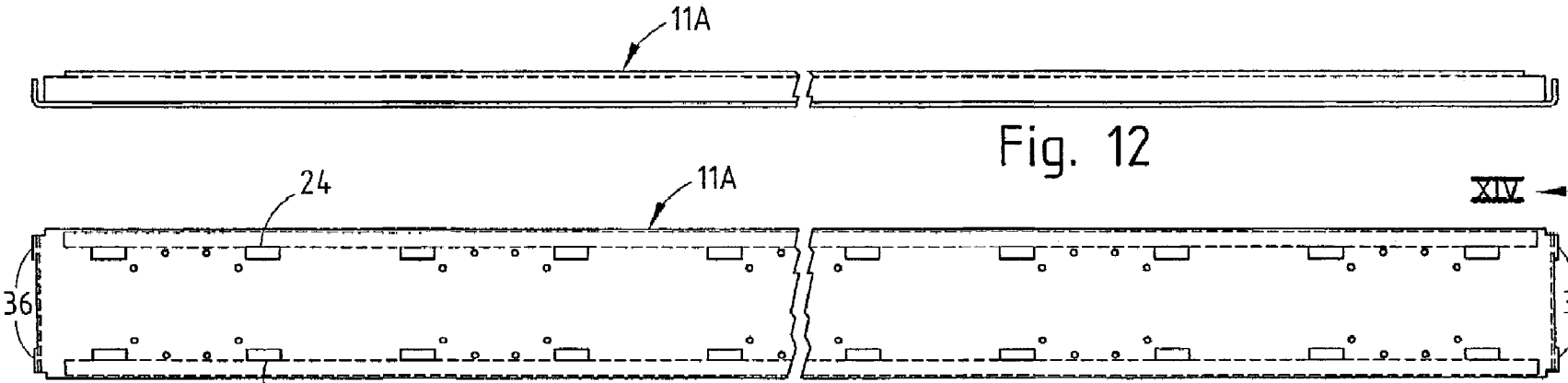
Fig. 12
Fig. 13
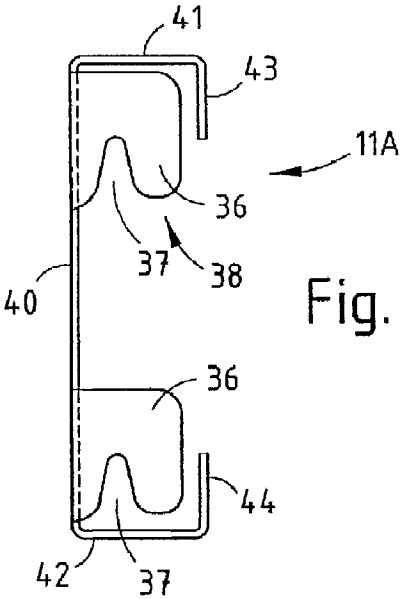
Fig. 14

222
9
223
217
191
220
221
224
218
219
216
215
222

8
192
27
28
9
191
23
24
25
26
190
10
2

CUSTOMIZABLE PARTITION SYSTEM

CROSS REFERENCE TO RELATED APPLICATION

The present application is a continuation-in-part of application Ser. No. 10/077,553, filed Feb. 15, 2002 now U.S. Pat. No. 6,684,929, entitled PANEL SYSTEM, the entire contents of which are incorporated herein in its entirety. Further, the present application is related to application Ser. No. 10/076,709, filed Feb. 15, 2002, entitled PANEL SYSTEM WITH MODULAR APPLIANCE MOUNTING ARRANGEMENT, the entire contents of which are also incorporated herein in its entirety.

BACKGROUND OF THE INVENTION

The present invention relates to a customizable partition system adapted to support a wide variety of options and accessories, while maintaining an optimal appearance. More particularly, the present invention relates to a partition system that is adapted to flexibly support a high density of wiring and electrical utilities (e.g. an internally-open partition frame having multiple vertical and horizontal wireways, both lay-in and feed-through wire routing, flexible utility support brackets and wire management), and that is adapted to provide a wide variety of customizable and functional surface configurations (e.g. a markerboard wall surface, a slatwall, a colored/covered wall surface, a wall surface including utility outlets, a transparent window) and that is adapted to flexibly and adjustably support furniture accessories (e.g. a worksurface), and yet that maintains a very high-quality appearance with uniform lines, uniform width gaps, sleek, well-defined trim lines, and absence of light leaks and unsightly areas). Further, the present invention provides a partition system having excellent flexibility, customizability, rearrangeability, reconfigurability, and intuitive assembly.

Modern offices often require that a partition system be able to flexibly support a high density of wiring and electrical utilities to offices formed by the partition system, without the partition system itself consuming too much of the building space that it subdivides. However, this is not easily accomplished since business owners have different needs and preferences, particular jobs have different requirements and functions, and particular workers have different needs and personal preferences. The situation is complicated by the fact that wiring literally comes and goes to work sites from all directions (including up, down, forwardly, rearwardly, laterally to the right and to the left, around corners, etc), and further, wiring is constantly being added, removed, rerouted, and rearranged. Also, new outlets and electrical features and components are often being added, removed, and/or relocated.

Modern offices incorporate design flexibility to handle the management of increasing amounts of electric and computer-related appliances. Both aesthetics and function dictate wire routing (whether lay-in or feed-through), as well as sources and destinations of the wires. This requires that the partition system be able to flexibly support the specific work activity being performed, including providing a wide variety of customizable and functional surface configurations (e.g. a markerboard wall surface, a slatwall, a colored/covered wall surface, a wall surface including utility outlets, a transparent window). This is also not easily accomplished, since particular jobs have specialized needs. For example, a secretary may need paper-handling accessories, while an engineer may need worksurface space, or a manager may have a need for a markerboard to take notes from meetings. At the same time, it is important that surface configurations be secure, and that they not come loose and/or look sloppy and/or become crooked over time.

Further, the present invention provides a partition system having excellent flexibility, customizability, rearrangeability, reconfigurability, and intuitive assembly.

Accordingly, an apparatus is desired having the aforementioned advantages and solving the aforementioned problems.

SUMMARY OF THE PRESENT INVENTION

In one aspect of the present invention, a partition system includes a partition frame having front and rear sides and opposing vertical side edges. The partition system also has vertically-spaced horizontally-oriented first and second beams that extend between the vertical side edges. A utility management bracket is attached vertically between the first and second beams. The bracket defines at least one forwardly-open horizontal front channel with open ends and at least one rearwardly-open horizontal rear channel with open ends with the front and rear channels being adapted to receive wires laid in from the front side and the rear side, respectively. At least one front cover and at least one rear cover are releasably attached to the partition frame that aesthetically cover the front and rear sides, including the utility management bracket.

In another aspect of the present invention, a partition system comprises a partition frame having front and rear sides, and vertical side edges, and having vertically-spaced horizontally-oriented first and second beams that extend between the vertical side edges, the first and second beams having a first depth dimension. A utility management first bracket is attached vertically between the first and second beams, the first bracket defining at least one forwardly-open horizontal front channel with open ends. The front channel is adapted to receive wires laid in from the front side. The first bracket has a second depth dimension that is at most half of the first depth dimension of the first and second beams, so that another bracket identical in depth to the first bracket can be attached behind the first bracket. At least one front cover and at least one rear cover are releasably attached to the partition frame that aesthetically cover the front and rear sides.

In yet another aspect of the present invention, a partition system includes first and second panel frames interconnected at an angle in plan view to form a concave corner. The first and second panel frames define at least one horizontally-extending lay-in continuous channel on an outside of the first and second panel frames that is adapted to receive wiring laid into the channel around the concave corner. First and second covers are attached to the first and second panel frames. The first and second covers each have an inner surface enclosing the at least one horizontally-extending lay-in channel on the respective first and second panel frames. The first and second covers each have inner and outer surfaces defining a thickness and including abutting side edges at the concave corner. At least one of the first and second covers includes an angled edge portion on the one cover's inner surface that forms a reduced thickness at the abutting side edges so as to enlarge the horizontally-extending lay-in channel under the first and second covers at the concave corner, the angled edge portion providing relief adapted to reduce a sharpness of a bend in the wiring as the wiring extends around the concave corner.

In another aspect of the present invention, a partition panel includes a partition frame having at least two vertical posts and at least two horizontal beams. The posts each include a vertical row of regularly-spaced slots extending from a top to a bottom of the posts, and the horizontal beams each include a horizontal row of regularly-spaced slots extending from one end to an opposite end of the beams and across the posts. At least one cover panel is attached to the partition frame and aesthetically covers at least a portion of a side of the partition frame between the vertical and horizontal rows of regularly-spaced slots but provides access to the vertical and horizontal rows of regularly-spaced slots.

In another aspect of the present invention, a slatwall construction suitable for use in a workspace, includes upper and lower slatwall components. An interlock feature includes a first overlap flange formed integrally on a top of the lower slatwall component and a second overlap flange integrally formed on a bottom of the upper slatwall component. The first and second overlap flanges include first and second L-shaped sections that overlap and interlockingly engage. At least one of the upper and lower slatwall components further includes a retainer flange forming a gap with the first and second overlap flanges. A plurality of wedging fasteners extend into the gap and cause the first and second overlap flanges to frictionally engage in front and rear locations to form a torsionally-strong joint that resists bending. By this arrangement, the interlock feature securely attaches the upper and lower slatwall components together in a rigid horizontal connection that resists bending.

In still another aspect of the present invention, a partition system includes a partition panel having a panel frame with front and rear sides, and having vertical posts and horizontal beams defining an opening through the front and rear sides. A window tile is provided to cover the opening. A pair of side brackets engage and cover inboard surfaces on the posts and at least partially cover front and rear surfaces on the posts. Top and bottom trim brackets include ends that engage the side brackets, and bodies that cover visible surfaces on the horizontal beams that define a part of the opening. Upper and lower window retaining brackets include flanges that capture edges of the window tile and retain the window tile to the panel frame.

In another aspect of the present invention, a partition system includes a partition panel having a panel frame with front and rear sides and having vertical posts and horizontal beams defining an opening through the front and rear sides. The partition panel also has a planar tile having top and bottom edges. Trim components are attached to the panel frames to cover portions of the posts and beams. Upper and lower retaining brackets include J flanges that engage and capture the top and bottom edges of the planar tile to retain the planar tile to the panel frame. The J flanges include rear surfaces having a plurality of horizontally-spaced aperture patterns thereon, and the retaining brackets further include spring clips with legs engaging the aperture patterns on the rear surface in a location not visible from the front side of the partition panel.

In yet another aspect of the present invention, a partition panel includes a panel frame including apertures. A component including spring clips releasably engages the apertures to retain the component on the panel frame. A security clip is positioned on and engages one of the spring clips to prevent unauthorized removal of the spring clip.

In another aspect of the present invention, a security system includes a one-piece spring clip made of high-strength resilient metal, the clip having angled sections forming a wedge-shaped section adapted to releasably engage apertures in a first component to retain a second component to the first component. A separate security clip is positioned in the wedge-shaped section to prevent unauthorized removal of the spring clip.

In still another aspect of the present invention, a furniture system includes a partition panel having a panel frame defining first and second rows of horizontal slots, a worksurface, and a worksurface support including a first bracket selectively engaging the first row of horizontal slots, a second bracket selectively engaging the second row of horizontal slots in a vertically aligned condition with the first bracket, and a third bracket engaging and capturing the first and second brackets to retain. the first and second brackets in the vertically aligned condition and in a non-releasable interlocked engagement with the first and second rows of slots.

In still another aspect of the present invention, an apparatus includes a partition panel having a panel frame member with at least one horizontal row of regularly-spaced slots. A one-piece bracket includes first and second parallel arms and a bendable loop connecting the parallel arms. The first and second parallel arms each include a free end with first and second hooks, respectively, formed thereon. The hooks extend laterally so that when the first and second hooks are engaged with selected ones of the slots in the partition panel, the first and second parallel arms extend vertically parallel a face of the partition panel. The first and second hooks each have a front portion adapted to engage a front of the panel frame member, a rear portion adapted to fit through the selected slots and engage an interior surface of the panel frame member, and a neck portion extending between the front portion and the rear portion. The first and second hooks are shaped so that the first and second hooks can be installed upon deforming the bendable loop and upon manipulating the bracket, but further are shaped so that the first and second hooks cannot be removed from the selected slots unless the bendable loop is again deformed.

In yet another aspect of the present invention, a partition cover adapted to aesthetically cover part of a partition frame includes a panel body with an aesthetic outer surface, an inner surface, a vertical side edge, and top and bottom edges. A recess is defined between the top and bottom edges at the vertical side edge. The panel body includes fasteners configured and adapted to engage the partition frame and support the panel body to aesthetically cover part of the partition frame. A light seal is adjustably retained on the panel body and is adjustably extendable from the recess to expose different amounts of the light seal along the vertical side edge. By this arrangement, the light seal can be used to selectively cover differently-sized gaps between the panel body and an adjacent structure spaced from the vertical side edge.

These and other features, objects, and advantages of the present invention will become apparent to a person of ordinary skill upon reading the following description and claims together with reference to the accompanying drawings.

BRIEF DESCRIPTION OF DRAWINGS

FIG. 2;

FIG. 2;

FIG. 3C;

FIG. 3D;

FIG. 12 is a fragmentary top plan view of a light-duty intermediate horizontal beam;

FIG. 13 is a fragmentary, front elevational view of the light-duty intermediate horizontal beam of FIG. 12;

FIG. 14 is an end view of the light-duty intermediate horizontal beam of FIG. 13 taken along the line XIV-XIV.

FIG. 23C;

FIG. 29;

FIG. 45.

FIG. 59A is a cross sectional view taken along lines 59A-59A in FIG. 59;

FIGS. 99-100 are additional perspective views of the adjacent panel frames and corner wire routing trim shown in FIG. 96;

FIG. 103, which is a cross-sectional end view of FIG. 102;

FIG. 104 being a side view of an end trim and FIG. 105 being an end view of a panel frame with apertures for receiving the end trim shown in FIG. 104;

FIG. 106 showing the hook attachment clip of FIG. 104;

FIG. 107 showing an end view of a section of the end trim having the clip thereon from FIG. 104; and FIG. 108 showing a corner attachment of a top trim to an end trim and FIG. 109 showing a cross section of the assembly of FIG. 108.

DETAILED DESCRIPTION OF THE PREFERRED EMBODIMENT

The present application is related to co-pending patent application Ser. No. 10/076,709, entitled PARTITION PANEL WITH MODULAR APPLIANCE MOUNTING ARRANGEMENT, filed Feb. 15, 2002, the entire contents of which are hereby incorporated herein by reference.

Figure 1A:
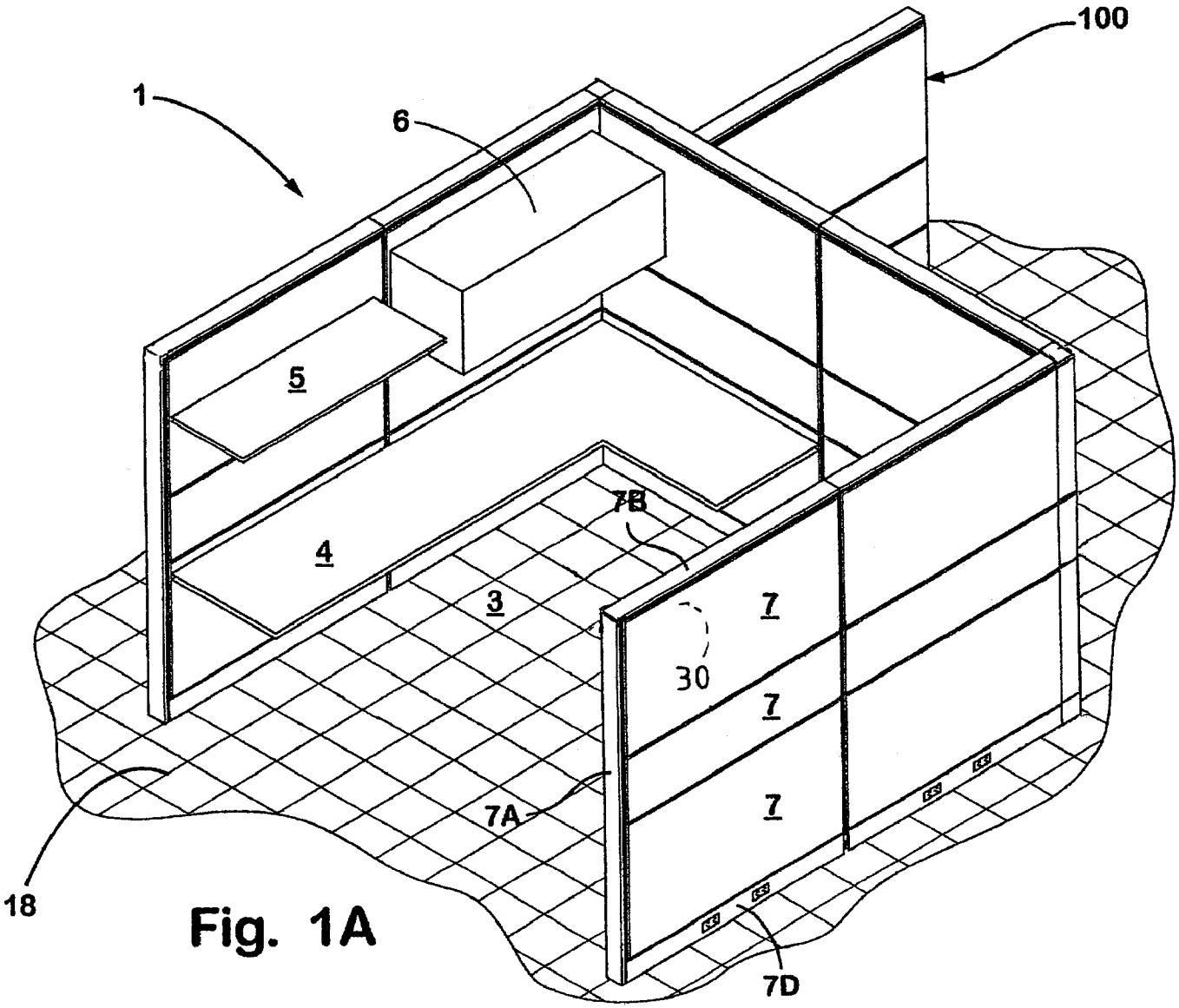
FIG. 1A is a perspective view of a partition panel system embodying the present invention.

For purposes of description herein, the terms "upper," "lower," "right," "left," "rear," "front," "vertical," "horizontal," and derivatives thereof shall relate to the invention as oriented in FIG. 1A. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1B:
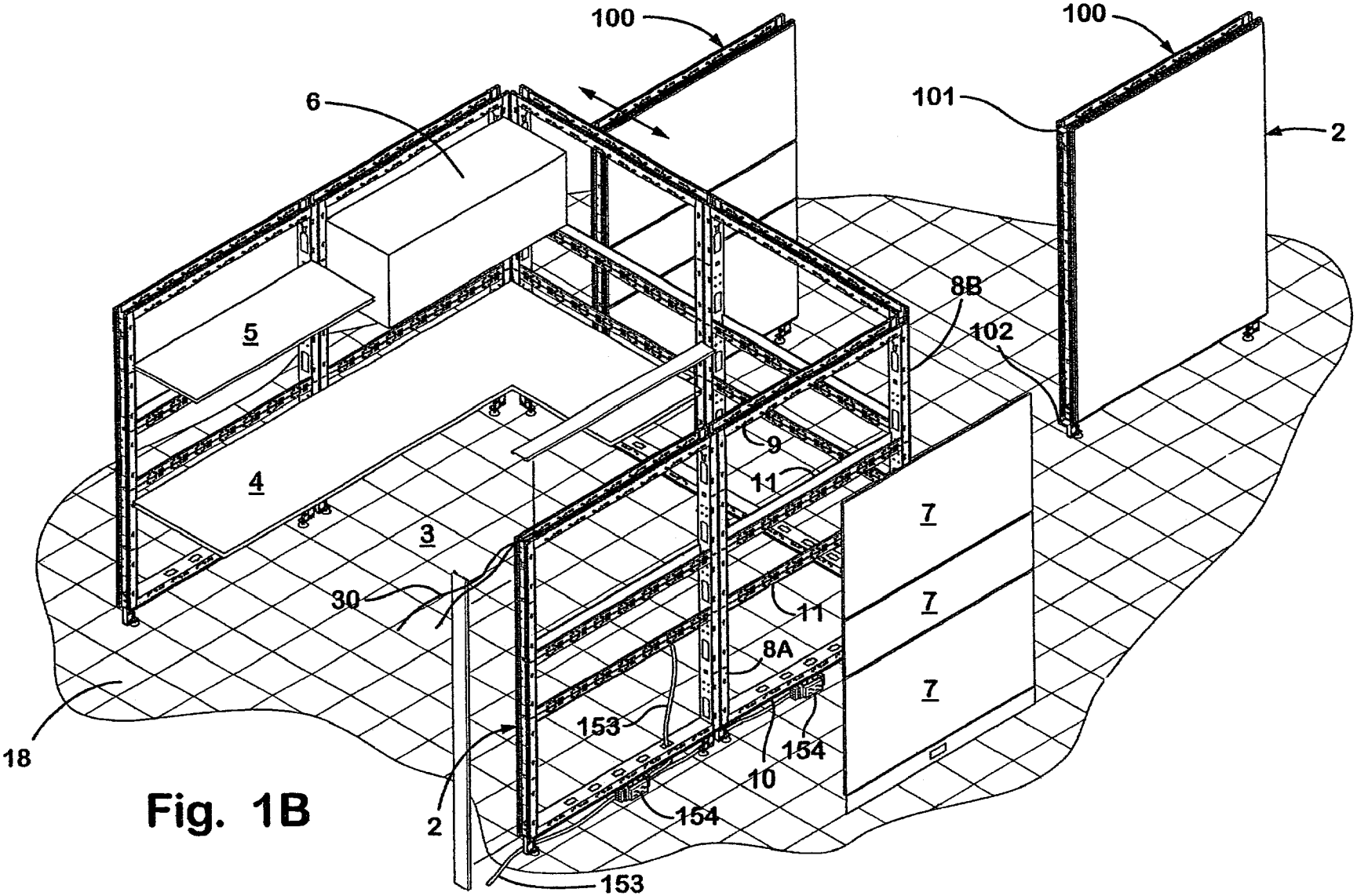
FIG. 1B is a partially exploded, perspective view of the partition panel system of FIG. 1A.

The reference numeral 1 (FIGS. 1A and 1B) generally designates a partition system 1 embodying the present invention, which is particularly designed for use in open office plans, and other similar settings and environments. Partition system 1 includes a plurality of partition frames 2 that are rigidly interconnected to define a workspace 3 that may include various hang-on furniture units such as a worksurface 4, shelf 5, or storage unit 6. As described in more detail below, a plurality of cover panels or "skins" 7 may be connected to the partition frames 2 to close off the partition frame 2 and provide privacy for a user. Trim members 7A and 7B cover the edge portions of the frames 2, and base trim 7D closes off the lower portion of the partitions. Lower frame members 10 are spaced above floor surface 18 to define a lower horizontal raceway 152. Power lines 153 and power receptacles 154 in raceway 152 provide power to the partition system.

Figures 2, 3, 4, 5, 7, 8, 9, 10:
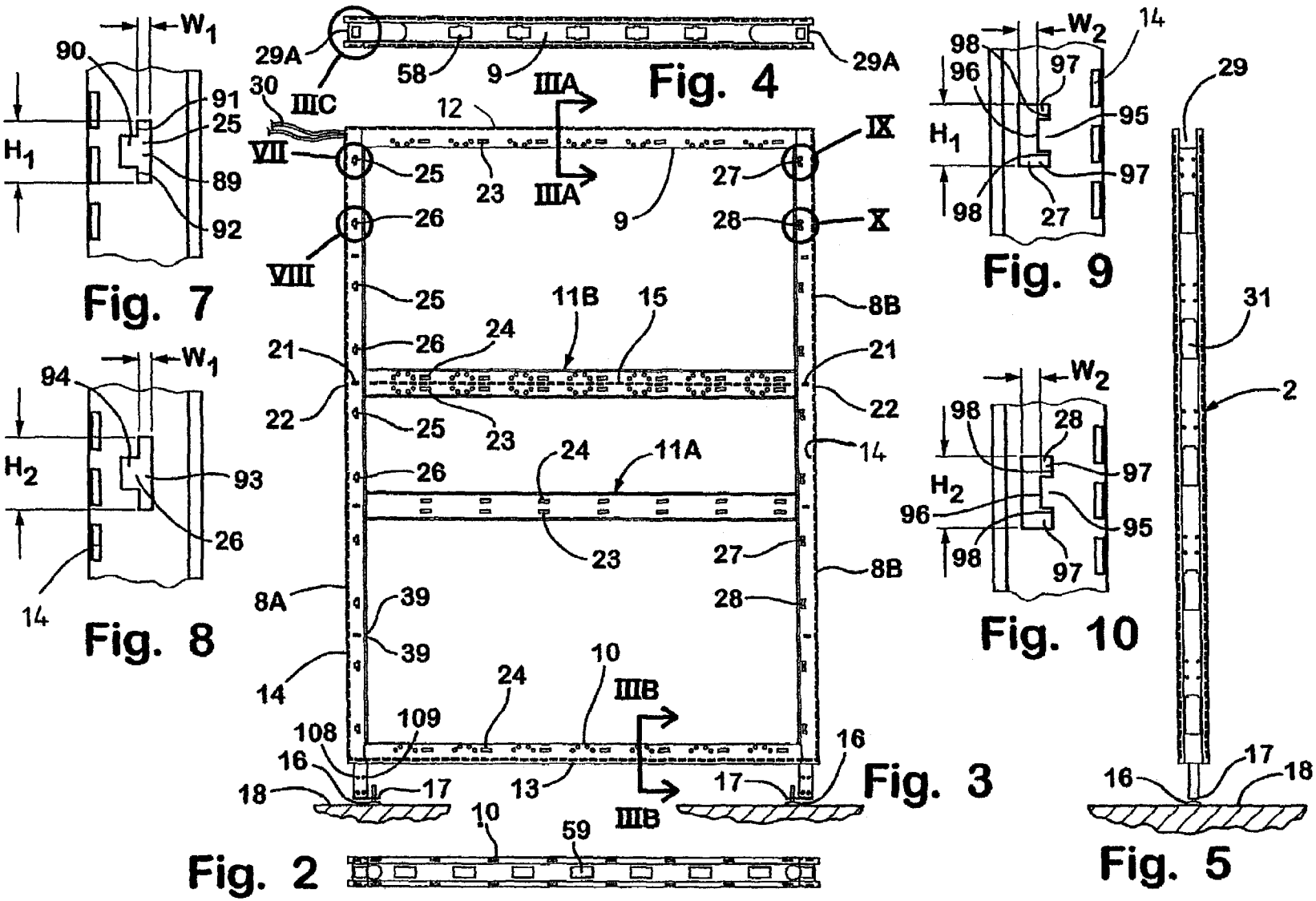
FIG. 2 is a bottom view of a partition frame.
FIG. 3 is a front elevational view of the panel frame of FIG. 2.
FIG. 4 is a top plan view of the panel frame of FIG. 3.
FIG. 5 is a right elevational view of the panel frame of FIG. 3.
FIG. 7 is an enlarged view of an aperture that receives a mounting clip to support a cover panel.
FIG. 8 is an enlarged view of an aperture that receives a mounting clip to support a cover panel.
FIG. 9 is an enlarged view of an aperture that receives a mounting clip to support a cover panel.
FIG. 10 is an enlarged view of an aperture that receives a mounting clip to support a cover panel.

With further reference to FIG. 3, partition frame 2 includes a pair of upright frame members 8A, 8B, and upper frame member 9 and lower frame 10. The horizontal frame members 9 and 10 extend between the upright frame members, and rigidly interconnect the vertical frame members 8A and 8B to form the partition frame 2. Intermediate beams 11A and 11B are releasably interconnected with the vertical frame members 8A and 8B, and can be vertically repositioned within the interior of partition frame 2. As discussed in more detail below, beam 11A is a "light-duty" beam that includes openings 23 and 24 for attachment of a cover panel 7, but does not include slots 15 for supporting hang-on furniture units. As also discussed in more detail below, beam 11B is a structural beam, and includes openings 23 and 24 for attachment of cover panels 7, and also includes a horizontal row of slots 15 for supporting hang-on furniture units such as a worksurface 4, shelf 5, or storage unit 6. The upper horizontal frame member 9 includes an upper horizontal row of slots 12, and lower horizontal frame member 10 includes a lower horizontal row of slots 13. The vertical frame members 8A and 8B each include a vertical row of slots 14. The horizontal rows of slots 12, 13 may also be utilized to support hang-on furniture units such as the shelf 5 and storage unit 6 illustrated in FIG. 1. The vertical rows of slots 14 in vertical frame members 8 may also be utilized to support hang-on furniture items such as the worksurface 4 illustrated in FIG. 1. The frame 2 includes glides 16 that threadably engage feet 17 to provide height adjustment for the partition frame 2 to account for irregularities in a floor surface 18. Vertical frame members 8A and 8B include upper openings 19 (see also FIG. 6) and 20 that are aligned with the upper horizontal row of slots 12 to provide a continuous row of slots 12 across the vertical frame members 8. Similarly, vertical frame members 8A and 8B include openings 21 and 22 at a plurality of vertically spaced-apart locations to align with the intermediate beam 11 and provide a continuous horizontal row of slots 15.

Figure 6:
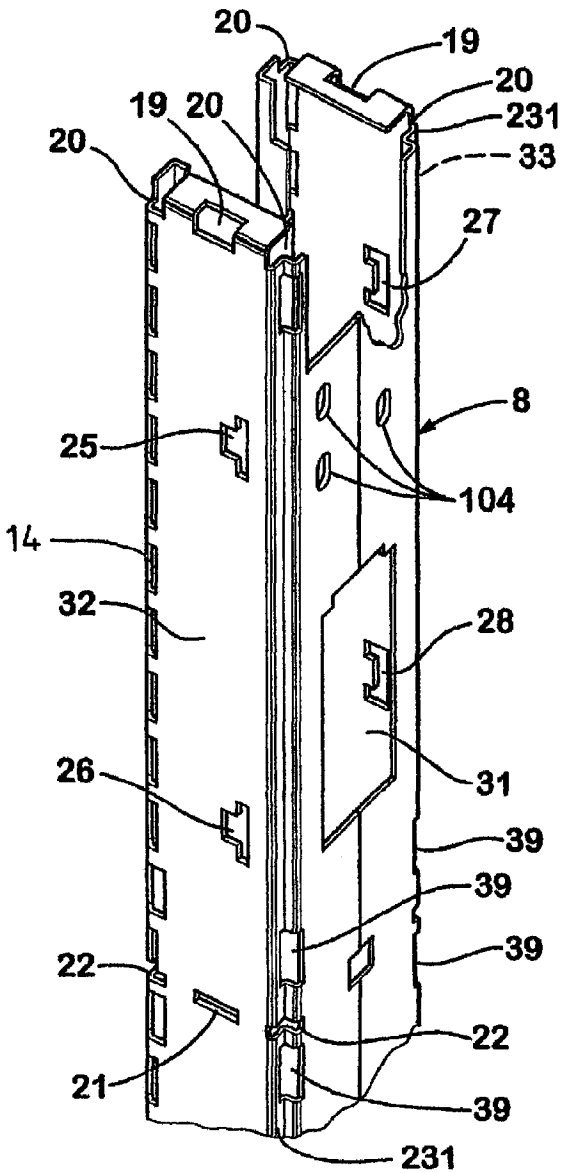
FIG. 6 is a fragmentary perspective view of a vertical frame member.

As described in more detail below, upper horizontal frame member 9 includes a plurality of openings 23 for securing cover panel 7, and lower horizontal frame member 10 includes openings 24 that are also utilized to secure the cover panel 7. As also described in more detail below, "left" vertical frame members 8A include upper left openings 25 and lower left openings 26 that are also utilized to secure the cover panels 7 to the partition frame 2. The "right" vertical frame member 8B includes an upper right opening 27 and a lower right opening 28, each of which are also utilized to support cover panels 7. Upper horizontal frame member 9 includes an upwardly opening U-shaped channel 29 to permit lay-in of utility lines such as communication lines 30 along the upper edge of the partition. Similarly, vertical side frame members 8 include vertical outwardly opening channels 29A (FIG. 4) to permit vertical routing of utility lines along the vertical side edges of the frame 2. Upper horizontal frame member 9 includes openings 58 to permit routing of utility lines through the frame member 9, and lower horizontal frame member 10 includes openings 59 (FIG. 2) therethrough to permit pass-through of utility lines through the lower frame member 10. With further reference to FIG. 6, vertical frame members 8A and 8B also include a plurality of large apertures 31 to permit pass-through of wiring or other utility lines through the vertical frame members 8A and 8B. Each vertical frame member 8A, 8B includes a plurality of openings 25 and 26 in a first side face 32, and a plurality of openings 27 and 28 in a second, opposite side face 33. Accordingly, the vertical frame member 8 can be utilized as either a "left-hand" vertical frame member 8A (FIG. 3), or as a "right-hand" vertical frame member 8B, depending upon the orientation of the vertical frame member 8.

Figure 3A:
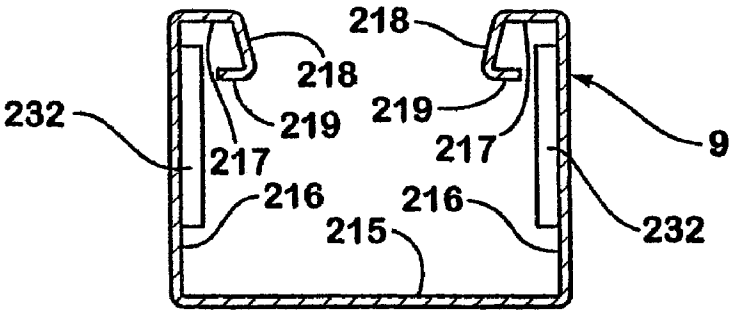
FIG. 3A is a cross-sectional view taken along the line IIIA-IIIA.
Figure 3B:
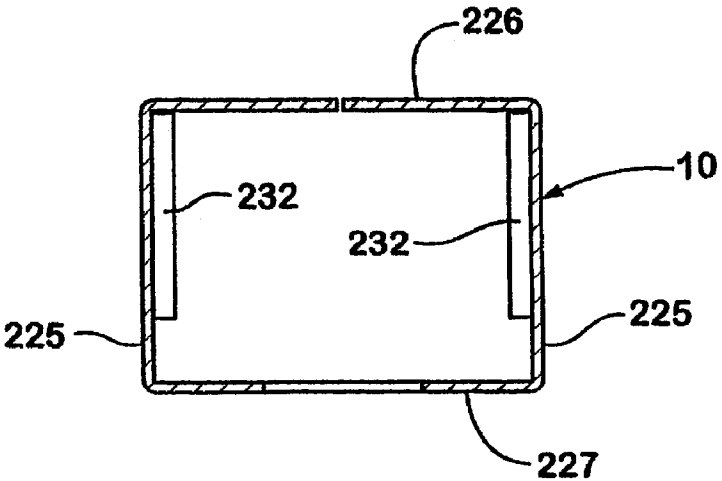
FIG. 3B is a cross-sectional view taken along the line IIIB-IIIB.

With further reference to FIG. 3A, cross member 9 includes a lower horizontal web 215 and vertical side webs 216 forming a generally U-shaped cross section. A horizontal portion 217 extends inwardly from the vertical side webs 216, and an inwardly angled portion 218 extends downwardly from the horizontal portion 217. An edge portion 219 extends horizontally from the angled portion 218. As described in detail below, lower horizontal frame member 9 and upper horizontal frame member 10 each include angled flanges 232 that facilitate welding of the opposite end portions of the frame members 9 and 10 to the vertical frame members 8A and 8B.

Figure 3C:
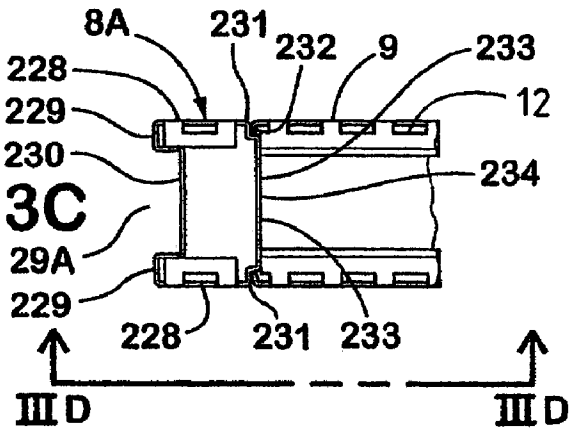
FIG. 3C is a partially fragmentary, cross-sectional view of the partition frame of FIG. 4.
Figure 3D:
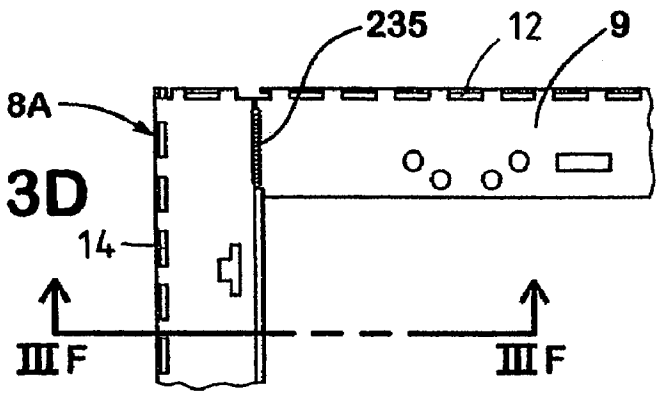
FIG. 3D is a partially fragmentary view taken along the line IIID-IIID.
Figure 3F:
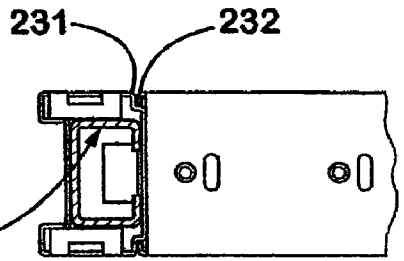
FIG. 3F is a partially fragmentary, cross-sectional view taken along the line IIIF-IIIF.

With further reference to FIG. 3C, vertical frame member 8A has a generally tubular cross-sectional shape including vertically extending outer webs 228, edge web portions 229, and offset edge web portion 230. Inwardly extending vertical web portions 233 extend towards one another and fit closely together at seam 234. A vertically extending V-groove 231 is formed at the intersection between the vertically extending web portions 228 and 233. When assembled, the angled webs 232 of horizontal frame members 9 and 10 are received in the vertically extending V-grooves 231. With further reference to FIG. 3D, a bead of weld material 235 rigidly interconnects the vertical frame member 8A with the horizontal frame member 9 and 10. The V-groove 231 and angled flanges 232 permit a flat surface, such that the weld material 235 does not protrude outwardly causing unsightly appearance and/or interfering with the mounting of cover panels 7, or other components. Preferably, each of the frame members 8A, 9, and 10 are roll-formed, thereby providing a cost-effective yet rigid and durable construction. With further reference to FIG. 3F, a corner bracket member 193 may be received within the vertical upright 8A, and is welded to the vertical frame member 8A and upper horizontal frame member 9 to strengthen the upper corners of the frame 2. The corner bracket 193 is described in more detail below in connection with FIG. 44.

Figure 11:
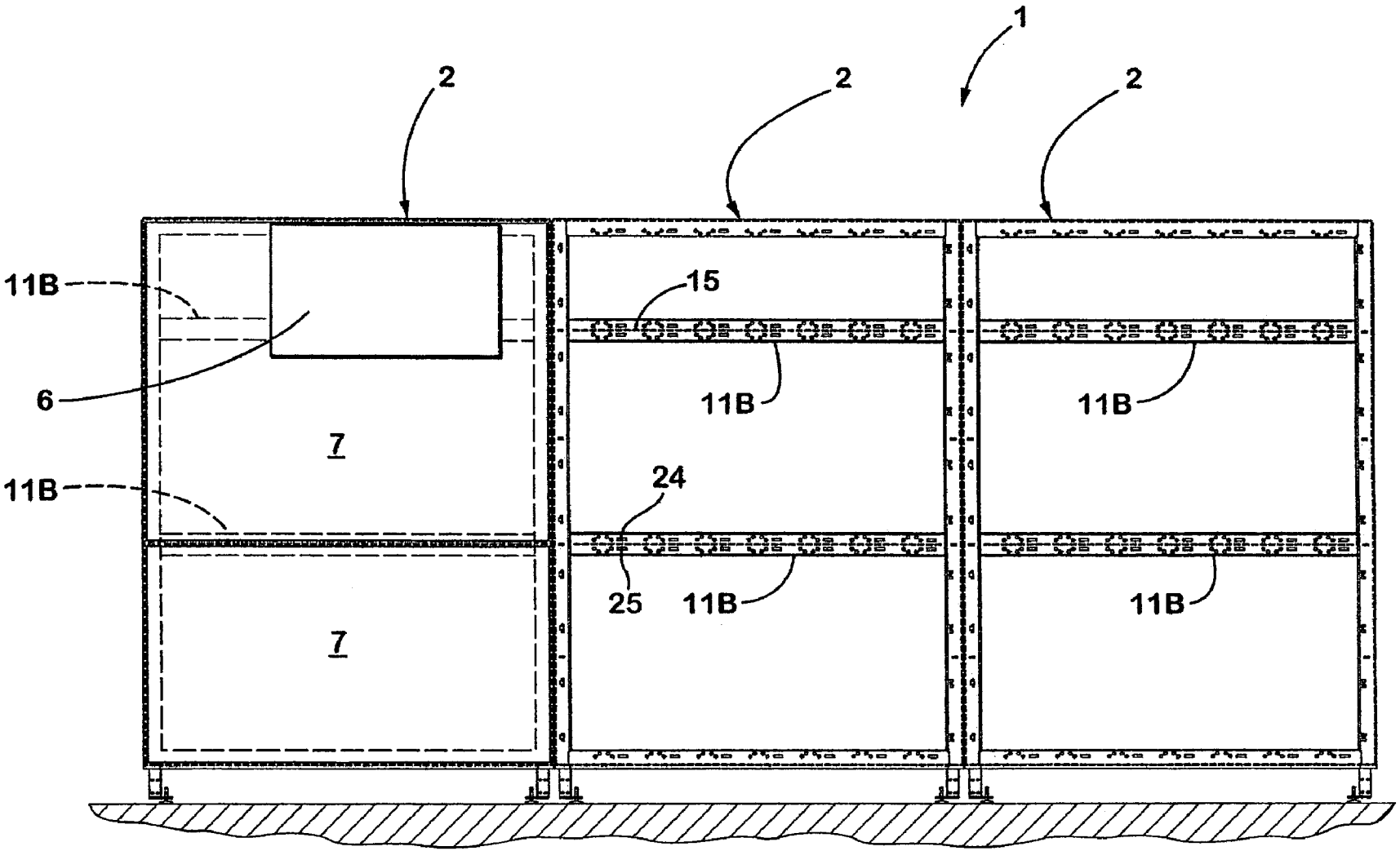
FIG. 11 is a plan view of a partition system embodying the present invention, illustrating the intermediate horizontal beams, cover panels, and hang-on furniture units.

With further reference to FIG. 11, a plurality of structural intermediate beams 11B may be mounted in the partition frame 2, thus providing a continuous row of slots 15 extending across the adjacent partition frames 2. This arrangement permits continuous horizontal adjustment of a hang-on furniture unit such as storage unit 6. Due to the openings 21 and 22 in the vertical frame members 8, the storage unit 6 can be positioned at any horizontal location along the adjacent frames 2, and may straddle a pair of adjacent frame member 8 if required for a particular application.

Figure 14A:
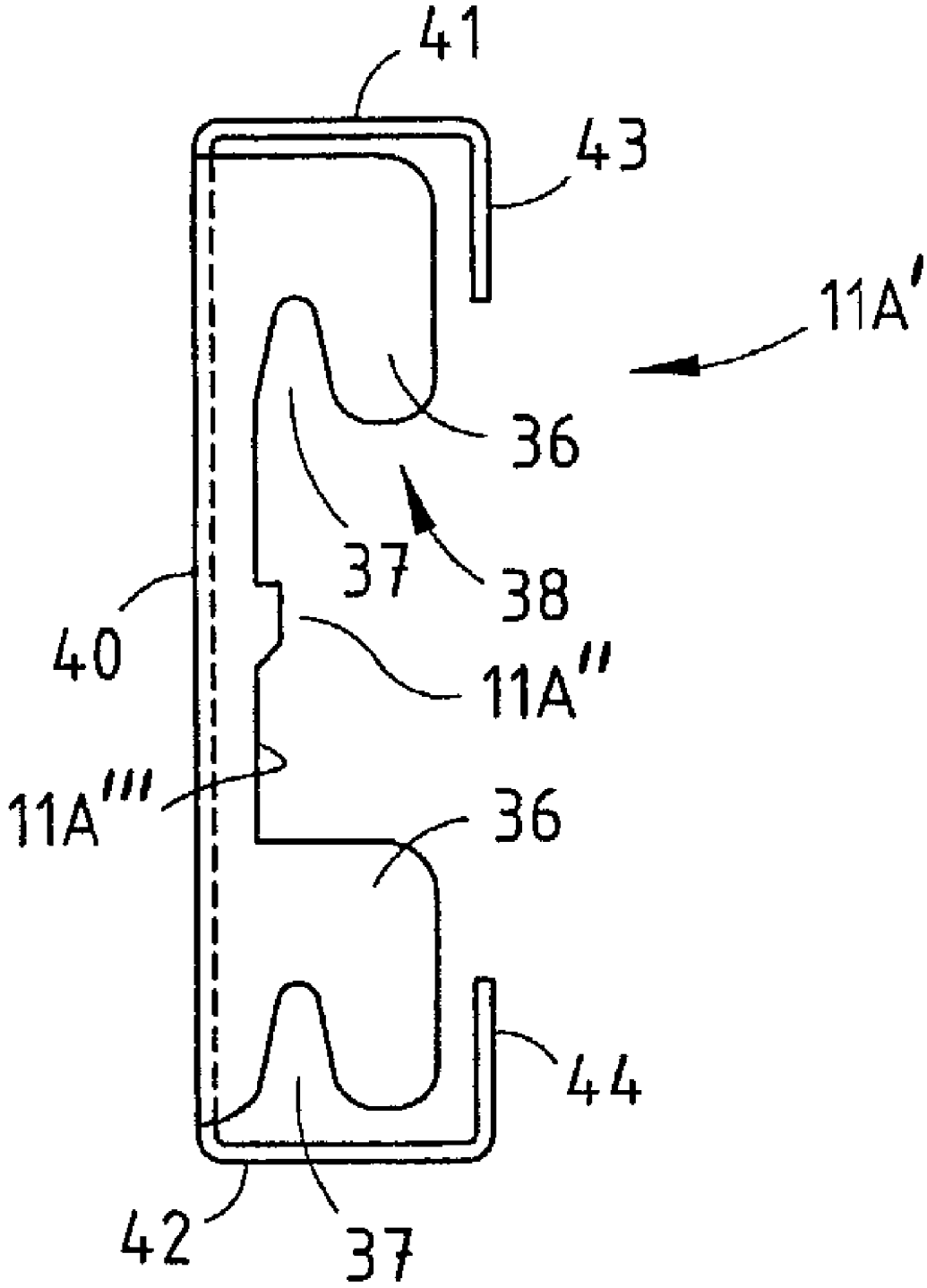
FIG. 14A is a modified beam similar to FIG. 14 but including an integral anti-dislodgment tab.

With reference to FIGS. 12-14, light-duty beam 11A includes a plurality of openings 23 and 24 for mounting cover panels 7. However, the beam 11A does not include a horizontal row of slots 15 for supporting hang-on furniture units such as storage unit 6. Thus, the beam 11A is utilized for applications wherein hang-on furniture units are not needed at a specific location, but segmented cover panels 7 are desired. Beam 11A includes a pair of tabs 36 at each end, each of which includes a tapered slot 37 forming a hook 38. Each vertical frame member 8A and 8B (FIG. 6) includes pairs of openings 39 (FIGS. 17A and 17B) located generally at the same heights as openings 21 and 22. Beam 11A is installed by inserting hooks 38 into openings 39 at the desired height. Each vertical frame member 8A and 8B includes pairs of openings 39 adjacent the first side face 32, and another pair of openings 39 adjacent the second side face 33, such that a pair of beams 11A can be mounted at the same height in a back to back manner. Alternately, a single beam 11A can be mounted on one side of the vertical frame member 8 if segmented cover panels 7 are only being mounted on one side of the partition frame 2. Beam 11A includes a vertical web 40 and an upper horizontal web 41 extending from the vertical web 40 and terminating in a downwardly extending flange 43. Similarly, lower horizontal web 42 extends from the vertical web 40 and terminates in upwardly extending flange 44. A modified beam 11A' (FIG. 14A) includes features similar to beam 11A, but further includes a detent 11A" formed along a flange 11A'" that extends between and co-planar with hooks 36. The detent 11A" engages a slot 14 between the pair of slots 14 engaged by hooks 36.

Figure 15:
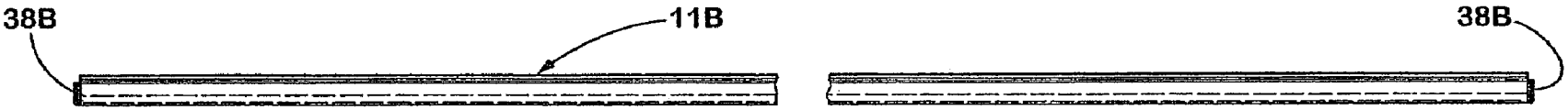
FIG. 15 is a fragmentary, top plan view of a structural intermediate horizontal beam.
Figure 16:
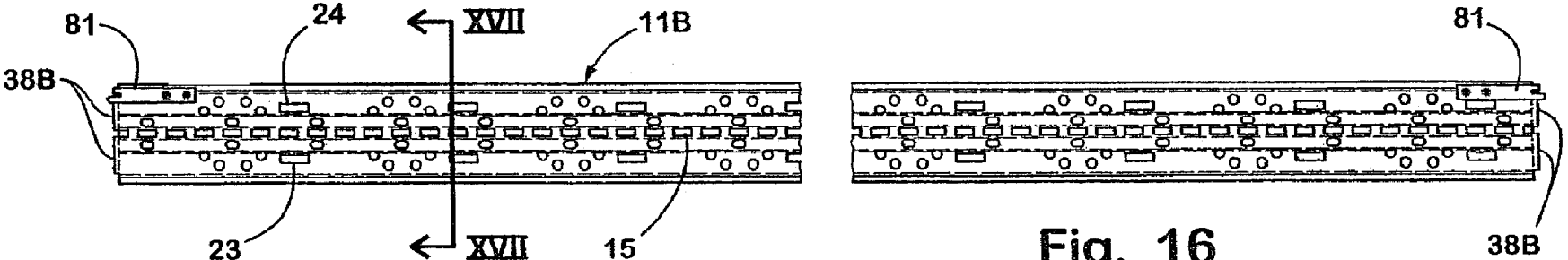
FIG. 16 is a fragmentary, front elevational view of the structural intermediate horizontal beam of FIG. 15.
Figure 17:
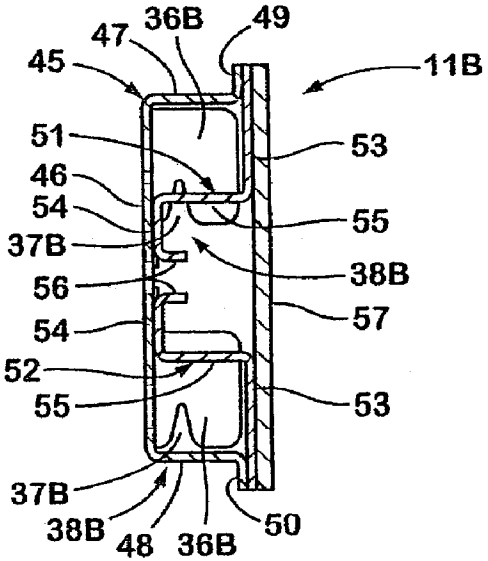
FIG. 17 is a cross-sectional view of the structural intermediate horizontal beam of FIG. 16 taken along the line XVII-XVII.
Figure 17C:
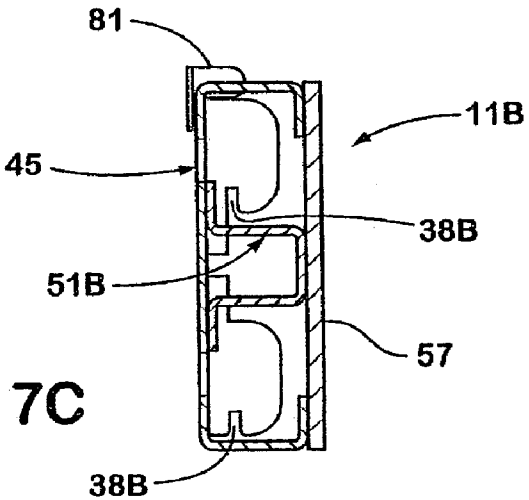
FIG. 17C is a cross-sectional view of an alternate embodiment of the structural intermediate horizontal beam of FIG. 17.

A structural intermediate beam 11B (FIGS. 15-17) includes tabs 36B with tapered slots 37B forming hooks 38B that are received in openings 39 of vertical frame member 8 in substantially the same manner described above in connection with hooks 38 of intermediate beam 11A. Intermediate beam 11B includes a first member 45 having a vertical web 46, upper web 47 terminating in upwardly extending flange 49. Similarly, lower web 48 of first member 45 terminates in a downwardly extending flange 50. A first inner reinforcing member 51 includes a first vertical web 53, and a second vertical web 54 that are interconnected by a horizontal web 55. An inner flange 56 extends inwardly from the second vertical web 54. A second inner reinforcing member 52 is a mirror image of the first inner reinforcing member 51. A back plate 57 is secured to the first and second inner reinforcing members 51 and 52 by welding or other suitable arrangement, and the first member 45 is similarly secured to the first and second inner reinforcing members 51 and 52. The combination of the first member 54, first and second reinforcing members 51 and 52, and back plate 57 together provide substantial structural strength, such that furniture units may be supported on the intermediate beam 11B by inserting the hooks (not shown) of the hang-on furniture unit into the horizontal row of slots 15. One example of such a hang-on furniture unit that mounts to a horizontal row of slots is the Pathways® Segment® storage bin that is manufactured by Steelcase, Inc. of Grand Rapids, Mich. The structural beam 11B can be selectively positioned on the partition frame 2 at a selected height, and the hang-on furniture unit such as storage unit 6 may be horizontally positioned at a desired location along the horizontal row of slots 15. Thus, the hang-on furniture unit can be positioned at a desired location and adjusted both vertically and horizontally.

In an alternate embodiment, beam 11B includes a single hat-shaped elongated reinforcing member that is welded or otherwise secured to the first member 45 and/or backing plate 57.

Figure 17B:
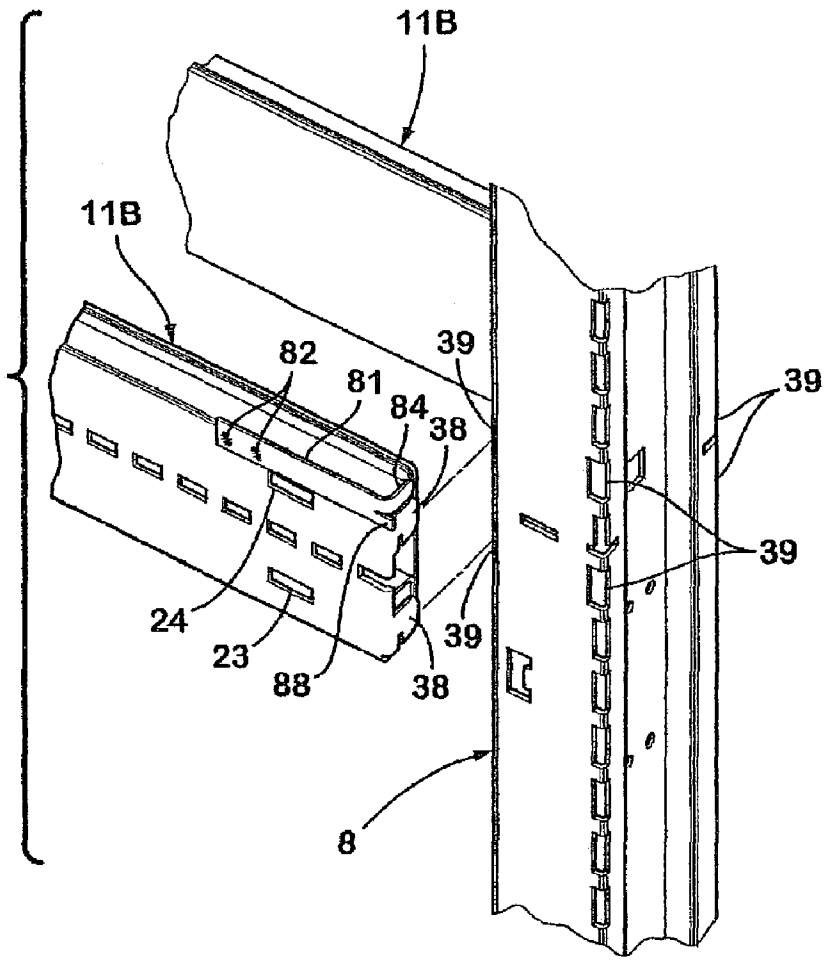
FIGS. 17A and 17B are fragmentary, exploded, perspective views of opposite end portions of an intermediate beam having a safety catch.
Figure 17A:
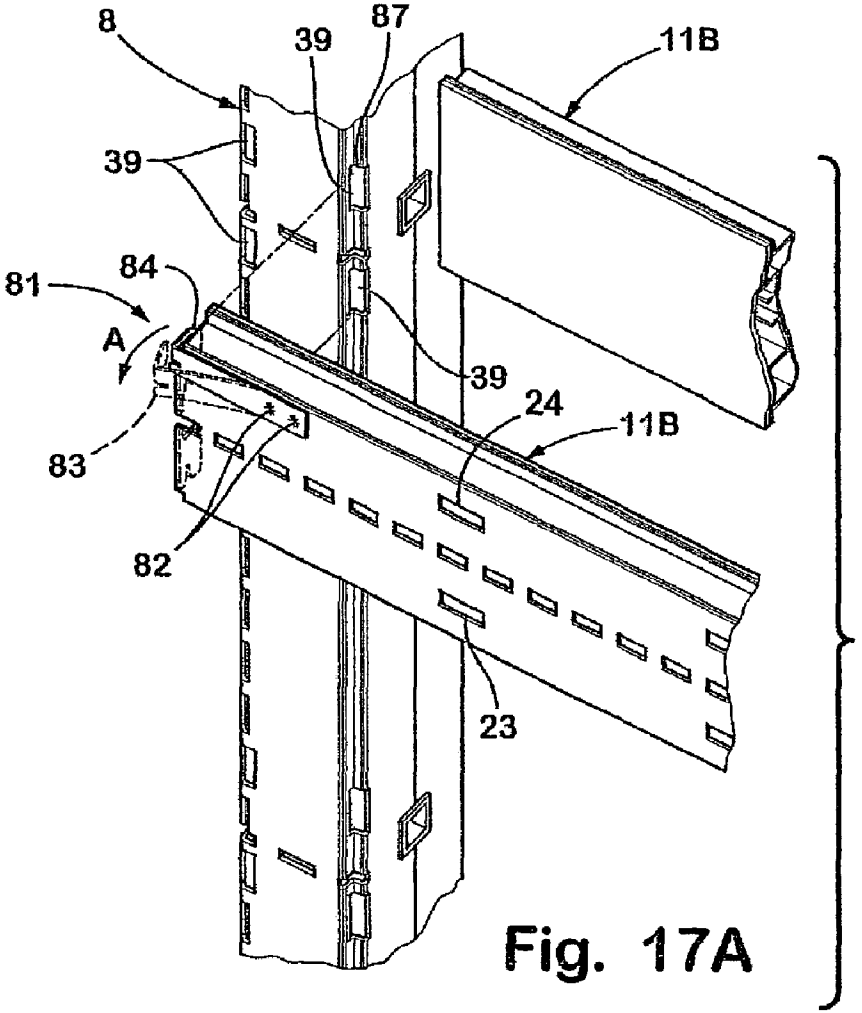
Figure 17G:
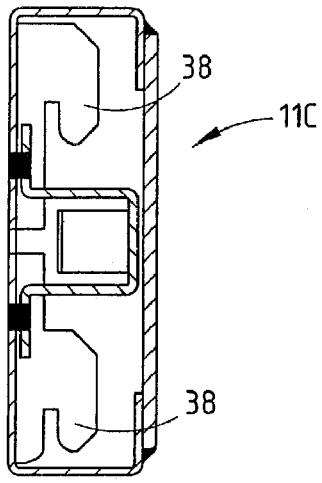
FIGS. 17G and 17H are cross-sections taken along the lines XVIIG-XVIIH in FIG. 17D.
Figure 17H:
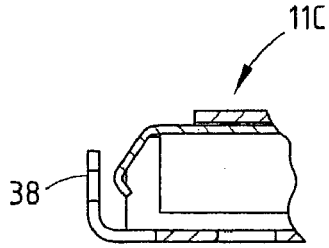

With further reference to FIGS. 17A and 17B, beam 11B may include a spring-steel safety catch 81 to prevent inadvertent disengagement of hooks 38 from openings 39. The safety catch 81 may be spot-welded to the structural beam 11B at 82, such that the end portion 83 is able to flex outwardly in the direction of the arrow "A" (FIG. 17A). During insertion of the hooks 38 into the openings 39, the end of the tab 84 contacts the outer surface 87 of the vertical frame member 87, and flexes in the direction of the arrow "A". After insertion of hooks 38, beam 11B is shifted downwardly to engage the hooks 38. The end portion 83 of catch 81 will then return to a position parallel to the beam 11B, with the tab 84 snapping into the opening 39, such that the beam 11B cannot be inadvertently shifted upwardly to disengage hooks 38. To disengage the hooks 38, the small, straight tab 88 of catch 81 is grasped, and the end portion 83 is flexed outwardly to disengage the tab 84, such that the beam 11B can be shifted upwardly to remove the hooks 38 from the openings 39. If required, the light-duty intermediate beams 1 A may also include a safety catch 81.

Figure 17E:
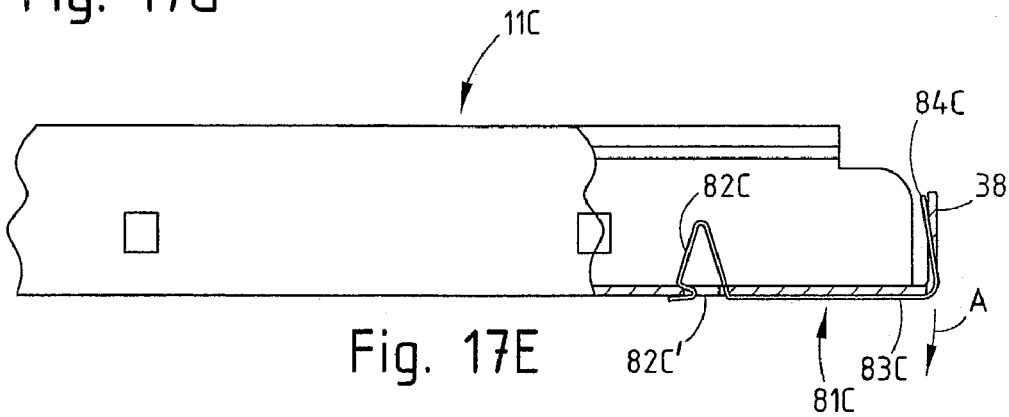
FIG. 17E is an enlarged top view of a right end of the beam in FIG. 17D, partially broken away to show a spring-clip-attached safety catch.
Figure 17D:
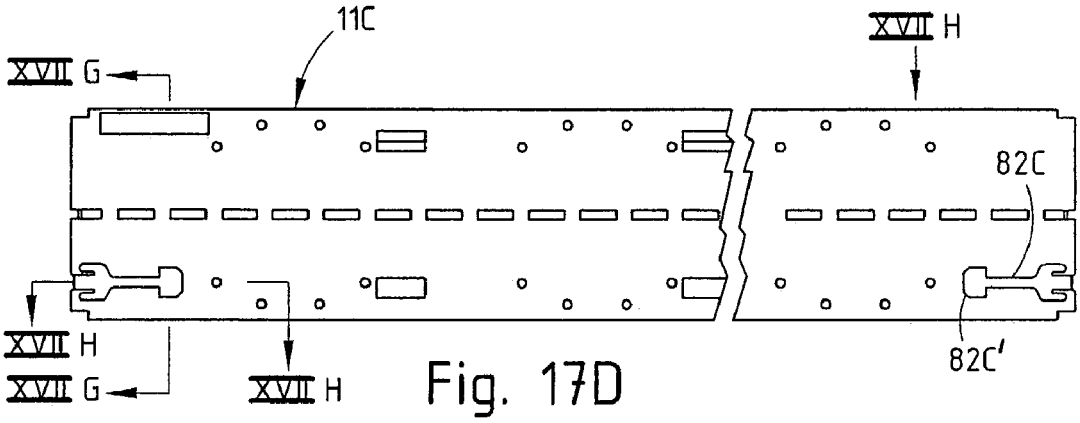
FIG. 17D is a front view of a modified intermediate beam similar to FIGS. 17A-17B.
Figure 17F:
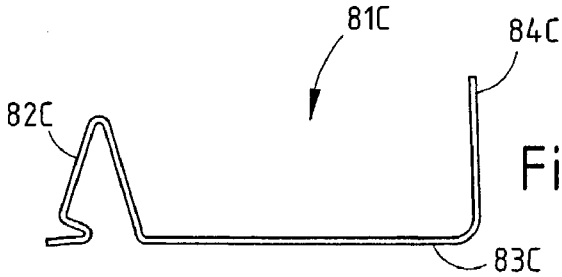
FIG. 17F is a side view of the safety catch shown in FIG. 17E.

FIGS. 17D-17E disclose a modified intermediate beam 11C that is very similar to beam 11B, but beam 11C has a modified safety catch 81C to prevent inadvertent disengagement of hooks 38 from openings 39. Safety catch 81C is made of spring-steel and includes a V-shaped spring clip 82C at one end shaped to engage a square aperture 82C' in the beam 11C, and includes an opposite hooked end portion 83C that is able to flex outwardly in the direction of arrow "A" (FIG. 17E). A tab 84C engages an opening 39 when the hooks 38C are hooked in place in a frame member 8B, like the tab 84 on safety catch 81 discussed above.

Figure 18A:
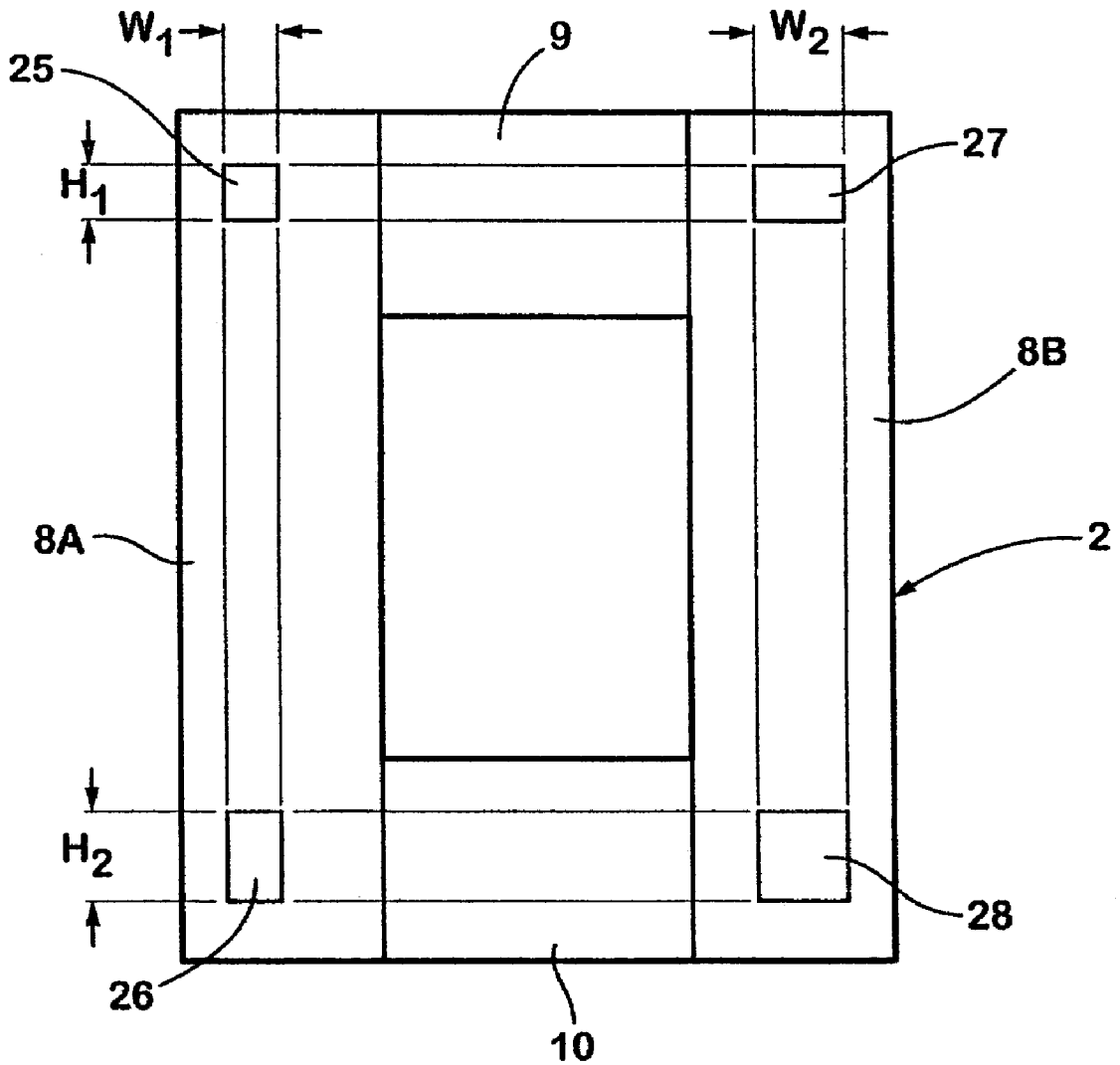
FIG. 18A is a schematic side elevational view of the partition frame of FIG. 3 illustrating the tolerancing scheme for mounting the cover panels.

FIG. 18A schematically illustrates the dimensions and tolerancing scheme provided by openings 25-28. The dimensions and configuration of openings 25-28 in frame 2 are chosen to permit greater production tolerances while alleviating tolerance stack-ups that would otherwise lead to unsightly variations in the gaps between adjacent cover panels 7. As illustrated schematically in FIG. 18A, upper left opening 25 has a relatively small horizontal dimension W1, and a relatively small vertical dimension H1. Thus, a cover panel mounting clip 60 (see also FIG. 26) that is received in opening 25 will "pin" the upper left corner of cover panel 7, allowing little or no horizontal or vertical float. Opening 26 also has a relatively small width W1 preventing horizontal float of the lower left corner of cover panel 7. However, opening 26 has a vertical dimension H2 that is somewhat greater than dimension H1, such that the lower left corner of cover panel 7 can float vertically. Upper right opening 27 has a relatively small vertical dimension H1 that is the same as that of opening 25, substantially preventing vertical float of the upper right corner of cover panel 7. Opening 27 has a horizontal dimension W2 that is greater than horizontal dimension W1, such that the upper right corner of cover panel 7 can float horizontally. Opening 28 has a vertical dimension H2 and a horizontal dimension W2 such that the lower right corner of cover panel 7 can float both horizontally and vertically. Thus, although clips received in openings 25, 26, 27 and 28 will each retain a cover panel 7 to the frame 2, the right vertical side edge of cover panel 7 will float, and the lower horizontal edge of cover panel 7 will also float. It should be understood that this tolerancing scheme could also be utilized with the openings 25-28 in different orientations. For example, openings 28 could have a vertical dimension H1 and a horizontal dimension W1. In this example, opening 25 would have dimensions H2 and W2, and that dimensions of openings 26 and 27 would be switched from the configuration of FIG. 18A.

Figure 18B:
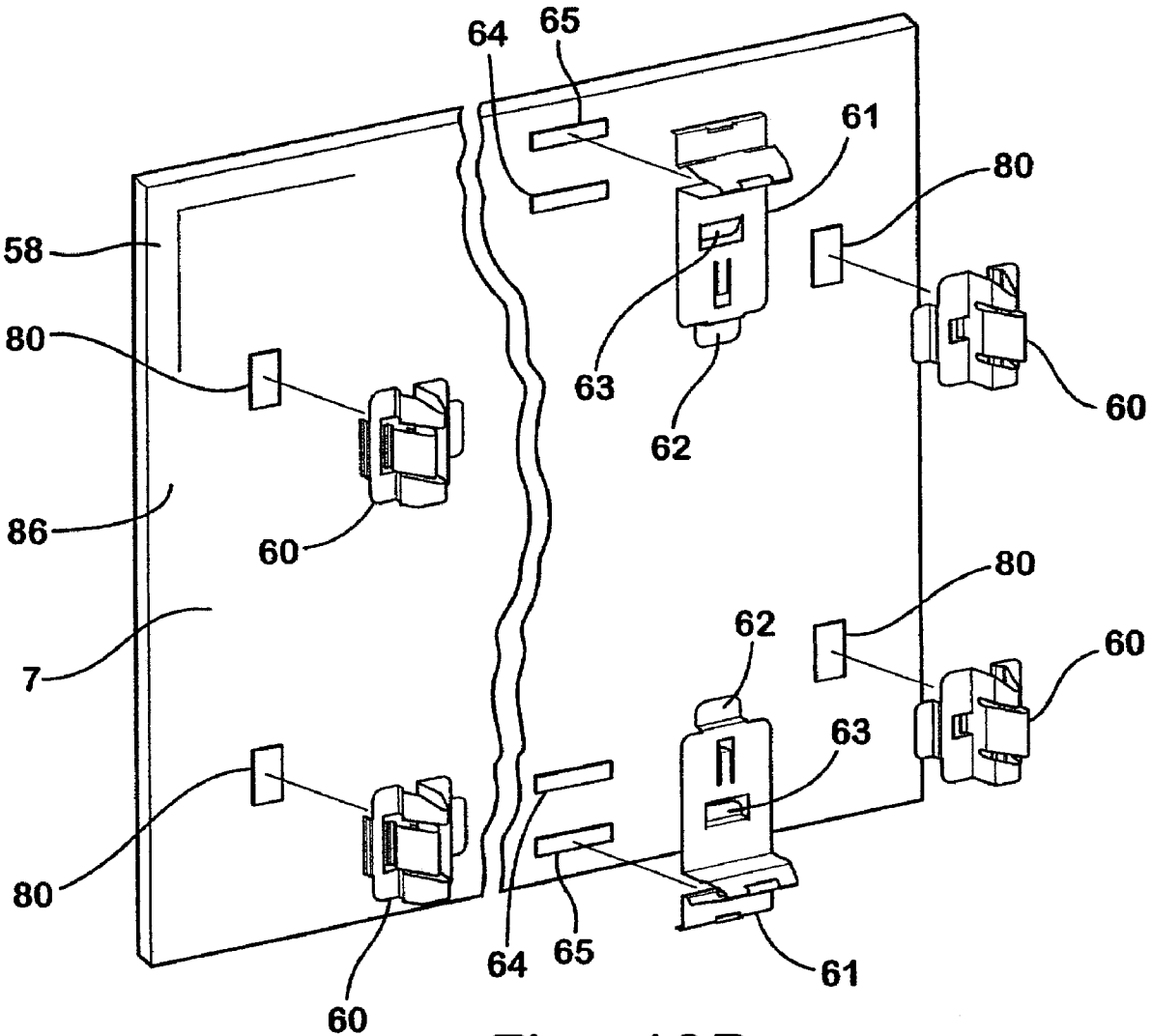
FIG. 18B is a fragmentary, exploded, perspective view showing the mounting of the cover panel retaining clips to a cover panel.
Figure 22:
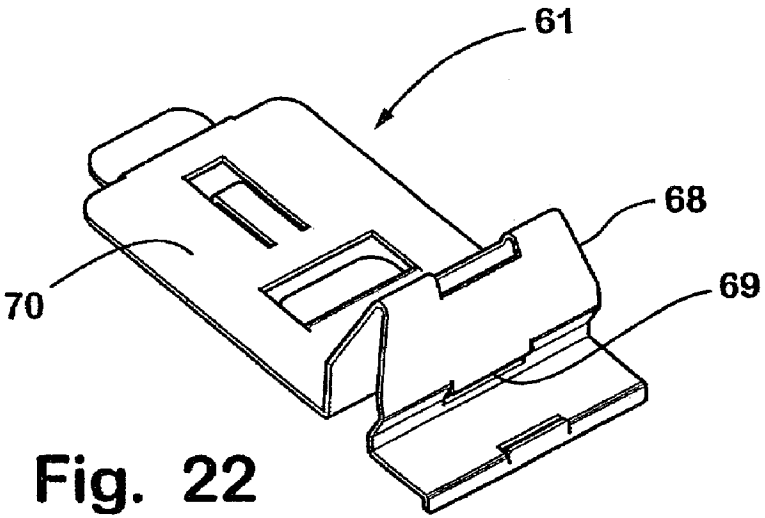
FIG. 22 is a perspective view of the top/bottom cover panel mounting clip of FIG. 19.
Figure 21:
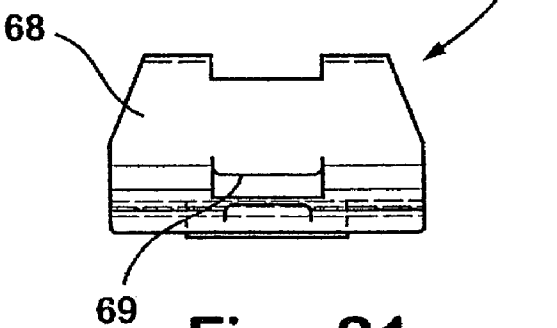
FIG. 21 is a right elevational view of the top/bottom cover panel mounting clip of FIG. 19.
Figure 20:
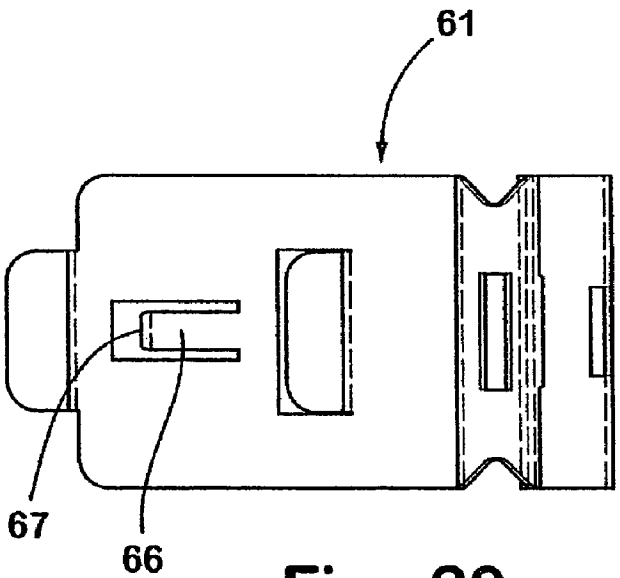
FIG. 20 is a top plan view of the top/bottom cover panel mounting clip of FIG. 19.
Figure 19:
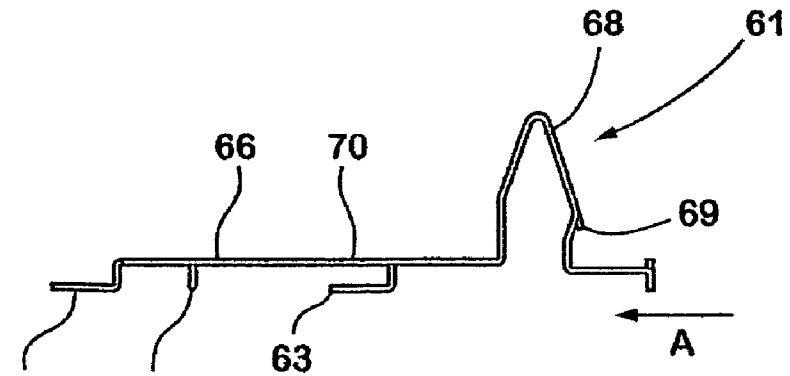
FIG. 19 is a front elevational view of the top/bottom cover panel mounting clip of FIG. 18.

With further reference to FIG. 18B, cover panel 7 includes a plurality of side clips 60, and a plurality of upper and lower clips 61. The side clips 60 are received in the openings 25, 26, 27, and 28 (FIGS. 7-10) of vertical frame members 8A and 8B. As described in more detail below, clips 60 (FIGS. 24-26) include a pair of outer V-shaped fingers 23 that are relatively rigid and prevent horizontal movement of cover panel 7 when the clips engage T-shaped openings 25 (FIG. 7) and 26 (FIG. 8). Clips 60 also include a relatively flexible center "finger" 75 that permits some horizontal movement of clip 60 when installed into a U-shaped opening 27 (FIG. 9) or 28 (FIG. 10). Significantly, T-shaped openings 25 and 26 will engage fingers 73 but provide clearance for finger 75. Conversely, U-shaped openings 27 and 28 are configured to only engage flexible center finger 75 while providing clearance for fingers 73 to thereby permit horizontal float. Thus, a single clip design 60 can be utilized to horizontally lock the position of cover panel 7 when engaging T-shaped openings 25 and 26, yet also may be utilized to permit horizontal float when engaging U-shaped openings 27 and 28. When a full height cover panel 7 is utilized, the upper and lower clips 61 engage the openings 23 in upper frame member 9, and the openings 24 in lower horizontal frame member 10. Alternately, if segmented cover panels 7 are utilized in conjunction with an intermediate horizontal beam 11A or 11B, the upper and lower clips 61 engage openings 23 and 24 of the intermediate horizontal beam 11A or 11B. With further reference to FIGS. 19-22, each upper and lower clip 61 includes a first tab 62 that is received in a first opening 64 in cover panel 7. Similarly, a second tab 63 of clip 61 is received in a second opening 65 in cover panel 7. Each upper and lower clip 61 includes a flexible retainer 66 having a tab 67. During installation of each upper and lower clip 61 in the openings 64 and 65, the tab 67 initially contacts the cover panel 7, and flexes to permit insertion of tabs 62 and 63 in openings 64 and 65. After the tabs 62 and 63 are fully engaged, the flexible retainer 66 returns to the position illustrated in FIGS. 19-22, and the tab 67 engages the edge of opening 64 to prevent inadvertent removal of the clip 61. The flexible V-shaped portion 68 is received in an opening 23 or 24 in partition frame 2, and a small retaining tab 69 engages the inner sidewall of the frame member to thereby retain the cover panel 7. The base portion 70 of each upper and lower clip 61 is stationary relative to the cover panel 7, such that the flexible V-shaped portion 68 generates a force biasing the clip 61 and cover panel 7 in the direction of the arrow "A" (FIG. 19) when installed on the partition frame 2. At least one lower clip 61 and at least one upper clip 61 are utilized on each cover panel 7, and the clips 61 are rotated 180 degrees relative to one another, such that the biasing force of the upper and lower clips 61 acts vertically in opposite directions.

Figure 26:
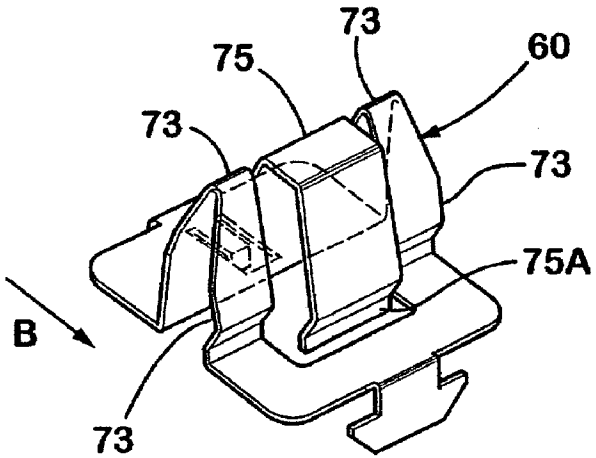
FIG. 26 is a perspective view of the cover panel mounting clip of FIG. 23.
Figure 25:
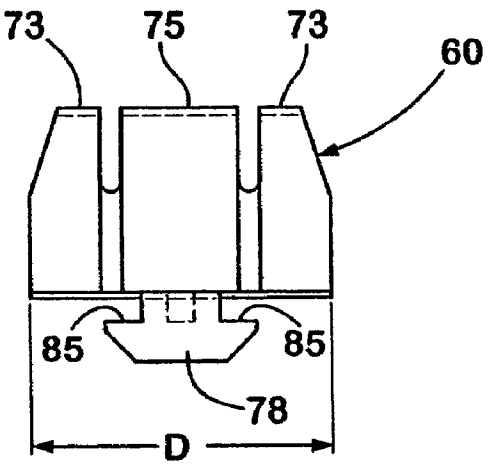
FIG. 25 is a right side elevational view of the cover panel mounting clip of FIG. 23.
Figure 24:
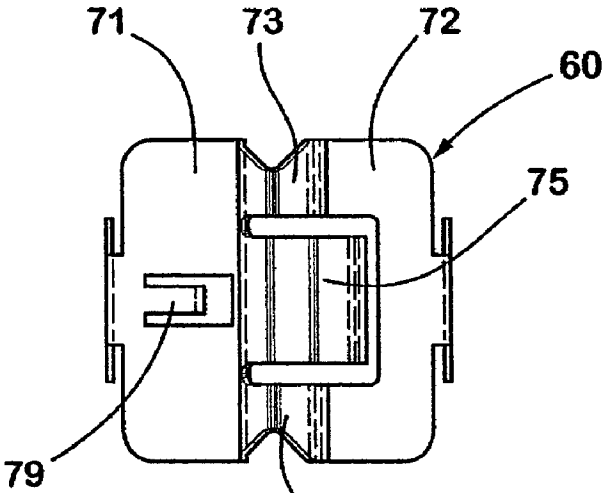
FIG. 24 is a top plan view of the cover panel mounting clip of FIG. 23.

With further reference to FIGS. 24-26, each side clip 60 includes first and second base portions 71 and 72 that are interconnected by a pair of outer V-shaped fingers 73. Each V-shaped portion 73 includes an angled portion 74 that bears laterally against the inner side edge of the opening in the partition frame 2 when installed to thereby retain the clip 60 and cover panel 7 to the partition frame 2. A larger central finger 75 similarly includes an angled portion 76 to retain the clip 60 and cover panel 7 to partition frame 2. Clip 60 includes first and second tabs 77 and 78 that are received in openings 80 of cover panel 7. A flexible retainer 79 contacts the surface 86 of cover panel 7, and biases the upper surfaces 85 of tabs 77 and 78 into engagement with the inner side of the cover panel frame member 58.

With reference to FIG. 7, each upper left opening 25 has a "T" shape including a vertical portion 89 having a width W1 and height H1. The dimension H1 is only slightly greater than the width D (FIG. 25) of clip 60 such that clip 60 cannot shift vertically when positioned in opening 25. Opening 25 also includes a horizontal cutout portion 90. When side clip 60 engages opening 25, the center finger 75 extends into the cutout portion 90 to horizontally locate cover panel 7, and does not provide a retaining function.

Outer fingers 73 are generally V-shaped and securely hold the cover panel 7 to prevent side-to-side movement. Center finger 75 is also V-shaped. However, end 75A of finger 75 is cantilevered, permitting clip 60 to shift in the direction of arrow "B" (FIG. 26) when clip 60 is received in a U-shaped opening 27 or 28. Such shifting may be required due to dimensional variations in the cover panel 7 and/or the sizes/locations of openings 25-28.

The shape of the mounting openings 25-28 in frame 2 determines which fingers of clip 60 engage the opening. T-shaped openings 25 and 26 engage fingers 73, thereby "locking" the horizontal position of left vertical edge of cover panel 7. In contrast, U-shaped openings 27 and 28 only engage center finger 75. Because the center finger 75 is much more flexible than outer fingers 73, the right vertical edge of cover panel 7 will "float" if the dimensions of cover panel 7 vary due to production tolerances and the like.

The side clip 60 is oriented such that the angled portion 76 of clip 60 extends into the cutout portion 90 of opening 25, and the angled portions 74 of outer fingers 73 engage the vertical edges 91 and 92 of opening 25. Each lower left opening 26 (FIG. 8) also has a T-shape, and includes a vertical portion 93 having a width W1 and height H2. Lower left opening 26 includes a cutout horizontal portion 94 that is substantially similar to the cutout portion 90 of upper left opening 25. Although the vertical portion 89 of upper left opening 25 has the same width W1 as the vertical portion 93 of lower left opening 26, the heights HI and H2 of the vertical portions 89 and 93, respectively, are different. The dimensions W1 and HI are chosen such that the upper left side spring clip 60 engages the upper left opening 25 with close tolerances, such that the upper left side spring clip 60 cannot shift horizontally or vertically within the upper left opening 25. However, the height H2 is greater than the height Hi, such that the lower left side clip 60 can shift vertically within the lower left opening 26 to accommodate variations in the vertical distance between a pair of side clips 60 due to production tolerances and the like will cause the position of the lower clip 60 to "shift" vertically within opening 26. However, the width W1 of lower left opening 26 prevents horizontal shifting of the lower left clip 60.

With further reference to FIGS. 9 and 10, the upper right opening 27 has a height H1 that is the same as height H1 of upper left opening 25, and lower right opening 28 has a height H2 that is the same as the height H2 of lower left opening 26. As discussed above, because the dimension H1 is only slightly greater than the width D (FIG. 25) of side clip 60, the side clip 60 in the upper right opening 27 will be closely located vertically. However, the height H2 of the lower right opening 28 is substantially greater than the width D of side clip 60, such that a side clip 60 located in the lower right opening 28 can shift vertically to accommodate dimensional variations.

Openings 27 and 28 each include a tab 95 with an edge 96. Openings 27 and 28 also include cutouts 97 adjacent tabs 95.

When a side clip 60 is inserted into the openings 27 and 28, the center finger 75 of clip 60 engages the edge 96 of tab 95, and the outer fingers 73 are positioned within the cutouts 97, but do not contact the side edges 98 of cutouts 97. The outer fingers 73 of clip 60 are substantially less flexible than the center finger 75, such that the cover panel 7 is horizontally fixed due to the contact of the outer finger 73 with the openings 25 and 26. If the horizontal dimension between the left pair of side clips 60 on cover panel 7 and the right pair of side clips 60 on cover panel 7 varies, such variation will cause the position of the right edge of the cover panel 7 to vary because the side clips 60 located in the right openings 27 and 28 will "shift" horizontally due to the flexibility of center finger 75. Similarly, the uppermost pair of side clips 60 that are positioned in upper openings 25 and 27 is relatively fixed. If the vertical dimension between the upper pair of side clips 60 and the lower pair of side clips 60 varies, the lower pair of side clips 60 will "float" vertically within the lower openings 26 and 28 because the vertical dimension H2 of the lower openings is greater than the vertical dimension H1 of the upper pair of openings 25 and 27.

Figure 26B:
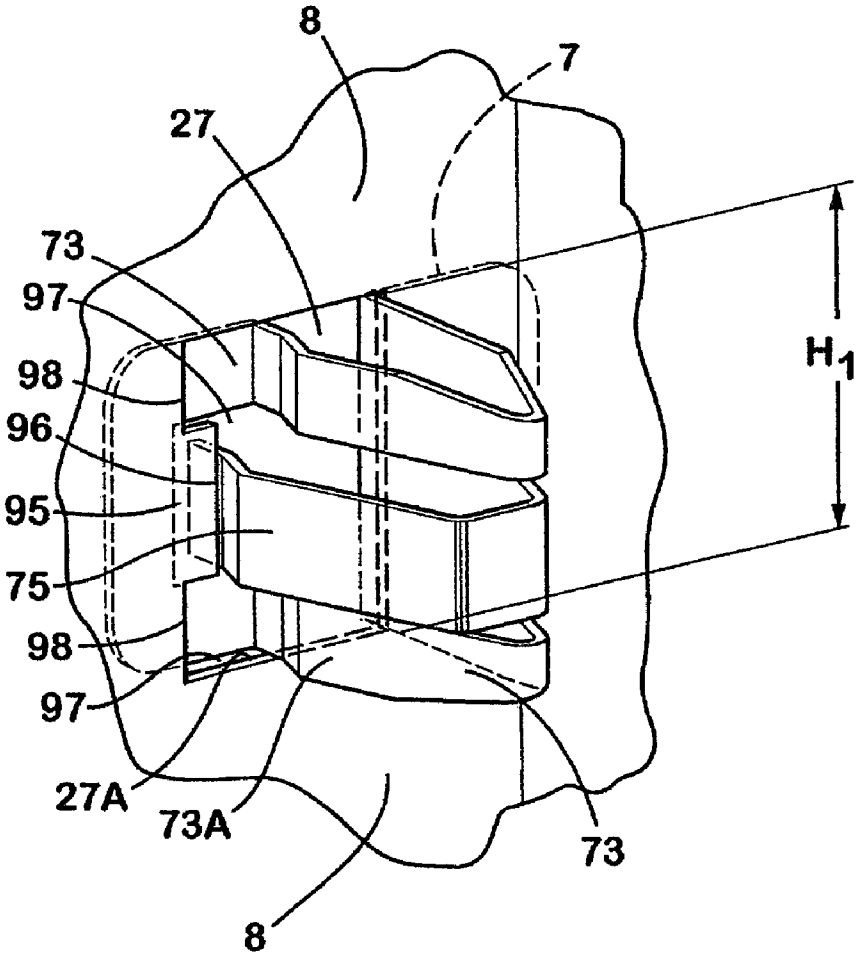
FIG. 26B is a fragmentary, perspective view showing a cover panel mounting clip extending through an opening in the sidewall of a vertical frame member.
Figure 26A:
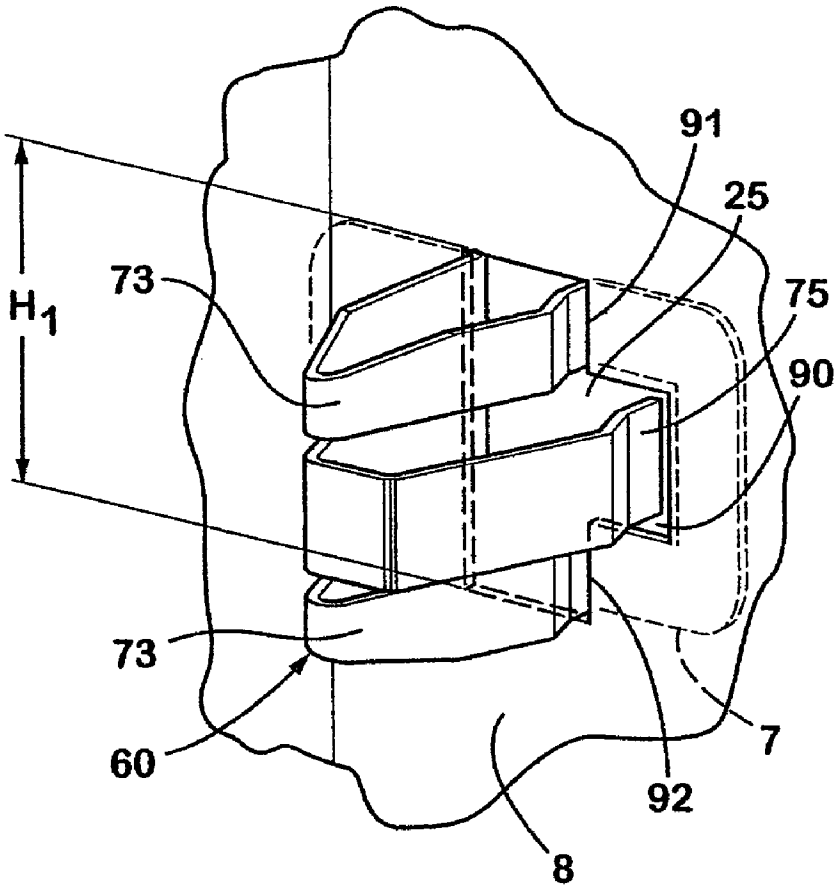
FIG. 26A is a fragmentary, perspective view showing a cover panel mounting clip extending through an opening in the sidewall of a vertical frame member.

FIG. 26A further illustrates the engagement of clip 60 in a T-shaped opening 25. As discussed above, outer legs 73 contact vertical edge portion 91 and 92 of opening 25, and thereby prevent horizontal movement of cover panel 7. Center fingers 75 extend into cutout 90. Cutout 90 is larger than finger 75, such that finger 75 does not contact the edges of opening 25 and thus does not provide any retaining action when received in opening 25. Clip 60 engages opening 26 in substantially the same manner as just described in connection with opening 25 except that opening 26 has a vertical dimension H2 that is greater than Hi to permit vertical shifting of clip 60 within opening 26.

With further reference to FIG. 26B, when clip 60 is received within a U-shaped opening 27, flexible center finger 75 will contact edge 96 of tab 95. Outer fingers 73 are received in cutout areas 97 of opening 27. Cutout areas 97 are larger than fingers 73, such that fingers 73 do not contact the vertical side edges 98 of opening 27, such that fingers 73 do not horizontally position cover panel 7 when received in opening 27. Because leg 75 is flexible, clip 60 can move horizontally within opening 27. Lower edge 73A of lower leg 73 contacts lower edge 27A of opening 27 to vertically support cover panel 7. Clip 60 engages lower U-shaped opening 28 in substantially the same manner as opening 27, except that lower opening 28 has a vertical dimension H2 that is greater than vertical dimension H1 to thereby permit vertical movement (float) of clip 60 within opening 28 due to dimensional variations and the like.

In summary, the upper left openings 25 in each panel frame 2 "fixes" the upper left corner of the associated cover panel 7 both horizontally and vertically, such that variations in horizontal dimensions will cause the right edge of the cover panel 7 and/or right side clips 60 to shift horizontally, and variations in the vertical dimensions of the cover panel 7 due to production tolerances, etc. will cause the lower edge of the cover panel 7 and/or lower clips 60 to shift vertically. Precisely locating or fixing the left edge of the cover panel 7 in this manner permits greater production tolerances while maintaining a specified variation in the horizontal gap between horizontally adjacent cover panels 7. Similarly, fixing the upper edge of cover panel 7 permits larger vertical tolerances while maintaining the required vertical gap between vertically adjacent cover panels 7 when segmented cover panels are utilized. Furthermore, this arrangement permits greater tolerancing of the dimensions between side clips 60, while providing proper positioning of panel 7 based on the upper left clip 60.

Figure 7A:
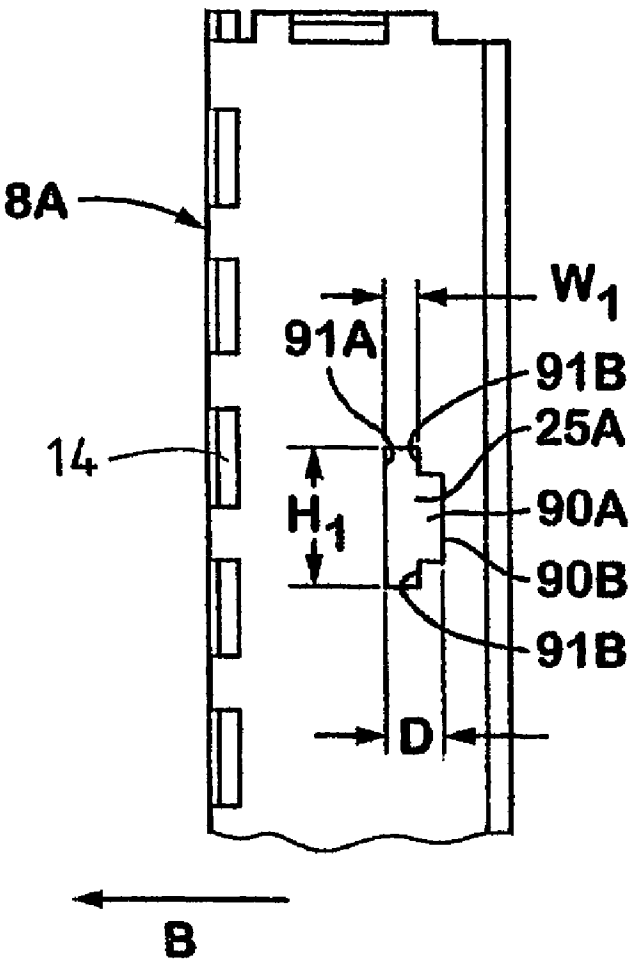
FIG. 7A is an enlarged view of an alternate embodiment of the aperture of FIG. 7.

With reference to FIG. 7A, an alternate embodiment 25A of the opening 25 is generally T-shaped and provides substantially the same cover panel mounting characteristics as described above in connection with opening 25. However, the opening 25A is oriented with the cutout 90A extending inwardly. The alternate opening 25A is utilized in conjunction with an alternate clip 60A described in more detail below, and illustrated in FIGS. 23A-23D. Clip 60A includes a center finger 75A and outer fingers 73A that operate in substantially the same manner as the fingers 73 and 75 of clip 60 described in detail above. The outer finger 73A tightly engage the side edges 91A and 91B of opening 25A to locate the cover panel 7. However, unlike opening 25, opening 25A has an overall horizontal dimension "D" that is relatively small such that the center finger 75A of clip 60A engages the side edge 90B of cutout 90A. Thus, the flexible center finger 75A will bias the cover panel outwardly in the direction of the arrow "B", ensuring that that cover panel 7 is in tension to prevent bowing, bulging or other distortion of the cover panel 7.

Figure 9A:
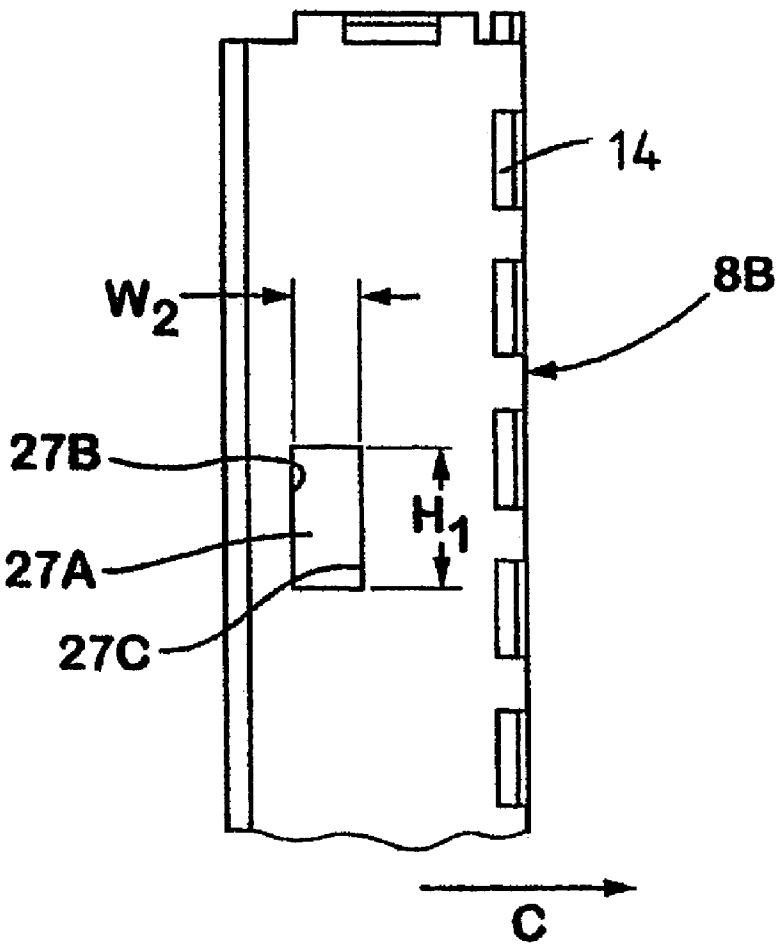
FIG. 9A is an enlarged view of an alternate embodiment of the aperture of FIG. 9.

With further reference to FIG. 9A, an alternate embodiment 27A of opening 27 provides substantially the same cover panel mounting characteristics as described above with respect to opening 27. The width W2 of opening 27A is relatively large, such that only the flexible center finger 75A of clip 60A engages the side edge 27B of opening 27A. The base portion 60B (FIG. 23B) of clip 60A contacts the side edge 27C of opening 27A. The engagement of flexible center finger 75A along side edge 27B of opening 27A biases the cover panel 7 in the direction of the arrow "C" (FIG. 9A), thereby creating horizontal tension in cover panel 7 to prevent bowing, bulging or other deformation of the cover panel 7.

A lower opening (not shown) having substantially the same shape as opening 25A, only having a height H2 may be utilized to provide substantially the same cover panel mounting characteristics as opening 26 described in detail above. Similarly, a lower right opening (not shown) having substantially the same shape as opening 27A may be provided, with the lower opening having a height H2, such that the lower right opening would provide substantially the same mounting characteristics as opening 28 described in detail above. Thus, the shape of the openings 25A and 27A provide a horizontal tension on cover panel 7, but otherwise provide the same tolerancing characteristics as described in detail above in connection with openings 25-28, and illustrated schematically in FIG. 18A.

Figure 23:
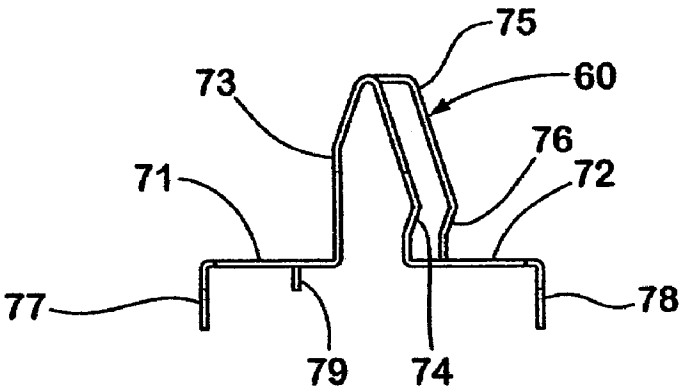
FIG. 23 is a front elevational view of a cover panel clip utilized along the left and right vertical side edges of a cover panel.
Figure 23C:
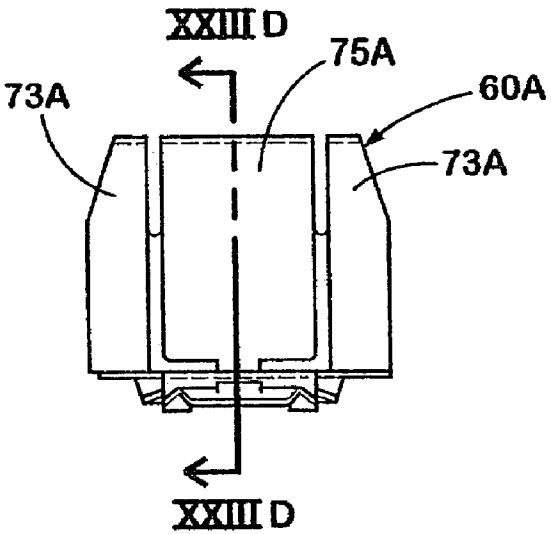
FIG. 23C is a front elevational view of the clip of FIG. 23A.
Figure 23D:
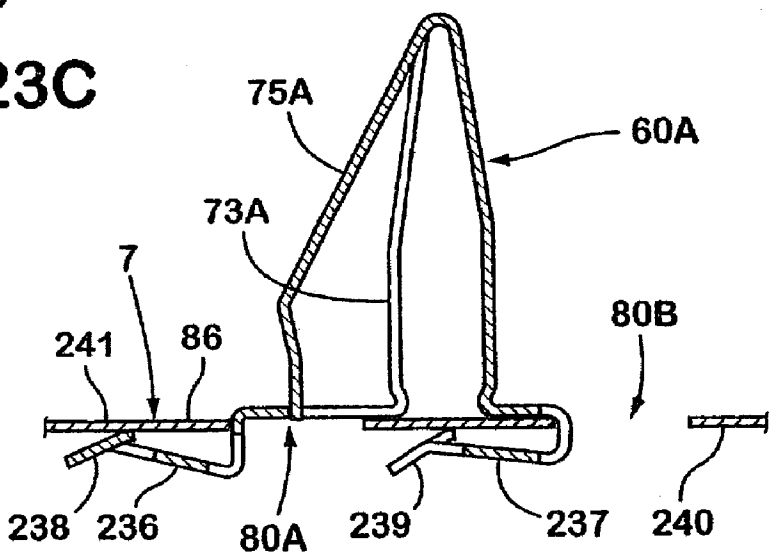
FIG. 23D is a cross-sectional view taken along the line XXIIID-XXIIID.
Figure 23A:
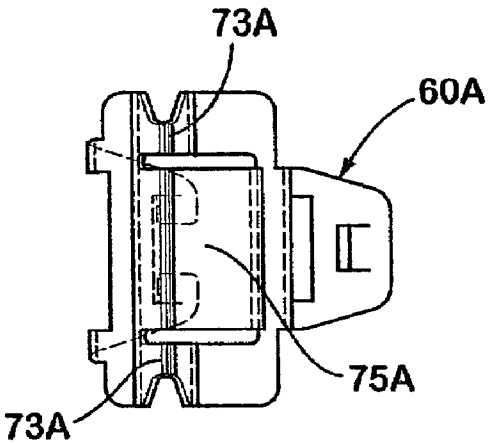
FIG. 23A is a top plan view of an alternate embodiment of the cover panel clip illustrated in FIGS. 23-26.
Figure 23B:
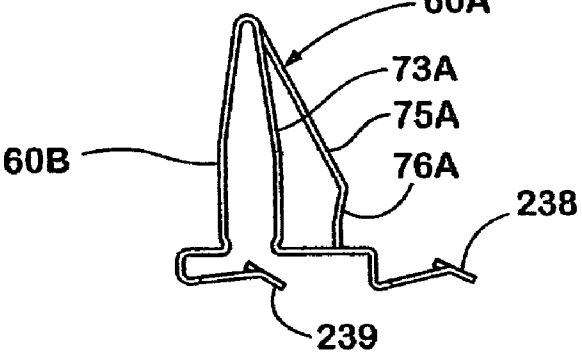
FIG. 23B is a side elevational view of the clip of FIG. 23A.

With reference to FIG. 23D, clip 60A includes a pair of flexible extensions 236 and 237, which are received within openings 80A and 80B in the rear surface 86 of cover panel 7. When installed in the position illustrated in FIG. 23D, retainers 238 and 239 of flexible extensions 236 and 237 engage the inner surface 240 of metal sheet 241 of cover panel 7, thereby retaining the clip 60A on the cover panel 7.

Figure 27:
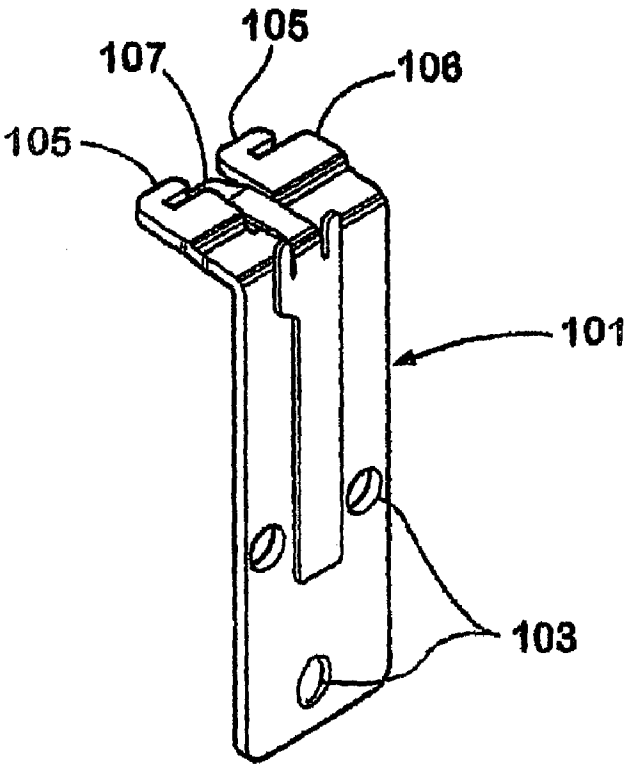
FIG. 27 is a perspective view of an upper connector bracket for mounting an off-module panel.

With reference to FIG. 1, partition system 1 may include an off-module panel 100 that includes a partition frame 2 having exactly the same construction as the other partition panels in the system (see, e.g. FIGS. 2-5). An upper bracket 101 and lower bracket 102 are connected to the panel 100 and interconnect the panel 100 to the upper horizontal row of slots 12 and lower horizontal row of slots 13 of the partition frame 2 to which the off-module panel 100 is being connected. The in-line row of partitions that the off-module panel is connected to is commonly known as a "spine wall". With further reference to FIG. 27, upper connector bracket 101 includes openings 103 that receive conventional fasteners or the like to secure the bracket 101 to the openings 104 (see also FIG. 6) of a frame upright 8. Bracket 101 includes a horizontal extension 106 with a pair of horizontally oriented hooks 106 that are received in selected ones of the upper horizontal row of slots 12. If the off-module panel 100 is of a lesser height than the adjacent panel frame 2 to which it is being connected, the hooks 105 may be received in the horizontal row of slots 15 of a structural intermediate beam 11B. A flexible catch 107 is made of spring-steel, and extends downwardly slightly. During installation, the hooks 105 are first inserted into the slots 12 and then shifted horizontally to engage the hooks 105. During insertion of hooks 105, catch 107 flexes downwardly upon contacting the frame member 9, and then springs back into the slot 12 as the bracket 101 is shifted to fully engage the hooks 105. The catch 107 thus prevents inadvertent disengagement of hooks 105. To disengage the bracket 101, the catch 107 is flexed out of engagement with the slot 12, and the bracket 101 is shifted horizontally to disengage hooks 101.

Figure 28:
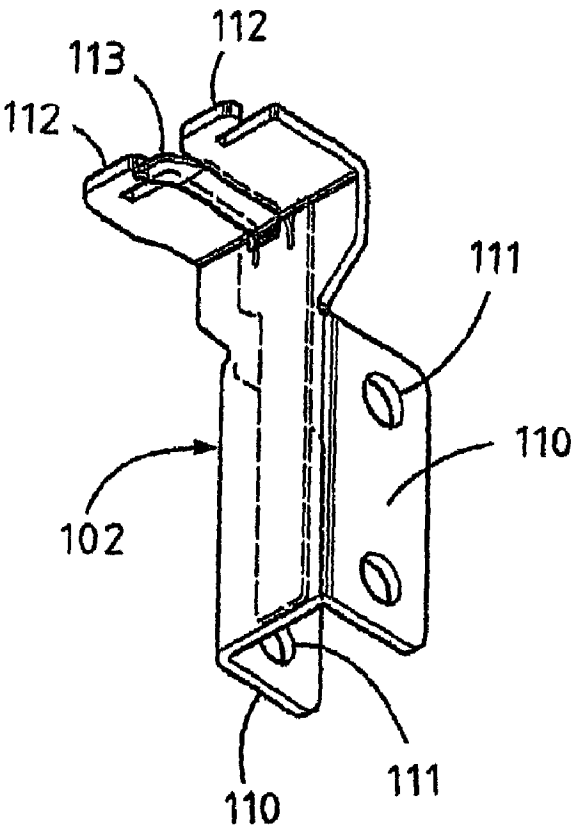
FIG. 28 is a perspective view of a lower bracket for mounting an off-module panel.

With reference to FIG. 28, lower bracket 102 includes a pair of flanges 110, each of which has a pair of openings 111. When installed, the flanges 110 of bracket 102 extend around the leg 108 (see also FIG. 3) of frame 2, and conventional fasteners or the like (not shown) are received in the openings 111 and 109 to secure the bracket 102 to the leg 108. Bracket 102 includes a pair of horizontally oriented hooks 112 and a flexible catch 113. The hooks 112 and catch 113 operate in substantially the same manner as the hooks 105 and catch 107 of upper bracket 101, as described above. The upper and lower brackets 101 and 102 permit the off-module panel 100 to be connected to a frame 2 at substantially any horizontal location.

Figure 29:
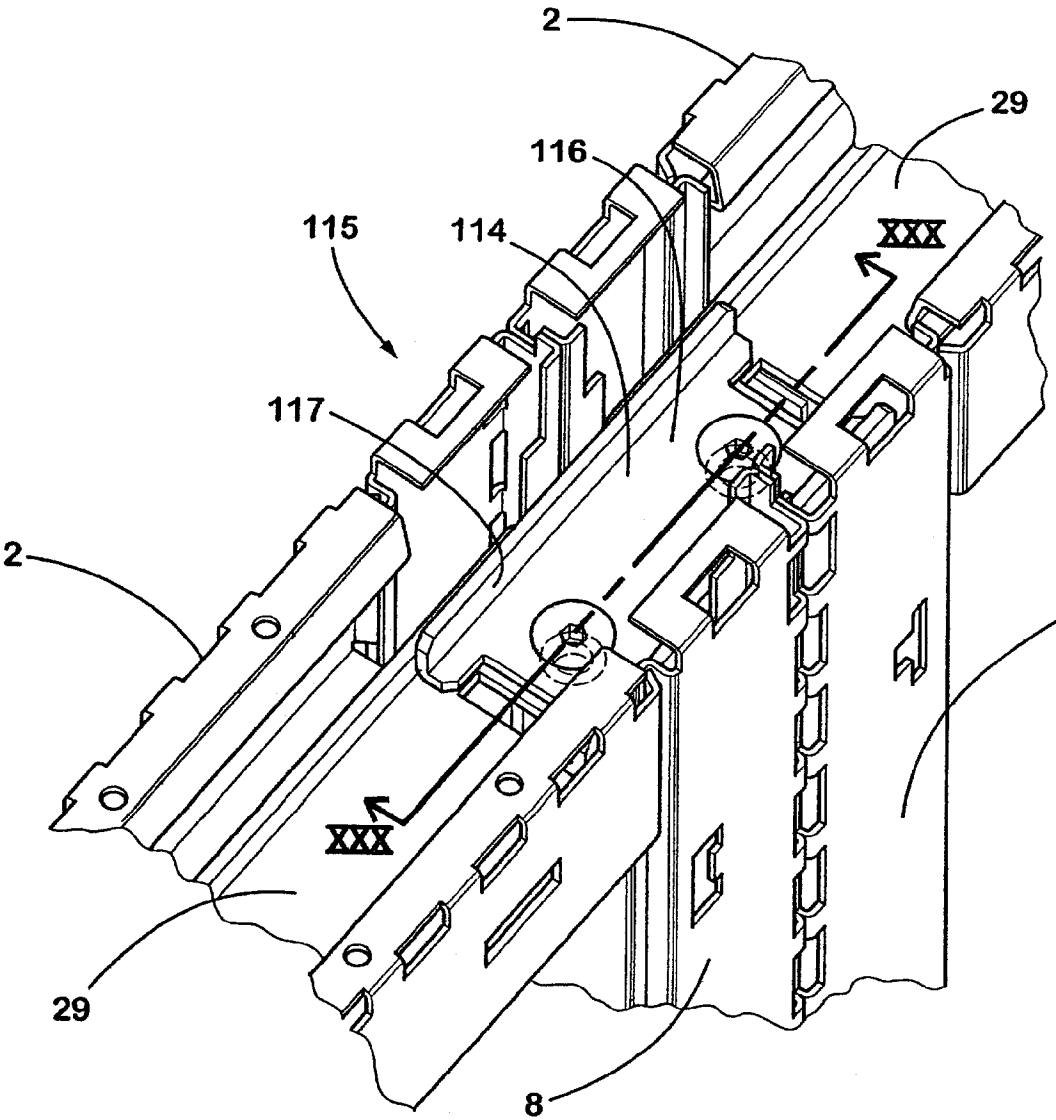
FIG. 29 is a fragmentary, perspective view of an in-line connector.
Figure 29A:
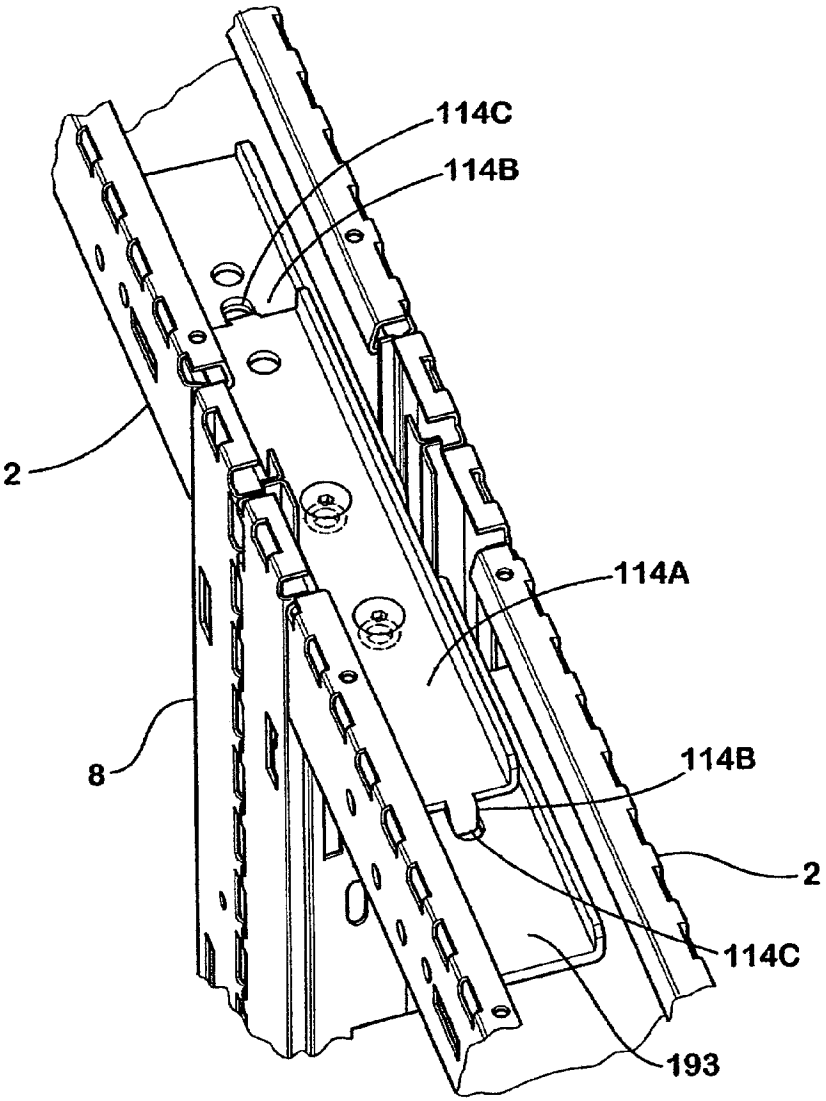
Figure 29C:
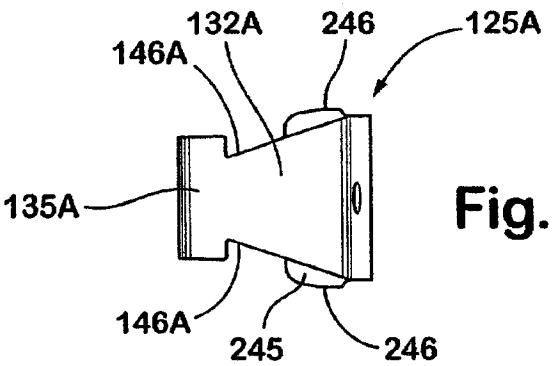
Figure 29D:
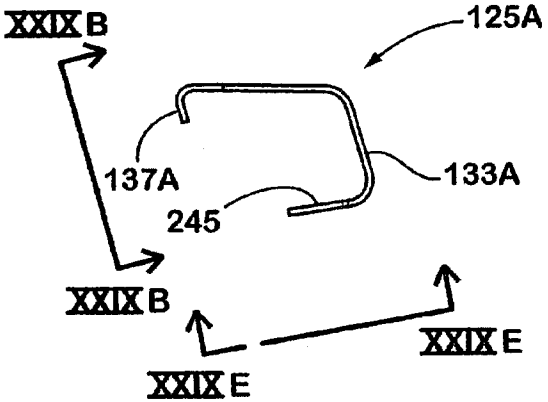
Figure 29B:
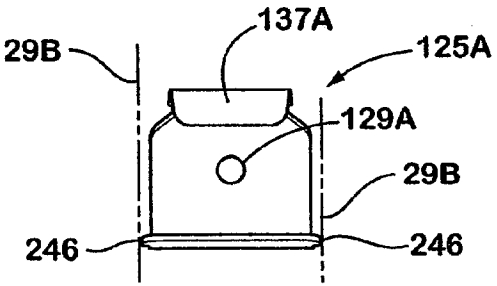
Figure 29E:
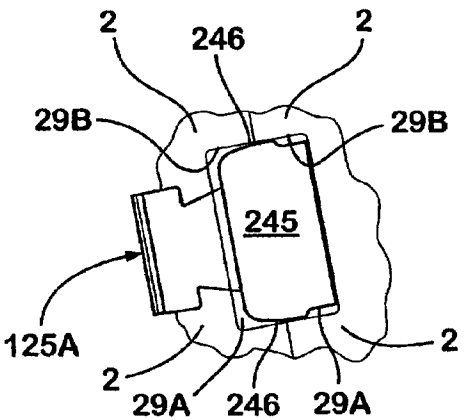
Figure 30:
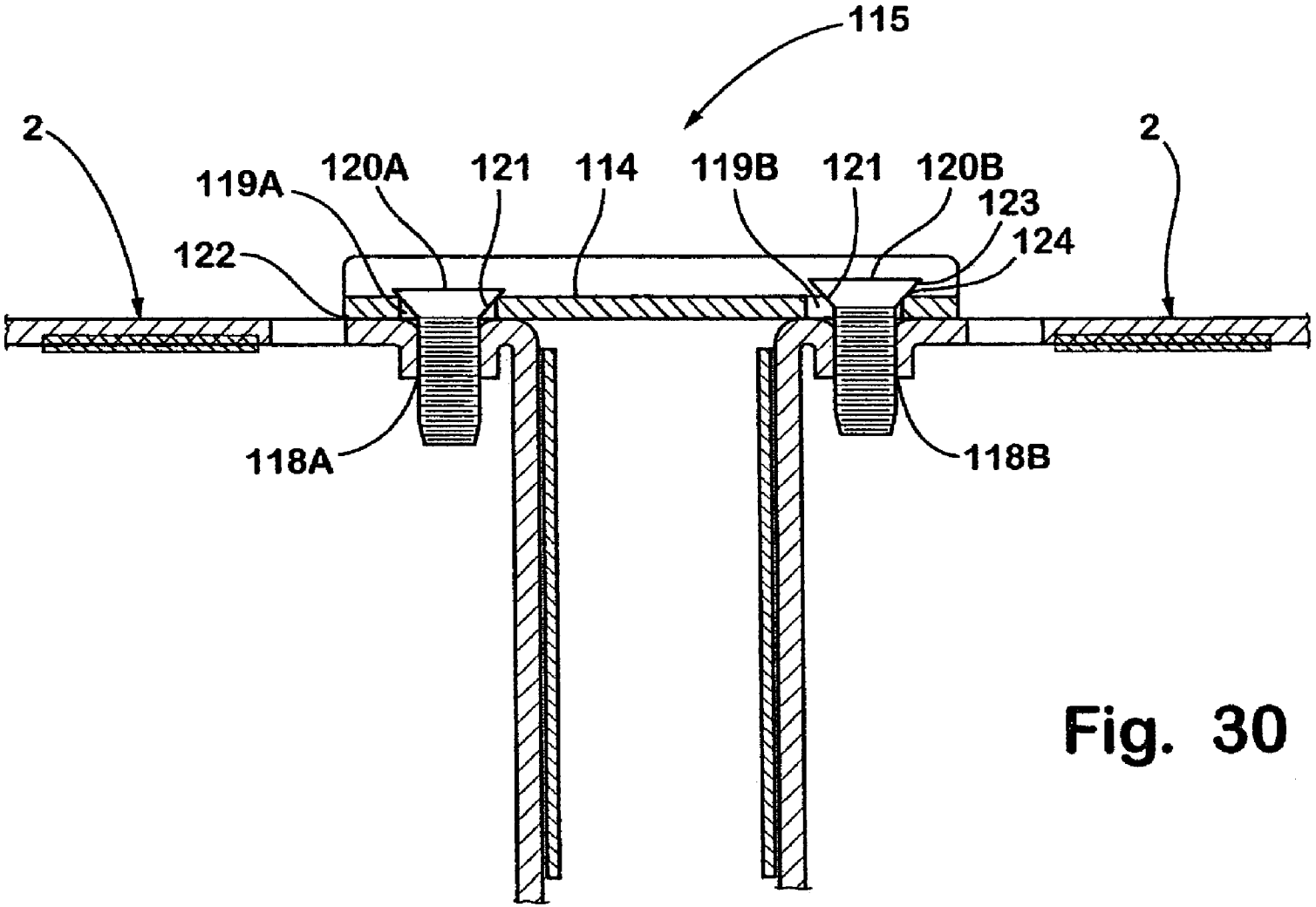
FIG. 30 is a cross-sectional view of the in-line connector taken along the line XXX-XXX.

With further reference to FIG. 29, an in-line connector bracket 114 is provided to interconnect a pair of adjacent panel frames 2 to form an in-line junction 115. Bracket 114 has a base web 116 and a pair of upstanding flanges 117, such that the bracket 114 has a U-shaped shell cross section. With further reference to FIG. 30, a pair of threaded openings 118 in the frame 2 threadably receive fasteners 120A and 120B, each of which has a conventional conically shaped head 121. The fasteners 120A and 120B extend through the clearance openings 119A and 119B of bracket 114. During assembly, the fastener 120A is first tightened, drawing the in-line bracket 114 into tight contact with the upper surface 122 of frame 2. The fastener 120B is then threadably engaged in the threaded opening 118B. The distance between the openings 119A and 119B is somewhat smaller than the spacing between the openings 118A and 118B when the pair of adjacent frames 2 are abutting one another. Thus, the outer conical surface 123 of head 121 of thread fastener 120B will contact the edge 124 of clearance hole 119B. As the threaded fastener 120B is further tightened, the adjacent frames 20 will thus be drawn or forced together into tight contact with one another. Furthermore, the upstanding flanges 117 of bracket 114 have a width that is the same or less than the width of channels 29 along the upper edge of the adjacent frames 2, such that the bracket 114 also serves to align the adjacent frames 2 into the same plane.

Figure 31:
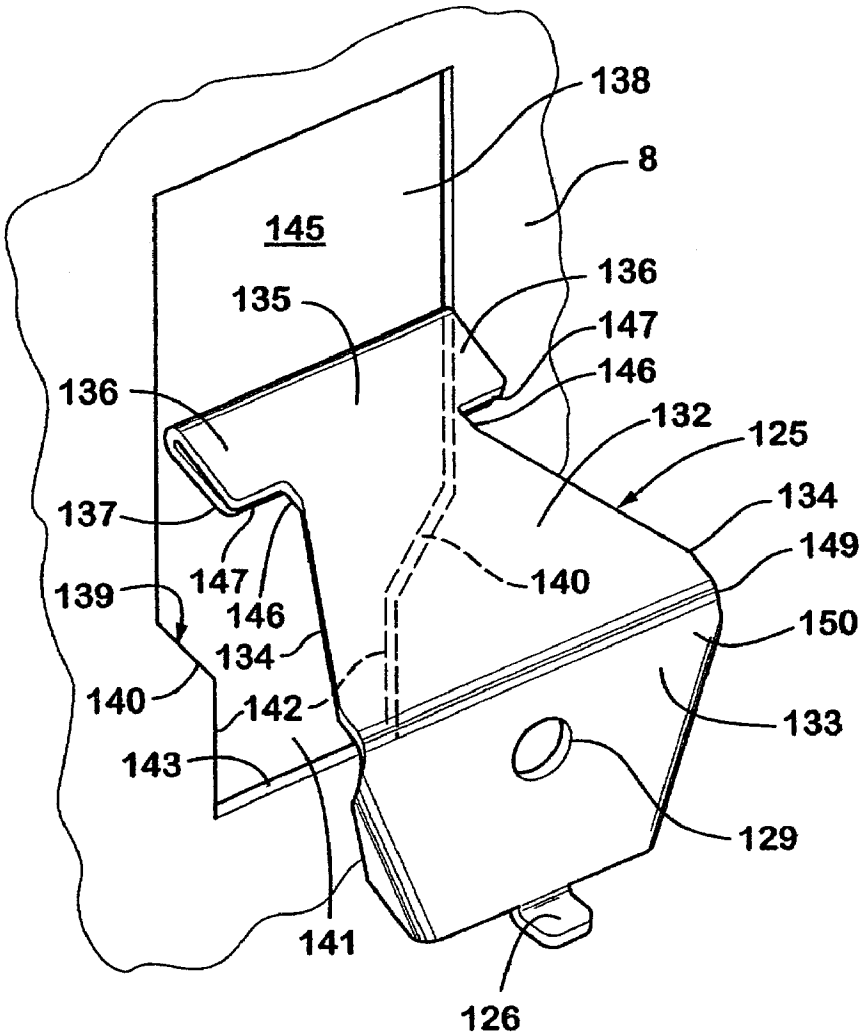
FIG. 31 is a perspective view of a lower in-line connector bracket.
Figure 32:
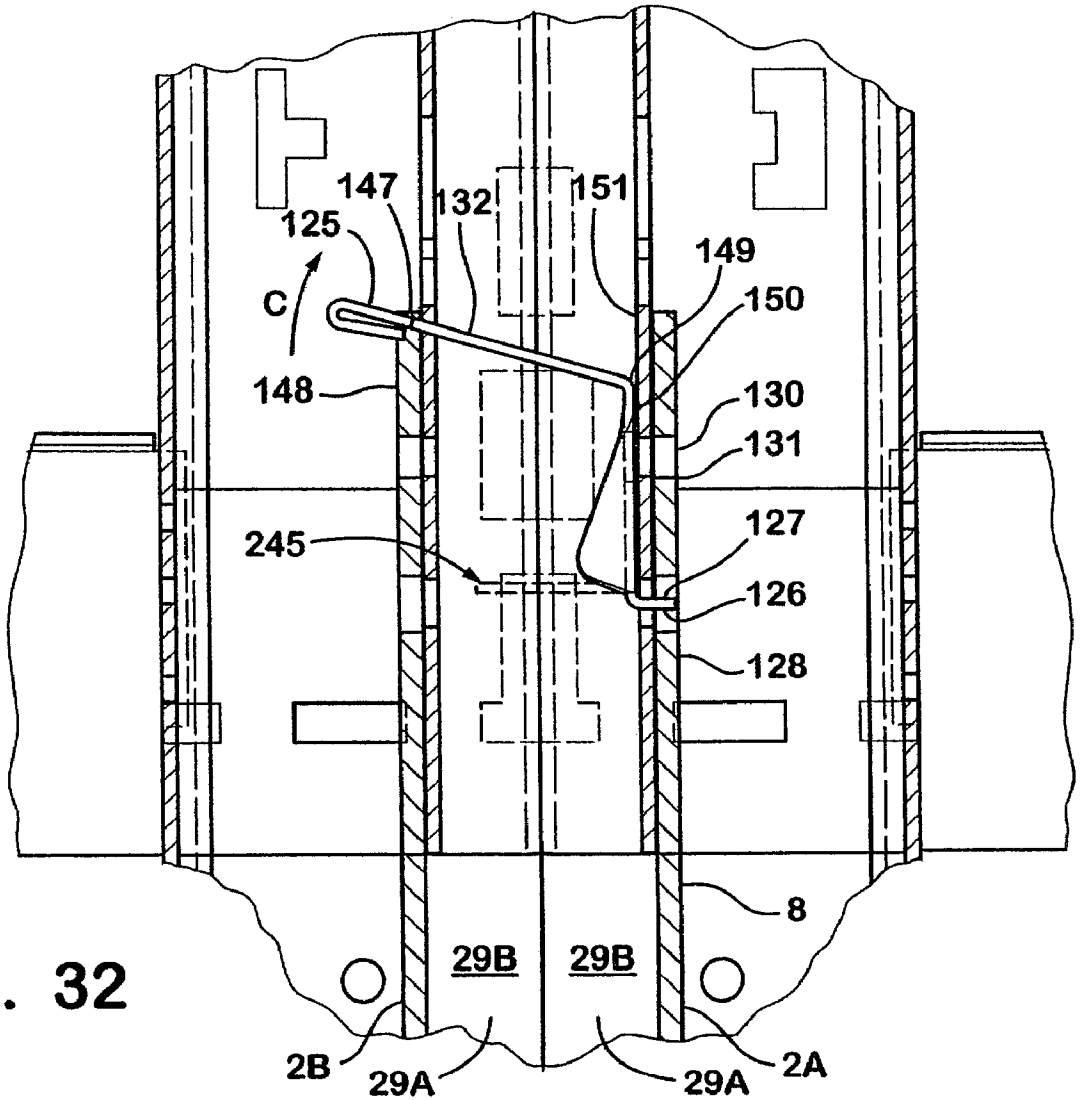
FIG. 32 is a cross-sectional view of a portion of a pair of adjacent partition panels showing the engagement of the bracket of FIG. 31 with the partition panels.

With further reference to FIG. 31, a lower in-line connector bracket 125 is utilized to interconnect the adjacent panels 2 adjacent the lower corners thereof. Bracket 125 includes a small tab 126 that is received in an opening 127 (see also FIG. 32) in a sidewall 128 of vertical frame member 8A. Opening 129 in bracket 125 receives a threaded fastener 130 that engages threaded opening 131 in sidewall 128 of vertical frame member 8 to thereby secure the bracket 125 to the frame 2A. Bracket 125 also includes a tongue 132 that extends from flange 133. Tongue 131 includes tapered edges 134 and an enlarged end portion 135 with extensions 136. A flap 137 is folded over to provide additional strength for the end portion 135. Vertical frame member 8 includes an opening 138 with a lower edge 139 having tapered portions 140. Lower edge 139 also defines a cutout 141 having side edges 142 and a lower edge 143.

Figure 33:
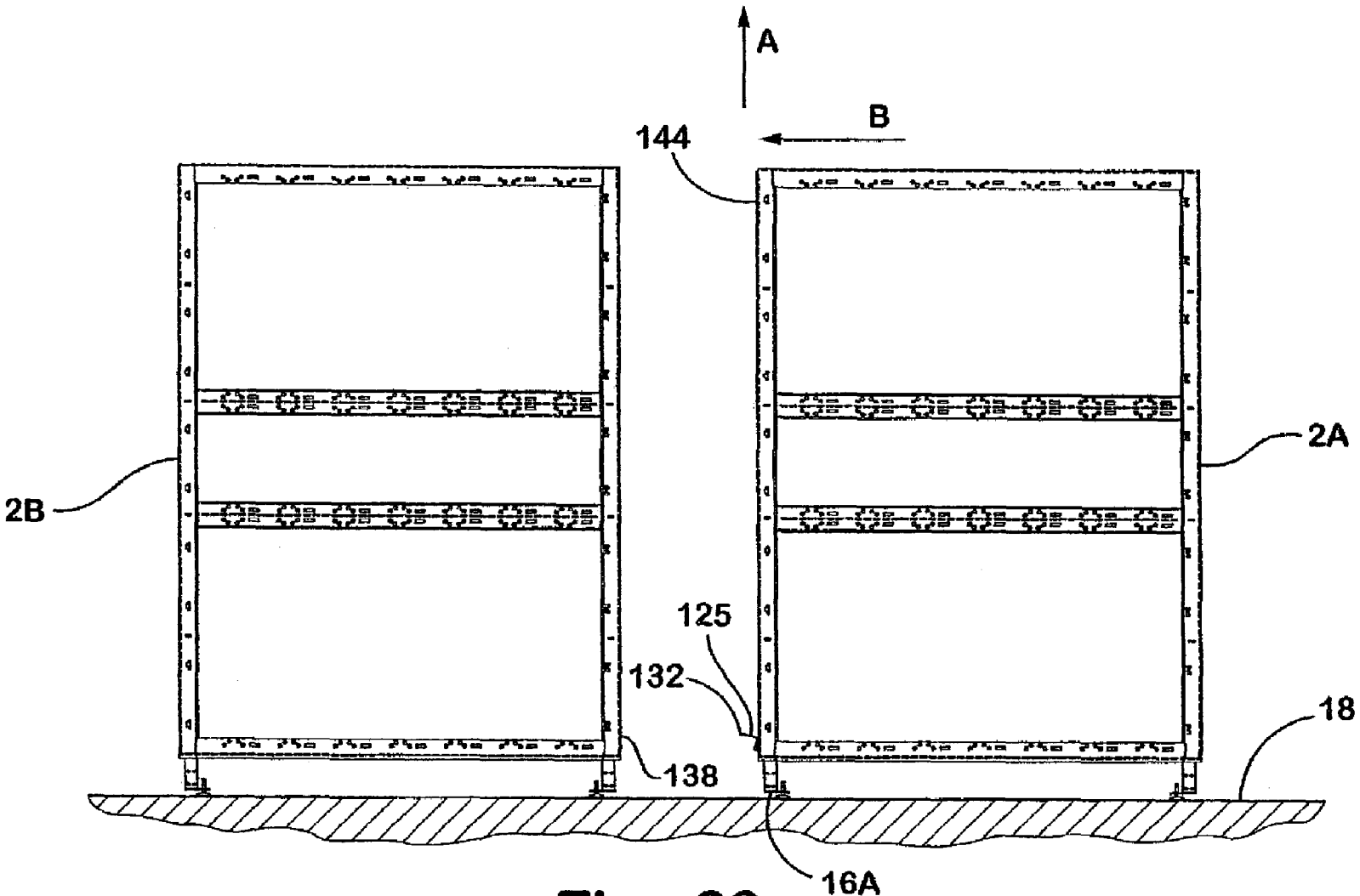
FIG. 33 is a side elevational view illustrating the assembly of a pair of side-by-side partition frames.

With further reference to FIG. 33, bracket 125 is first secured to the side edge 144 of a first partition frame 2A. The side edge 144 of frame 2A is then lifted slightly, and the tongue 132 of bracket 125 is inserted into the large upper portion 145 (see also FIG. 31) of opening 138 of the adjacent partition frame 2B. Edge 144 of partition frame 2A is then lowered, such that the root portions 146 of edges 134 of bracket 125 fit closely against the edges 142 of cutout 141. As the edge 144 of partition frame 2A is lowered, the tongue 132 will engage the lower edge 143 of cutout 141, such that the glide 16A of partition frame 2A is elevated or held slightly off the floor surface 18. The upper bracket 114 is then installed by tightening the threaded fasteners 120A and 120B. As the fasteners 120A and 120B are tightened, the side edge 144 of partition frame 2A is forced downwardly. The edges 147 of bracket 125 are brought into contact with the inner side surface 148 (FIG. 32) of partition frame 2B. As the fasteners 120A and 120B are further tightened, the tongue 132 will bend upwardly about the bend 149 defined between the tongue 132 and the web 133. The distance between the edges 147 and the web 133 is selected to ensure that the adjacent frames 2A and 2B will not vertically align without deformation of the bracket 125. As the tongue 132 flexes upwardly, the tongue 132 is placed in tension such that the upper portion 150 of web 133 bends outwardly slightly from the outer surface 151 of vertical frame member 8. The tension on tongue 132 and deformation of web 133 thereby tightly pulled the adjacent frames 2A and 2B into abutting engagement with one another. Furthermore, the root portions 146 of tongue 132 closely engage the edges 142 of cutout 141, such that the adjacent frames 2A and 2B are also aligned in the same vertical plane.

An alternate embodiment 114A of the in-line connector bracket may also be utilized to interconnect a pair of adjacent panel frames 2. The bracket 114A is substantially the same as bracket 114 described in detail above, except that bracket 114A includes a pair of downwardly extending tabs 114B that are received within openings 114C of bracket 193. Tabs 114B are closely received within the openings 114C to thereby maintain the alignment of the bracket 114A and the adjacent partition frames 2.

With further reference to FIGS. 29B-29E, an alternate embodiment 125A of the lower in-line connector bracket includes a tongue 132A with an enlarged end portion 135A that interconnects a pair of adjacent panel frames 2 in substantially the same manner as described in detail above in connection with in-line connector bracket 125. However, unlike bracket 125 described above, the root portions 146A of bracket 125A fits loosely within the cutout 141 of opening 145 (see also FIG. 31), such that the tongue 132A of bracket 125A does not substantially align the adjacent panel frames 2. Bracket 125A includes a lower extension 245 having opposite side edges 246 that fit closely against the sidewalls 29B of vertical channels 29A (FIG. 29E) of the adjacent partition frames 2. The lower extension 245 is also illustrated in dashed lines in FIG. 32 to further illustrate the positioning and alignment features of the lower extension 245. Tongue 132A includes a downwardly extending flap 137A that provides stiffness to the enlarged end portion 135A of bracket 125A.

Figure 35:
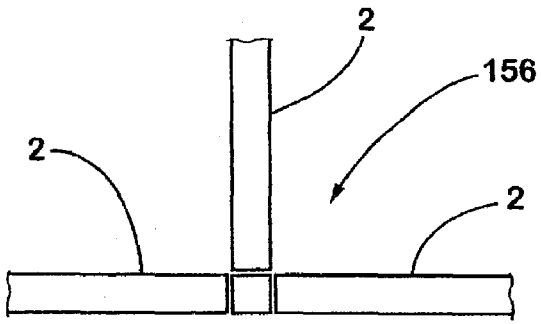
FIG. 35 is a schematic plan view of three adjacent partition panels that are interconnected to form a T junction.
Figure 34:
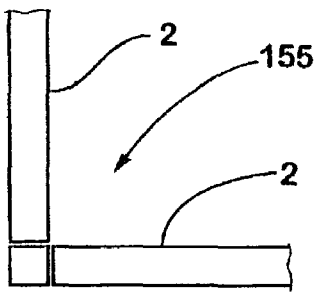
FIG. 34 is a schematic plan view of a pair of partition panels forming an L junction.
Figure 38:
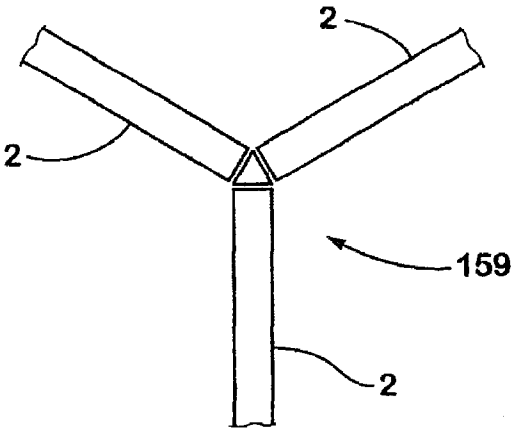
FIG. 38 is a schematic plan view of three adjacent panels that are interconnected at 120° angles relative to one another to form a Y junction.

With further reference to FIG. 34, a pair of adjacent partition panel frames 2 may also be interconnected to form an L junction 155 when seen in plan view. The adjacent panel frames may also be joined to form a T junction 156 (FIG. 35), an X junction 157 (FIG. 36), a V junction 158 (FIG. 37), or a Y junction 159 (FIG. 38).

Figure 39:
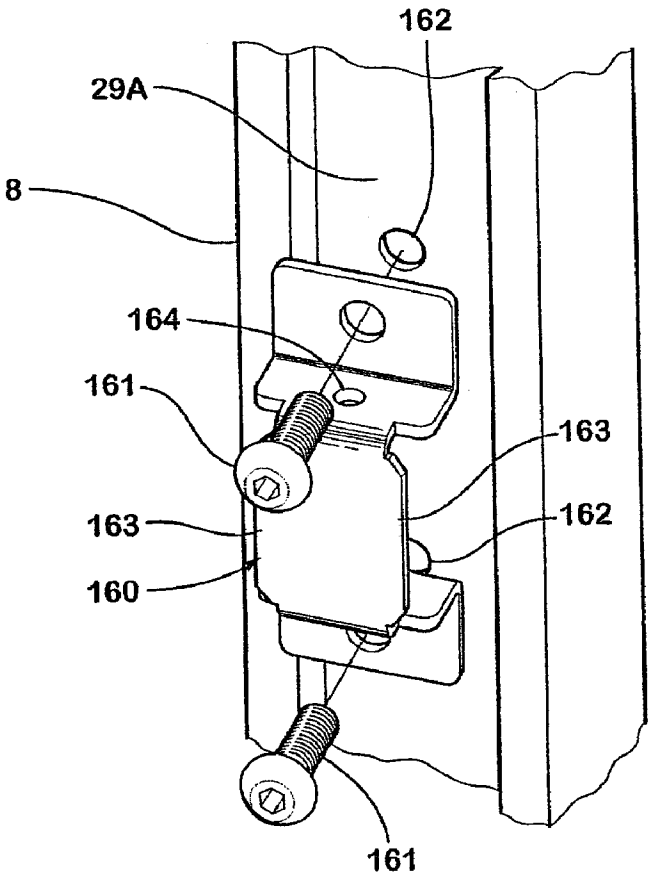
FIG. 39 is a partially fragmentary perspective view of a portion of a vertical frame member and a bracket that interconnects the panels to form the L, T, X, V, Y junctions of FIGS. 34-38.

With further reference to FIG. 39, a bracket 160 is one of the components utilized to form the junctions illustrated in FIGS. 34-38. Bracket 160 is secured within the channel 29 of a vertical frame member 8 via conventional threaded fasteners 161 that are received in threaded openings 162 of vertical frame member 8.

Figure 36:
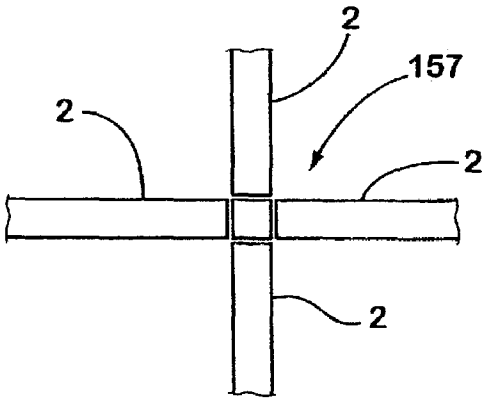
FIG. 36 is a schematic plan view of four adjacent panels that are interconnected to form an X junction.
Figure 40:
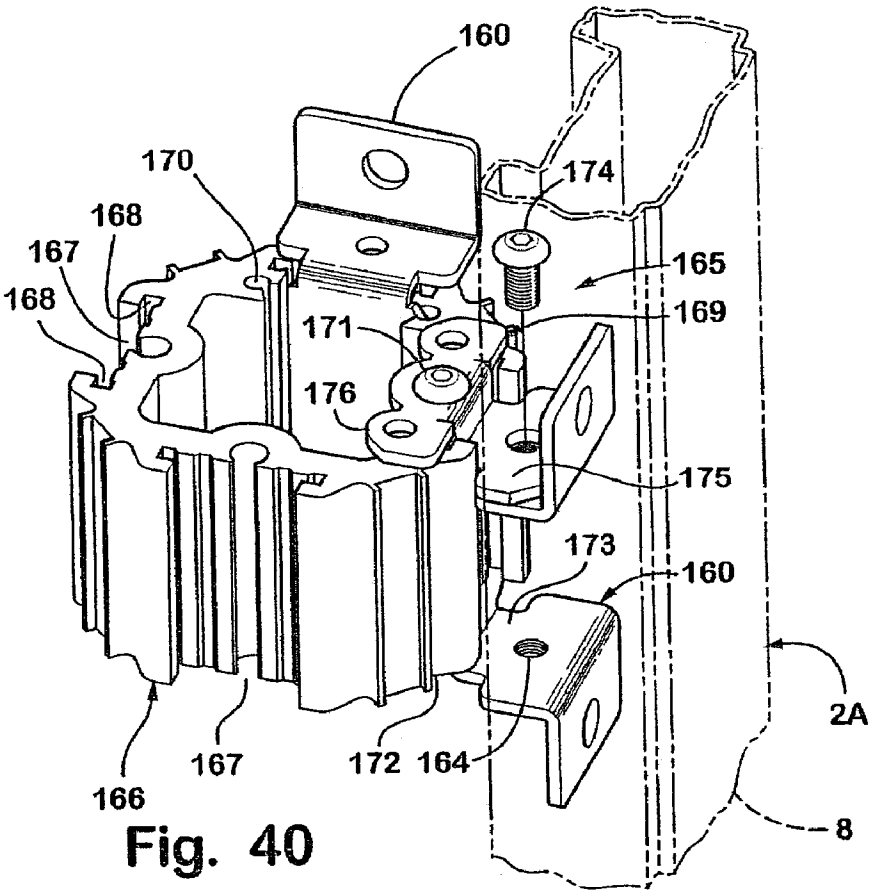
FIGS. 40-40B are perspective views illustrating bracket assemblies that may be utilized to interconnect the panels to form the L, T, and X plan configurations.
Figure 40A:
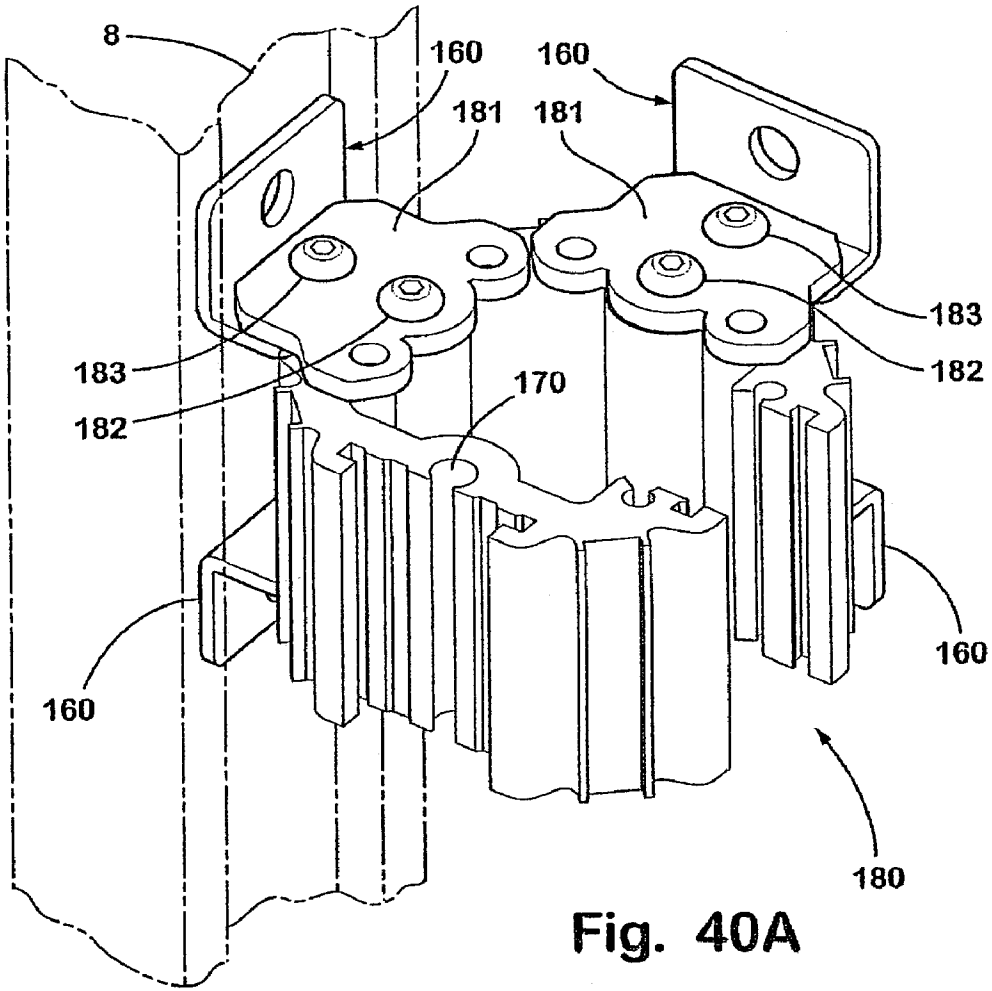
Figure 40B:
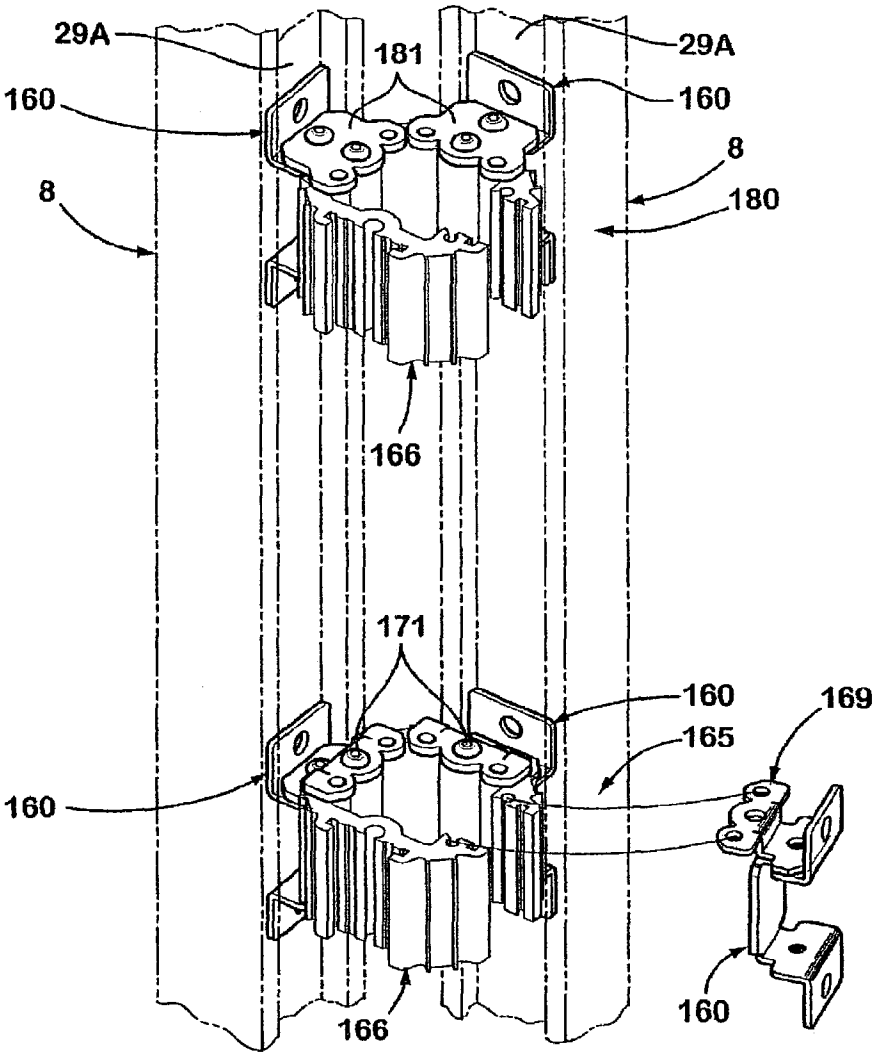

With further reference to FIGS. 40-40B, upper and lower bracket assemblies 180, 165, respectively include an extrusion 166 that may be utilized to form either an L junction 155 (FIG. 34), a T junction 156 (FIG. 35), or an X junction 157 (FIG. 36). Extrusion 166 includes four channels 167, each of which includes a pair of opposed slots 168. During assembly, a bracket 160 is first secured to the vertical frame member 8 adjacent the lower end thereof in vertical channel 29A. Extrusion 166 of lower bracket assembly 165 is then placed on the bracket 160 by sliding the extrusion 166 downwardly with the edges 163 of bracket 160 being received in the opposed slots 168 of channel 167. A retainer bracket 169 is then secured to the extrusion 166 via conventional fasteners 171 that are received in screw bosses 170 of extrusion 166. A threaded fastener 174 is then used to connect the retainer bracket 169 to the bracket 160. Flange 175 of retainer bracket 169 is offset lower than the upper flange 176, such that extrusion 166 is offset vertically relative to bracket 160, with the lower edge 172 of extrusion 166 forming a gap relative to the surface 173 of bracket 160. The extrusion 166 is thus retained on a first partition frame 2A. To assemble the plan configurations illustrated in FIGS. 34, 35 and 36 brackets 160 (or brackets 970, see FIG. 99A) are next secured to the required number of partition panel frames 2. The required number of partition panel frames 2 can then be secured to the extrusion 166 that is attached to the first partition frame 2A by lifting the panel edge, and sliding the edges 163 of the bracket 160 downwardly into the opposed slots 168 of channel 167 of extrusion 166. If required for a particular application, a single adjacent panel frame 2A can be assembled to form the L junction 155 of FIG. 34. Alternately, two additional panel frames may be connected to the first panel frame 2A to form the T junction 156 of FIG. 35. Finally, three additional panel frames 2 can be interconnected with the first panel frame 2A to form the X junction 157 illustrated in FIG. 36.

Extrusion 166 can also be utilized in conjunction with an upper bracket assembly 180. After the lower bracket assembly 165 is assembled, and the adjacent frames are positioned in the desired configuration, brackets 160 are secured to the first panel frame 2A and the adjacent panel frames. The extrusion 166 is then slid downwardly into engagement with the brackets 160, and plates 181 are then utilized to interconnect the brackets 160 to the extrusion 166 via conventional threaded fasteners 182 that are received in screw bosses 170, and fasteners 183 that are received in threaded openings 164 of brackets 160.

Figure 37:
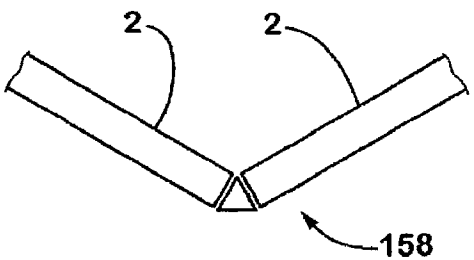
FIG. 37 is a schematic plan view of a pair of panels that are interconnected to form a V junction having a 120° angle between the panels.
Figure 41:
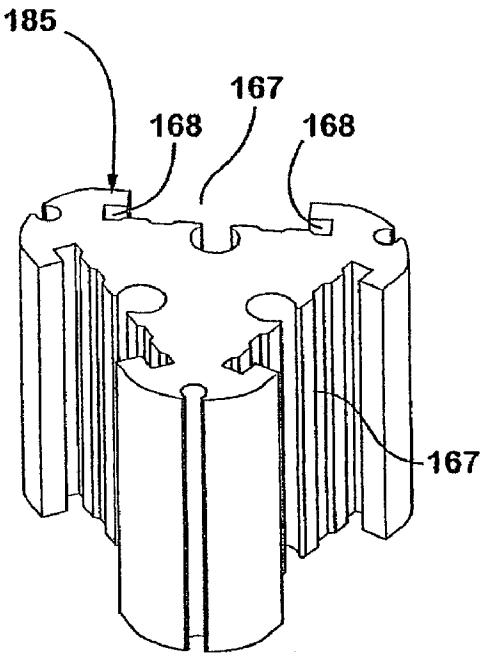
FIG. 41 is a perspective view of a bracket that may be utilized to form the V and Y plan configurations of FIGS. 37 and 38.

With further reference to FIG. 41, an extrusion 185 may be utilized to form the V junction of FIG. 37, and may also be utilized to form the Y junction 159 of FIG. 38. Extrusion 185 includes a plurality of channels 167 that are substantially the same as those of extrusion 166, and the extrusion 185 is utilized to interconnect the adjacent panels in the desired plan configuration in substantially the same manner as described in detail above in connection with extrusion 166.

Figures 42, 46:
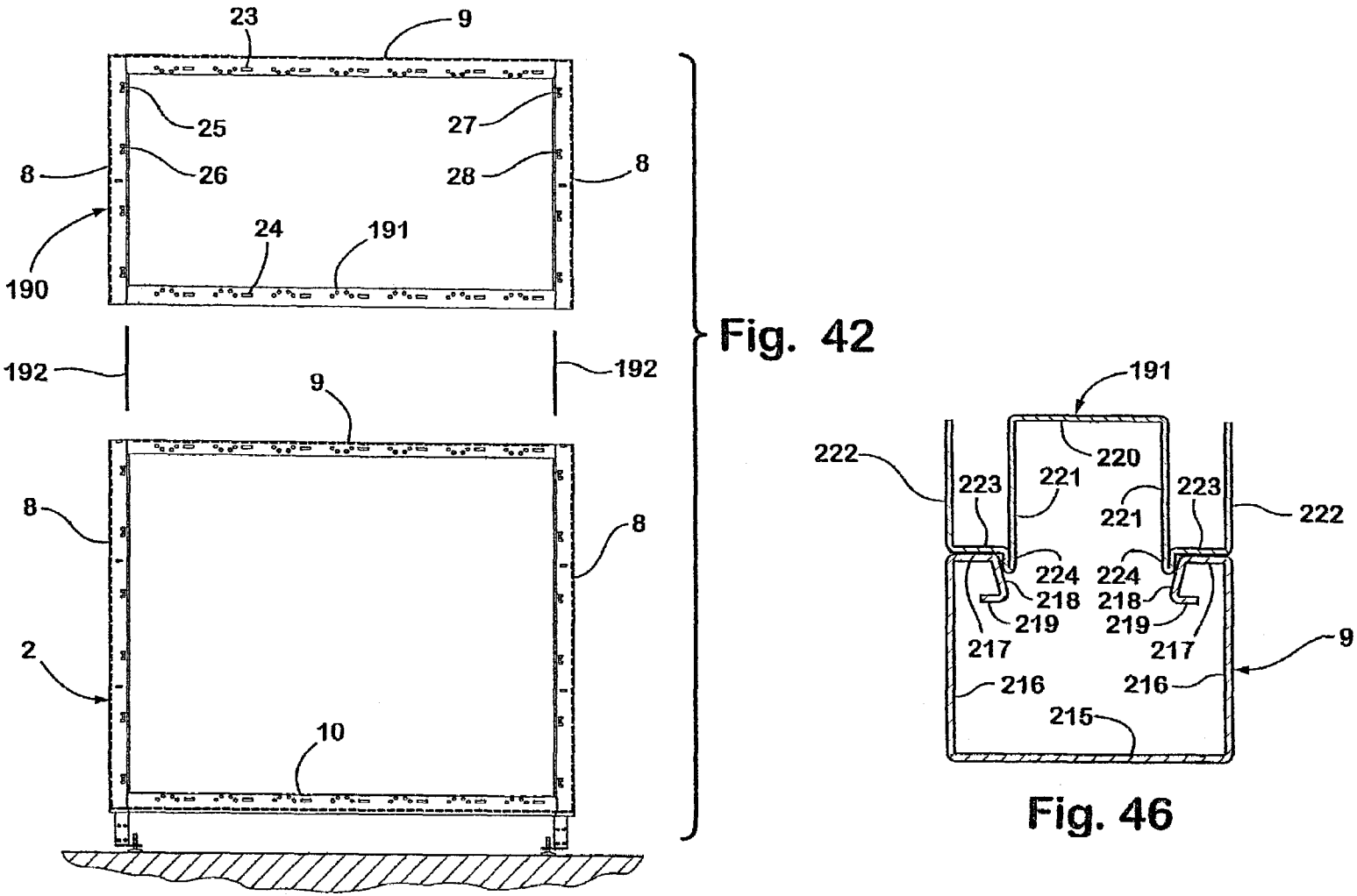
FIG. 42 is an exploded side view of a partition assembly including a base frame and stacker frame.
FIG. 46 is a cross-sectional view taken along the line XLVI-XLVI.

With further reference to FIG. 42, a stacker frame 190 may be secured to the partition frame 2 to increase the height of the partition panel. Stacker frame 190 includes vertical frame members 8 and a horizontal upper frame member 9 that are substantially identical to the frame members 8 and 9 of the base frame 2. However, as described in more detail below, the lower horizontal cross member 191 of stacker frame 190 is somewhat different than the lower horizontal cross member 10 of the base frame 2. A pair of connectors or bayonets 192 extend into the vertical side frame members 8 of the base frame 2 and stacker frame 190 when assembled to rigidly interconnect the stacker frame 190 and base frame 2. With further reference to FIG. 46, cross member 9 includes a lower horizontal web 215 and vertical side webs 216 forming a generally U-shaped cross section. A horizontal portion 217 extends inwardly from the vertical side webs 216, and an inwardly angled portion 218 extends downwardly from the horizontal portion 217. An edge portion 219 extends horizontally from the angled portion 218. Cross member 191 of the stacker frame 190 includes an upper horizontal web portion 220, vertical inner webs 221, and upwardly extending outer vertical webs 222 that connect to the inner web 221 via horizontal web portions 223. Folded over flange portions 224 project downwardly below the horizontal web portions 223. When assembled as shown in FIG. 46, the horizontal web portions 223 of stacker cross member 191 abut or rest on the horizontal portions 217 of the horizontal cross member 9. The folded over flange portions 224 fit closely against the angled portions 218 of cross member 9 to facilitate side-to-side alignment of the horizontal frame member 191 with the cross member 9.

Figure 43:
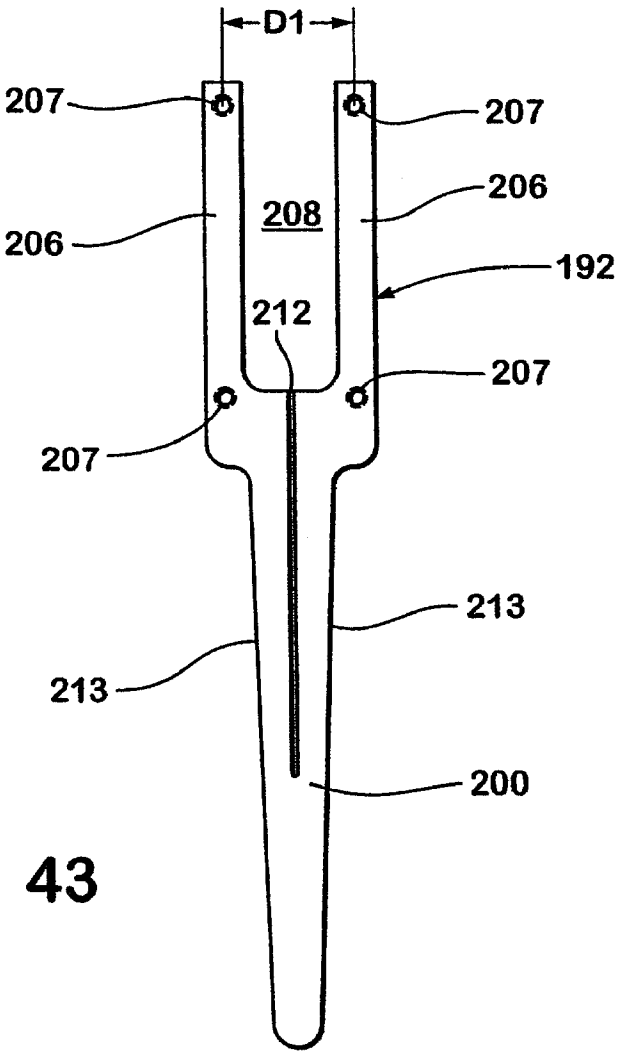
FIG. 43 is a front view of the bayonet of FIG. 43 that connects the stacker frame to the base frame.
Figure 45:
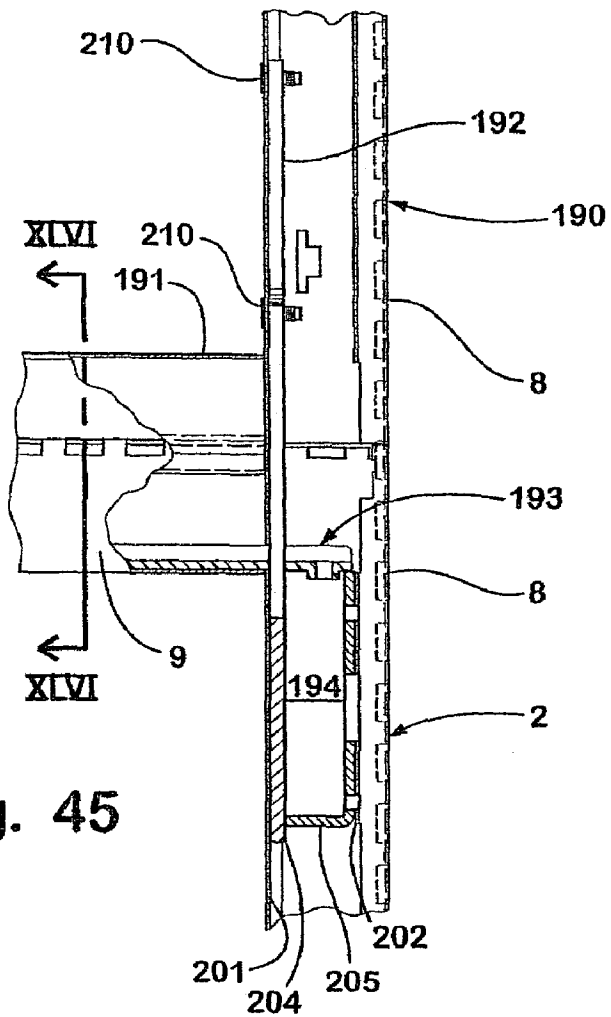
FIG. 45 is a fragmentary cross-sectional view of the stacker frame, base frame, and bayonet.
Figure 44:
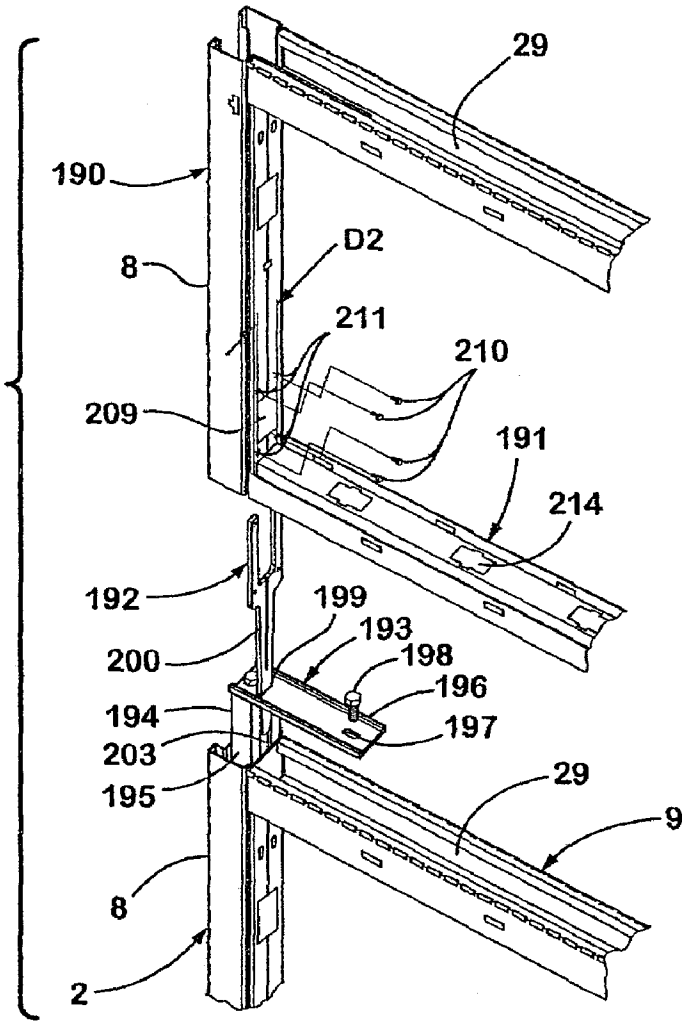
FIG. 44 is a fragmentary, exploded perspective view of the base frame, stacker frame, and bayonet.

With further reference to FIG. 44, a corner bracket 193 includes a vertical portion 194 that is received in the open upper end 195 of the vertical side frame member 8 of base frame 2. Bracket 193 also includes a plate-like horizontal portion 196 that fits into the channel 29 when assembled. A threaded fastener 198 is received in an oval opening 197 to secure the bracket 193 to the base frame 2. Alternately, corner bracket 193 could be welded to the base frame 2, or otherwise suitably secured thereto. Bracket 193 includes a rectangular opening 199 through the horizontal portion 196 that receives the elongated lower end 200 (see also FIG. 43) of bayonet bracket 192. With further reference to FIG. 45, the vertical portion 194 of corner bracket 193 fits closely between the inner sidewalls 201 and 208 of vertical frame member 8 of base frame 2. The elongated lower end 200 of bayonet bracket 192 fits closely within the elongated slot 203 (FIG. 44) in the vertical portion 194 of the corner bracket 193. The slot 203 ensures that the bayonet bracket 192 is maintained in a vertical position. An opening 204 (FIG. 45) in the lower sidewall 205 of corner bracket 193 maintains the bayonet bracket 192 in a vertical orientation relative to rotation in the plane of the frames 2 and 190.

With reference to FIG. 43, bayonet bracket 192 includes a pair of upper extensions 206, and a plurality of threaded openings 207. The extensions 206 form a U-shaped open area 208 that aligns with the opening 209 (FIG. 44) in stacker frame 190 to permit pass-through of utility lines. A plurality of threaded fasteners 210 extend through the clearance openings 211 in the vertical side frame member of stacker frame 190 and are threadably received in the threaded openings 207 of bayonet bracket 192 when assembled. Bayonet bracket 192 includes an elongated slot 212 that extends a substantial distance into the elongated lower end 200. The distance D1 between the threaded openings 207 in bayonet bracket 192 is somewhat less than the distance D2 (FIG. 44) between the clearance openings 211 in the vertical frame member 8 of stacker frame 190. Threaded fasteners 210 have a conventional conical head, such that as the threaded fasteners 210 are tightened, the conical head contacts the edges of the openings 211. As the threaded fasteners 210 are further tightened, the upper extensions 206 are forced apart slightly, thereby forcing the side edges 213 of elongated lower end 200 of bayonet bracket 192 into tight engagement with the side edges of the rectangular opening 199 in corner bracket 193. Thus, the bayonet bracket 192 rigidly secures the stacker frame 190 to the base frame 2, and also aligns the stacker frame 190 relative to the base frame 2.

Stacker 190 includes an upper channel 29 for horizontal routing of utility lines such as data or communications lines or the like. The lower frame member 191 of stacker frame 190 includes a plurality of openings 214 that align with the openings 58 (see also FIG. 4) in upper horizontal frame member 9 of the base frame 2 to permit vertical routing of wiring between the stacker frame 190 and the base frame 2. Stacker frame 190 also includes a plurality of openings 23, 24, 25, 26, 27 and 28 for mounting of cover panels 7 in substantially the same manner as described above.

Modified Construction

Bottom In-Line Connector

Figure 47:
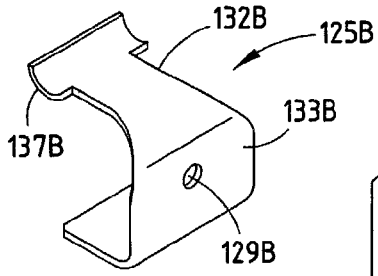
FIGS. 47-49 are perspective views showing use of a bottom attachment bracket, FIGS. 48 and 49 showing attachment to the two adjacent posts of in-line connected panel frames.
Figure 48:
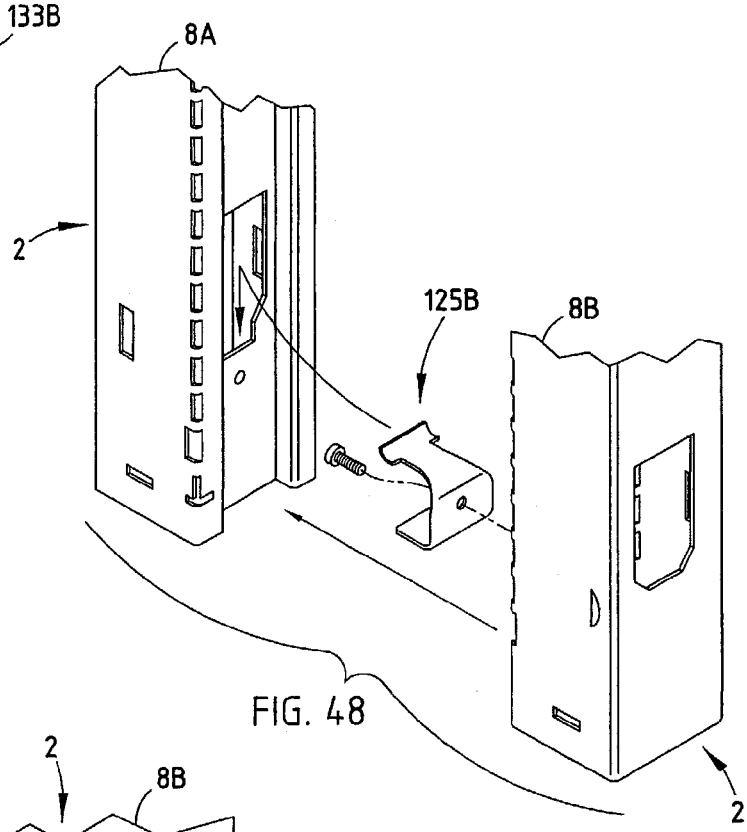
Figure 49:
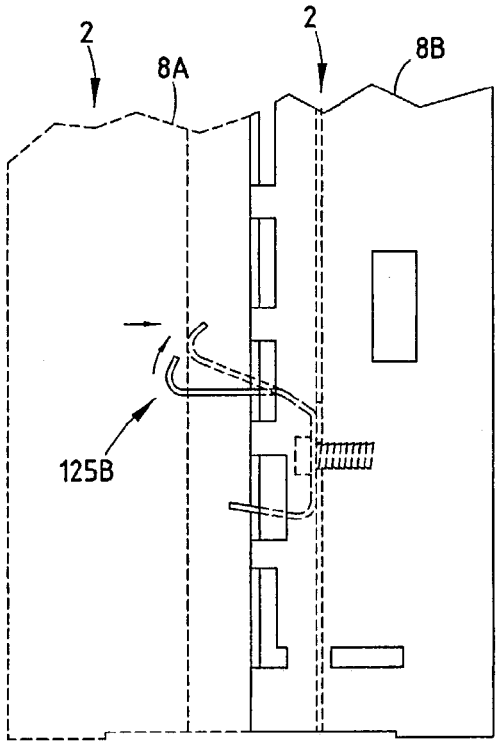

A second modified bottom in-line connector 125B (FIGS. 47-49) is similar to the bottom in-line connector 125 (FIGS. 31-32) and the bottom in-line connector 125A (FIGS. 29B-29E) in shape and function. Specifically, the modified in-line bottom connector 125B connects adjacent in-line panels 2 at a bottom location not too far above the floor surface. The connector 125B is designed to draw the panels 2 toward each other as one panel frame is placed against a first panel frame 2, and then lowered into alignment with the first frame 2. However, connector 125B differs in that it includes a T-shaped tongue 132B with an upwardly curled flap 137B. Also, a lower body or web 133B includes a hole 129B for receiving a bolt or threaded fastener to attach the in-line connector 125B to a vertical frame member 8A of a panel frame 2. The web 133B has a width sized to fit closely into the vertical channel defined on an outboard surface of the vertical frame member 8, so that additional alignment features, such as an interlock tab (127) of the connector 125 and/or the extended side edges (246) of the connector 125A, are not needed.

Window Construction

Figure 50:
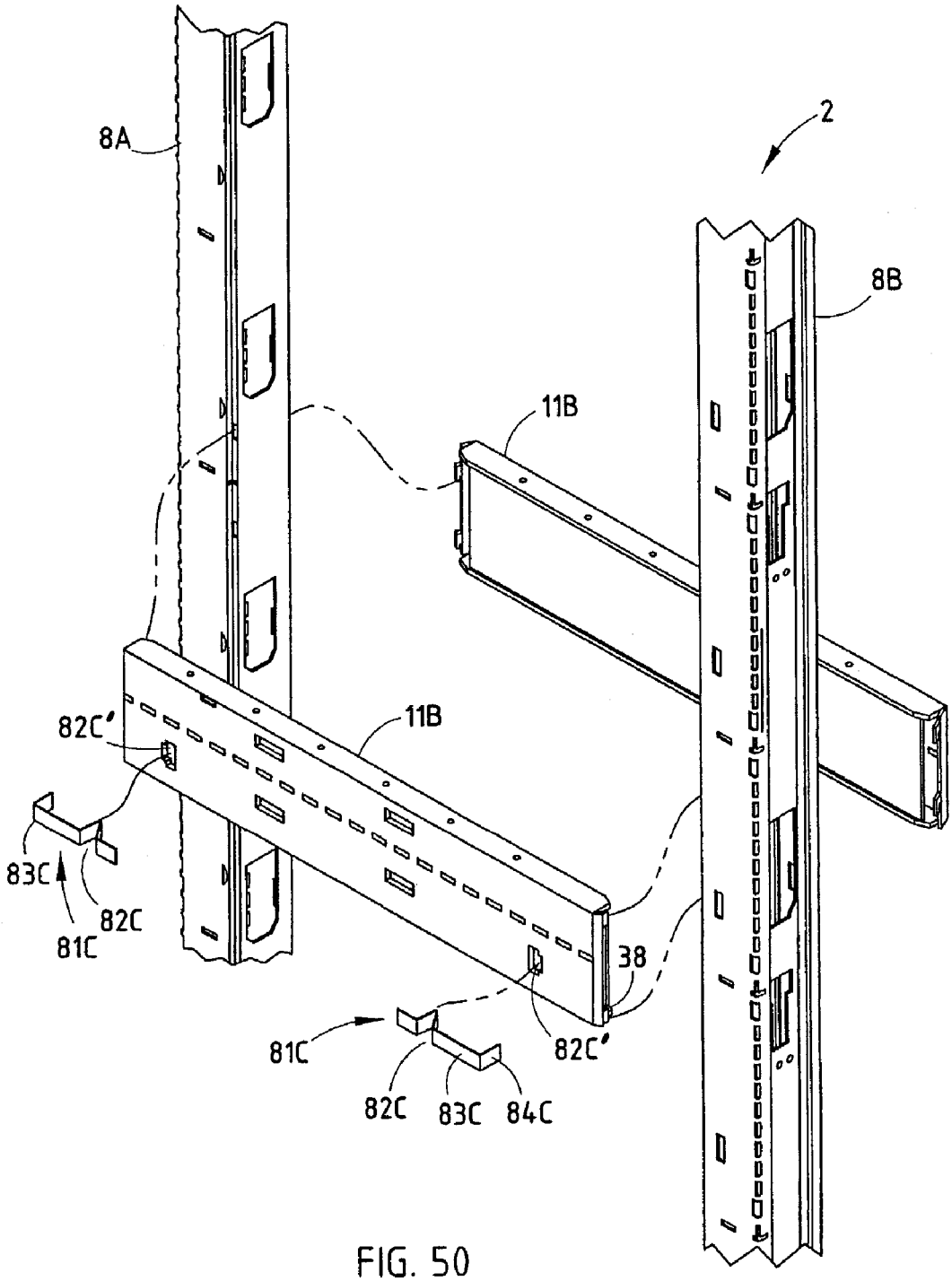
FIGS. 50-57 are perspective views showing sequential attachment of components on a window construction, including structural cross beams (FIG. 50), side brackets (FIGS. 51-52 and cross section 51A), top and bottom brackets (FIGS. 53-54), a lower window supporting channel (FIG. 55), and attachment of J brackets and the window panel to the panel frame (FIGS. 56-57)
Figures 51, 51A:
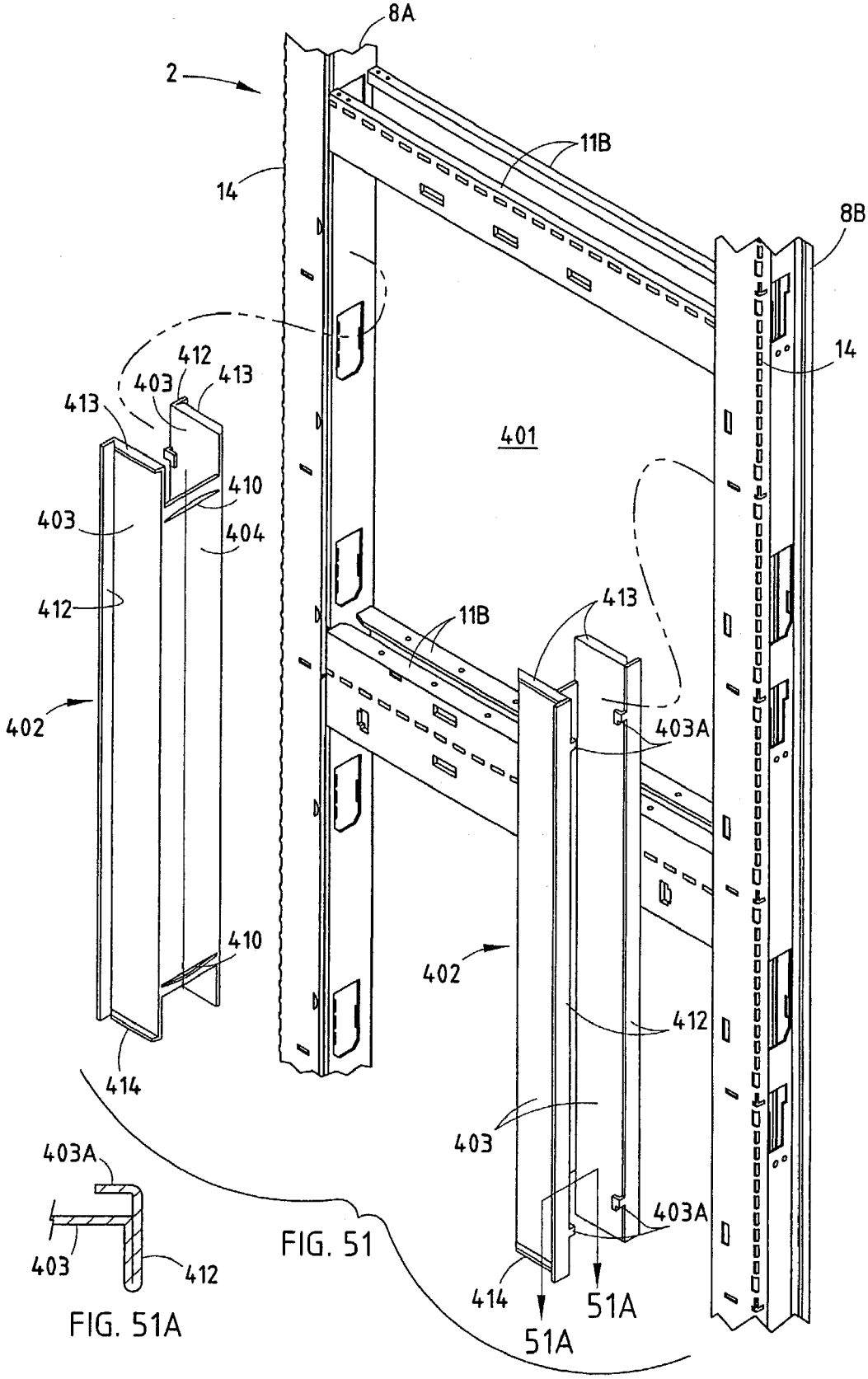
Figure 52:
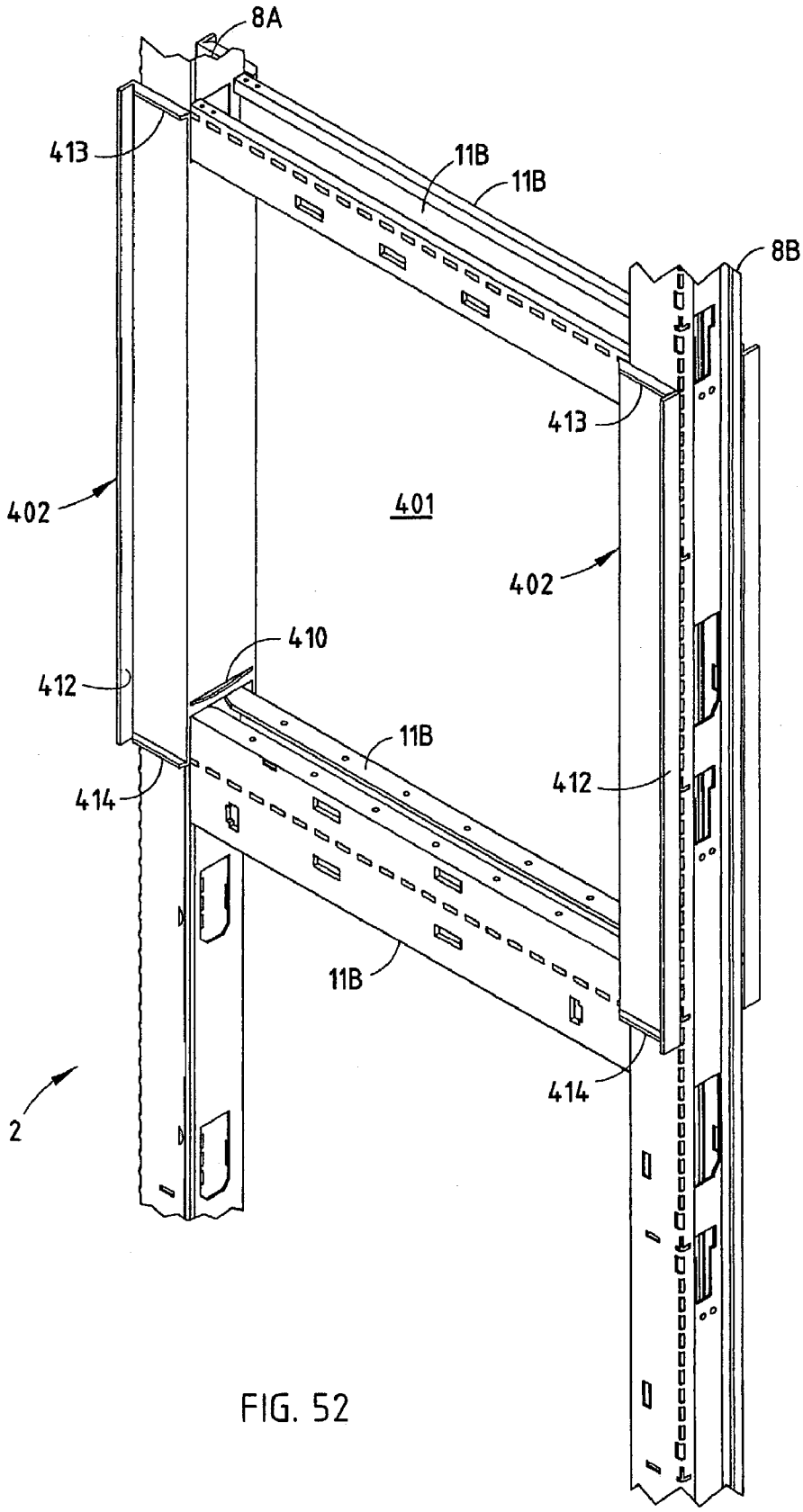

A window construction 400 (FIG. 57) includes a pair of cross beams 11B (FIG. 50) attached to upright posts 8A (or 8B) on the panel frame 2 to define a window opening 401 (FIG. 51). It is noted that one or more structural vertically-oriented beams or brackets (not shown) can be extended between vertically-spaced cross beams 1B, if necessary, to define a window opening smaller than a full width of a particular panel frame 2. A pair of side brackets 402 engage and cover inboard surfaces on the posts. The side brackets 402 have a U-shaped cross section sized to mateably fit onto the posts 8A (or 8B) (FIGS. 51-52), with the parallel legs 403 of the brackets 402 fitting onto and covering opposing sides of the posts, and with the transverse wall 404 of the brackets covering an inside surface of the posts 8A that form the window opening 401. The legs 403 are preferably bent inwardly about 1° or 2° so that the legs 403 frictionally engage and clamp onto opposing sides of the posts 8A (or 8B). When fully installed, the legs 403 allow access to the vertical slots 14 on the panel frame 2. Hooks 403A can be included on legs 403 that engage slots 14 to more positively secure the side brackets 402 in place. The illustrated hooks 403A (FIG. 51A) extend parallel the legs 403.

Figure 53:
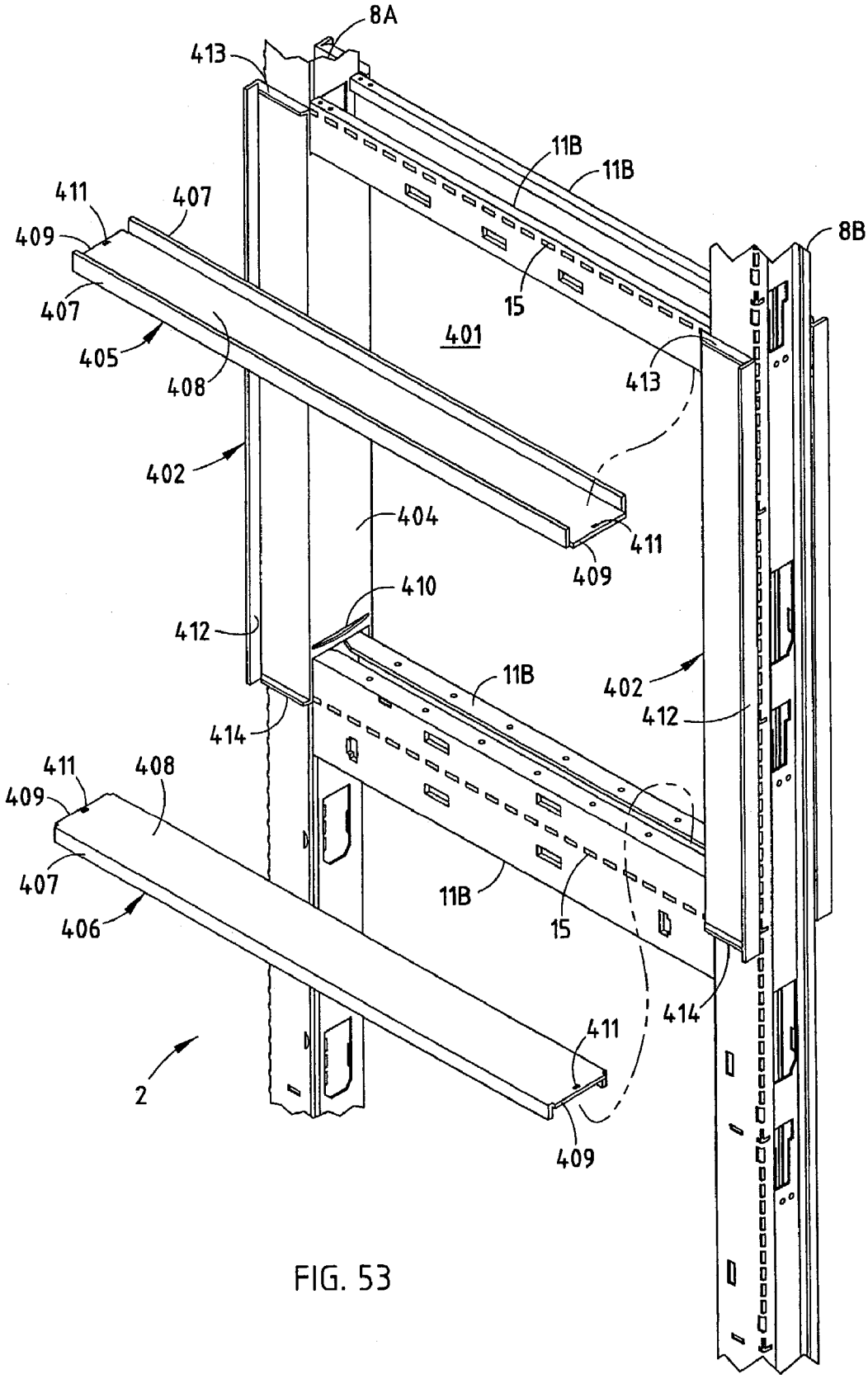
Figure 54:
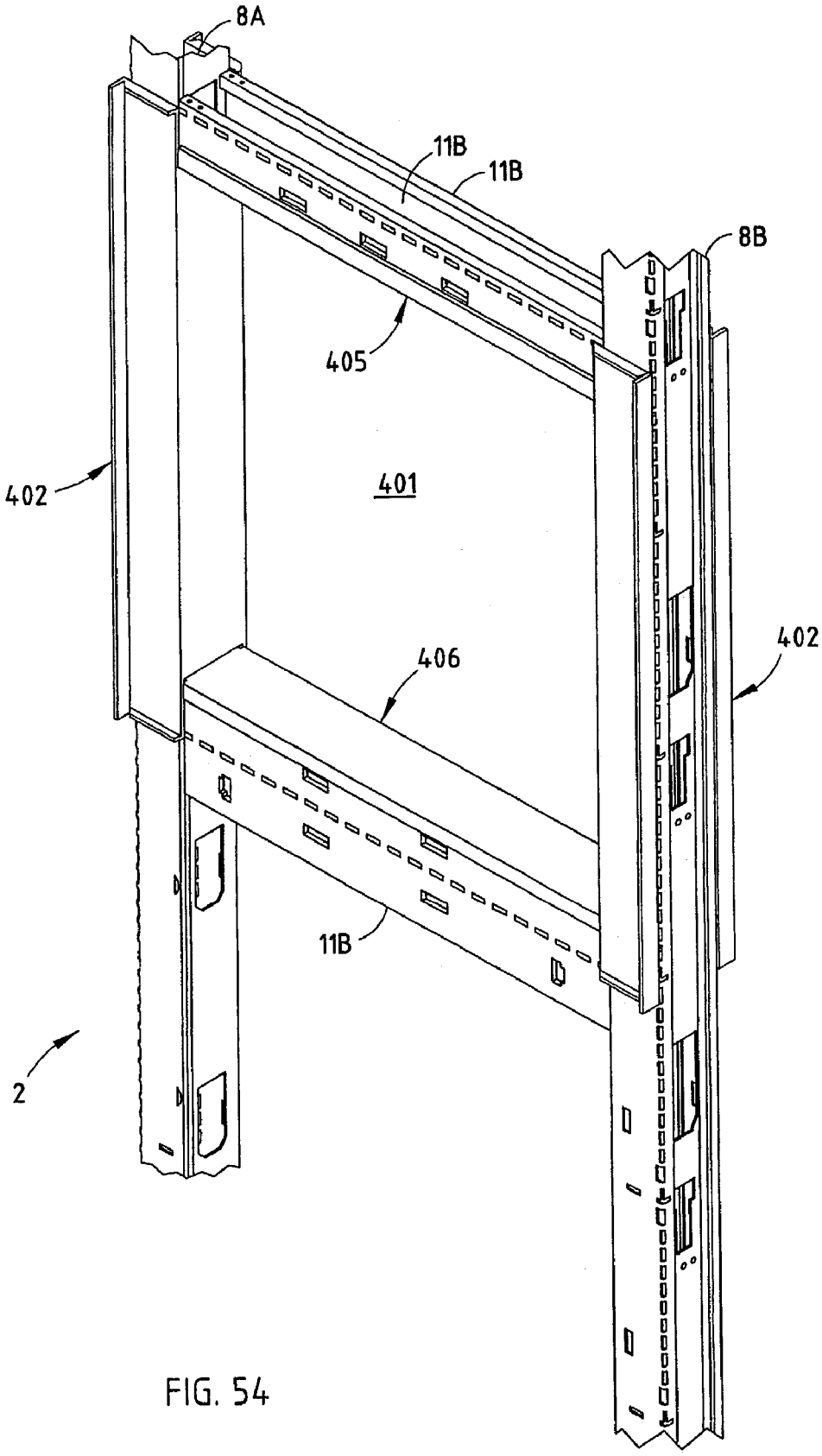

Top and bottom trim brackets 405 and 406 (FIGS. 53-54) also have a U-shaped cross section with parallel legs 407 and transverse wall 408, though legs 407 are foreshortened to allow access to one of the rows of horizontal slots 12, 13, or 15. Tongued flanges 409 on the ends of the transverse walls 408 engage dish-shaped slots 410 in the side brackets, with a detent button 411 being located on the tongued flanges 409 to snap past and detentingly engage the transverse wall 404 of each side bracket 402 as the top and bottom trim brackets 405 and 406 are moved into position. The arrangement of the brackets 402, 405, and 406 provide a clean, aesthetically acceptable appearance around the window opening 401 that is very easy to install, yet that is secure and removable.

Figure 55:
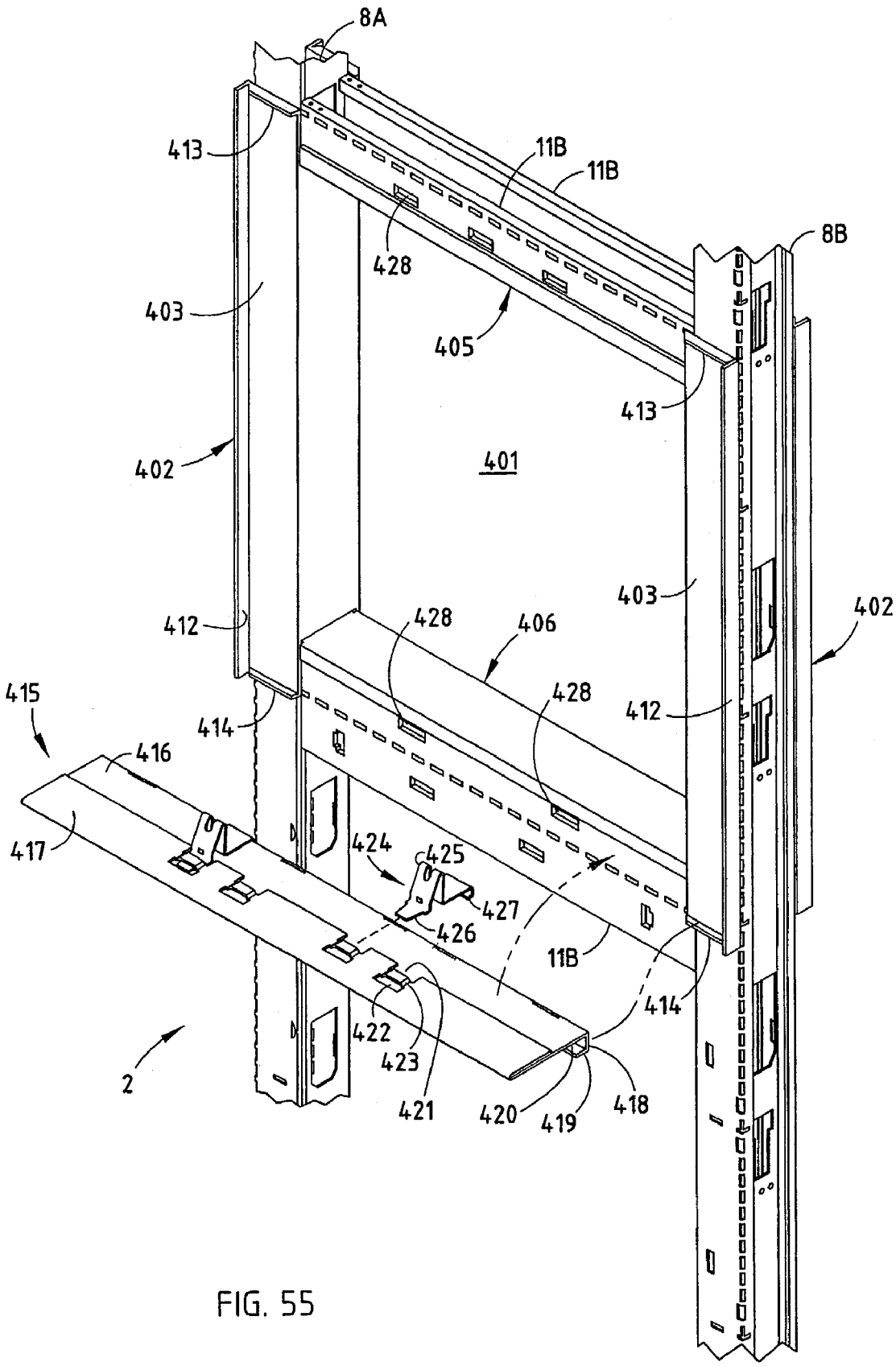
Figure 56:
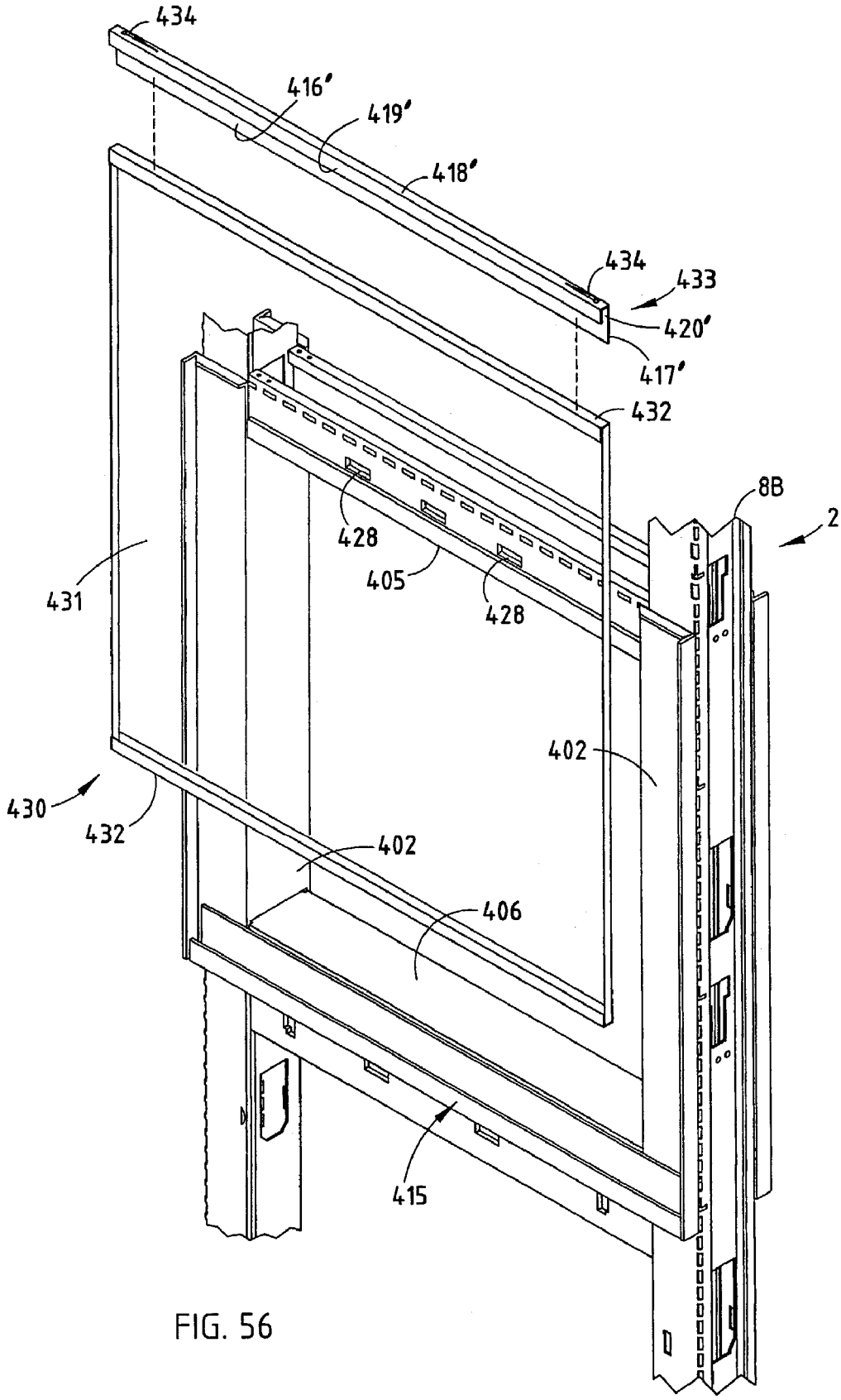
Figure 57:
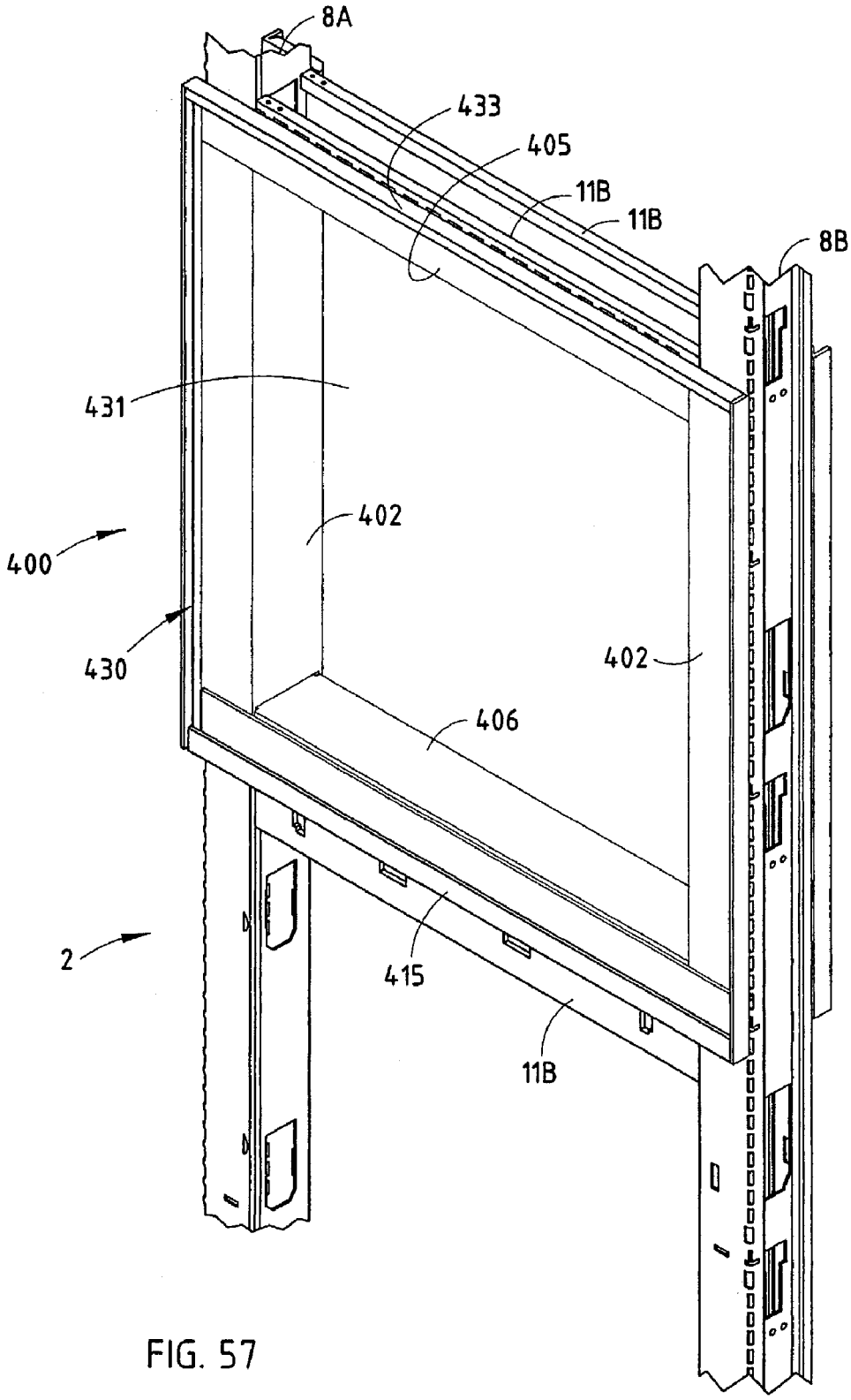

The side brackets 402 (FIG. 55) include a flange 412 extending a length of the legs 403, and further include top and bottom flanges 413 and 414 at a top and bottom of the legs 403. A bottom J bracket 415 includes a main flange 416, a doubled-back flange 417 that covers a top half of the main flange 416, and bottom and front short flanges 418 and 419 forming a glass-supporting channel 420 at a bottom of the main flange 416. An aperture pattern in the form of notches 421 and adjacent apertures 422 are formed along an edge of the doubled-back flange 417, and a raised band of material 423 is located between each notch 421 and the adjacent aperture 422 for receiving a spring clip 424. The spring clip 424 includes a resilient wedge-shaped portion 425, a top leg 426 for engaging the raised band 423, and a bottom hooked leg 427 that engages a slot in a rear corner of the bottom short flange 418. To install the J bracket 415 (FIG. 55), the bracket 415 is moved so that slots on a corner of the bottom short flange 418 and main flange 416 receive the bottom flanges 414 on the side brackets 402. The J bracket 415 can then be tipped forward against the posts 8A (and 8B) so that the wedge-shaped portion 425 of the spring clips 424 engage the mating apertures 428 on the panel frame 2. A glass panel assembly 430 (FIG. 56) includes a glass panel 431, two (or four) U-shaped edge protectors 432, and a top J bracket 433. The top J bracket 433 includes a main flange 416', a doubled back flange 417', and short flanges 418' and 419' forming a glass-supporting channel 420', not unlike the J bracket 415. The glass panel assembly 430 is slid into the glass-supporting channels 420 and 420' of brackets 415 and 433. The top J bracket 433 includes spring clips (similar to spring clips 424) that engage a backside of the J bracket 433 and that snap into the apertures 428 in the panel frame 2. The bottom short flange 418 on the bottom J bracket 415 and the similar flange on the top J bracket 433 each include arcuately shaped bands of material 434 that center the glass panel assembly 430 in the window opening, and that provide a "perimeter cushion" for the glass panel in the partition system from adjacent components attached to the panel frame 2 (FIG. 57).

Markerboard Construction

Figure 58:
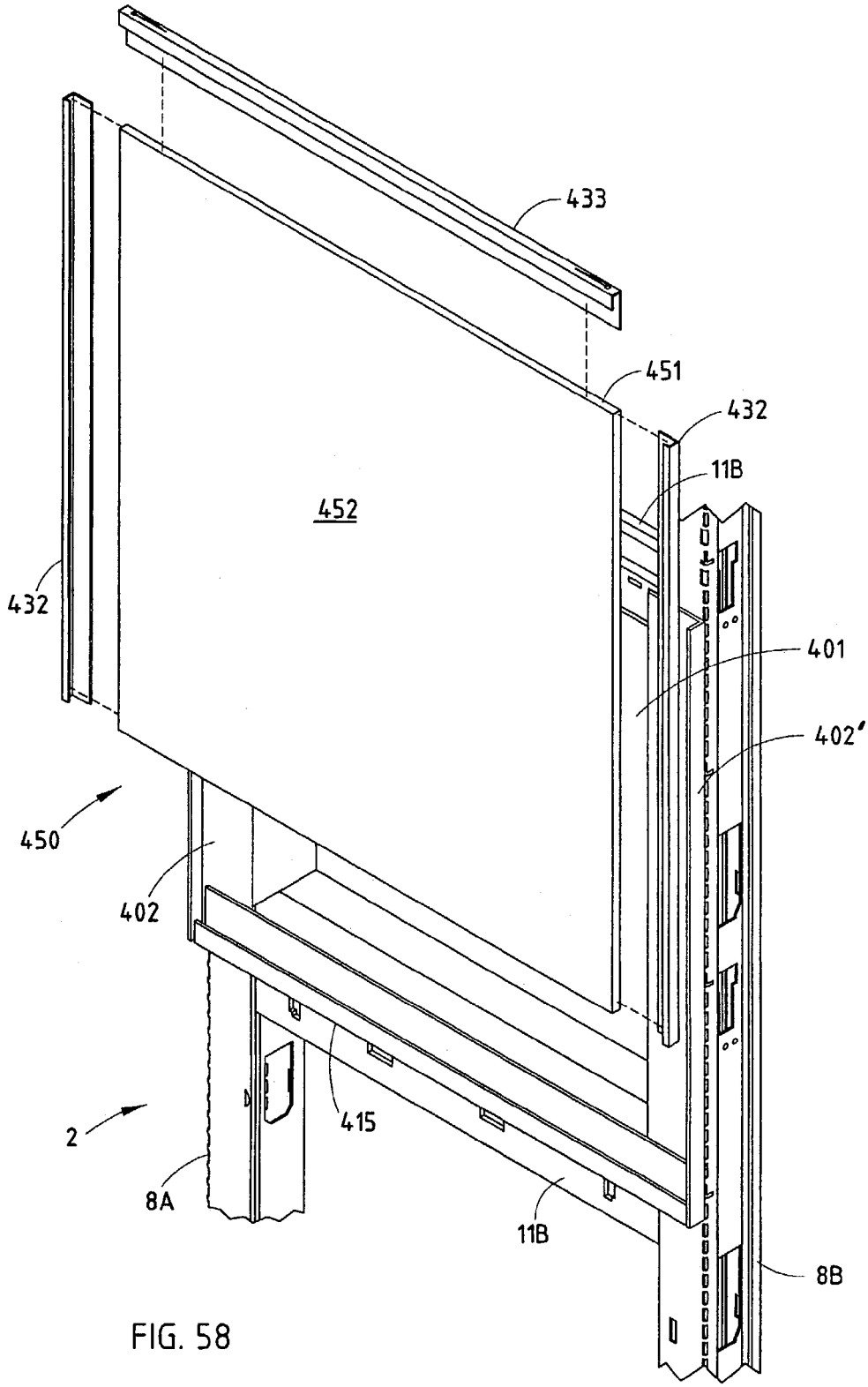
FIGS. 58-60 are perspective views showing assembly of a marker board to a panel frame.
Figure 59:
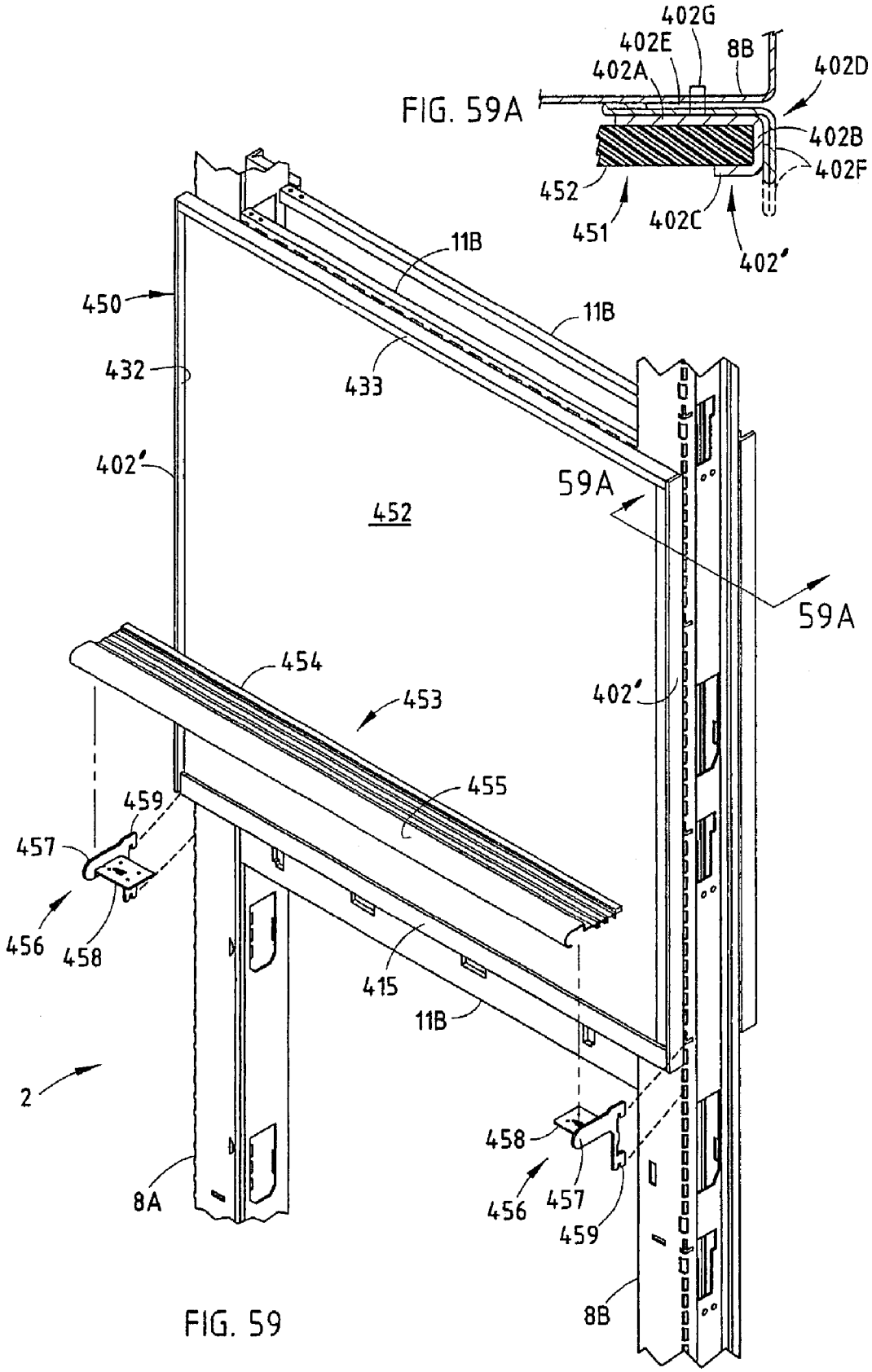

The markerboard assembly 450 (FIG. 58) is similar to the window construction 400, in that top and bottom J brackets 415, 433 and spring clips 424 are used. In markerboard assembly 450, a markerboard panel 451 is substituted for the glass panel 431. The markerboard panel 451 has an erasable surface 452 that can be written on with an erasable marker. Constructions for providing the erasable surface are well known in the art, such that a detailed description of them is not necessary for an understanding by a person skilled in this art. Side trim 402' (FIG. 59A) are J-shaped, and include a long leg 402A lying against a face of the vertical frame member 8B, and edge and front legs 402B and 402C forming a channel for closely receiving an edge of the markerboard panel 451. A dust edge 402D includes an L-shaped body with a long leg 402E located behind the long leg 402A of the trim 402' and a forwardly extending leg 402F. The leg 402F can be short (see solid lines) or long (see dashed lines), but is preferably long enough to form a border that prevents dust and colored particles from being wiped off the markerboard surface onto covers 7 that are located adjacent the markerboard 451. A hook 402G on the long leg 402E engages a mating aperture on the frame member 8B to hold the dust edge 402D in place.

Figure 60:
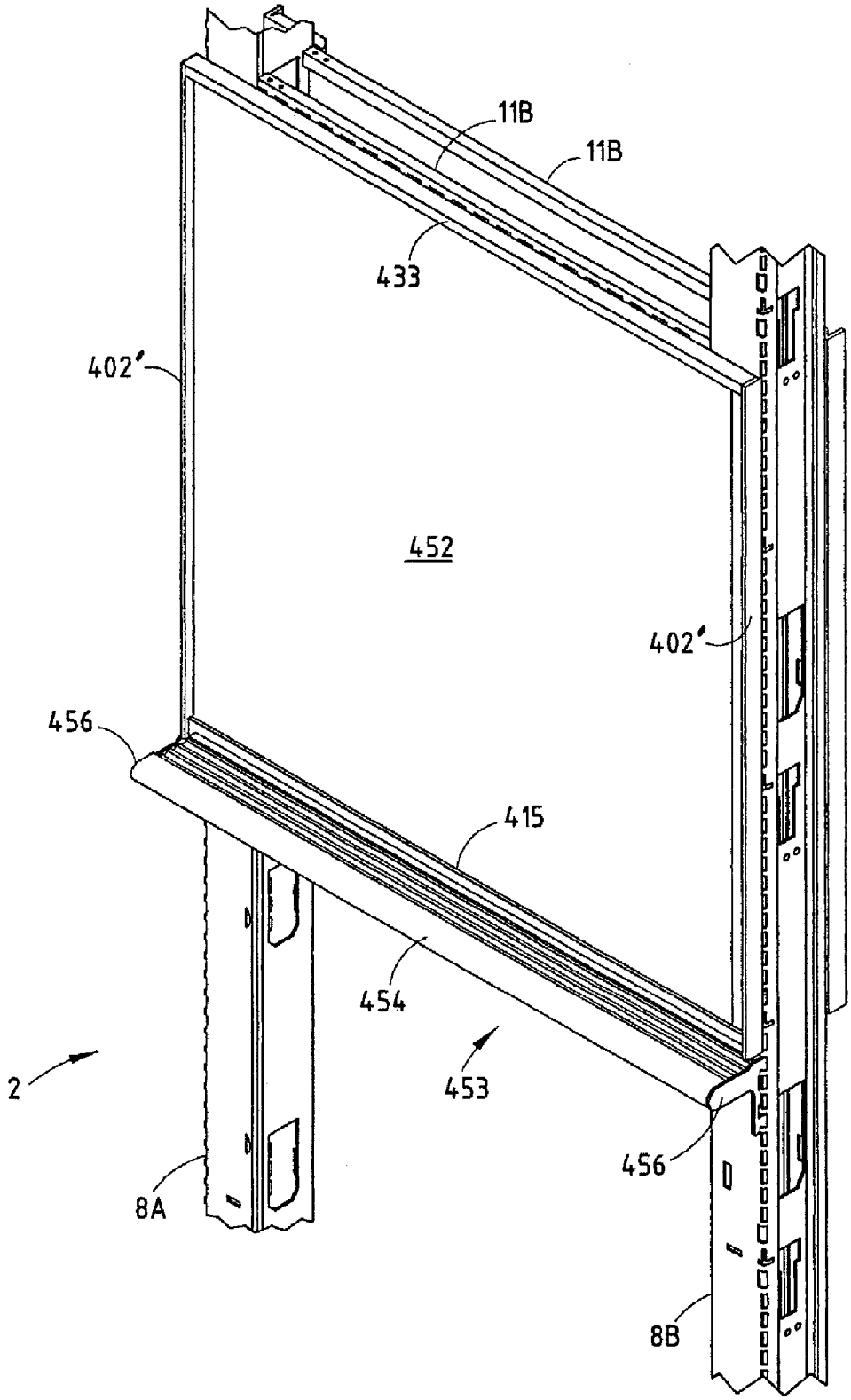

After assembly of the markerboard assembly 450 to a panel frame 2 (FIG. 59), a tray 453 for supporting erasable markers is provided as follows. The tray 453 includes an elongated extrusion 454 with ridges for securely retaining the erasable markers, and a rounded front edge 455 for aesthetics and for presenting a non-sharp front edge. End brackets 456 include a body 457 shaped to mateably engage and cover an end of the extrusion 454. A flange 458 extends from body 457 under the extrusion 454 for supporting the extrusion 454, and for receiving screws to securely attach the extrusion 454 to the flange 458. Hooks 459 also extend from the body 457 and are shaped to engage selected ones of the vertical slots 14. By this arrangement (FIG. 60), the tray 453 can be located at any convenient height. Further, the markerboard assembly 450 itself can be located at any convenient location and height on the panel frame 2, since the components of the panel frame 2 can be arranged to provide an opening wherever desired on the panel frame 2.

Slatwall Construction

Figure 61:
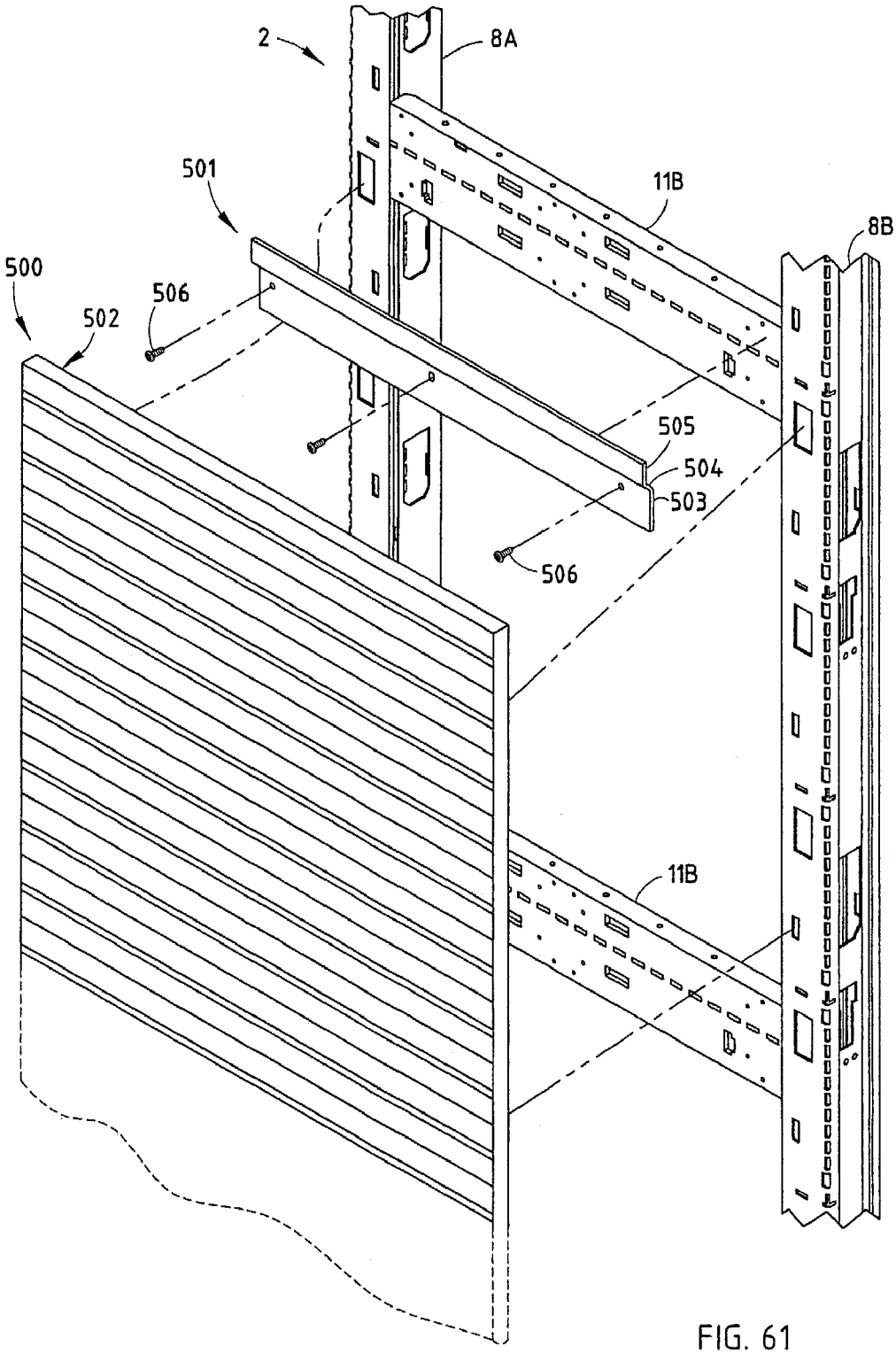
FIG. 61 is a perspective view showing attachment of a slatwall construction to a panel frame.
Figure 62:
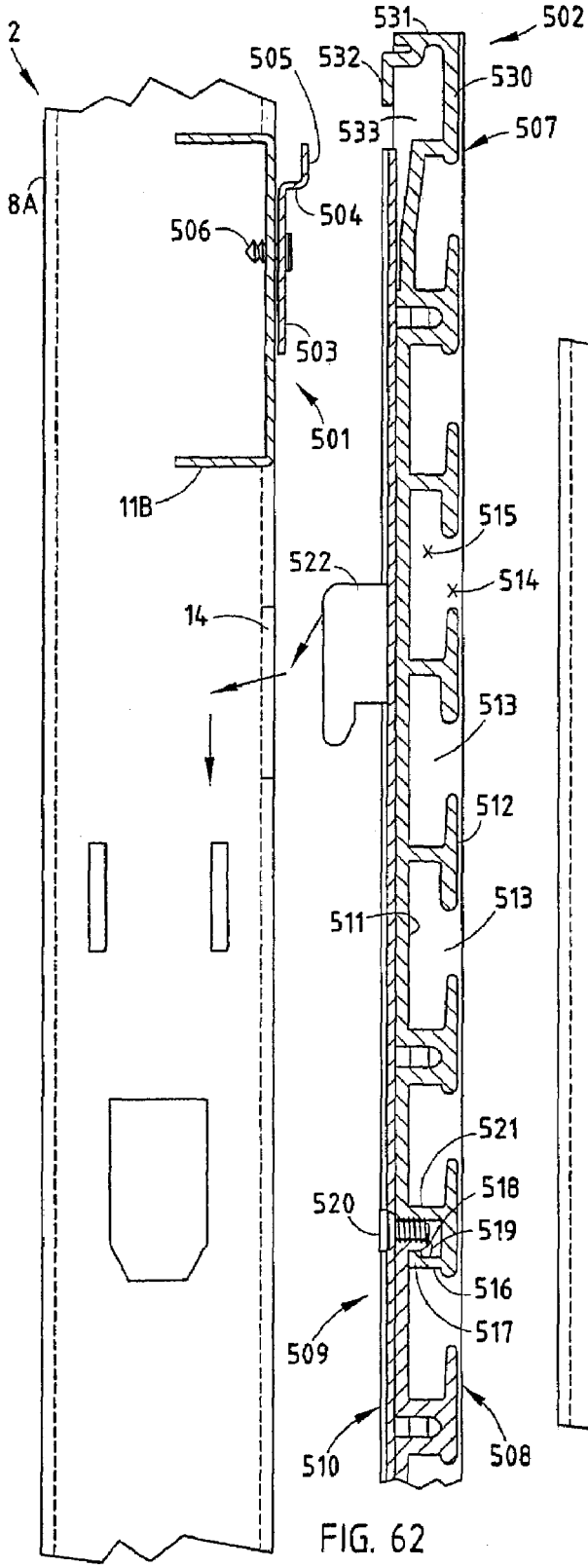
FIGS. 62-63 are cross-sectional side views of the slatwall construction positioned adjacent to and ready for engagement with a panel frame.
Figure 63:
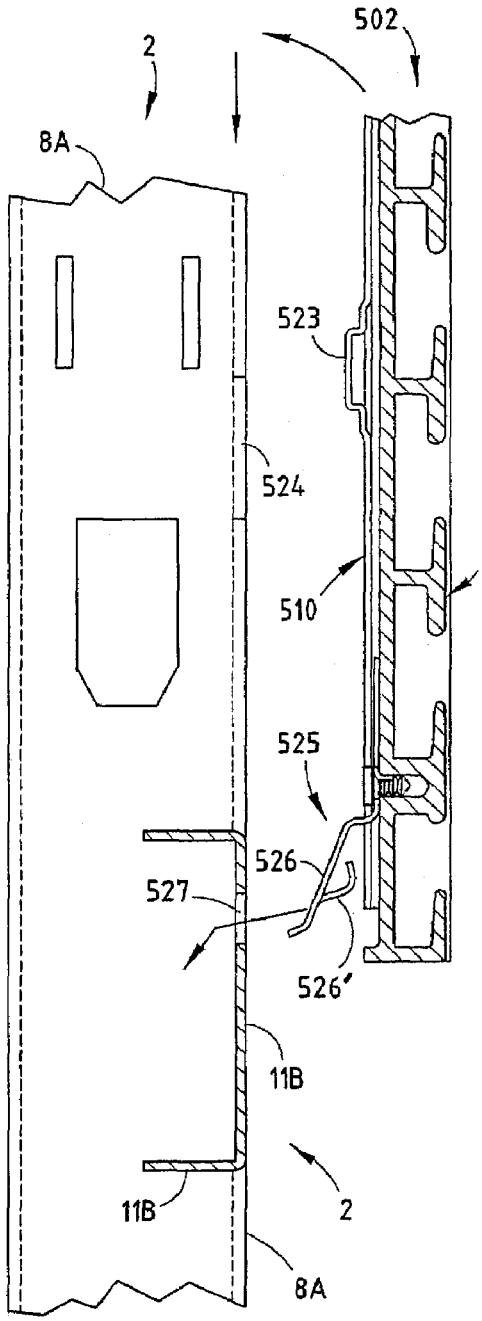

A slatwall construction 500 (FIG. 61) includes a top bracket 501 and a slatwall component 502. The top bracket 501 includes a panel-abutting flange 503, and an "up" hook formed by out flange 504 and up flange 505. The panel-abutting flange 503 includes holes for receiving screws 506 to attach the bracket 501 securely to the beam 11B of the panel frame 2, with the hook 504/505 extending upwardly. The illustrated slatwall component 501 (FIGS. 62-63) includes top and bottom slot-forming extrusions 507 and 508 attached together by an interfitting edge arrangement 509 and vertically-extending side-located mounting brackets 510, described as follows.

The slot-forming extrusions 507 and 508 (FIG. 62) each include a back wall 511, and forwardly extending T-shaped sections 512 forming horizontally-elongated T-shaped slots 513 across the extrusions, with narrowed access slits 514 for accessing the enlarged bottom sections 515 of the slots 513. Slatwalls with T-shaped slots are generally known in the art.

Figure 66:
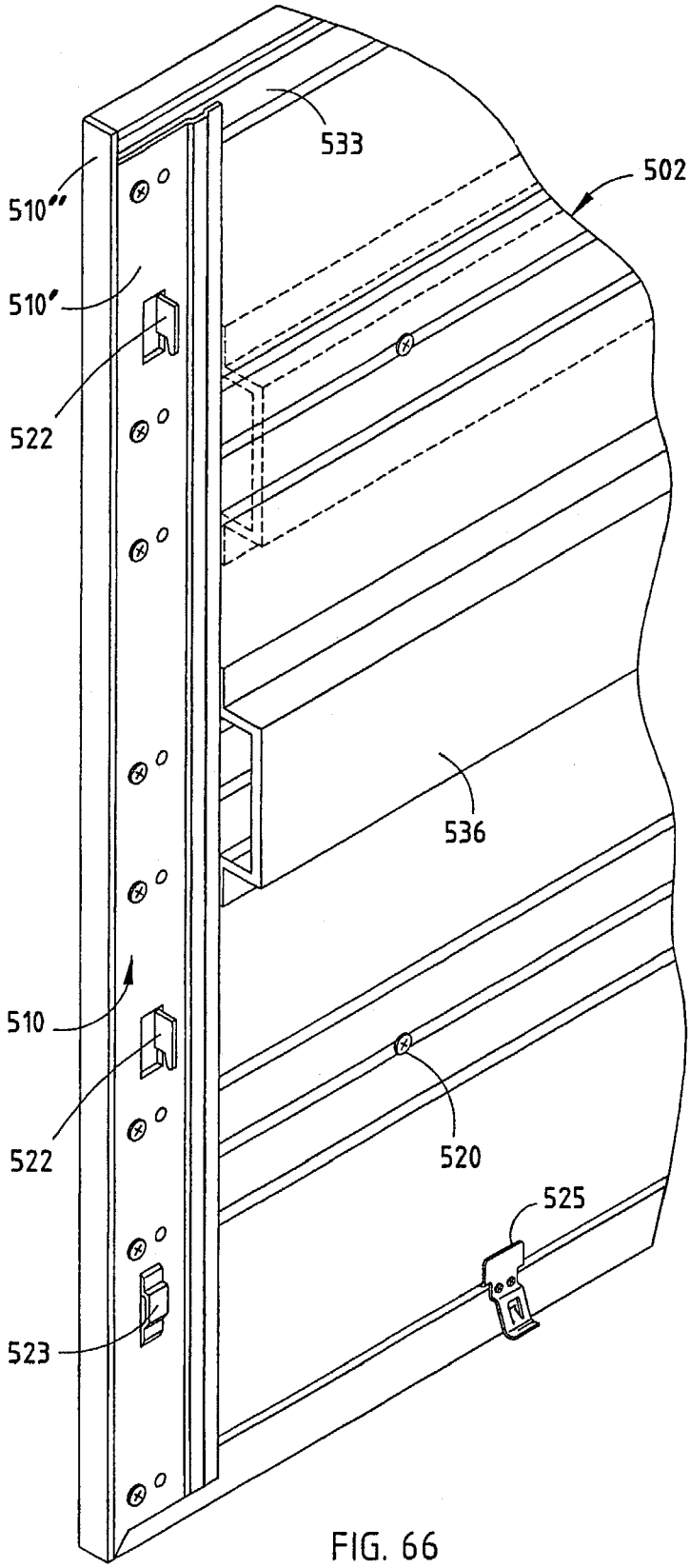
FIG. 66 is a rear perspective view of the slatwall construction of FIG. 61, but extended vertically.

The lowermost T-shaped section 512 (FIG. 62) on the top extrusion 507 includes a reverse flange 516 with an upwardly-turned "up" lip 517. The uppermost T-shaped section 512 on the bottom extrusion 508 includes a forwardly-extending flange 518 with a downwardly-turned "down" lip 519. The interfitting edge arrangement 509 is formed by the forwardly-extending flange 518 fitting inside and onto the reverse flange 516, with the lips 517 and 519 interlockingly engaging. A plurality of screws 520 are threadably engaged into the space between a stem 521 on the lowermost T-shaped section 512 and the forwardly-extending flange 518. The screw 520 extends through the mounting bracket 510, and tightly retains the mounting bracket 510 to the sections 512 and further keeps the sections 512 in vertical alignment. The mounting bracket 510 includes a flat body 510' and side flange 510" that forms a side edge of the slatwall component 502 (FIG. 66). The bracket 510 (FIG. 63) further includes hooks 522 shaped to engage selected vertical slots 14, and still further includes an interlock strap 523 (FIG. 63) that snaps into a mating aperture 524 in the post 8A (and 8B) as the slatwall construction 502 is lowered and snapped into a locked position. The screw 520 includes a flat head with tapered countersink/under-surface, such that the screw head does not protrude rearward of the slatwall rear surface. This is a tremendous advantage, since it prevents interference conditions. Also, by addition of "extra" screws 520 per linear foot (such as every 12 inches, or more preferably every 6 inches for extra strong joints), the interfitting edge arrangement 509 becomes increasingly stronger. Thus, the joint can easily be made as strong as required for a particular functional use or application.

Figure 64:
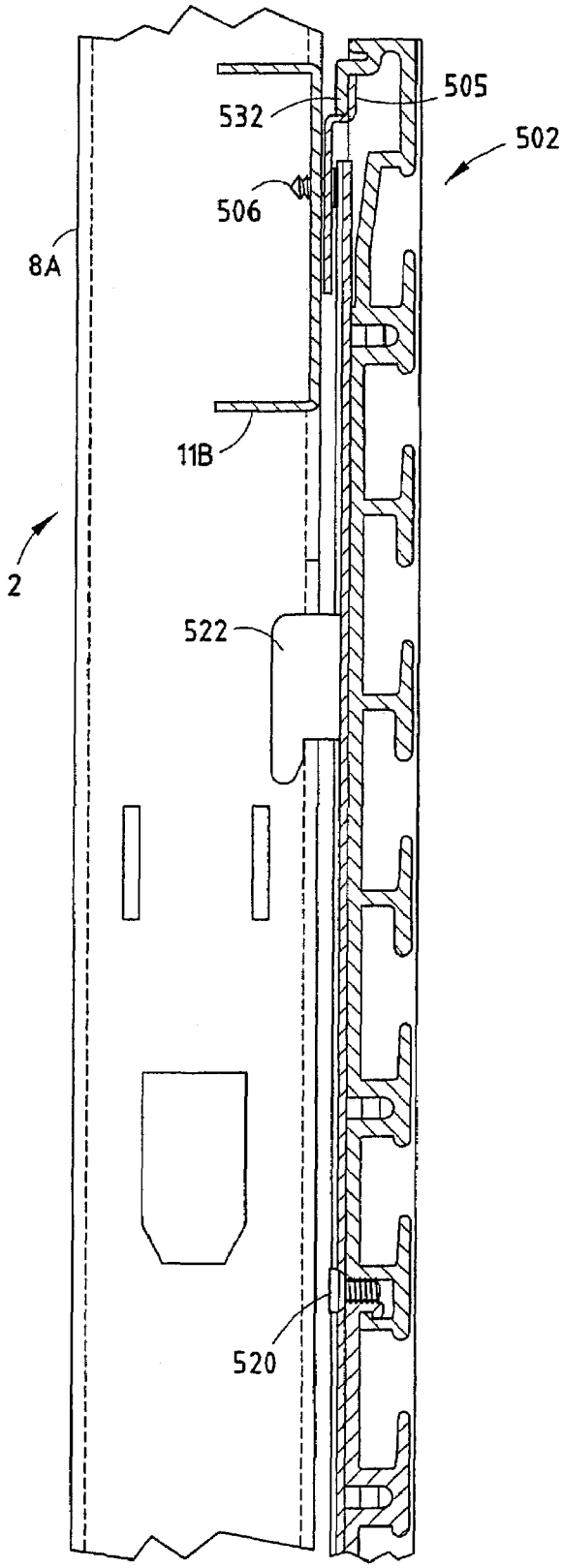
FIGS. 64-65 are similar to FIGS. 62-63, but with the slatwall construction attached to the panel frame.
Figure 65:
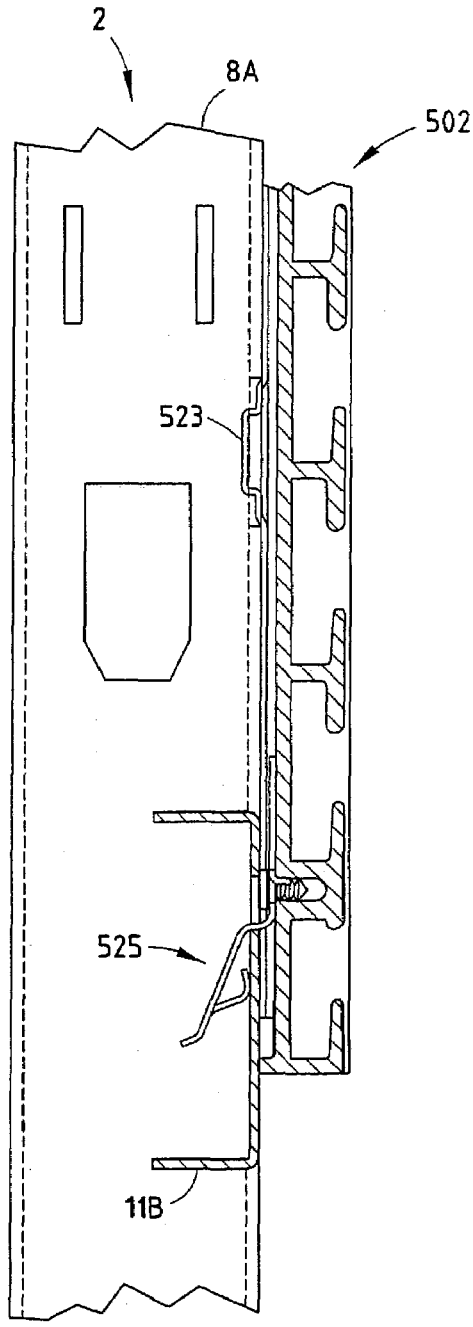

A spring clip 525 (FIGS. 63 and 65) is attached to a bottom of the lowermost section 512, and includes a downwardly-angled resilient leg 526 with a friction tab 526' that frictionally engages the material of the post 8A under an aperture 527 in the post 8A. This holds a bottom of the slatwall construction 500 tightly against the panel frame 2. The upper slatwall section 512 (FIGS. 62 and 64) has an inverted U-shape, including front, top, and rear flanges 530-532 forming a cavity 533. The "up" hook formed by flanges 504/505 fits into the cavity 533, and when the slatwall construction is lowered, the up flange 505 engages a hidden side of the rear flange 532. This holds a top of the slatwall construction 500 tightly against the panel frame 2. The combination of the spring clip 525, the hook 522, and the interlock strap 523 cause the slatwall to securely engage the panel frame 2 with a secure and positive feel, with the final interlock action occurring with a noticeable audible "snap" sound as the interlock strap 523 engages. Where additional support and stiffness is desired on a back side of the slatwall construction, such as when the slatwall is vertically extended to 24 inches or more, reinforcement beams 536 are added (FIG. 66). However, it is noted that the interfitting edge arrangement 509 is surprisingly and unexpectedly stiff and strong, and can be made even stronger by addition of extra screws 520.

Covers with Adjustable Light Seals and Angled Light Seals

Figure 68A:
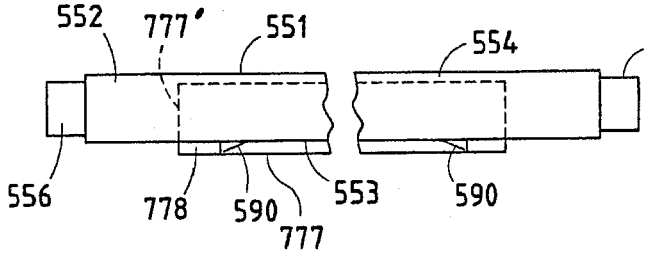
FIGS. 67-68 are perspective views of a cover panel, FIG. 67A being a fragmentary corner section and including a resiliently bent light seal ready for installation to the cover panel and FIG. 68 showing the light seal attached to the cover panel, and FIG. 68A being a fragmentary top view showing a retention and alignment barb.
Figure 67:
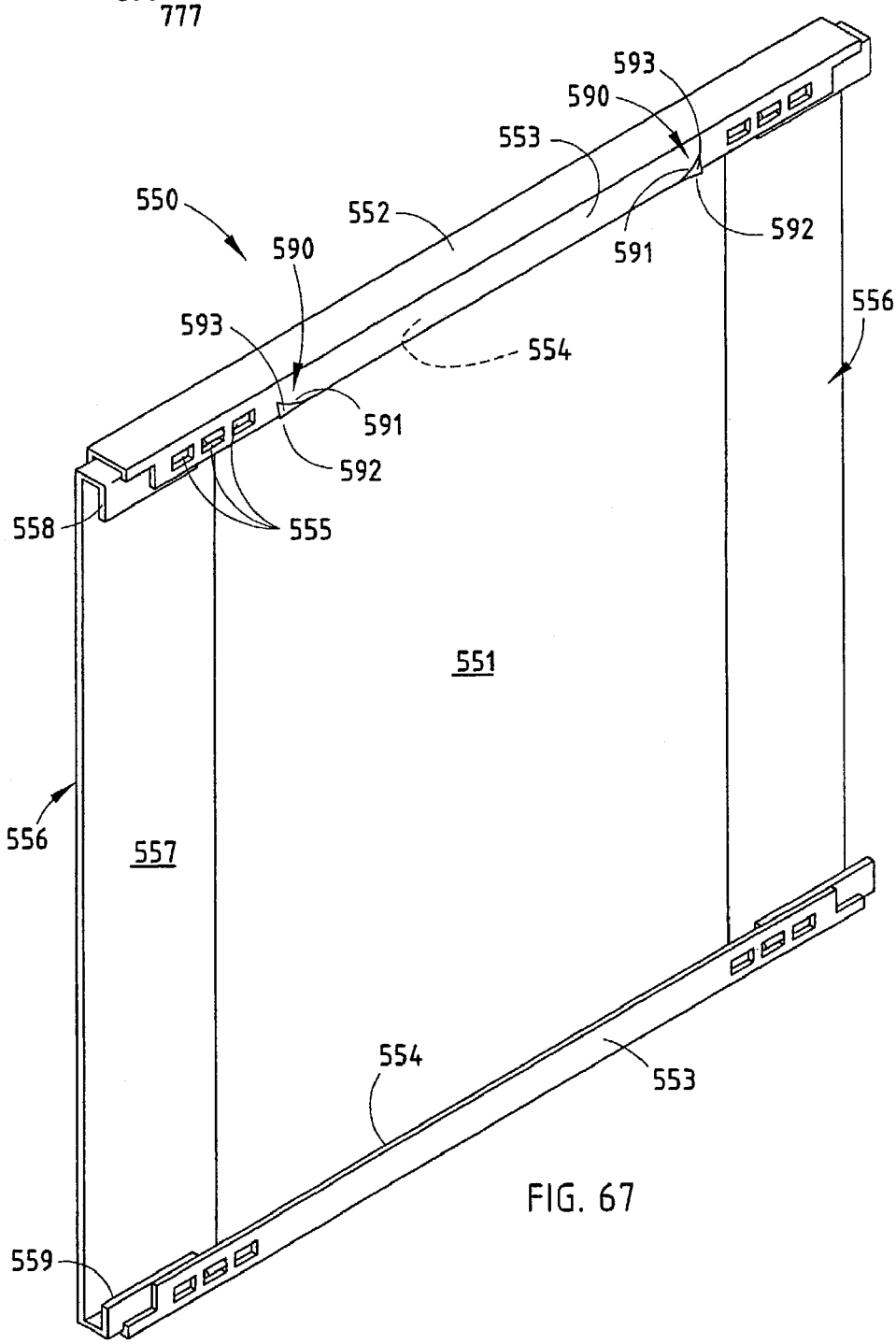
Figure 67A:
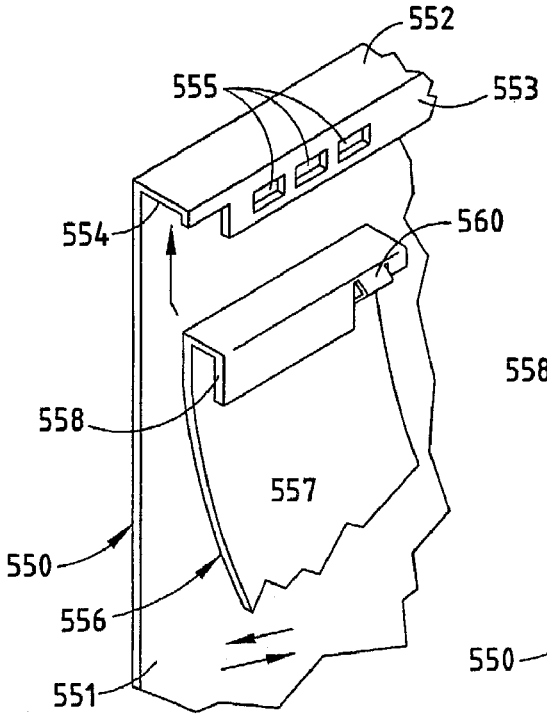
Figure 68:
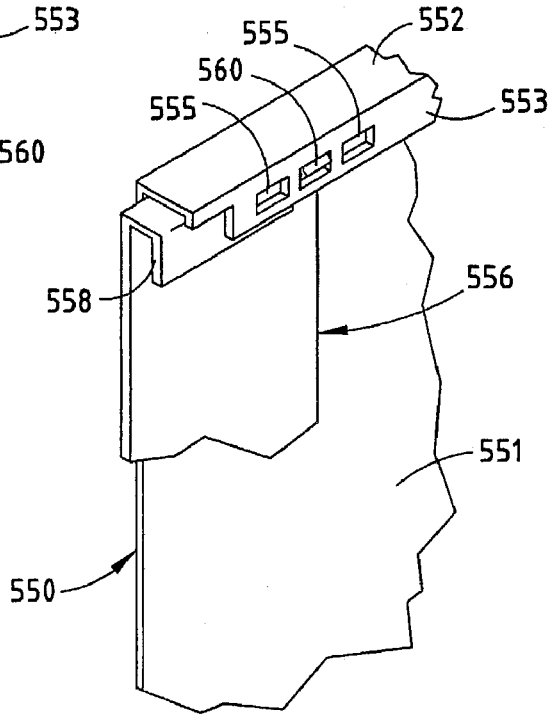

A cover 550 (FIG. 67) is provided for sealing and closing gaps and light leaks along the panel frames 2. The cover 550 is attached to the panel frame 2 by snap clips as discussed above and disclosed in FIGS. 18A-26B, or as disclosed below and in FIGS. 70-79. The illustrated cover 550 includes a painted sheet metal panel body 551 (although it is contemplated that the cover could be covered with fabric, or otherwise aesthetically treated and given a quality surface). Opposing C-shaped retainers (552/553/555) are formed along top and bottom edges of the body 551 by rearwardly-extending flanges 552 and vertical flanges 553. The flanges 552/553 form horizontal tracks 554 against a back surface of the panel body 551. Three (or more) apertures 555 are formed along the flanges 553. An adjustable light seal 556 includes a panel 557 with a textured or treated front surface. Upper and lower edges 558 and 559 of the panel 557 are bent to mateably fit into the tracks 554 for horizontal sliding movement. A resilient protrusion 560 (FIG. 67A) is formed in a location on the upper and lower edges 558 and 559, and is shaped to detentingly engage a selected one of the apertures 555. The panel 557 of the light seal 556 can be flexed and bowed (compare FIG. 67A to FIG. 68) to help insert the edges 558 and 559 into the tracks 554, and for adjustment. The light seal 556 can be adjusted between an inboard storage position where the light seal 556 is completely hidden behind the cover 550, and an intermediate position where the light seal 556 is partially extended from an edge of the cover 550 for sealing against a close adjacent structure, and a fully extended position where the light seal 556 is well-suited for closing a large gap between the cover 550 and another structure, such as may occur at a corner formed by panel frames 2.

Figure 69:
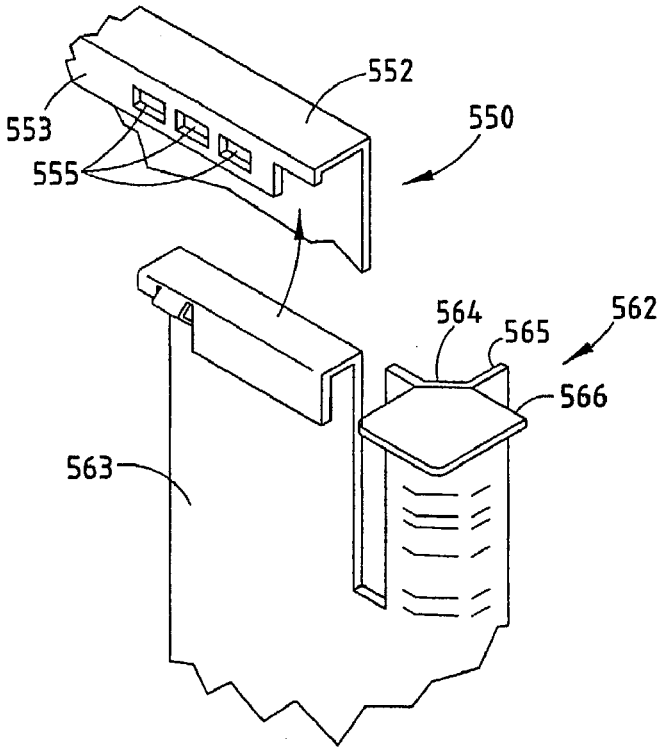
FIG. 69 is a perspective view of an exploded corner section of the cover shown in FIG. 67, including a light seal for positioning at a concave corner formed by perpendicularly interconnected panel frames.

A second light seal 562 (FIG. 69) is attached to an opposite edge of the cover 550 from the adjustable light seal 556. The light seal 562 is optimally suited to form a light seal around a concave corner, as described below. The light seal 562 includes a panel 563 similar to the panel 557 of light seal 556. Top and bottom edges of the light seal 562 similarly engage the tracks 554. However, the edge of the light seal 562 includes a first portion 564 angled at about 45° and a second portion 565 angled at an additional 45° (i.e. 90° to the panel 563). A horizontal tab 566 extends from a top of the first portion 564, for providing additional hiding power for blocking a person from seeing vertically down into a corner at an angle to the panel frame 2. When two panel frames 2 are attached to form a concave corner (FIG. 70), the cover 550 can be attached at the concave corner, with the angled light seal 562 positioned at the concave corner adjacent another cover 550. When thus positioned, the light seal 562 has its first portion 564 forming a beveled (angled) dark corner. Since the angled portion 564 of the light seal 562 is dark colored, it is difficult to see that the corner is beveled in a manner providing additional room for wiring extending around the corner. The second portion 565 is designed to tuck under an edge of the cover on the adjacent panel frame 2. Thus, the complete concave corner is light sealed. This configuration presents a very attractive and visually clean appearance, and solves a major problem of "rats nests" and unsightly "see-into" areas at corners of interconnected panel frames 2.

Novel Cover Attachment

Some covers are attached using spring clips. For example, see the discussion of covers 7 above (and also see the covers of FIGS. 18A-18B, and the spring clips of FIGS. 19-26B). It is contemplated that the covers 550 (FIGS. 70-79) can also be configured to receive spring clips and be attached in this same way.

Figure 70:
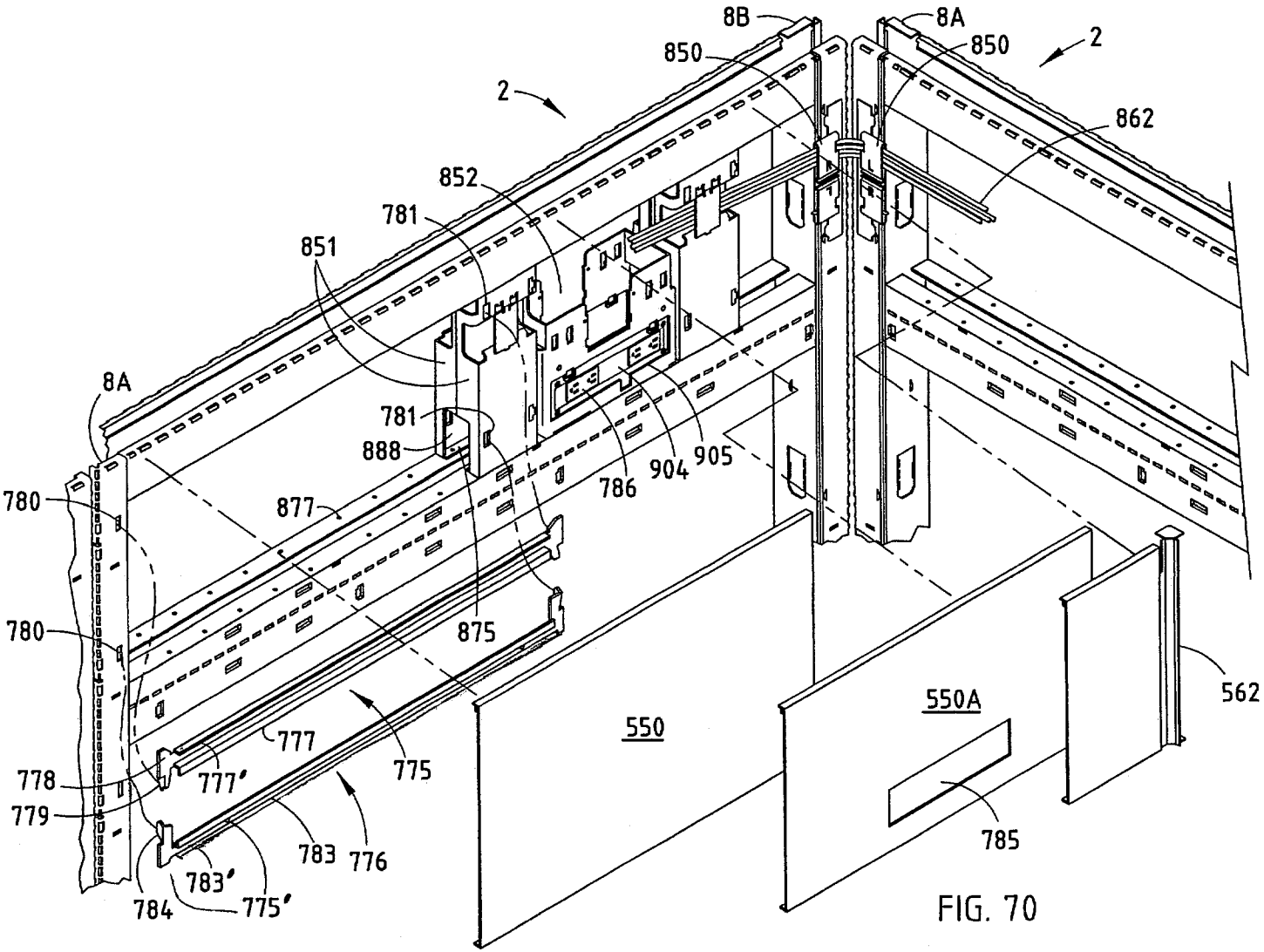
FIG. 70 is a partially exploded view of the present panel system with three types of cover panels exploded away.
Figure 71:
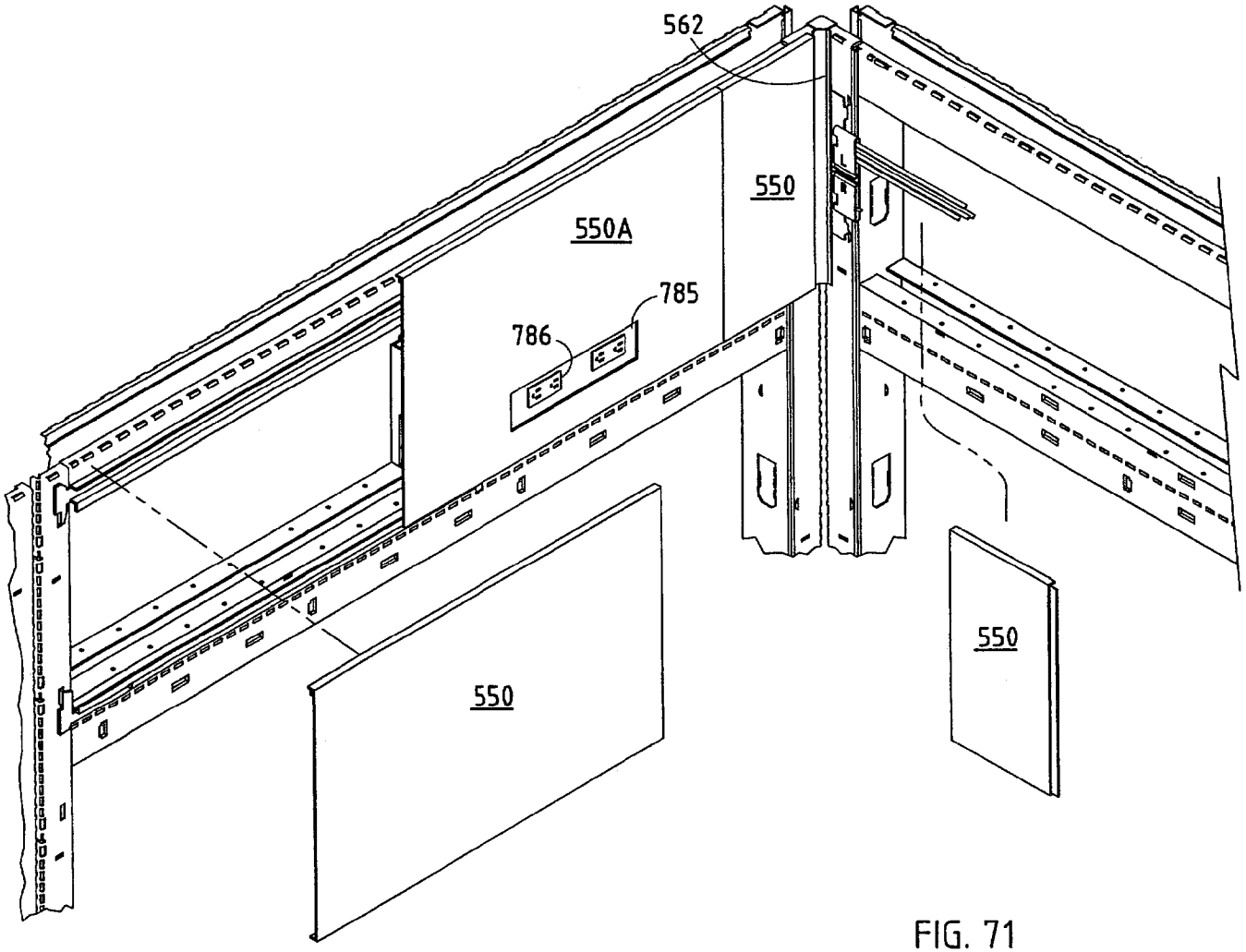
FIG. 71 is an exploded perspective view similar to FIG. 70, but with two of the cover panels attached.

However, the illustrated covers 550 (FIG. 70) are attachable in a novel way using cover mounting brackets 775 and 776. The cover mounting bracket 775 includes a horizontally-elongated body 777 with perpendicular flanges shaped to stiffen each other and form a retainer 777' shaped to mateably engage the track 554 formed by the top flanges 552 and 553 of the cover 550. End sections 778 are formed on the body 777 with hooks 779 shaped to securely engage apertures 780 in the posts 8A (or apertures 781 in the wire-managing bracket 851 or 852). The bottom mounting bracket 776 similarly includes an elongated body 783 with flanges forming a retainer 783' for mateably engaging the lower track 554 and with hooks 784 for engaging apertures 780 (or apertures 781) in the frame 2. The mounting brackets 775 and 776 can be relatively long and not only are attached by hooks 779 and 784, but also are attached by screws 775' into the horizontal beams of the panel frame 2 that they lay against. The cover 550 can be attached by engaging the top and bottom tracks 554 with the retainers 777' and 783' (FIG. 70).

Notably, the covers 550 can be attached in a direction perpendicular to a face of the panel frame 2 by flexing and manipulating the brackets 775 and 776 and the cover 550. Alternatively, the cover(s) 550 (FIG. 70) are attached by engaging a leading end with the retainers 777' and 783', and then sliding the cover(s) 550 laterally along the mounting brackets 775 and 776 until the covers 550 are in a proper position. This sliding feature is a novel and important feature when the cover 550 is trapped behind an off-module panel frame 2 with an end positioned against the cover 550, since it allows removal of the "trapped" cover without disconnection of the off-module positioned panel frame 2. The illustrated cover 550 (FIGS. 67 and 68A) include a barb-like detent 590 shaped to engage the ends of the retainer lips 777' and 783' on brackets 775 and 776 to assure a proper and fully aligned final position. The detents 590 (FIGS. 67 and 68A) are spaced-apart triangular shapes, and include a bent edge 591 and an outwardly angled point 592. During installation of cover 550, as the cover 550 is slid along the retainers 777' and 783', an angled surface 593 on one of the detents 590 engages the top tab on the end 778 (or end 784) and slides up and over the top tab. As the (left) detent 590 finishes sliding over the end 778 (FIG. 68A), the other (right) detent 590 engages the associated other end 778. By this arrangement, the cover 550 is accurately secured on the retainers 775 and 776, since cover 550 is accurately located by detents 590 between the ends 778.

The cover 550 attaches in a novel way, as described above, but also releases in a novel way. By gripping the area of cover 550 near the detent 590, the flange 554 can be flexed toward the outer panel 554, which causes the detent 590 to move sufficiently to release from the up tab on end 778 (or 784). By simultaneously flexing a center of the flange 554, it has been found that the other detent 590 will also release. This allows the cover 550 to be shifted in either direction for removal. Where needed, an opening 785 (FIG. 70) can be formed in the cover 550A for providing access to a component in the panel frame 2, such as an electrical outlet 786 or communication or utility port (not specifically shown) mounted inside the panel frame 2.

Novel Spring Novel Spring Clip and Additive Locking Clip

Figure 72:
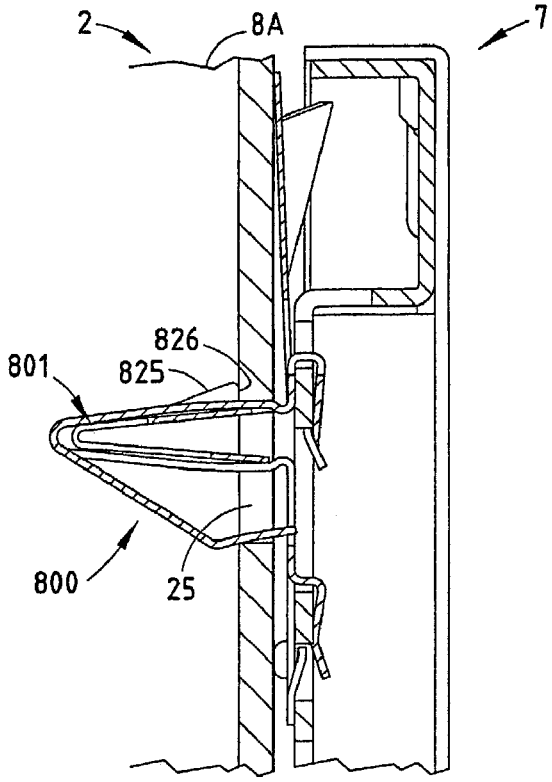
FIGS. 72-73 are enlarged cross-sectional fragmentary views showing the cover panel of FIG. 70 attached to a panel frame, the top spring clip also including a interlocking security locking clip.
Figure 73:
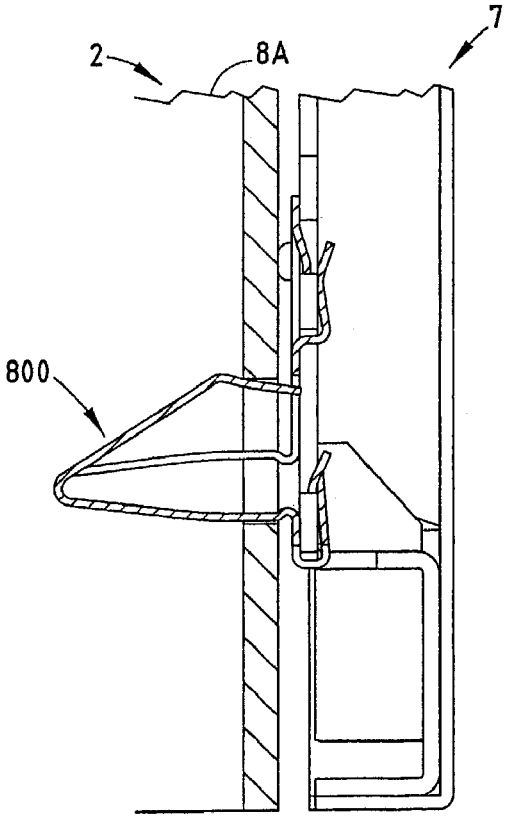
Figure 74:
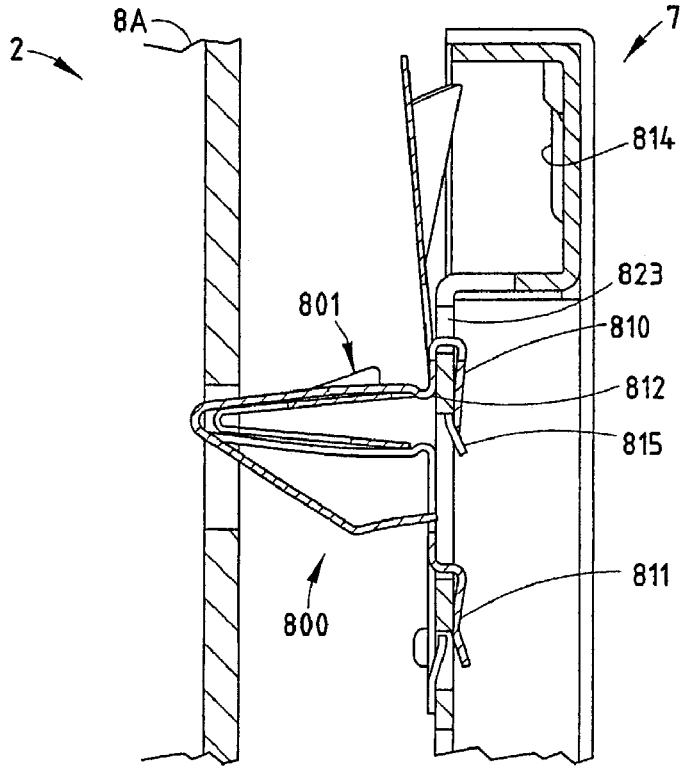
FIGS. 74 and 75 are side cross-sectional views similar to FIGS. 72 and 73, respectively, but immediately before final attachment.
Figure 75:
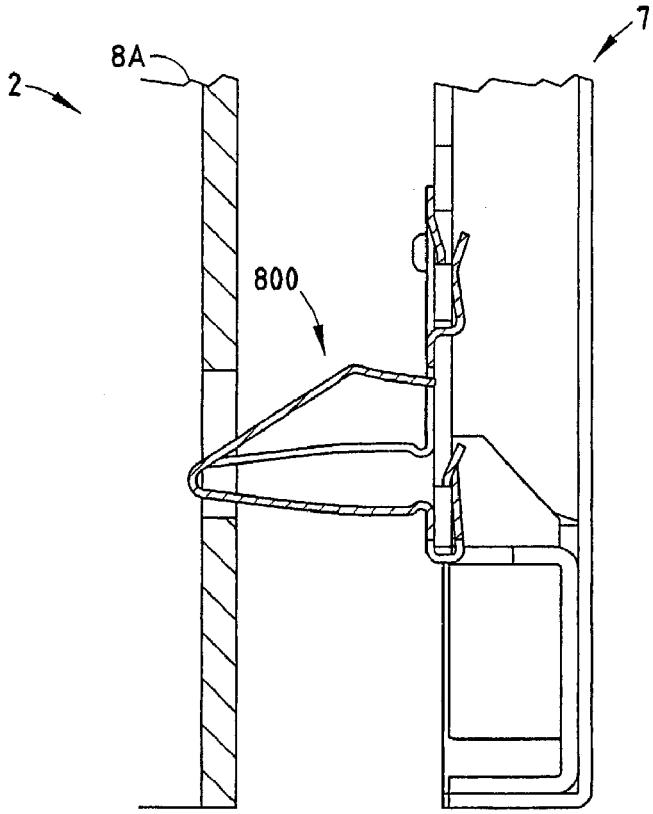
Figure 77:
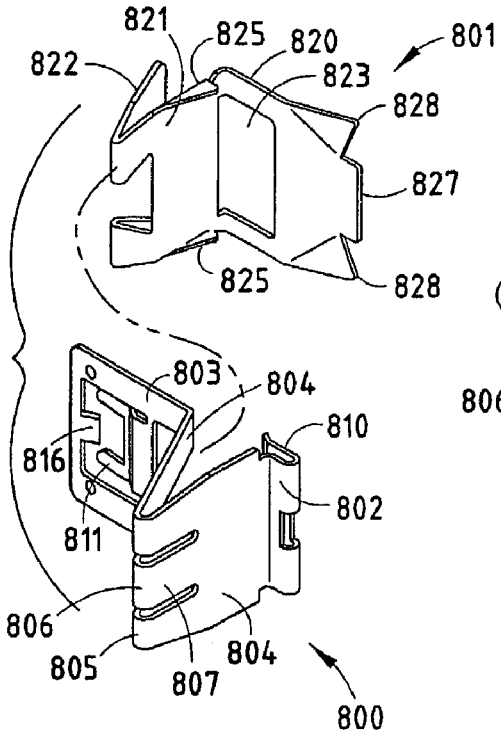
FIGS. 77-77A are perspective and side views similar to FIGS. 76 and 76A, respectively, but with the locking clip exploded away from the spring clip.
Figure 77A:
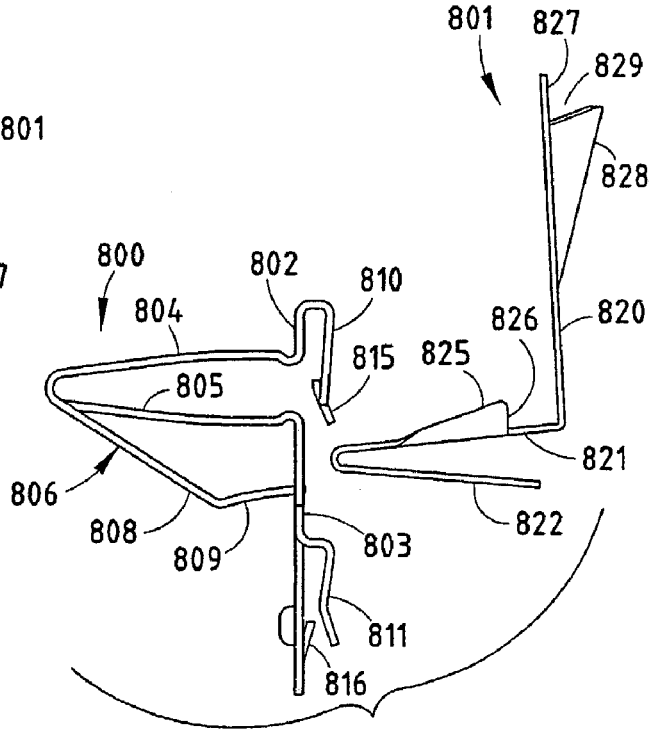

Novel spring clips 800 and security/locking clips 801 can be used to attach a cover 7 or utility-supporting module to the panel frame 2 (see the cover assembled to the panel frame in FIGS. 72-73, and see the cover positioned ready for assembly to the panel frame in FIGS. 74-75). The spring clip 800 (FIGS. 77 and 77A) is stamped from a single sheet of spring-steel material, and includes first and second co-planar sections 802 and 803 defining a planar base, and includes first and second angled sections 804 and 805 that extend from and interconnect the co-planar sections 802 and 803. The first angled sections 804 and 805 are each formed by two spaced-apart strips (FIG. 77). A third strip 806, located between the spaced-apart strips, is formed with a root 807 starting at about halfway up the angled section 804 and extends around the tip into an area near the second angled section 805. The third strip 806 is resiliently flexible, and includes a leafspring-like free end 808 that is bent outwardly from the angled section 805. The free end 808 includes a knuckle 809 for detentingly engaging one side of the aperture 25 in the panel frame 2 into which the spring clip 800 is frictionally engaged (FIG. 73). The first and second co-planar sections 802 and 803 each include a pair of first fingers 810 and 811 for frictionally engaging strips of steel 812 and 813 on the marginal backside frame 814 of cover 7. Angled interlock barbs 815 and 816 are located on the base sections 802 and 803 at a location near an end of the fingers 810 and 811. The interlock barbs 815 and 816 engage the strips 812 and 813 as the fingers 810 and 811 are moved into position on the strips 812 and 813 during installation of the spring clip 800 onto the cover 7 (see FIG. 75). The spring clip 800 is adapted to frictionally engage the marginal material forming the aperture 25 in the panel frame 2 simply by forcing the cover 7 toward the panel frame 2.

The retention force provided by spring clips 800 is entirely adequate for most situations. However, there are situations where additional retaining force is desired, or where the facility manager (or partition manufacturer) wants to provide an even more positive retaining force, or wants to provide an interlocked arrangement that prevents workers from removing the cover without authorization. Also, some components that are attached to the panel frame 2 may have an increased weight, thus causing the need for a more positive retention force. In such event, the spring clip 801 is useful.

Figure 76:
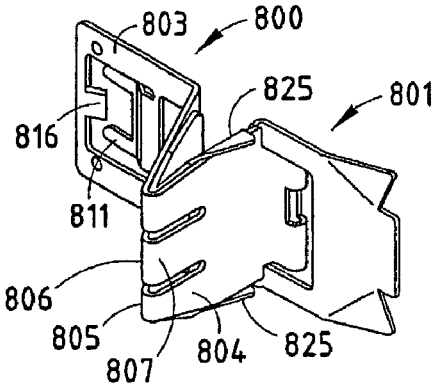
FIGS. 76-76A are perspective and side views of the spring clip shown in FIG. 74 with the locking clip positioned within the spring clip.
Figure 76A:
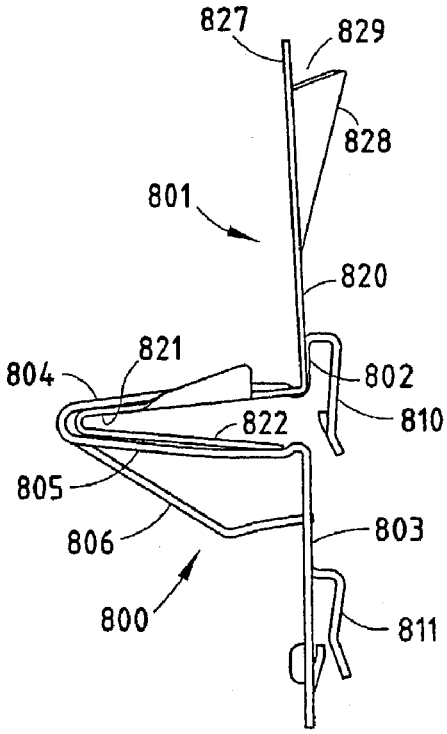

The locking clip 801 (FIGS. 72, 73, 77 and 77A) can be added to the spring clip 800. The locking clip 801 (FIGS. 77-77A) includes a base flange 820 and first and second angled sections 821 and 822. The base flange 820 includes an aperture 823 shaped to receive the base section 802. The first and second angled sections 821 and 822 are shaped to fit inside of and closely adjacent the first and second angled sections 804 and 805 on the spring clip 800 (see FIGS. 76 and 76A), with base flange 820 of the locking clip 801 lying approximately co-planar with the base 802 of the spring clip 800 and with the retainer finger 810 and interlock tab 815 extended through the aperture 823 in a location where they are able to attach to the strip 812 on the marginal perimeter frame 814 of the cover 7 (FIG. 74). A triangular retainer barb 825 (FIG. 77A) is formed on opposing side edges of the first angled section 821. The retainer barbs 825 receive the first angled section 804 on the spring clip 800, and extend a substantial dimension greater than a thickness of the material forming the first angled section 804. Also, the interlocking end 826 of the retainer barbs 825 is spaced a short distance from the plane of the base flange 820, and has a surface that is about parallel the base flange 820. Thus, when the locking clip 801 is inside the spring clip 800 and the cover 7 is attached to the panel frame 2 (FIG. 72), the interlocking end 826 of the retainer barbs 825 springs outward and engages the backside of the material forming the aperture 25 in the panel frame 2. As long as this condition continues, the cover 7 (or whatever component is held by combination of the spring clip 800 and the locking clip 801) simply cannot be removed.

Figure 72A:
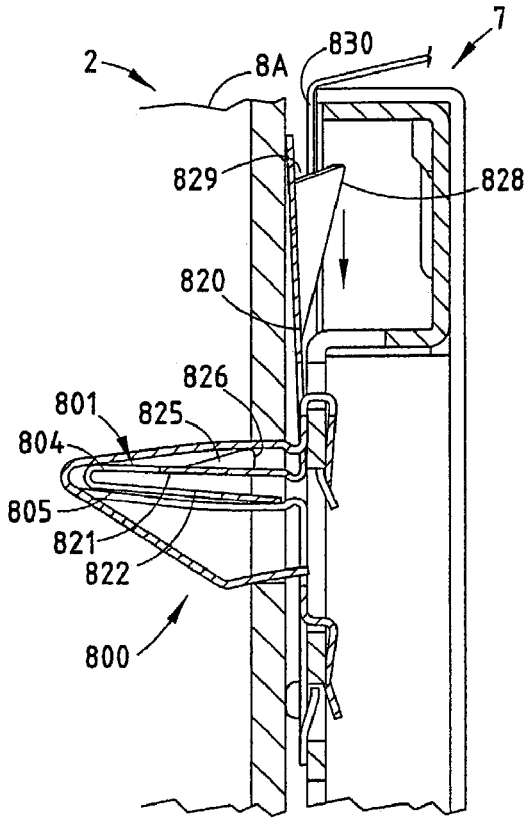
FIG. 72A is a side cross-sectional view similar to FIG. 72, but with the locking clip flexed to a release position.

The base flange 820 of the locking clip 801 (FIG. 77) is extended from the angled section 804, and includes a center tab 827 and side tabs 828 bent to form an upwardly open throat 829. The throat 829 can be easily found and engaged by a blade 830 (FIG. 72A), such as can be easily made by bending a blade of a putty knife. By pressing downwardly, the base flange 820 is moved downwardly, causing the first angled section 821 to flex toward the second angled section 822. When first angled section 821 flexes, the retainer barbs 825 are moved to a location inside the angled sections 804 and 805, thus releasing the interlocking end 826 from the back surface of the material forming the aperture 25 in the panel frame 2. As a result, the cover 7 is released.

Figure 78:
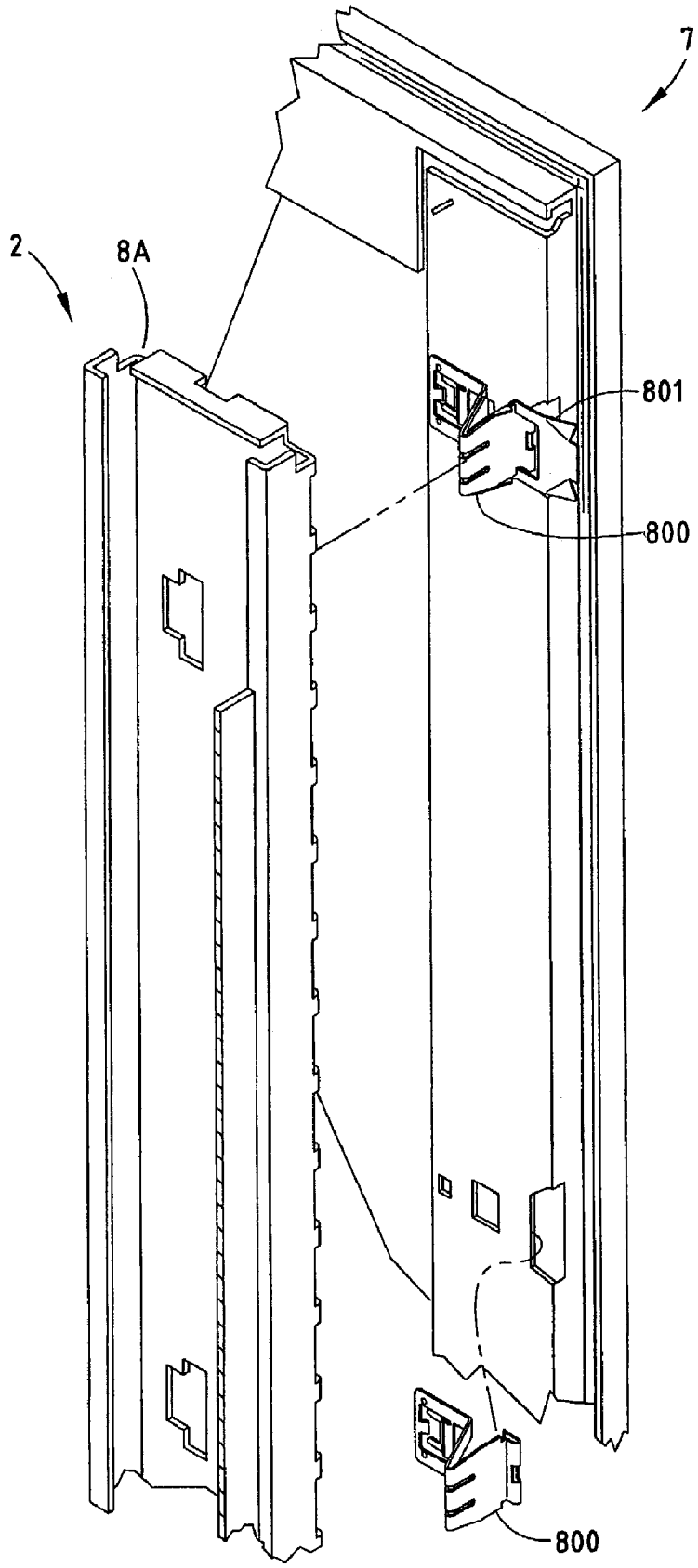
FIGS. 78 and 79 are perspective views showing attachment of a cover panel to a panel frame, FIG. 78 being immediately prior to attachment and FIG. 79 being after attachment, of the covers shown in FIG. 70.
Figure 79:
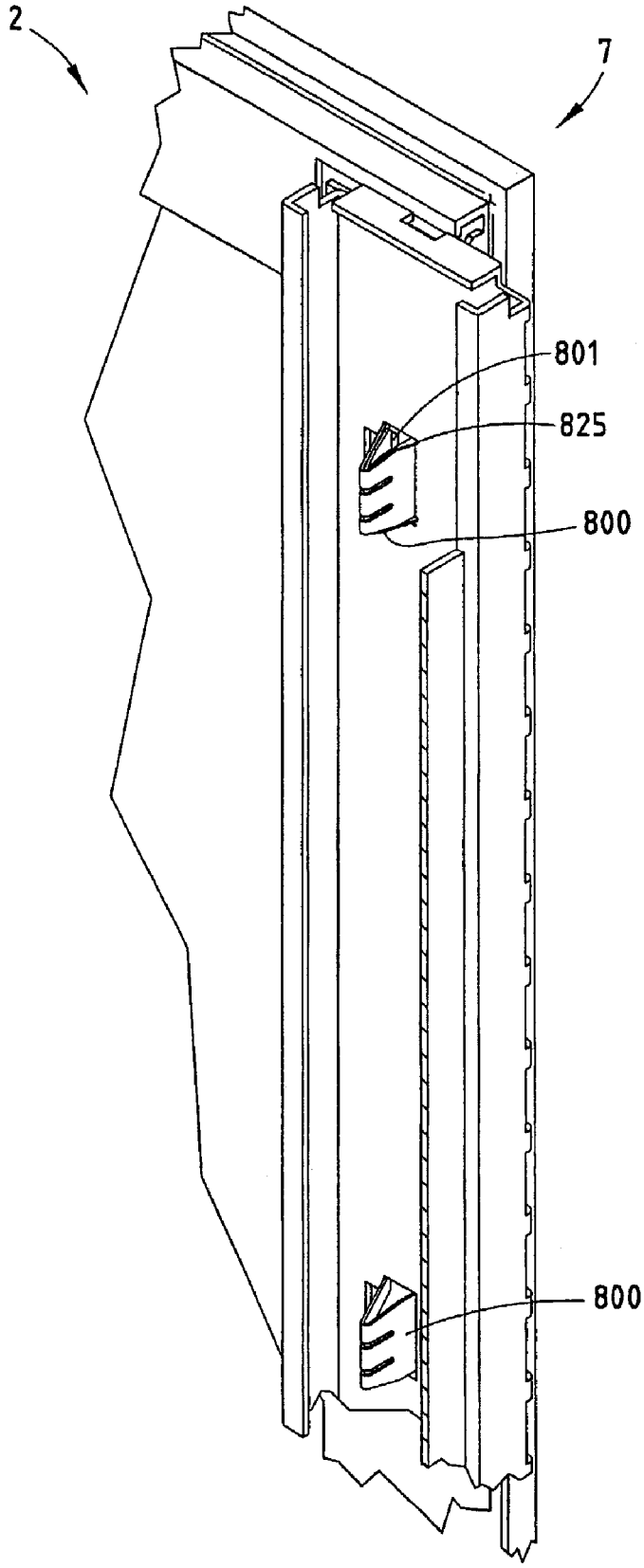

It is noted that where security is the issue, only a single locking clip 801 is necessary. For example, FIGS. 78 and 79 show one arrangement where spring clips 800 are used to attach a cover 7 to a panel frame 2, and only a single top clip 801 is used, such as in the upper right corner of the cover 7. Even with only a single locking clip 801, the cover 7 cannot be removed until the clip 801 is released.

Wire Management and Cable Management Brackets

The arrangement shown in FIG. 70 shows a wire management system that is particularly advantageous and that is believed to be novel. The wire management system includes a corner-wire-routing bracket 850, lateral-wire-routing upright bracket 851, and utility outlet supporting bracket 852 that cooperate as follows.

Figure 80A:
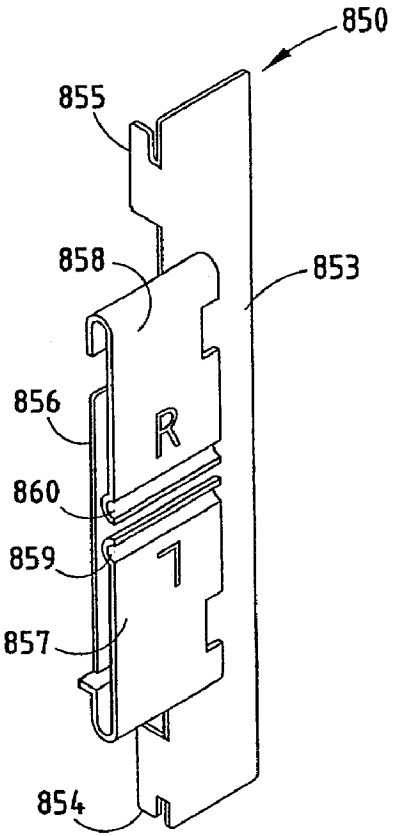
FIGS. 80 and 80A are views of a wire management bracket as shown in FIG. 70.
Figure 80:
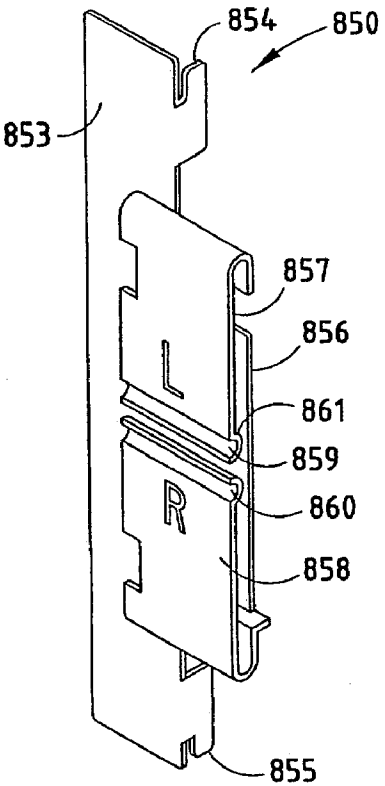

The corner bracket 850 (FIGS. 80 and 80A) can be one piece or can be multiple pieces attached together. The illustrated corner bracket 850 is one-piece and includes a planar strip 853 with perpendicular up and down hooks 854 and 855 formed along an outboard edge at top and bottom ends of the strip. A co-planar section 856 extends laterally from strip 853 from the same edge as hooks 854 and 855. Resilient wire retainer arms 857 and 858 extend from a top and a bottom of the co-planar section 856, and include curled back sections 859 and 860 that are parallel but spaced from the co-planar section 856. The free ends of the curled back sections 859 and 860 are spaced-apart, are resilient, and include a dimple 861, such that wires 862 (FIG. 70) can be extended between the free ends and under the curled back sections 859 and 860, where the wires 862 are closely retained and controlled for optimal positioning and managing on the panel frame 2. This is particularly important as the wires 862 are bent around the concave corner of the perpendicularly connected panel frames 2 in FIG. 70, since heavy wires may not bend well and hence may cause a poor fitting cover at a concave corner. This, in combination with the cover 550 with angled light seal 562, provides a very effective and high-quality-appearing arrangement where wires 862 extend around the concave corner, as illustrated.

The lateral-wire-routing upright bracket 851 (FIG. 81) includes a structural box shape formed by front, side, and rear panels 870-873. Top and bottom attachment flanges 874 and 875 are formed at a top and bottom of the upright bracket 851, include attachment holes 876 that align with holes 877 on the cross beams of the panel frame 2 and that are adapted to receive screws 878 (FIG. 82) to attach the bracket 851 to the panel frame 2. Notches 879 are formed in the front and side panels 870-872, which form a forwardly-open horizontal front channel with open ends that permits lay-in of wires 862 from a front of the panel frame 2. A wire-retention strap 881 includes top and bottom tabs 882 and 883 that releasably engage apertures 884 and 885 in the bracket 851, for retaining wires 862 within the wireway channel (FIG. 82). Second notches 887 (FIG. 81) are formed in the side and rear panels 871-873, Which form a rearwardly-open horizontal rear channel with open ends. This channel, if there is not a second bracket 851 attached behind the first bracket 851, will be open and will permit lay-in of wires 862 from a rear of the bracket 851. However, when a second bracket 851 is attached behind the first, a feed-through aperture 888 is provided (FIG. 70). Feed-through of wires 862 is sometimes desired and advantageous, since wires 862 are held in a center area of the panel frame 2 away from the covers 7 and separated from other wires in the notches 879. Accordingly, the bracket 851 can be used to create both lay-in and feed-through channels in the panel frame 2.

A modified bracket 851A (FIGS. 81A-81D) is very similar to bracket 851, but bracket 851A includes up tabs 898A and down tabs 898B that replace screws 898. The tabs 898A and 898B are shaped and located to engage holes 877 (FIG. 82) in the frame members 9 and 11B. the up tabs 898A (FIG. 81D) are supported by a resilient spring 898A' to allow vertical deflection to permit assembly of the bracket 85 1A between the frame members 9 and 11B.

The wire-retention strap 881A (FIG. 81E) is a unitary member having a flat body with a bottom hook 883A and a top spring clip 882A. The hook 883A fits into an apertured flange 883A' on the bracket 851A, and the spring clip 882A fits into a pocket between flanges 882A' and 882A" on the bracket 851. The strap 881A closed the lay-in front channel on the bracket 851A.

Figure 81:
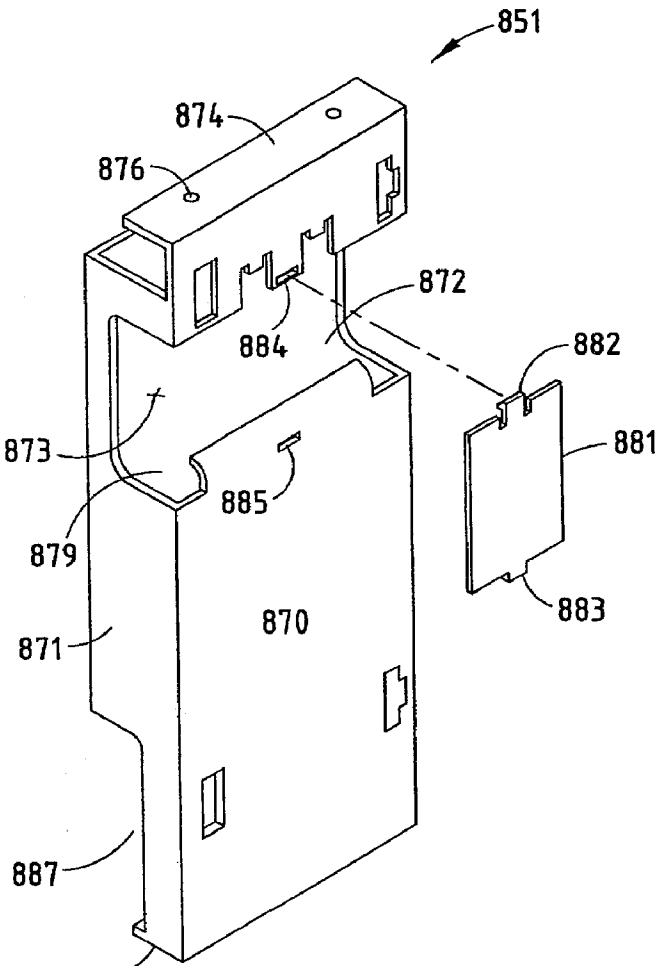
FIG. 81 is a perspective view of another wire management bracket as shown in FIG. 70.
Figure 81A:
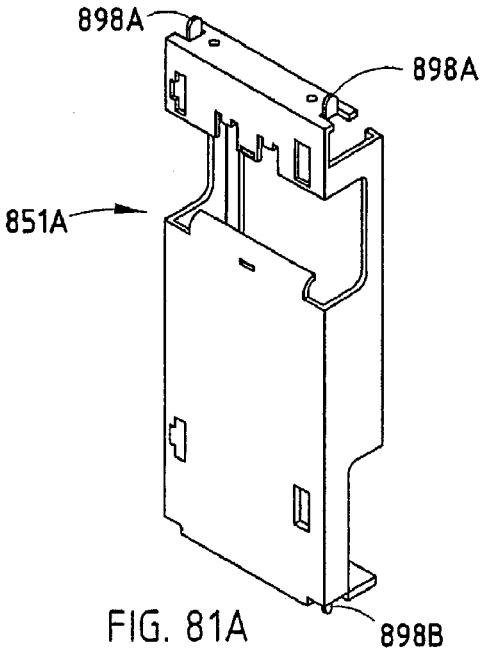
FIGS. 81A-81D are front perspective, rear perspective, front and side views of a modified wire management bracket similar to FIG. 81, FIG. 8 1E being an enlargement of the area 8 1E in FIG. 81D.
Figure 81B:
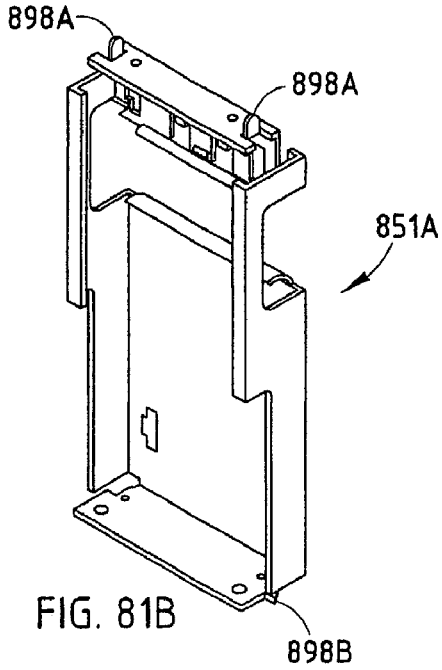
Figure 81C:
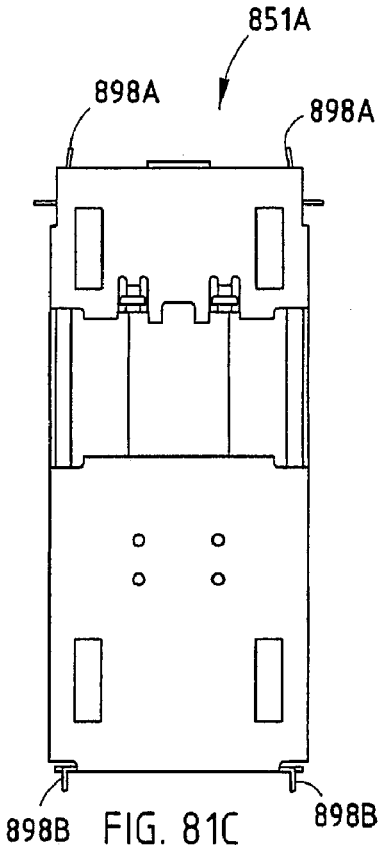
Figure 81D:
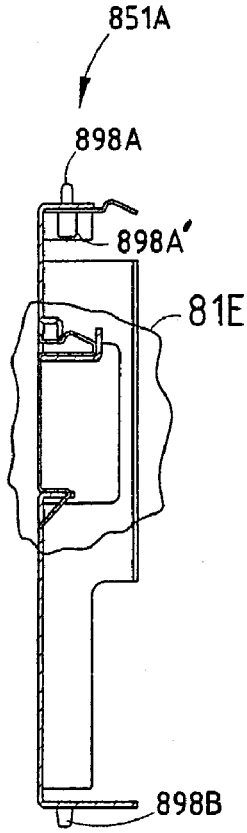
Figure 81E:
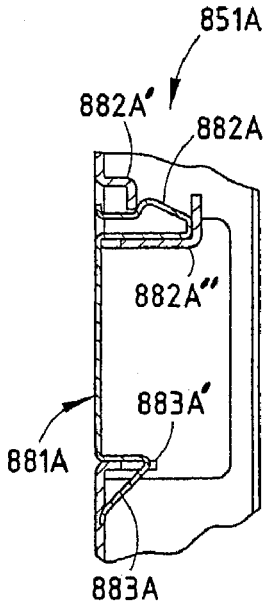
Figure 82:
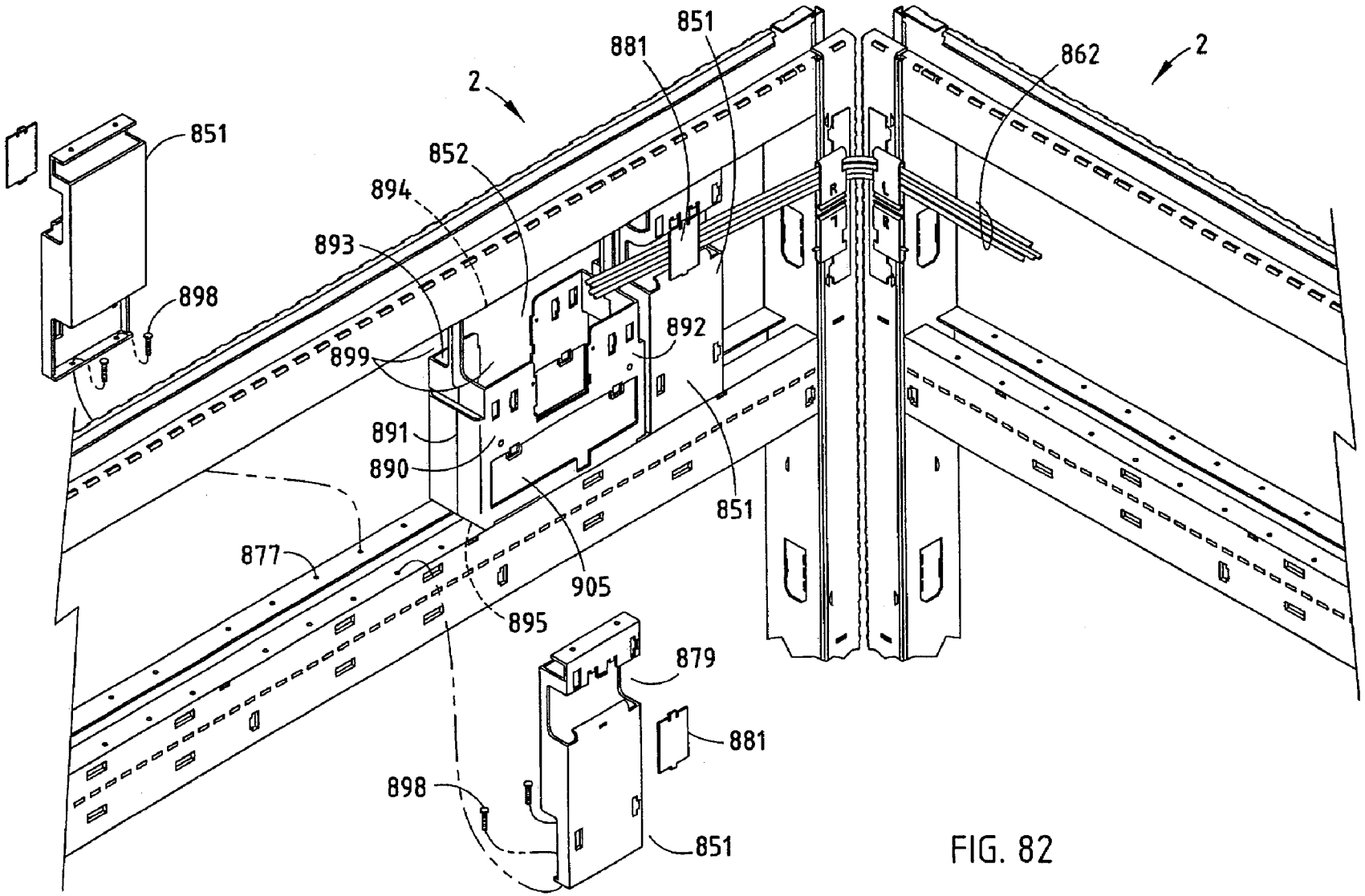
FIG. 82 is a view similar to FIG. 70, but with two of the wire management brackets of FIG. 81 exploded away.

The utility outlet supporting bracket 852 (FIG. 82) includes an upper portion that is not unlike the upright bracket 851 (FIG. 81). The utility supporting bracket 852 (FIG. 82) includes a structural box shape formed by front, side, and rear panels 890-893. Top and bottom attachment flanges 894 and 895 are formed at a top and bottom of the utility supporting bracket 852, and include attachment holes that align with holes 877 on the cross beams of the panel frame 2 and that are adapted to receive screws 898 (FIG. 82) to attach the bracket 852 to the panel frame 2. Notches 899 are formed in the front and side panels 890-892 that align with the notches, which form a forwardly-open horizontal front channel with open ends that permits lay-in of wires 862 from a front of the panel frame 2. A wire-retention strap, similar to strap 881 in bracket 851, can be used for retaining wires 862 within the channel of notches 899, if desired. The utility supporting bracket 852 can be large enough to be a same width as a depth of the panel frame 2, or can be made by positioning two brackets 852 back-to-back. As illustrated, an electrical module 904 (FIG. 70) is positioned inside of bracket 852 in an opening 905 in the lower half of a front face 906 of the bracket 852. The electrical module 904 is operably connected to the wires 862 and includes a pair of duplex power outlets 786. A cover 550A includes an opening 785 having a rectangular shape that permits access to the two duplex outlets 786. While only duplex power outlets 786 are shown, it is contemplated that a variety of different utilities can be provided in the opening 905 and supported by the bracket 852, such as data and communication cabling, video cabling, wires carrying different voltages, and non-electrical utility lines such as air, gas, light, etc.

Lay-In Frame

Figure 83:
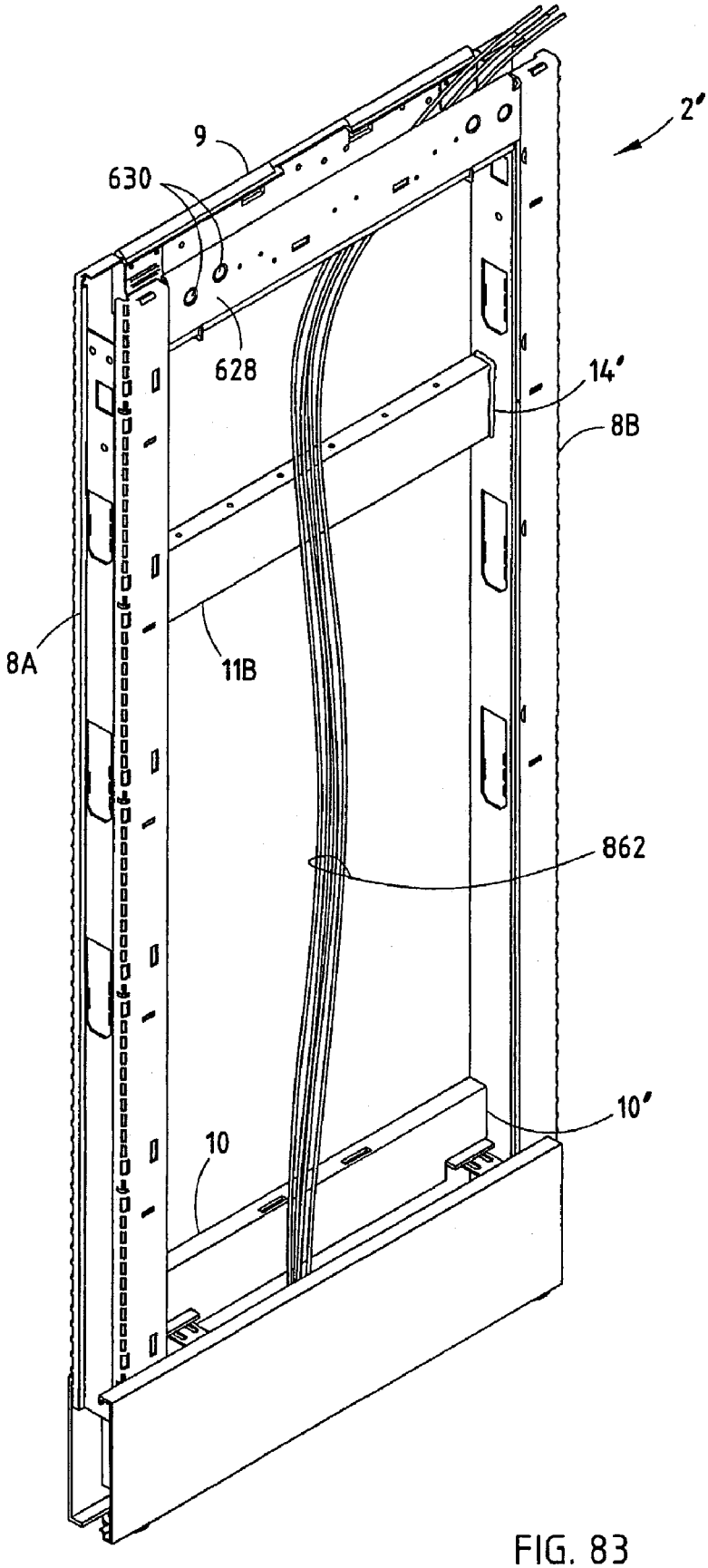
FIG. 83 is a perspective view of a panel frame similar to that shown in FIG. 70, But permitting lay-in from a front side of the panel frame.
Figure 84:
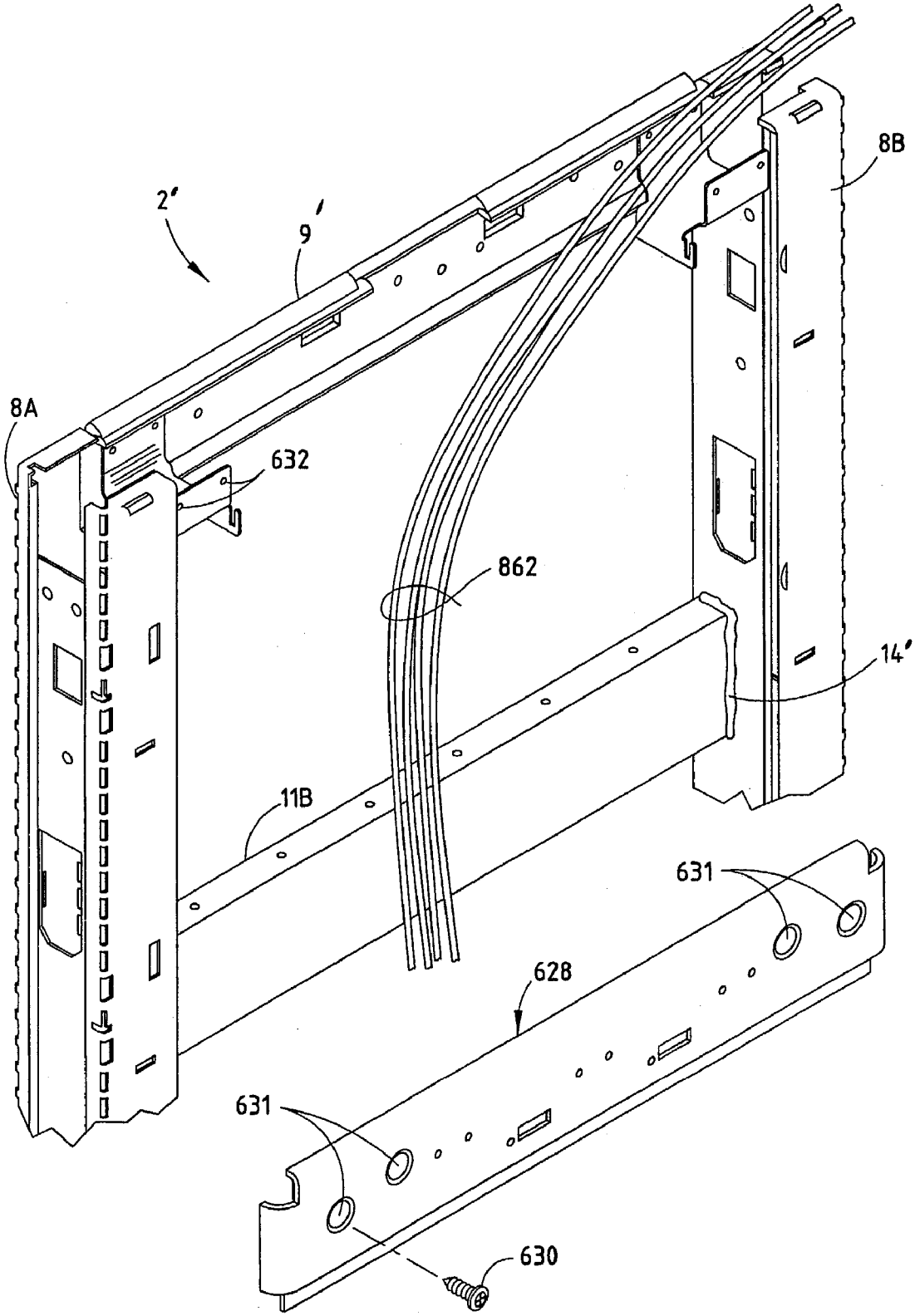
FIGS. 84 and 85 are top and bottom exploded partial perspective views of FIG. 83.
Figure 85:
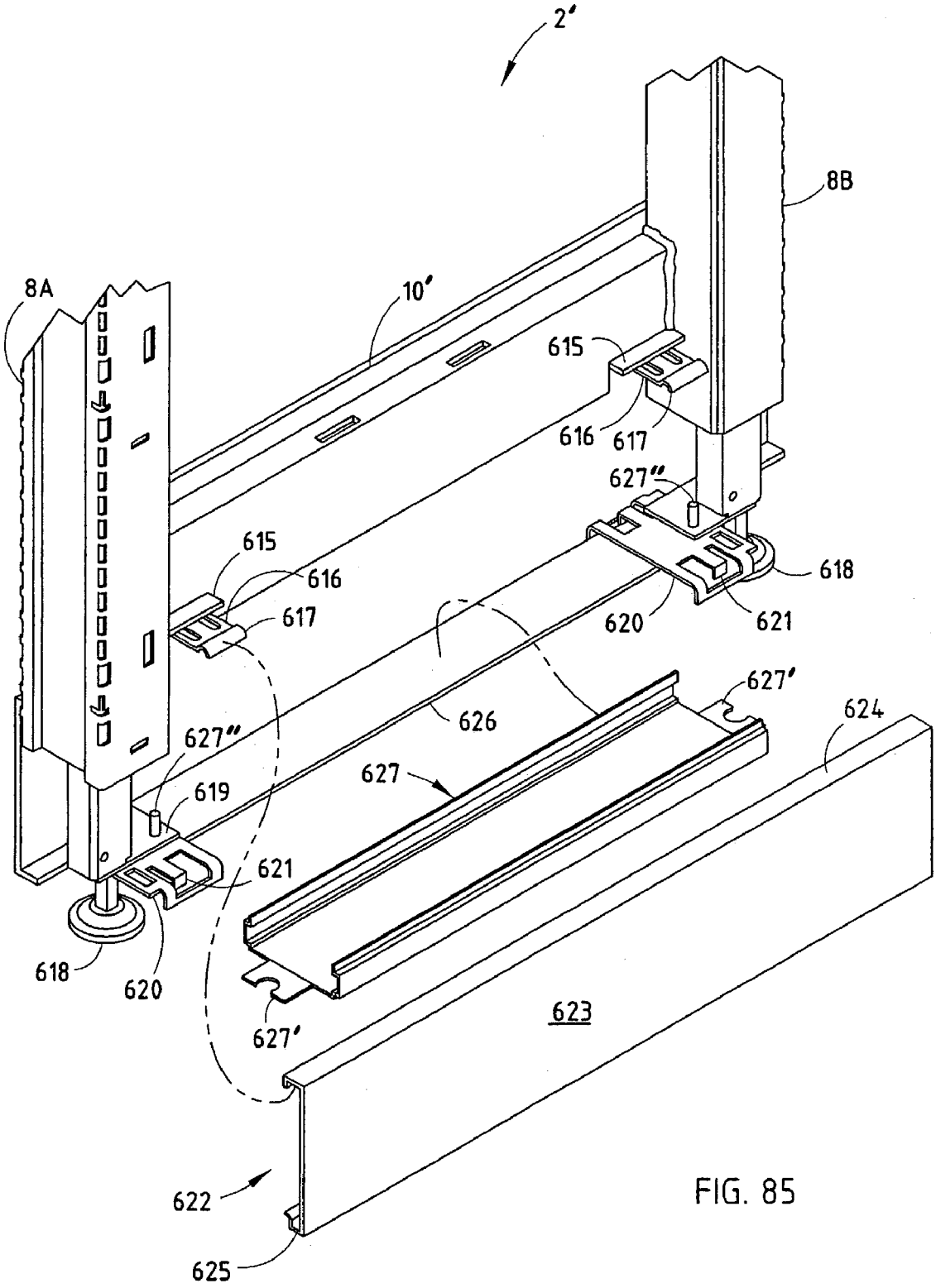

A modified panel frame 2' (FIGS. 83-85) is arranged to further support lay-in of wires 862 to the panel system 1. Specifically, the modified panel frame 2' includes a "totally open" side that permits lay-in of large bundles of wires from above or below, as described below. The modified panel frame 2 includes upright posts 8A and 8B, but only includes top and bottom horizontal frame members 9 and 10 on a rear side of the upright posts 8A and 8B (see FIGS. 84-85), and further only includes cross beam(s) 11B on the same rear side. The posts 8A, 8B, horizontal frame members 9, 10, and cross beam 11B are all welded permanently together, such as at the welds 10', 14'. As can be seen in FIGS. 84-85, this leaves the entire forward half of the panel frame 2' between the posts 8A and 8B open for laying in wires from above or below the panel frame 2'. The bottom horizontal frame member 10 (FIG. 85) includes a forwardly extending bracket 615 on a lower surface at each end of the frame member 10 near the adjacent posts 8A and 8B. A spring clip 616 is attached to the bracket 615 and includes a free end defining a radiused connector 617. The bottom of each post 8A (and 8B) includes a vertically adjustable glide 618. A second bracket 619 is attached to a bottom of the post 8A (above the glide) and extends in an inboard direction. A second spring clip 620 is attached to the second bracket 619 and extends forwardly, with a free end of the spring clip 620 defining a hook connector 621. The four spring clips 616 and 620 form a rectangular array. A base trim cover 622 includes a face 623 and top and bottom curled edges 624 and 625 that are adapted to frictionally engage the radiused connectors 617 and 621 to releasably retain the base trim cover 622 to the panel frame 2'. A stabilizer bar 626 is attached between the bottom brackets 619 to stabilize the posts 8A and 8B and to accurately maintain a distance between the glides 618. The illustrated stabilizer bar 626 extends a length of the panel frame 2' between the glides 618, but extends only half a depth of the panel frame 2' and is located in the rear half of the panel frame 2'. A U-shaped wire-supporting channel 627 (also called a "tray") can be positioned on the stabilizer bar 626, if desired, for increased wire carrying capability. The channel 627 includes slotted end tabs 627' that fit onto studs 627", so that the channel 627 is accurately and securely retained. Nuts (not shown) can be threaded onto the studs 627" for added security of the assembly. Top and bottom front structural channels 628 (FIGS. 83 and 84) are bolted to the panel frame 2' at locations corresponding to top and bottom frame members 9' and 10' (FIGS. 84 and 85) by screws 630 that extend through holes 631 and 632.

Base Cover and Cable Tray

Figure 85A:
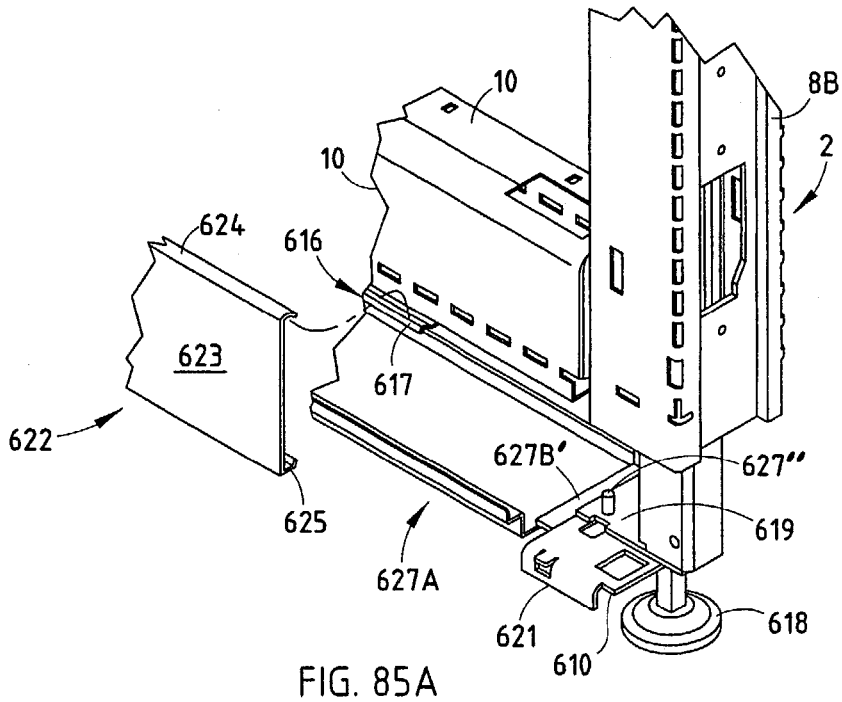
FIG. 85A is a perspective view of a lower corner of the frame shown in FIG. 1B.

FIG. 85A discloses a base cover and cable tray arrangement similar to that disclosed in FIG. 85, but for a standard panel frame 2. The frame 2 includes a plate bracket 619 with up stud 627" positioned inboard of the adjustable foot 17. A plate-like spring clip 620 is attached to plate bracket 619, and includes resilient fingers 621 shaped to engage a bottom lip 625 of the base trim cover 622 in opposition to a top spring clip 616 on the frame member 10, the top clip 616 having resilient fingers 617 engaging the top lip 624 on the base trim cover 622.

Figure 85B:
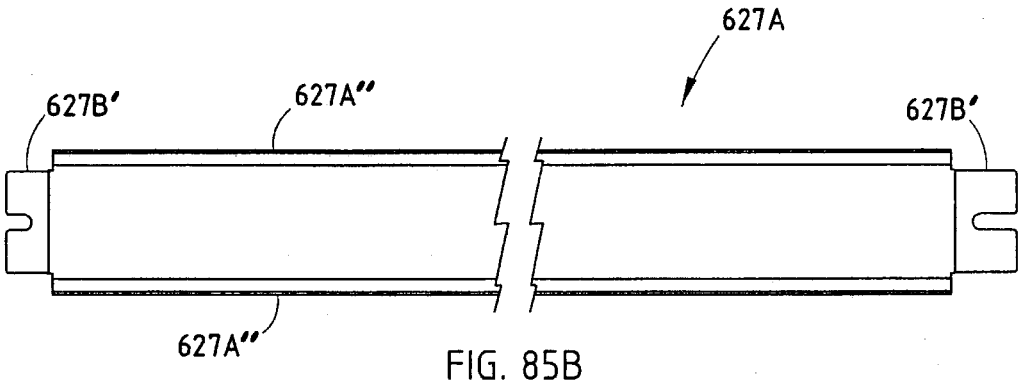
FIGS. 85B-85D are top, front, and end views of the tray shown in FIG. 85A, FIG. 85D being enlarged.
Figure 85C:
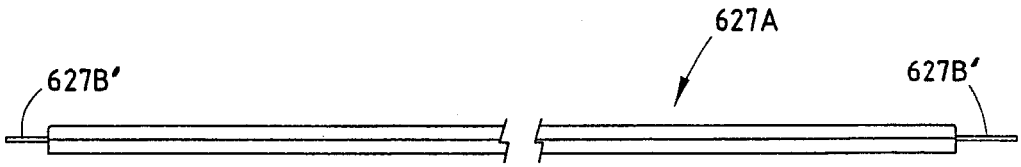
Figure 85D:
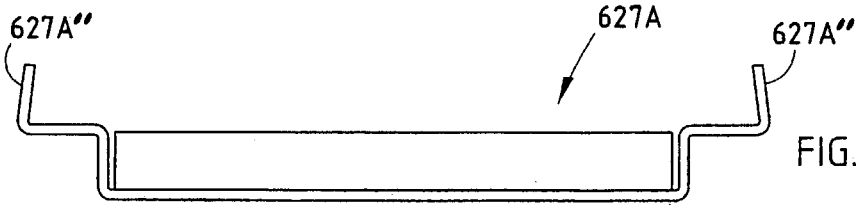

The tray 627A (FIG. 85B) includes a bottom 627A' and upwardly formal edges 627A" defining a channel for holding wiring. Dividing walls (not shown) can be added to divide the channel to separate wires therein. Slotted tabs 627B' extend from ends of the tray 627A, and are shaped and located to engage the studs 627". Optionally, the spring clip 620 can include resilient fingers that frictionally engage the tabs 627B' to hold the tray 627A in place on the frame 2.

Off-Module Worksurface Support Brackets

As apparent from the discussion above, the partition panel frame 2 (FIGS. 86-90) can be configured to define a "floor-level" row of horizontal slots 13 (i.e. on bottom horizontal frame member 10), a second row of horizontal slots 15 spaced above the slots 13 (i.e. on a cross beam 11B), and at least one vertical row of slots 14 (i.e. on a post 8A). Cover panels 7 are attached to the panel frame 2 to cover the panel frame 2 while permitting access to the first and second and vertical rows of slots 13, 15, and 14, respectively. An important inventive aspect of the present panel system is the "infinite" vertical and horizontal adjustability as provided by the vertical rows of slots, which extend completely from a top to a bottom of the posts 8A and 8B, and as provided by the horizontal rows of slots (in beams 9, 10, 11B), which extend completely from one side edge to another side edge of the panel frame 2 (including across the posts 8A and 8B). (See FIGS. 3 and 70.) The illustrated worksurface 4 (FIG. 86) takes advantage of this wide range of adjustability by utilizing a modified worksurface support 300 that attaches selectively to slots 13, 15 and 14. Notice that the worksurface support 300 permits location of the worksurface 4 anyplace along the panel system 1, regardless of where posts 8A are located. It is noted that the modified worksurface support 300 is modified from the worksurface support brackets 101 and 102 shown in FIGS. 27-28.

The present worksurface support 300 (FIG. 86) includes an upper bracket 301 (FIG. 87) selectively engaging the "upper" horizontal slots 15 in a structural beam 11B, a "lower" bracket 302 selectively engaging the "lower" floor-level row of horizontal slots 13 in a lower frame member 10, and a third "capturing" bracket 303 that telescopes down onto the first and second brackets 301 and 302 to capture and retain the first and second brackets 301 and 302 in a vertically-aligned captured position. In the vertically-aligned captured position, the brackets 301 and 302 are held in a non-releasable interlocked engagement with the first and second rows of slots 15 and 13. A cantilever bracket 304 adjustably engages vertical slots in the brackets 302 and 303 to support the worksurface 4 on the panel frame 2, as described below. Notably, the cantilever bracket 304 can be adjusted upwardly and downwardly within a range of about 6 to 8 inches, such that the worksurface 4 can be adjusted to an optimal height for a particular worker and task as described below. An anchor bracket 305 is attached to the vertical slots 14 at one of the posts 8A and to a rear edge of the worksurface 4 to help retain the worksurface 4 close to the panel frame 2, so that the worksurface 4 does not pull away from the panel frame 2 when vertically loaded. Also, a front strap 306 can be screw-attached under a front edge of adjacent worksurfaces 4 to help stabilize and align two adjacent worksurfaces 4.

More specifically, the upper bracket 301 (FIG. 88) includes right and left arms 307 and 308 interconnected by a bottom-located bendable loop 309. A top of the right and left arms 307 and 308 are separated along line 308'. Hooks 310 and 311 are located at a top of the arms 307 and 308, respectively. By bending the loop 309 and manipulating the arms 307 and 308, the hooks 310 and 311 can be extended into selected slots 15 (FIG. 87) on the cross beam 11B. When the arms 307 and 308 are held in a co-planar condition, the hooks 310 and 311 cannot be removed from the slots 15. Edge flanges 312 and 313 extend perpendicularly outwardly from the outboard edge of the arms 307 and 308.

Figure 90A:
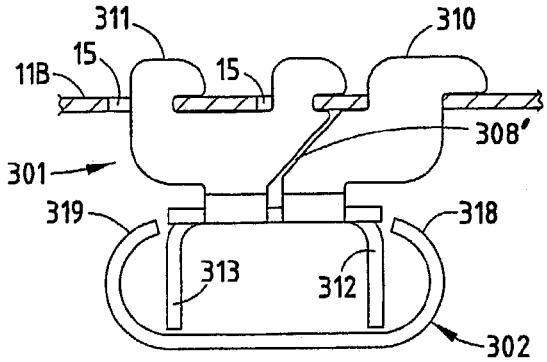
FIGS. 90 and 90A are cross-sectional views of the support system shown in FIG. 87.

The "lower" bracket 302 (FIG. 87) includes a horizontally-oriented bottom plate 315 with hooks 316 that can be manipulated into engagement with the slots 13 on the bottom horizontal frame member 10. The bracket 302 also includes an upright section 317 welded to or formed integrally with plate 315 that extends a distance above the structural cross beam 11B. The upright section 317 has a C-shaped cross section, with edges 318 and 319 of the upright section 317 wrapping around and capturing the edge flanges 312 and 313 on the upper bracket 301. (See FIG. 90A.) However, the edge flanges 312 and 313 are only captured to the extent that the upright section 317 is retained close to the panel frame 2, which does not occur until the bracket 303 is attached, as discussed below. A center section 320 of the upright section 317, i.e. the area between the edges 318 and 319, includes a vertical row of slots 321 that extend from a top of the upright section 317 downwardly about ¾ths of the way to a bottom of the upright section 317.

The capturing bracket 303 (FIG. 87) is vertically elongated about the same length as the second bracket 302, and includes a C-shaped cross section shaped to mateably vertically and telescopingly engage the lower bracket 302. The capturing bracket 303 includes side edges 322 and 323 that wrap slightly farther around than the edge 318 and 319, such that the side edges 322 and 323 wrap partially under the edges of arms 307 and 308. Because of this, the capturing bracket 303 holds the second "lower" bracket 302 against the first upper bracket 301. Because of the hooks 310, 311 on bracket 301 and hooks 316 on bracket 302, the brackets 301-303 are retained as a unit against the panel frame 2. (See FIG. 90.) A center section 324 (FIG. 87) between the side edges 322 and 323 includes three top slots 325, two mid-level slots 326, and a lower slot 327.

The cantilever bracket 304 (FIG. 87) is triangularly shaped, and includes a vertical rear edge having three top hooks 327, two mid-level hooks 328 and a single bottom hook 329. The hooks 327-329 are positioned to fit into the slots 325-327, respectively, and into slots 321 at a selected height. After the hooks 327-329 are positioned in the slots 325-327, the capturing bracket 303 is lowered to interlockingly engage the hooks 325-327 and prevent them from disengagement from the slots 312. By adjusting the capturing bracket 303 on the "lower" bracket 302, a height of the cantilever bracket 304 can be adjusted upwardly or downwardly between a range of about 6 to 8 inches. The cantilever bracket 304 includes a flat top edge with a flange 330' having several holes 331' for receiving screws to attach the worksurface 4 to the cantilever bracket 304. A top of the capturing bracket 303 engages a bottom surface of the worksurface 4 such that, when the worksurface 4 is attached to the cantilever bracket 304, the capturing bracket 303 cannot be raised to release the hooks 325-327. Thus, when fully assembled, the arrangement is non-releasable (unless the screws are removed that connect the worksurface 4 to the cantilever bracket 304).

Figure 89:
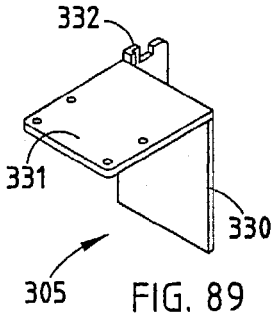
Figure 89A:
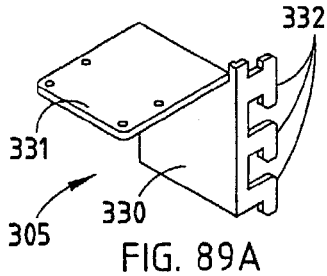
Figure 90:
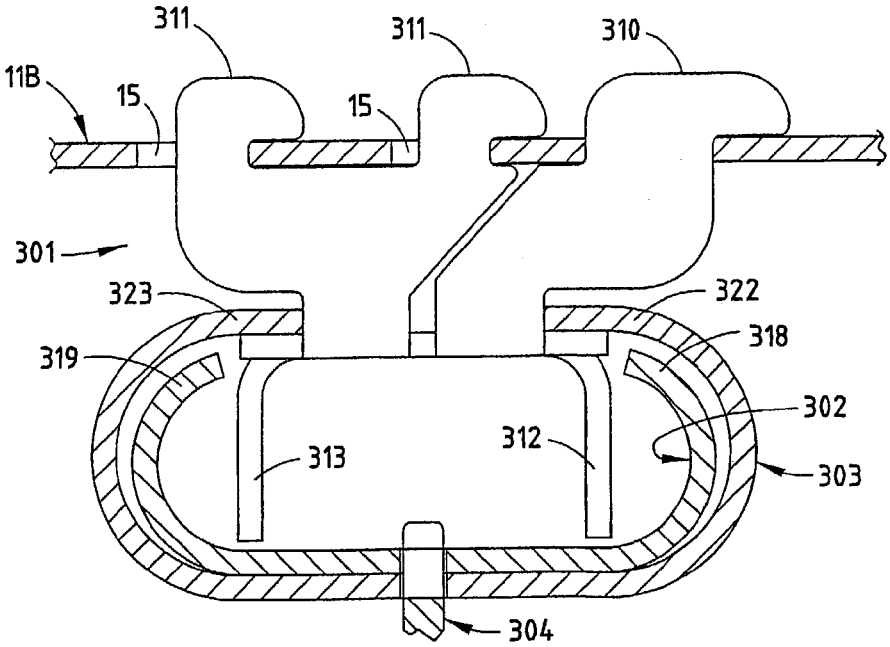

As described above, the worksurface 4 is attached to and supported on a panel frame 2. However, the hooks 310 and 311 (FIG. 87) on the "upper bracket" are only about halfway up on the capturing bracket 303 and are several inches below the worksurface 4. This results in an arrangement where a considerable torsional force can be placed on the brackets 301-304, such as is created by a person leaning on or sitting on a front edge of the worksurface 4. For this reason, anchoring brackets 305 may be needed. The anchoring brackets 305 (FIGS. 89 and 89A) include a plate 330 with an apertured horizontal flange 331 on one side for attachment to a bottom of the worksurface 4, and further include hooks 332 shaped to engage selected vertical slots 14 on posts 8A (or 8B). The anchoring brackets 305 retain a rear edge of the worksurface 4 close to the panel frame 2, such that the forces on the remaining brackets 301-304 are vertical and do not tend to cause the worksurface 4 to be pulled forward and away from the panel frame 2. This provides a much better distribution of force and a better-looking arrangement where a gap at a rear of the worksurface 4 remains small and uniform.

Figure 86:
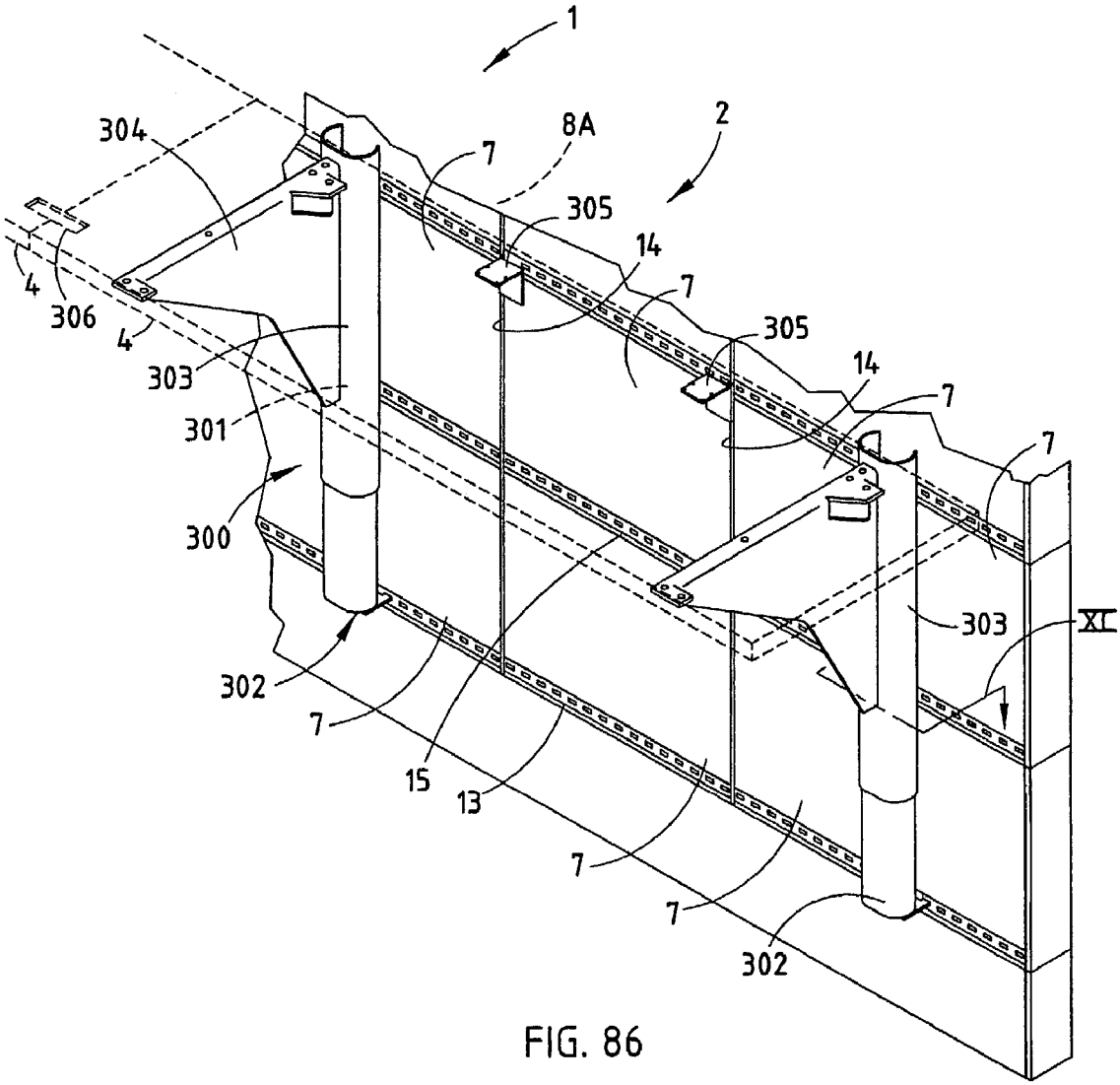
FIG. 86 is a perspective view of a worksurface support system attached to the present panel frame.
Figure 87:
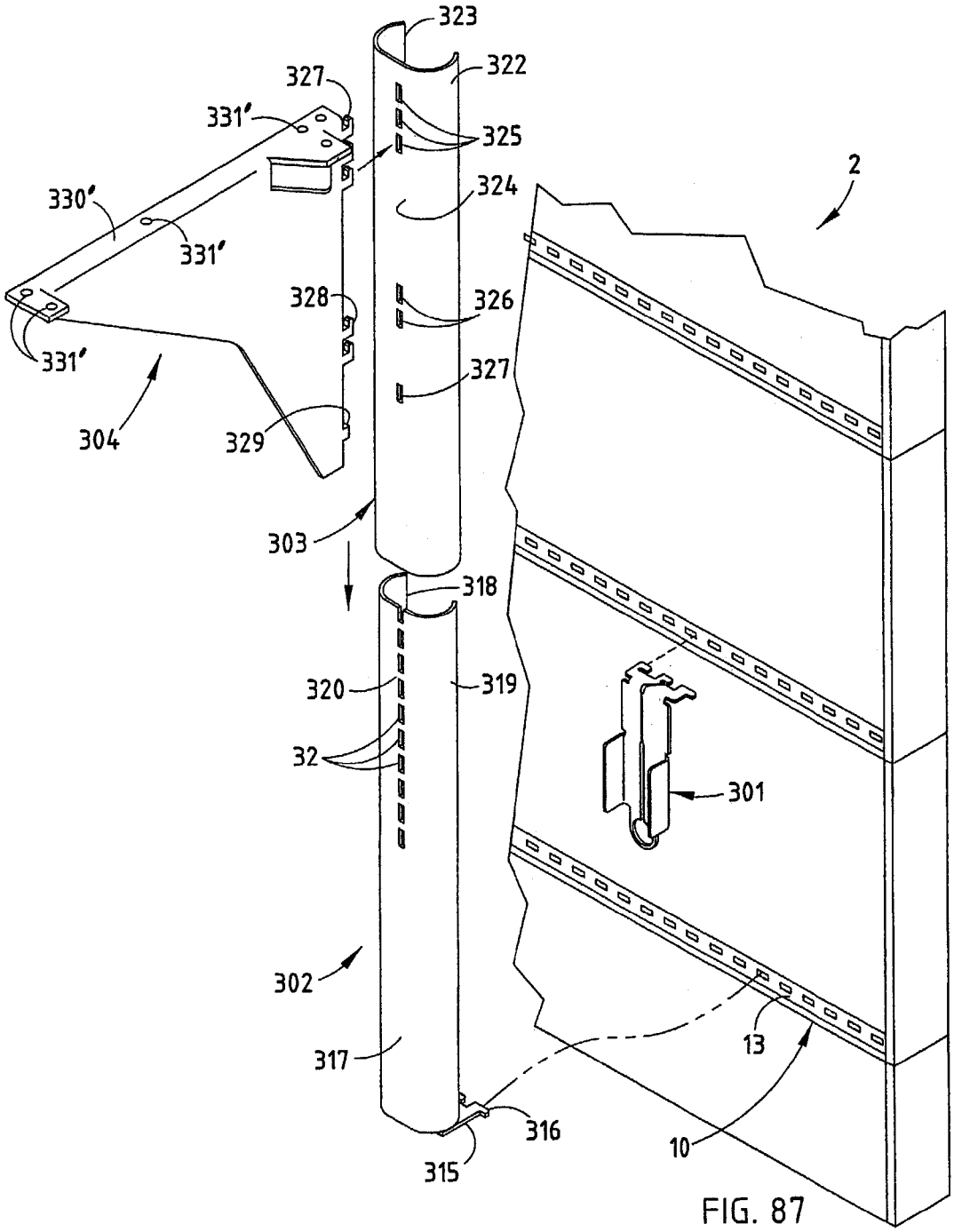
FIG. 87 is an exploded view of one of the support bracket systems in FIG. 86.
Figure 88:
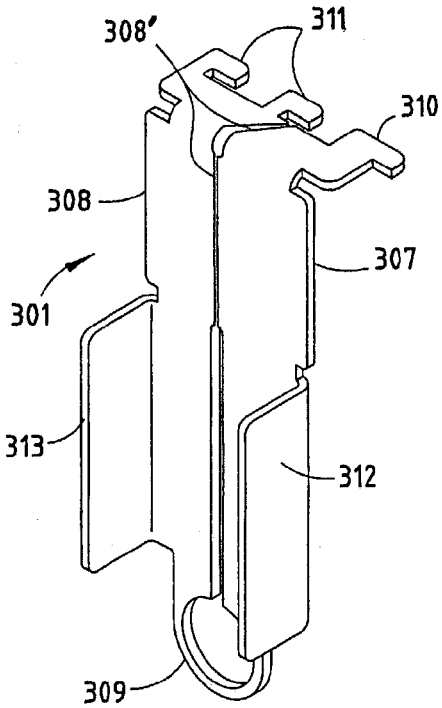
FIGS. 88-89A are perspective views of two of the brackets shown in FIG. 87.

When a long run of worksurfaces 4 are desired, it may be preferable to attach a front edge of the worksurfaces 4 together using a tying bracket 306 (FIG. 86). The tying bracket 306 is simply a strip of material having apertures therein for screw-attachment to the underside of front edges of adjacent worksurfaces 4. The tying bracket 306 keeps the worksurfaces 4 in horizontal alignment, and helps distribute unbalanced forces between the adjacent worksurfaces 4.

Advantageously, each of the brackets 301-306 is made as a single stamping, with the exception of bracket 302 which could be a single stamping if desired by bending the bottom plate from an end of the upright section, but which is illustrated as including the plate (315) welded to the upright section (317). The only fasteners used in the support system are the ones that engage a bottom of the worksurface, such that they are not easily visible. Hence, the present arrangement provides a very clean, uncluttered appearance.

Trim

Appearance remains an important part of any partition system, including the present partition system 1. A high-quality-appearing trim is particularly difficult where the partition system changes height. This is true because there are there several corners and gap lines that must be maintained at a uniform dimension and "square" orientation at a change of height. However, it is also true because trim merely sits on and aesthetically covers the assembled partition, and does not draw the structural components together. Thus, the trim must compensate for and align with itself, even where there are significant changes in floor height and partition panel heights, significant differences caused by a stack-up of tolerances and imperfect interconnections, and a variety of assembly and on-site variations that cause trim misalignment as the trim attempts to negotiate a balanced appearance. The present trim is believed to be novel and inventive in the way that it encloses and trims out a change of height area on the present partition system 1.

A related trim system is shown in application Ser. No. 10/113,379, filed Mar. 29, 2002, entitled PARTITION TRIM WITH SEPARATE INSERT, the entire contents of which is incorporated herein in its entirety for the purpose of providing a complete disclosure. The reader is invited to read the application '379 if additional information is desired about such trim. However, the discussion below is sufficient for an understanding of the present invention to a person of ordinary skill in this art.

Figure 91:
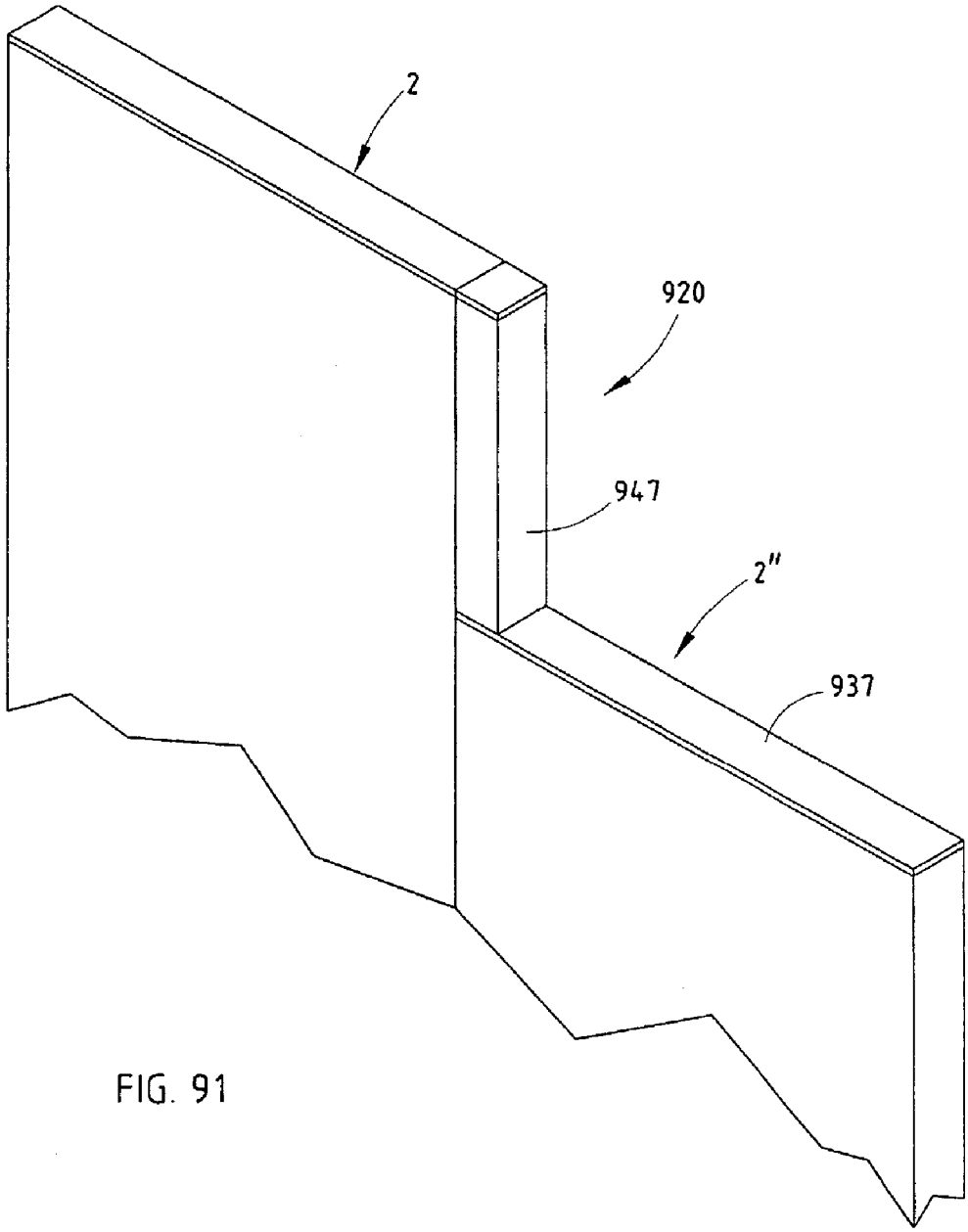
FIG. 91 is a perspective view of a change of height cable routing in-line joinder of two adjacent panel frames with wiring extending across their top channel.
Figure 92:
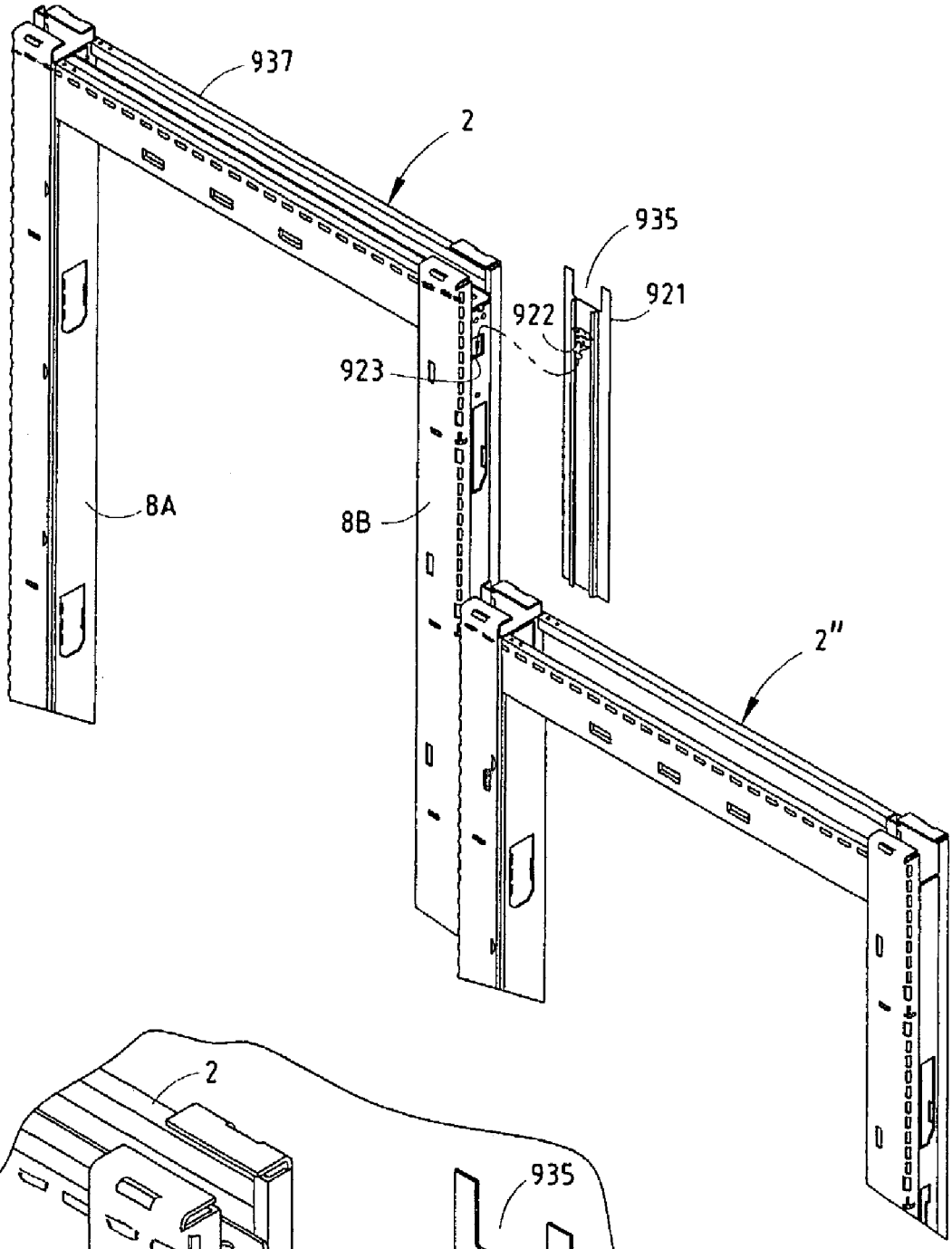
FIGS. 92-95 are perspective views of the two in-line adjacent partition frames, wiring, covering, and trim attached thereto.
Figure 92A:
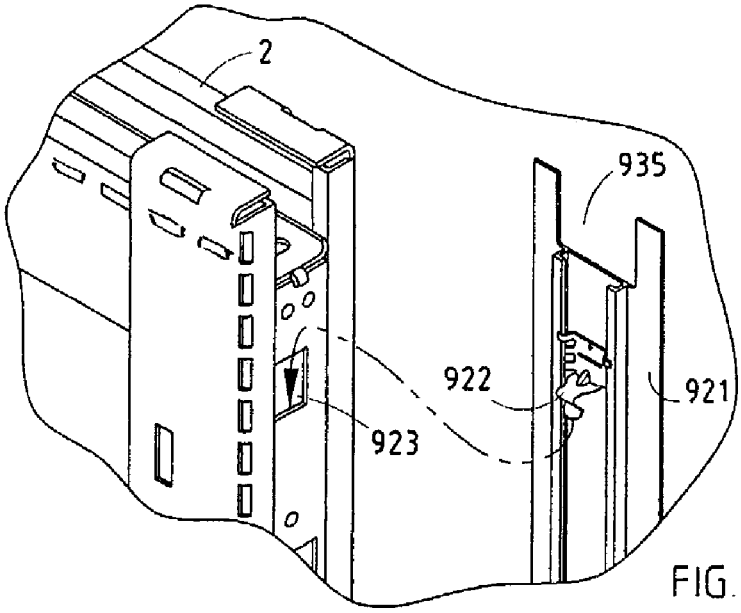
Figure 93:
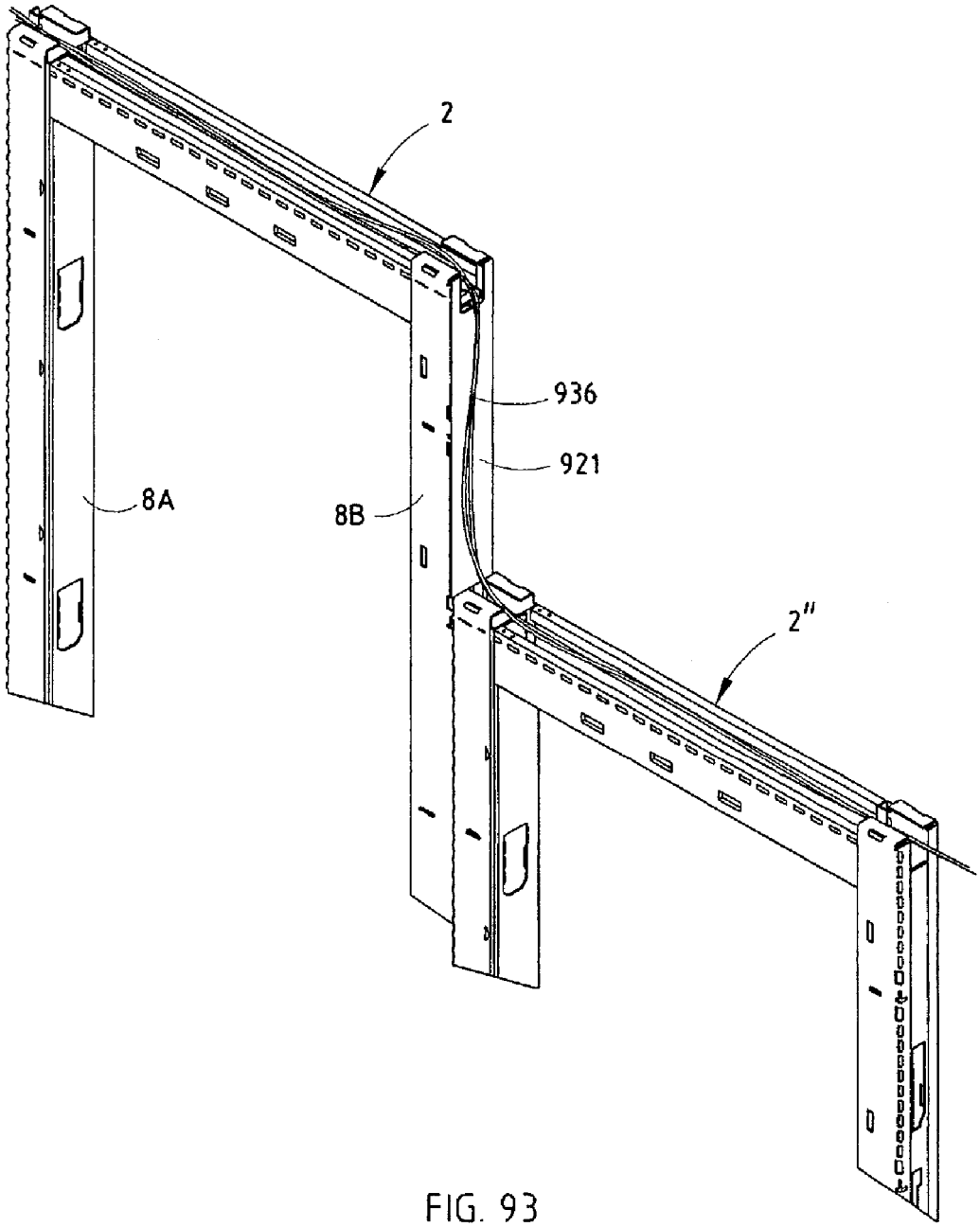
Figure 94:
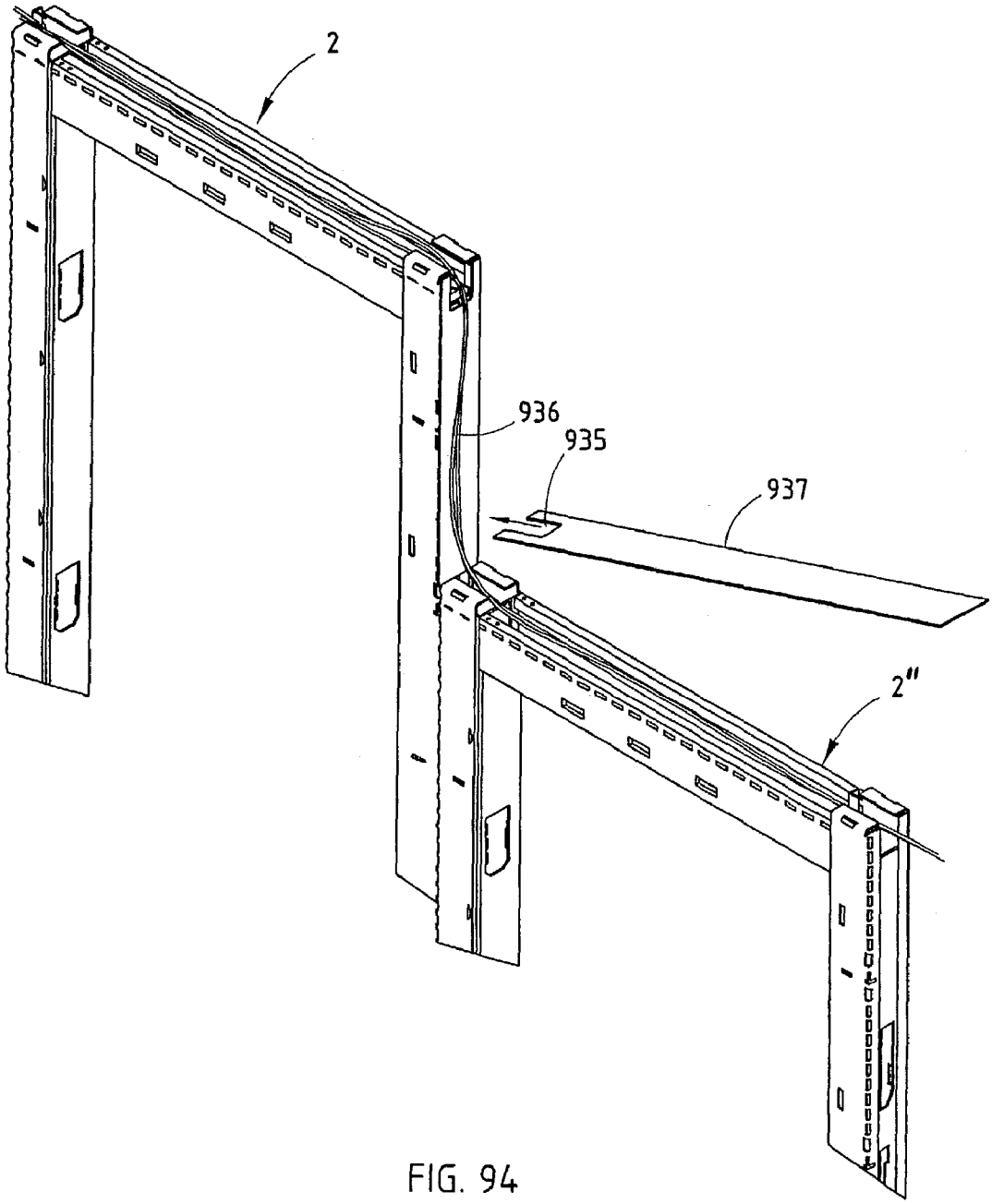
Figure 106:
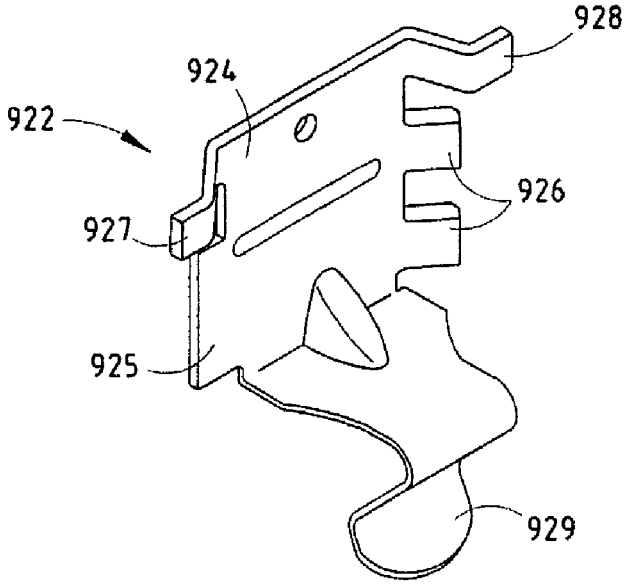
Figure 107:
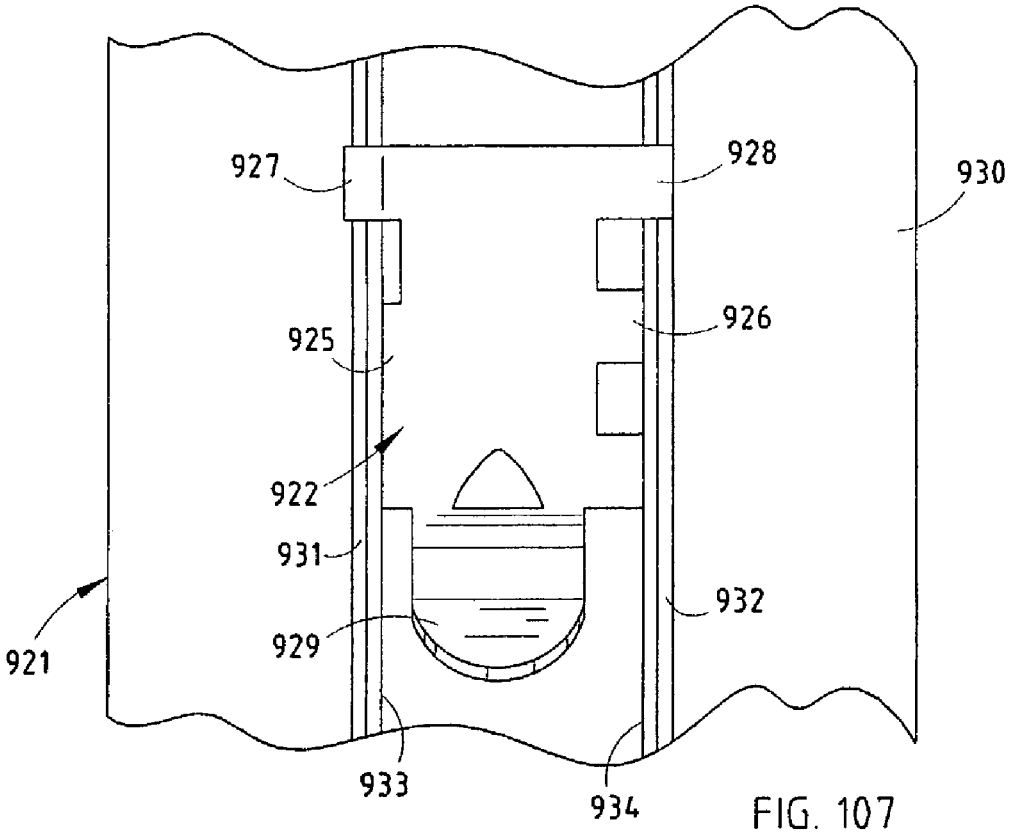

An in-line change of height region 920 (FIG. 91) includes a high panel frame 2 and a low panel frame 2" connected together with their front and rear faces aligned. A short end trim 921 (FIG. 92) is attached to the high panel frame 2 above the short panel frame 2" by a pair of hook brackets 922 on the end trim 921 that engage apertures 923 on the end of the high panel frame 2. Specifically, the hook brackets 922 (FIG. 106) are made of spring-steel and include a body plate 924 with side fingers 925 and 926, retainer tabs 927 and 928, and a resiliently bendable hook 929 on one end. The end trim 921 (FIG. 107) is a molded extrusion, such as polymeric material, having a planar body 930 with two spaced-apart ridges 931 and 932. The ridges 931 and 932 are spaced from the side edges of the body 930. The ridges 931 and 932 (FIG. 108) include channels 933 and 934 along their inboard surfaces shaped to receive the side fingers 925 and 926, with the tabs 927 and 928 engaging an outer tip of the ridges 931 and 932. This positions the tip of the hook 929 at a position where it will fit into the aperture 923 and frictionally engage the material below the aperture 923 to retain the trim 921 against an end of the high panel frame 2. The hook brackets 922 can be adjusted longitudinally along the end trim 921, such that the hook brackets 922 can be adjusted to any position required for good retention to the panel frame 2. One or more of the protrusions 925-928 are bent or slightly angled to provide a semi-permanently fixed attachment to the trim 921 after attachment to the ridges 931-932. The ends of the illustrated end trim 921 (FIG. 92) are notched at location 935 (FIG. 92) to facilitate routing or wires 936 (FIG. 94) along a top of the change of height area between panels 2 and 2".

Figure 101:
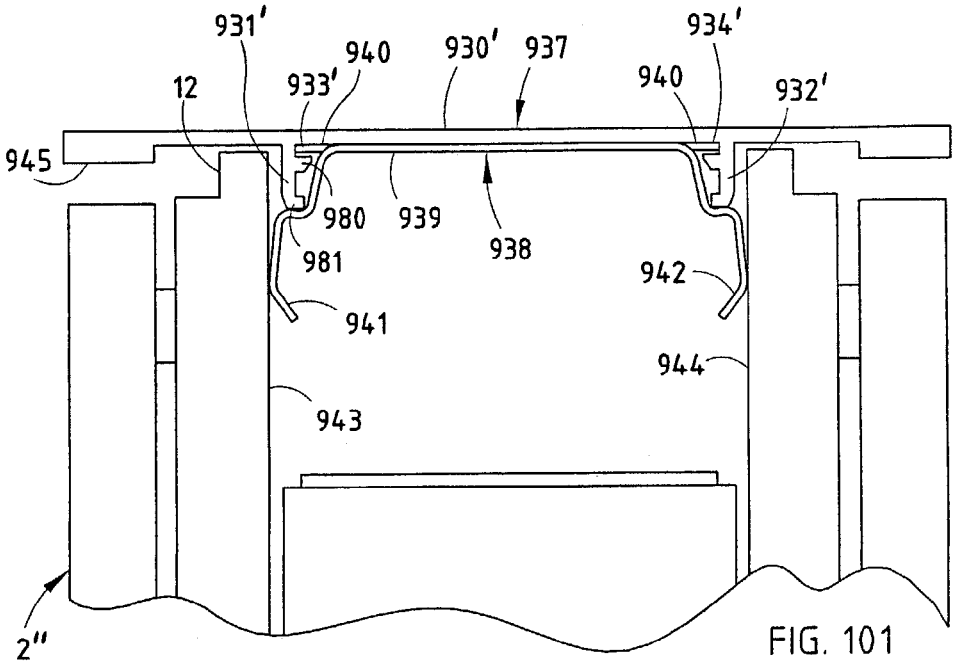
FIG. 101-109 disclose various trim attached to the partition frames in FIGS. 91 and 96, including FIG. 101, which is a cross-sectional end view of a top trim attached to a top of a panel frame, FIG. 102, which is an in-line connection of top trim.
Figure 102:
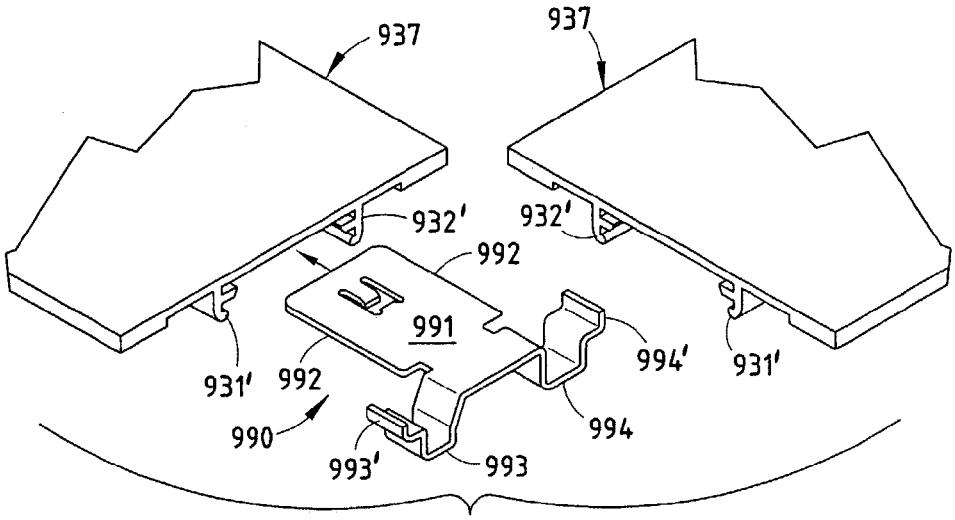

Top trim 937 (FIG. 94) is attached to cover a top of the panel frames 2 and 2". The top trim 937 has a cross-sectional shape very similar to the end trim 921. Specifically, the top trim 937 (FIG. 108) includes a planar body 930' and undersurface ridges 931' and 932' with inboard channels 933' and 934' as was found in the end trim 921 above. However, the ridges 931' and 932' are spaced slightly farther apart than ridges 931 and 932 so that the ridges 931, 932, 931, and 932' can mateably engage to form a 900 corner, as described below. A spring clip 938 (FIG. 101) includes a body 939 and tabs 940 (similar to fingers 925 and 926) for engaging the channels 933' and 934'. The spring clip 938 further includes resilient downwardly-extending legs 941 and 942 that bend outwardly under the tip of the ridges 931' and 932' and into frictional engagement with the surfaces 943 and 944 that define opposing sides of the top wireway in the panel frames 2 (and 2"). The trim body 930' can include downwardly-oriented edge ridges 945 along its edges to better cover a top of the panel frames 2 and 2" above the slots 12, if desired, but this is not necessary per se.

A cable routing trim 947 (FIG. 95) is attached over end trim 921 to cover wires 936. The cable routing trim 947 is box shaped, and includes orthogonally-related sidewalls 948-950 that define an open side 951 that faces the end trim 921 (FIG. 95A). A flat top trim piece 952 is attached to the sidewalls 948-950 by an L bracket 953, the L brackets 953 having holes on each leg with at least one screw 954 engaging a boss on the trim piece 952 and at least one screw 955 engaging a slot in a ridge 956 of the wall 949. A bottom surface of the top trim piece 952 includes perimeter-located recesses for mateably receiving a top of the sidewalls 948-950 of the trim 947. Additional fasteners can be used to secure the sidewalls 948-950 to the top trim piece 952 to provide an optimal appearance, such as additional brackets, adhesive, and the like. Connectors 958 are attached to open edge(s) 951 of the top trim piece 952, for aligning and connecting the open edge to a top trim 937. The connector 958 includes a body 960 with a screw hole for receiving a screw 961 that engages an apertured boss on the top trim piece 952 to hold the connector 958 at the open edge. Legs 963 orient the connector 958 at the edge 959. The body 960 extends outwardly beyond the open edge 959, and includes a pair of opposing arms 965 and 966 with fingers (similar to the fingers 925 and 926) for engaging the inboard channels 933' and 934' on the top trim 937. The fingers 967 and 968 align the trim 937 with the top trim piece 952.

Figure 95:
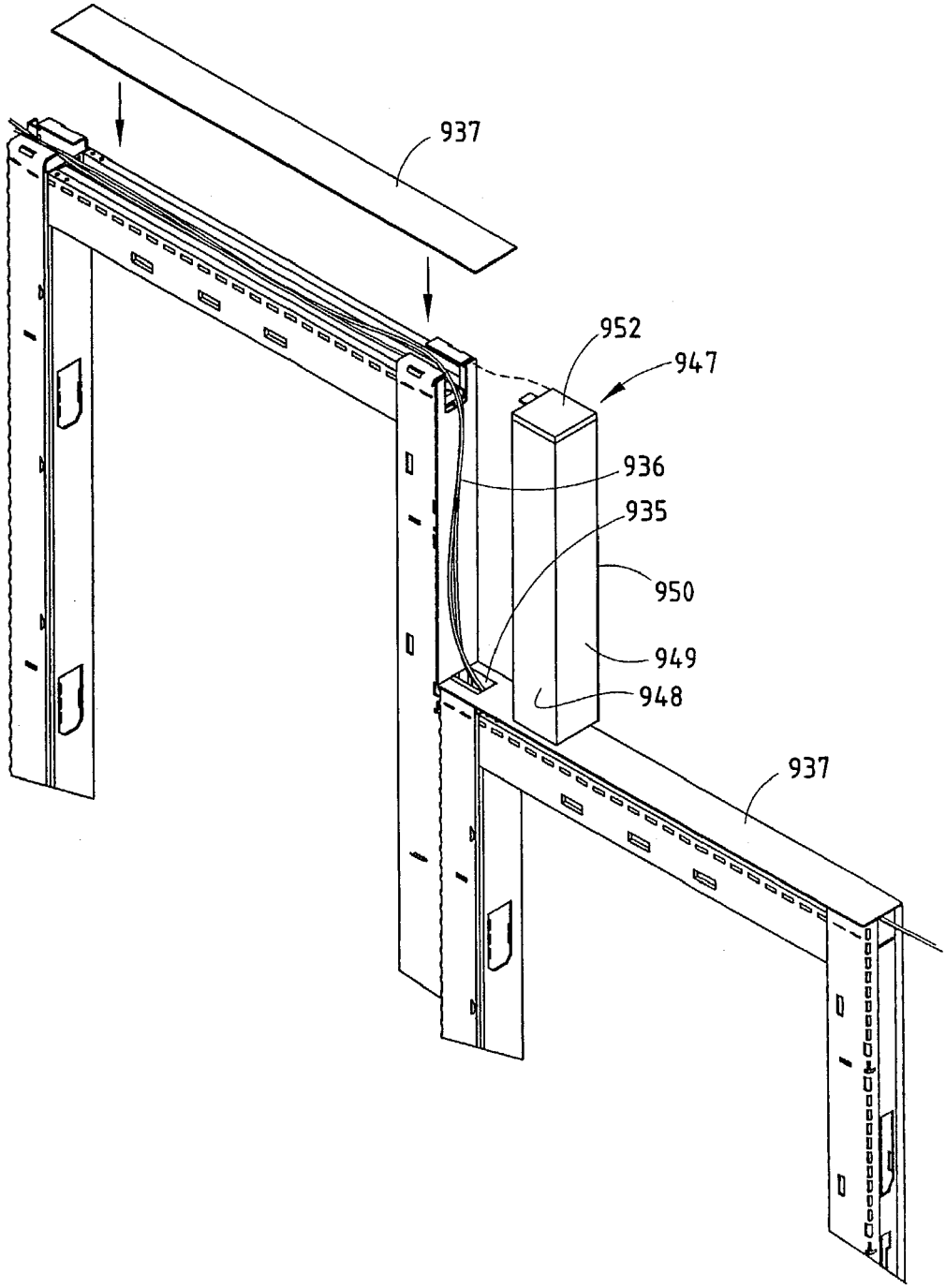
Figure 95A:
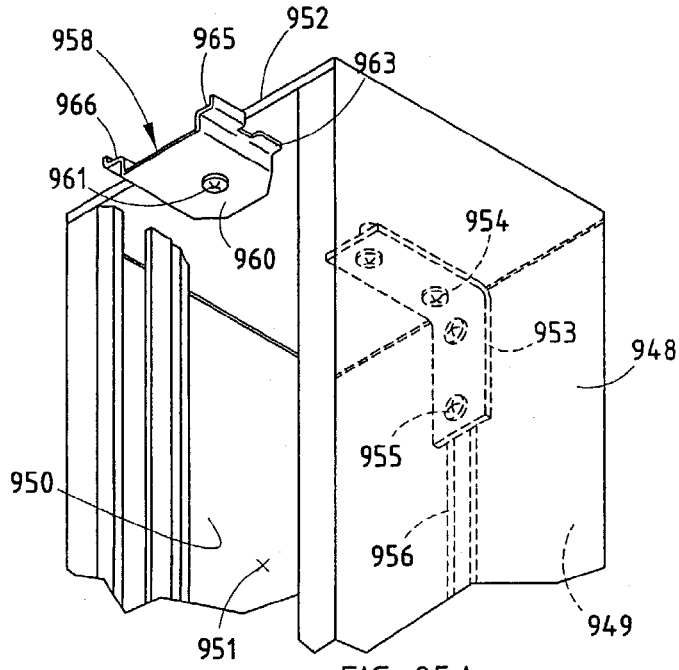
FIG. 95A is an enlarged fragmentary perspective view of the cable routing trim shown in FIG. 95.

A bottom of the cable routing trim 947 (i.e. sidewalls 948-950) (FIG. 95) can be retained on the top trim 937 of the short panel frame 2" with a bracket (not shown) that extends into the slot at location 935 of the trim 937 (FIG. 95). Alternatively, a bracket (not specifically shown) can be used that extends to a location where it can be attached to a side of the panel frame 2 (or 2") by screws.

Alternatively, in some arrangements, a bracket 970 (FIG. 99A) can be used having a first section 971 with a U-shaped cross section shaped to mateably engage the ridge 956 and be attached to the ridge 956 by screws 972. The first section 971 is extended to include a second section 973 with a similar U-shaped cross section. The second section 973 is shaped to mateably engage the ridge 956 of a similar trim sidewall 949' of a lower corner-forming trim 947', and be attached thereto by screws 974. The sidewalls 948 and 949 of the cable routing trim 947 and the sidewalls 949' of the cable routing trim 947' are maintained in good alignment due to a length of the sections 971 and 973.

The illustrated bracket 970 (FIG. 99A) further includes an inwardly-bent flange 975 with screw holes 976 therein. The flange 975 can be used for attaching brackets (not shown) to prevent the wires from pressing on the sidewalls 948-950, or for attaching to a partition frame.

Figure 96:
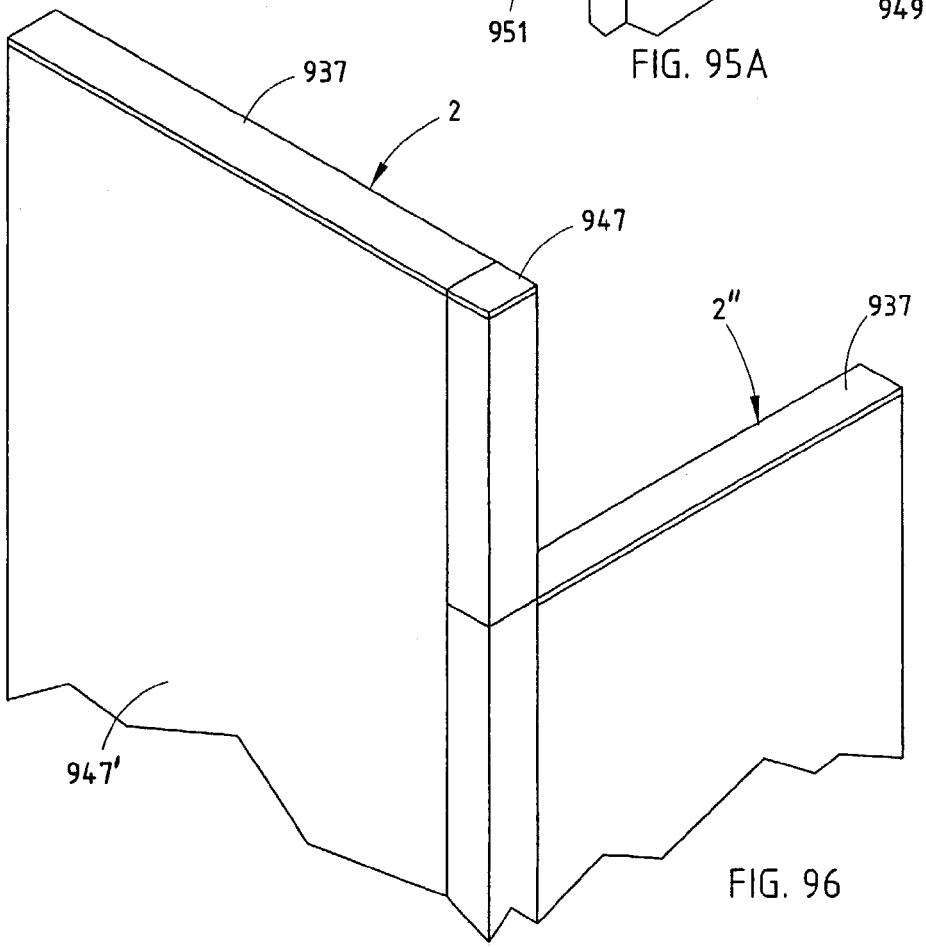
FIG. 96 is a perspective view of a change of height cable routing for corner connection where two different height partition frames are interconnected in an L-shaped relationship.
Figure 97:
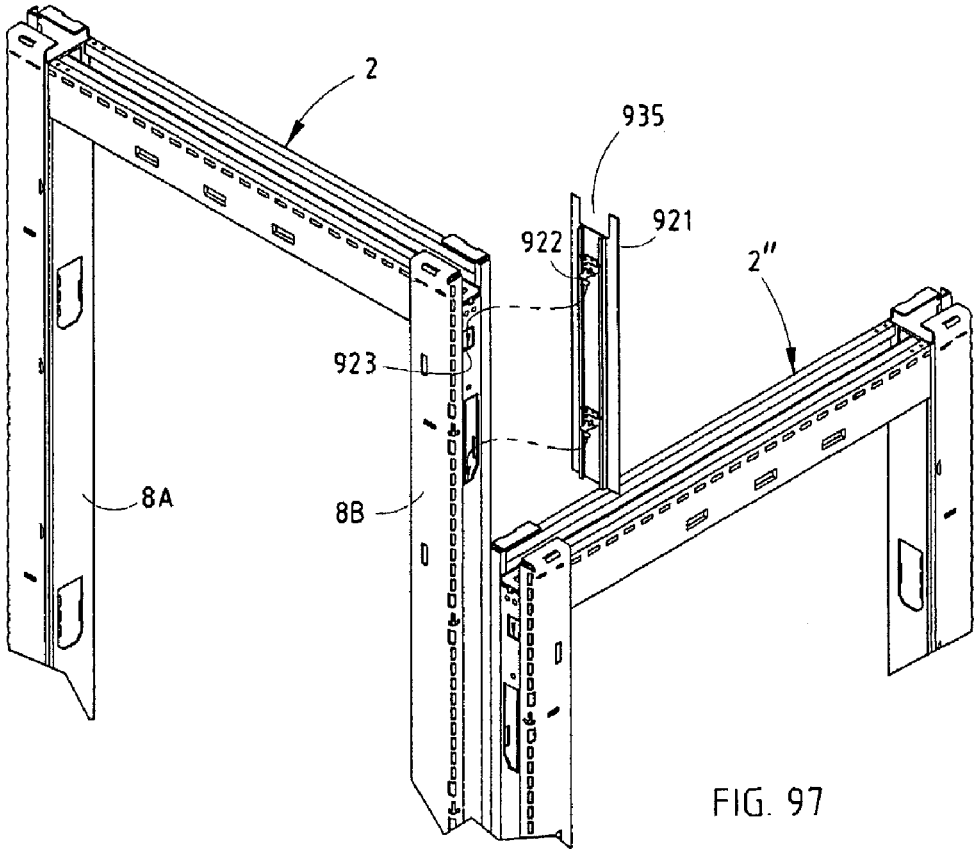
FIGS. 97-99 are perspective views of the adjacent panel frames including various trim.
Figure 97A:
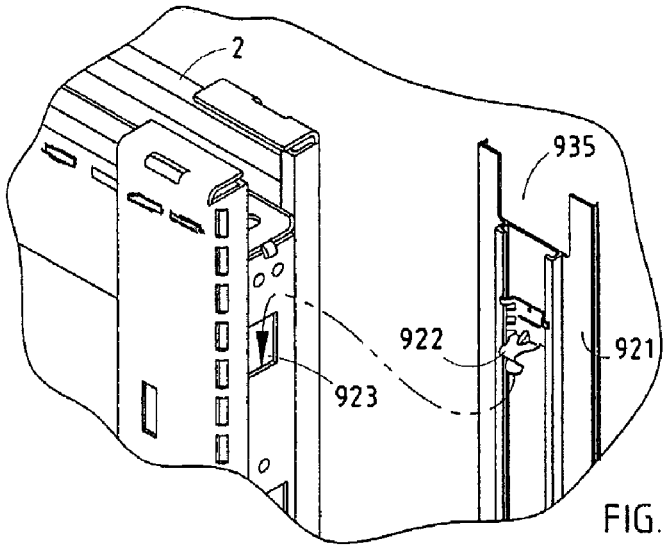
Figure 98:
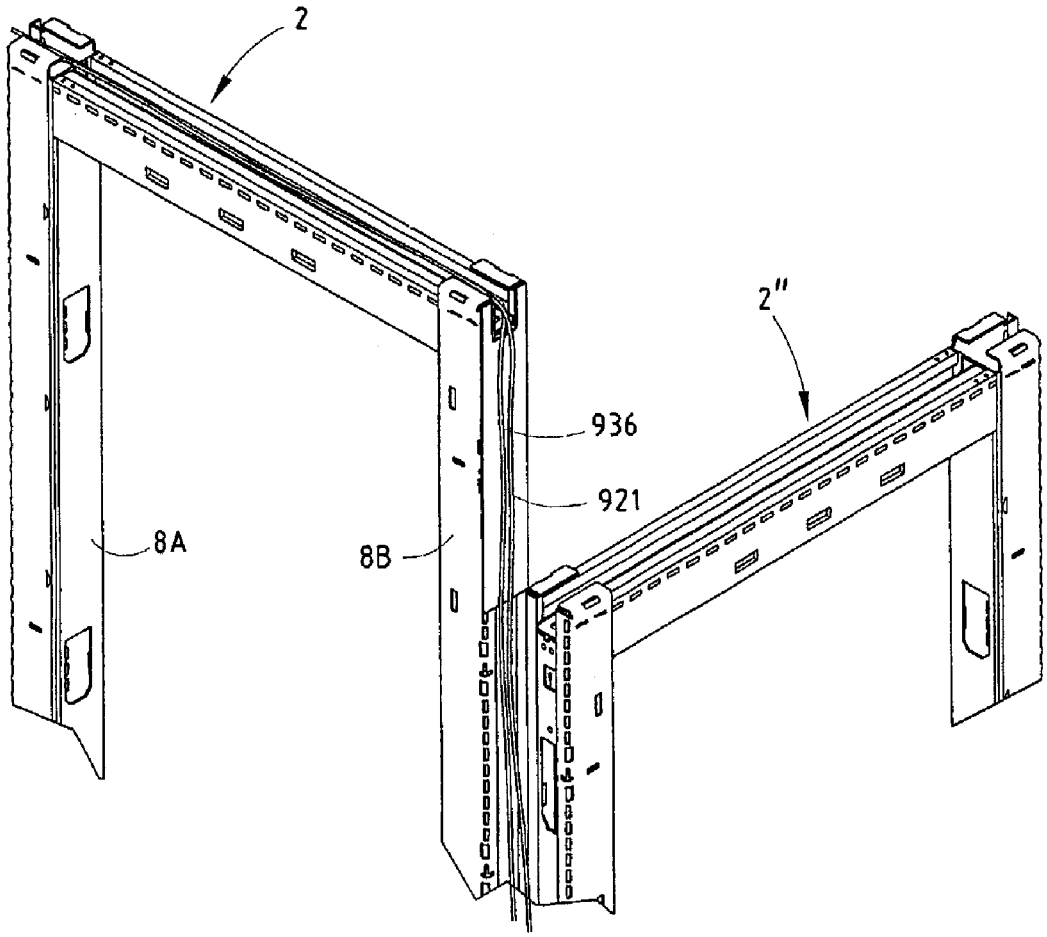
Figure 99:
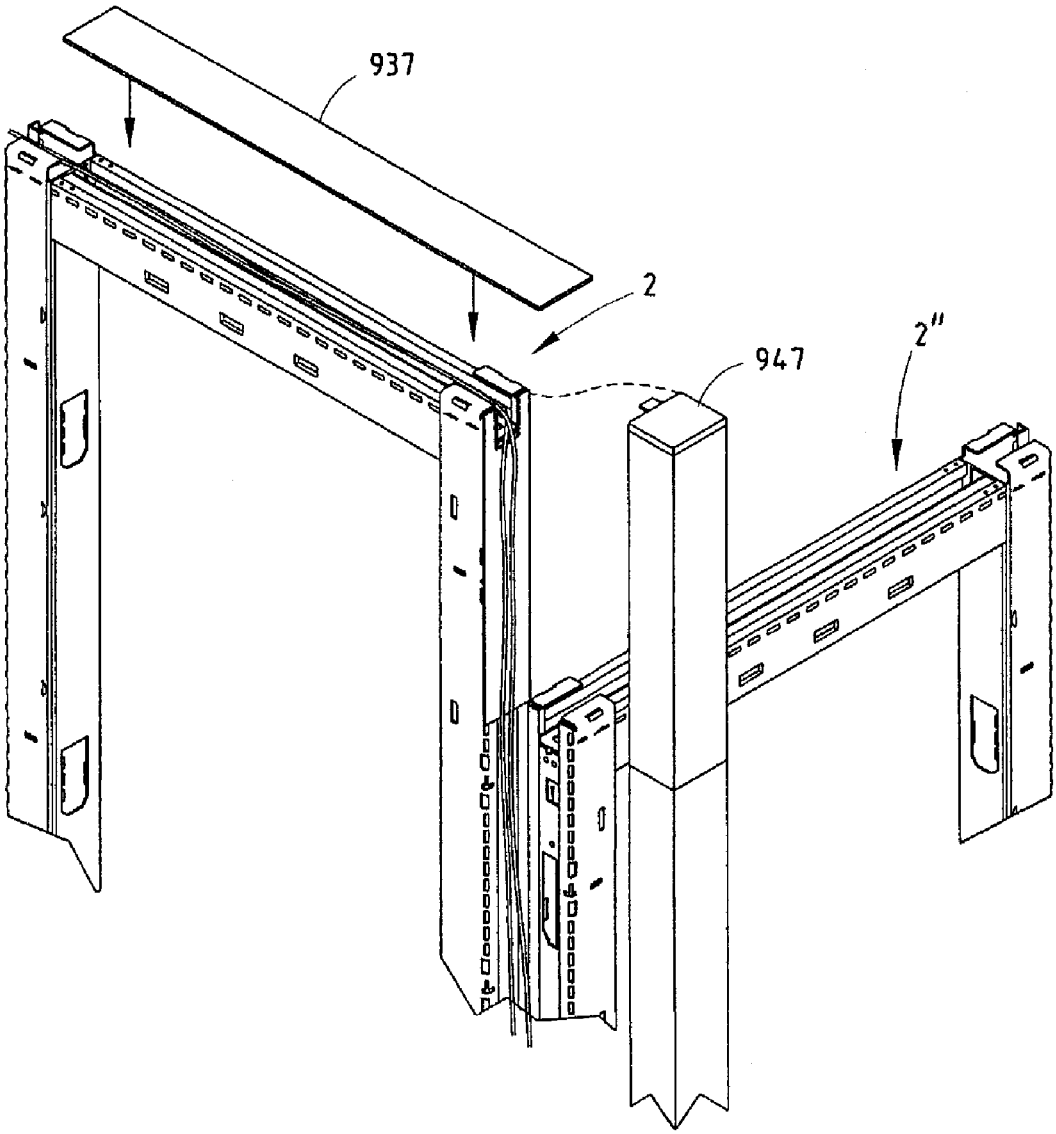
Figure 99A:
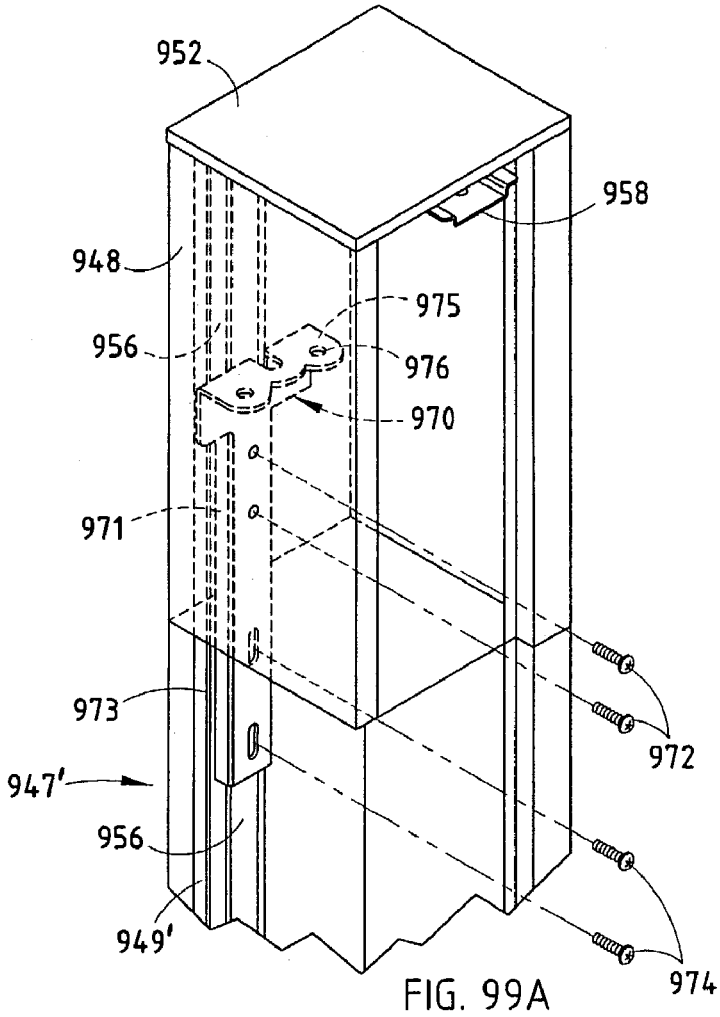
FIG. 99A-99B are perspective views of the wire routing corner trim shown in FIG. 96.
Figure 99B:
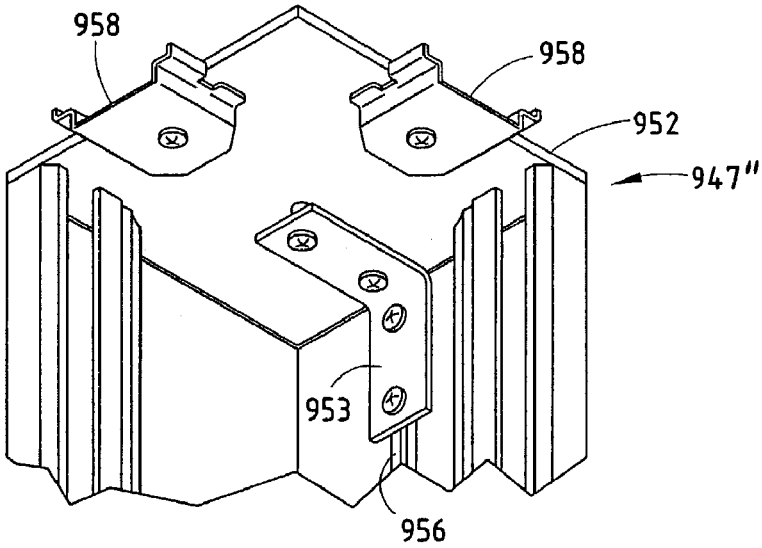
Figure 100:
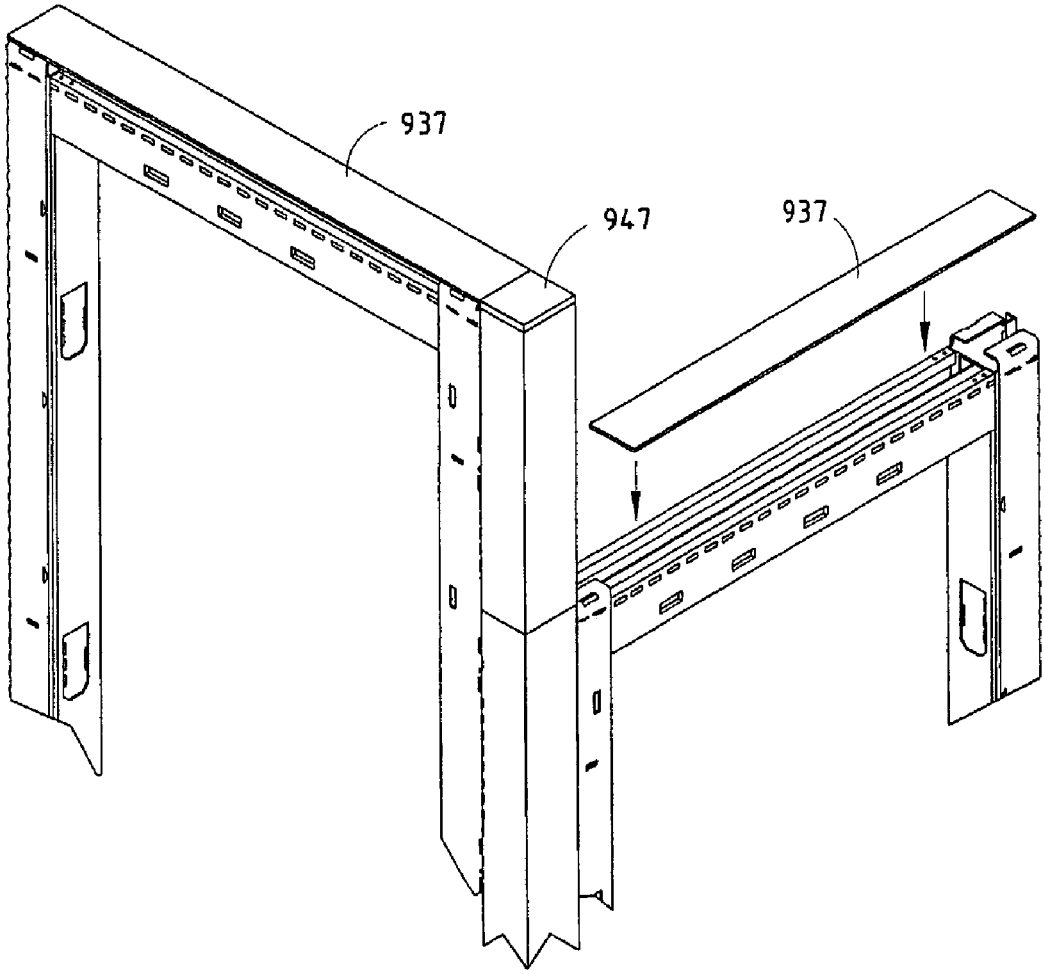

A high panel frame 2 and a low height panel frame 2" are connected at a 90° corner in FIG. 96. In this situation, a cable routing trim 947 and top trim 937 is used in a manner similar to that described above. Therefore, the description does not need to be repeated. However, as shown in FIG. 99A, a lower corner-forming trim 947' includes adjacent sidewalls that extend at 90° angles to each other. FIG. 99B shows a trim 947" similar to top trim 937, but having two open sides, a top piece 952, and two bracket connectors 958.

Figure 108:
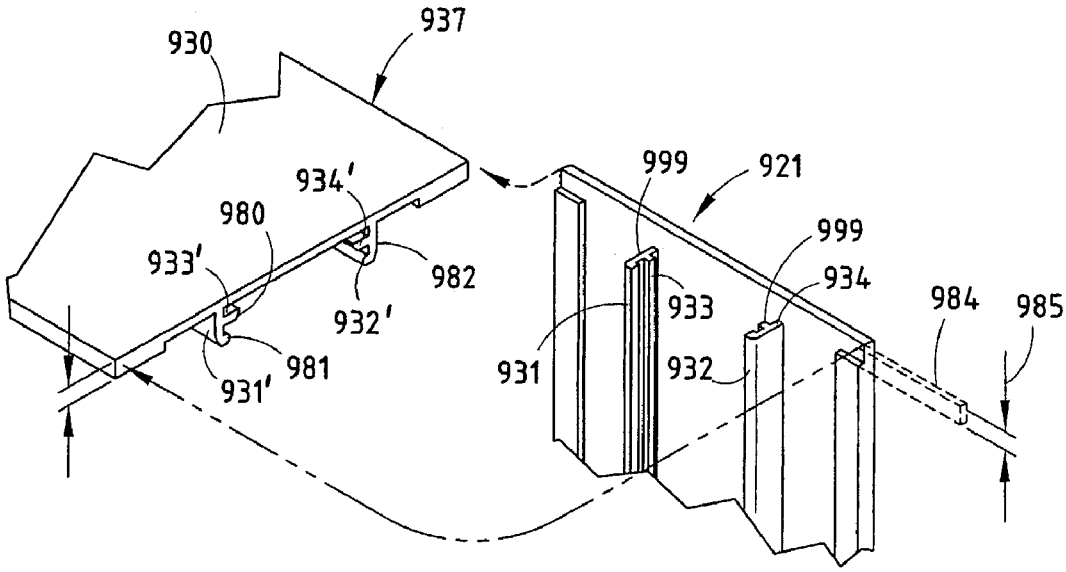
Figure 109:
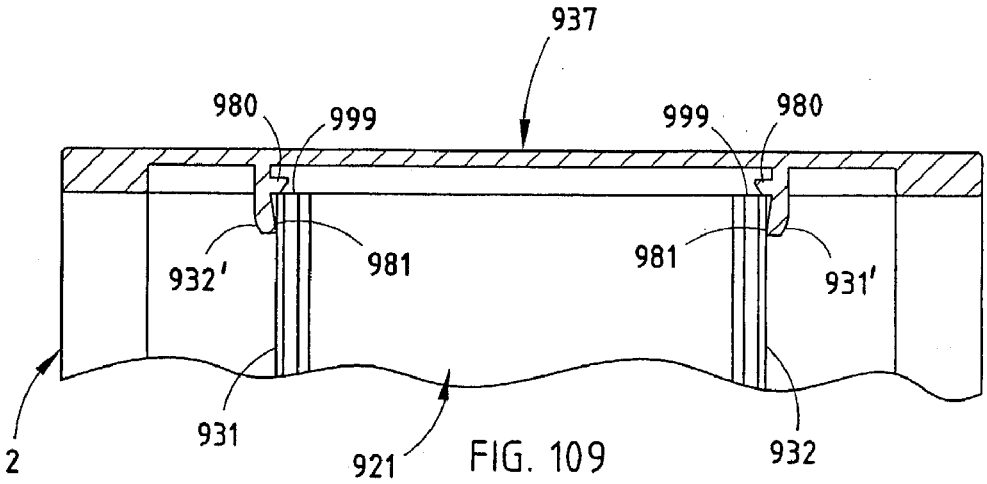

The top trim 937 and end trim 921 (FIGS. 108 and 109) are engaged, registered, and are assembled as follows. The top trim 937 includes ridges 931' and 932' with inboard channels 933' and 934' formed by upper and lower flanges 980 and 981, the upper flanges 980 being slightly longer than lower flanges 981. The end trim 921 includes ridges 931 and 932. A top end of the end trim 921 includes a machined-out section illustrated by the dashed lines 984 (FIG. 108). This space has a dimension 985 that is equal to a height of the body of the top trim 937. When mated together, an upper end of the ridges 931 and 932 of the end trim 921 fit between the outer end of the ridges 931' and 932' of the top trim 937 (FIG. 109). Further, the upper end surface 999 of the ridges 931 and 932 rest against a bottom of the upper flanges 980 and engage an inside surface of the lower flanges 981.

Figure 103:
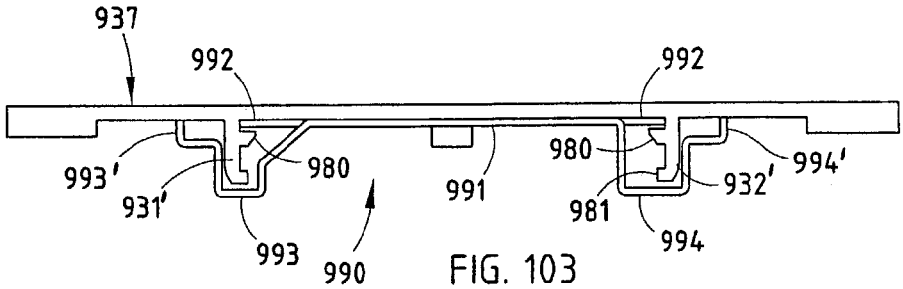
Figure 104:
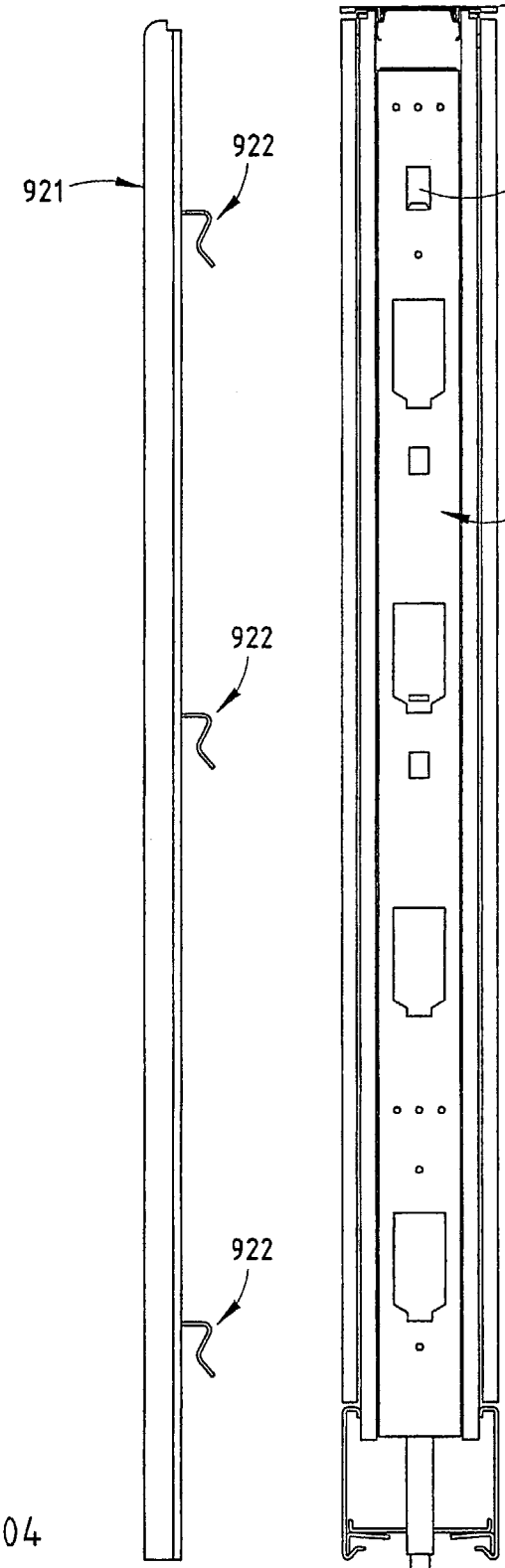
Figure 105:
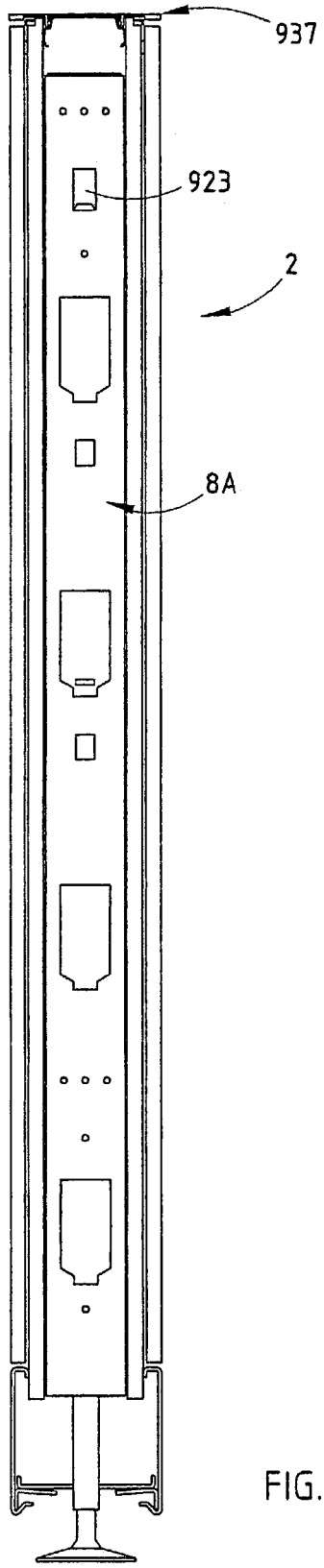

Top trim 937 can be connected in-line by an in-line connector 990 (FIGS. 103). The in-line connector 990 includes an elongated body 991 with edges 992 that fit above the upper flanges 980 on each of the abutting aligned top trim pieces 937. The connector 990 further includes opposing arms 993 and 994 that extend around to an outboard side of the ridges 931' and 932' to hold the ridges 931' and 932' in engagement with the edges 992, with tips 993' and 994' engaging the body panel of the trim 937. This reduces pressure on the ridges 931' and 932' even if there is some misalignment between the aligned co-linear top trims 937.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. In a partition system for dividing open office space into individual workstations, the improvement of a partition panel, comprising:

a panel frame including a plurality of outwardly opening mounting apertures;

a removable component including a plurality of outwardly extending spring clips frictionally engaging said mounting apertures in said panel frame to detachably retain said component on said panel frame; and a separate, removable locking clip nesting within and engaging one of said spring clips on said removable component, and including a barb which engages said panel frame in a locked position and positively prevents removal of said one spring clip from said panel frame, and positively interconnects said removable component and said panel frame in said locked position; said locking clip having a flexible portion configured for flexing which includes a release leg that is actuated to flex said locking clip to shift said barb out of engagement with said panel frame and into an unlocked position wherein said removable component can be removed from said panel frame.

2. A partition panel as set forth in claim 1, wherein:

said locking clip engages a resilient portion of said one spring clip.

3. A partition panel as set forth in claim 2, wherein:

said one spring clip includes mutually angled legs which define a wedge-shaped portion shaped to releasably engage said mounting apertures in said panel frame; and said locking clip is positioned in said wedge-shaped portion of said one spring clip.

4. A partition panel as set forth in claim 3, wherein:

said locking clip includes mutually angled legs shaped for close reception between said mutually angled legs of said one spring clip.

5. A partition panel as set forth in claim 4, wherein:

said mutually angled legs of said locking clip define said flexible portion thereof.

6. A partition panel as set forth in claim 5, wherein:

said component comprises a cover panel.

7. A partition panel as set forth in claim 5, wherein:

said component comprises a utility module.

8. A partition panel as set forth in claim 5, wherein:

said one spring clip is constructed from high-strength resilient metal.

9. A partition panel as set forth in claim 8, wherein:

said locking clip barb protrudes into an interior portion of an associated one of said mounting apertures and resiliently engages said panel frame to positively prevent inadvertent removal of said component from said panel frame.

10. A partition panel as set forth in claim 9, wherein:

said one spring clip includes a centrally disposed window shaped to receive therethrough said mutually angled legs of said locking clip.

11. A partition panel as set forth in claim 1, wherein:

said one spring clip includes mutually angled legs which define a wedge-shaped portion shaped to releasably engage said mounting apertures in said panel frame; and said locking clip is positioned in said wedge-shaped portion of said one spring clip.

12. A partition panel as set forth in claim 1, wherein:

said locking clip includes mutually angled legs shaped for close reception within said one spring clip.

13. A partition panel as set forth in claim 1, wherein:

said component comprises a cover panel.

14. A partition panel as set forth in claim 1, wherein:

said component comprises a utility module.

15. A partition panel as set forth in claim 1, wherein:

said one spring clip is constructed from high-strength resilient metal.

16. A partition panel as set forth in claim 1, wherein:

said locking clip barb protrudes into an interior portion of an associated one of said mounting apertures and resiliently engages said panel frame to positively prevent inadvertent removal of said component from said panel frame.

17. A partition panel as set forth in claim 1, wherein:

said one spring clip includes a centrally disposed window shaped to receive therethrough said mutually angled legs of said locking clip.

18. A partition panel as set forth in claim 1, wherein:

said locking clip includes mutually angled legs defining said flexible portion thereof.

19. A security system detachably interconnecting first and second components, comprising:

at least one mounting aperture disposed in said first component;

at least one spring clip connected with said second component and frictionally engaging said mounting aperture in said first component to detachably interconnect said first and second components; and a locking clip nesting within and engaging said spring clip on said second component, and including a barb which engages said first component in a locked position and positively prevents removal of said spring clip from said first component, and positively interconnects said first and second components in said locked position; said locking clip having a flexible portion configured for flexing which includes a release leg that is actuated to flex said locking clip to shift said barb out of engagement with said first component and into an unlocked position wherein said second component can be removed from said first component.

20. A security system as set forth in claim 19, wherein:

said locking clip engages a resilient portion of said one spring clip.

21. A security system as set forth in claim 20, wherein:

said one spring clip includes mutually angled legs which define a wedge-shaped portion shaped to releasably engage said mounting apertures in said first component; and said locking clip is positioned in said wedge-shaped portion of said one spring clip.

22. A security system as set forth in claim 21, wherein:

said locking clip includes mutually angled legs shaped for close reception between said mutually angled legs of said one spring clip.

23. A security system as set forth in claim 22, wherein:

said mutually angled legs of said locking clip define said flexible portion thereof.

24. A security system as set forth in claim 23, wherein:

said one spring clip is constructed from high-strength resilient metal.

25. A security system as set forth in claim 24, wherein:

said locking clip barb protrudes into an interior portion of an associated one of said mounting apertures and resiliently engages said first component to positively prevent inadvertent removal of said second component from said first component.

26. A security system as set forth in claim 25, wherein:

said one spring clip includes a centrally disposed window shaped to receive therethrough said mutually angled legs of said locking clip.

27. A security system as set forth in claim 19, wherein:

said one spring clip includes mutually angled legs which define a wedge-shaped portion shaped to releasably engage said apertures in said first component; and said locking clip is positioned in said wedge-shaped portion of said one spring clip.

28. A security system as set forth in claim 19, wherein:

said locking clip includes mutually angled legs shaped for close reception within said one spring clip.

29. A security system as set forth in claim 19, wherein:

said one spring clip is constructed from high-strength resilient metal.

30. A security system as set forth in claim 19, wherein:

said locking clip barb protrudes into an interior portion of an associated one of said mounting apertures and resiliently engages said first component to positively prevent inadvertent removal of said second component from said first component.

31. A security system as set forth in claim 19, wherein:

said one spring clip includes a centrally disposed window shaped to receive therethrough a portion of said locking clip.

32. A security system as set forth in claim 19, wherein:

said locking clip includes mutually angled legs defining said flexible portion thereof.

* * * * *